US005684260A

United States Patent [19]

Van Buskirk

[11] Patent Number: 5,684,260

[45] Date of Patent: Nov. 4, 1997

[54] APPARATUS AND METHOD FOR GENERATION AND SYNTHESIS OF AUDIO

[75] Inventor: James E. Van Buskirk, Richmond, Tex.

[73] Assignee: Texas Instruments Incorporated, Dallas, Tex.

[21] Appl. No.: 304,019

[22] Filed: Sep. 9, 1994

[51] Int. Cl.[6] ..... G10H 7/00

[52] U.S. Cl. ..... 84/604; 84/623; 84/624

[58] Field of Search ..... 84/600, 604, 623, 84/624, 627, 663

[56] References Cited

U.S. PATENT DOCUMENTS

| | | | |
|---|---|---|---|
| 3,809,786 | 5/1974 | Deutsch . | |
| 4,018,121 | 4/1977 | Chowning . | |
| 4,133,241 | 1/1979 | Niimi . | |
| 4,173,164 | 11/1979 | Adachi . | |
| 4,183,275 | 1/1980 | Niimi . | |
| 4,223,582 | 9/1980 | Kato . | |
| 4,253,367 | 3/1981 | Hiyoshi . | |
| 4,297,933 | 11/1981 | Nishimoto . | |
| 4,301,704 | 11/1981 | Nagai . | |
| 4,327,419 | 4/1982 | Deutsch et al. | 84/605 X |
| 4,406,204 | 9/1983 | Katoh . | |
| 4,422,362 | 12/1983 | Chibana . | |
| 4,455,911 | 6/1984 | Yamada . | |
| 4,554,857 | 11/1985 | Nishimoto . | |
| 4,616,546 | 10/1986 | Uchiyama . | |
| 4,643,066 | 2/1987 | Oya . | |
| 4,655,115 | 4/1987 | Nishimoto . | |
| 4,664,839 | 5/1987 | Nishimoto . | |
| 4,697,490 | 10/1987 | Deutsch | 84/608 |
| 4,706,537 | 11/1987 | Oguri . | |
| 4,719,833 | 1/1988 | Katoh . | |
| 4,747,332 | 5/1988 | Uchiyama . | |
| 4,748,888 | 6/1988 | Oya . | |
| 4,766,795 | 8/1988 | Takeuchi . | |
| 4,788,896 | 12/1988 | Uchiyama . | |
| 4,942,799 | 7/1990 | Suzuki | 84/603 |
| 5,022,304 | 6/1991 | Masaki | 84/607 |
| 5,025,702 | 6/1991 | Oya | 84/689 |
| 5,029,509 | 7/1991 | Serra et al. | 84/627 X |
| 5,033,352 | 7/1991 | Kellogg | 84/658 |
| 5,074,183 | 12/1991 | Chibana | 84/615 |
| 5,076,133 | 12/1991 | Toda | 84/624 |

(List continued on next page.)

OTHER PUBLICATIONS

Garcia, D.; *Precision Digital Sine–Wave Generation With the TMS32010*, "Digital Signal Processing Routines", Chapter 8, Digital Signal Processing, Texas Instruments, pp. 269–275+, Jan. 19, 1984.

*Primary Examiner*—William M. Shoop, Jr.
*Assistant Examiner*—Jeffrey W. Donels
*Attorney, Agent, or Firm*—Gerald E. Laws; C. Alan McClure; Richard L. Donaldson

[57] ABSTRACT

The method of the present invention preferably receives a predetermined number of input values or data from which it may be determined which one of a predetermined number of modulator waveforms is selected and which one of a predetermined number of carrier waveforms is selected for a desired audio signal, musical sound or tone. A portion of the input values are used to generate predetermined control signals which are used in combination with the selected modulation waveform to interpolate stored modulator harmonic spectral values to determine the modulator waveform's harmonic sideband(s). A second portion of the control values that have been generated are used in combination with the selected carrier waveform to then determine the carrier waveform's spectral values, amplitude and envelope amplitude. Following this the carrier and modulator spectral values are combined in a preselected manner to provide an appropriate composite signal. The resulting composite signal is then multiplied by the carrier wave envelope amplitude to obtain the proper amplitude of the output signal. Random or "white noise" spectral values are then appropriately combined with the composite waveform spectral values to provide an output signal representative of the desired audio signal, musical sound or tone. The foregoing steps are repeated for each one of the audio signals, musical sounds or tones (or "voices") that are required to be generated.

24 Claims, 9 Drawing Sheets

U.S. PATENT DOCUMENTS

| | | | |
|---|---|---|---|
| 5,094,136 | 3/1992 | Kudo | 84/603 |
| 5,138,924 | 8/1992 | Ohya | 84/604 |
| 5,182,415 | 1/1993 | Kunimoto | 84/660 |
| 5,191,161 | 3/1993 | Oya | 84/604 |
| 5,218,156 | 6/1993 | Iiuzuka | 84/624 |
| 5,229,535 | 7/1993 | Kozuki | 84/661 |
| 5,243,124 | 9/1993 | Kondratiuk et al. | 84/624 |
| 5,254,805 | 10/1993 | Iizuka | 84/626 |
| 5,401,897 | 3/1995 | Depalle et al. | 84/627 X |
| 5,412,152 | 5/1995 | Kageyama et al. | 84/607 |

604
CONTROL INFORMATION
614
ADDRESS GENERATOR
608
28 25 22 19 16 13 8 3 0 MI
S1 S2 S3 S4 S5 S6 S7 S8 S9 #
0 1 2 3 4 5 6 7 8 OFF SET
(DATA)
OUTPUT BUFFER (16 WORDS)
606
WAVEFORM COMBINOR 612
CARRIER AMPLITUDE
610
400
402
404
616b
S.F.
618
FINAL OUTPUT BUFFER (16 WORDS) 312
OUTPUT BUFFER (16 WORDS)
602
C1 C2 C7 C8
(DATA)
CONTROL INFORMATION
614a
ADDRESS GENERATOR
S.F.
616a
502
WHITE NOISE GENERATOR

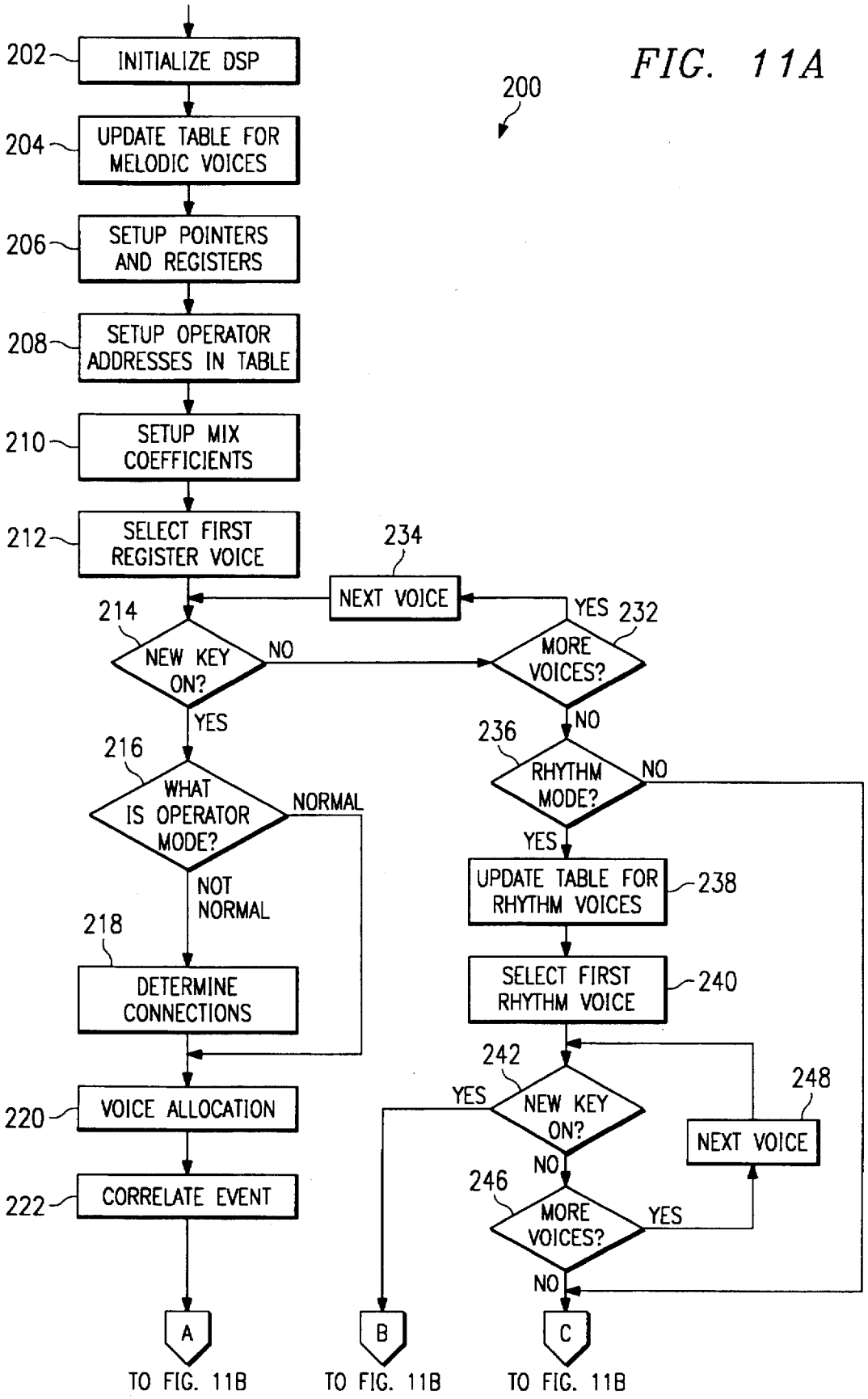
FIG. 11A
200
202
INITIALIZE DSP
204
UPDATE TABLE FOR MELODIC VOICES
206
SETUP POINTERS AND REGISTERS
208
SETUP OPERATOR ADDRESSES IN TABLE
210
SETUP MIX COEFFICIENTS
212
SELECT FIRST REGISTER VOICE
234
NEXT VOICE
214
NEW KEY ON?
NO
YES
232
MORE VOICES?
YES
NO
216
WHAT IS OPERATOR MODE?
NORMAL
NOT NORMAL
236
RHYTHM MODE?
NO
YES
218
DETERMINE CONNECTIONS
UPDATE TABLE FOR RHYTHM VOICES
238
SELECT FIRST RHYTHM VOICE
240
242
NEW KEY ON?
YES
NO
248
NEXT VOICE
220
VOICE ALLOCATION
222
CORRELATE EVENT
246
MORE VOICES?
YES
NO
A
B
C
TO FIG. 11B
TO FIG. 11B
TO FIG. 11B

APPARATUS AND METHOD FOR GENERATION AND SYNTHESIS OF AUDIO

NOTICE: COPYRIGHT C 1994 TEXAS INSTRUMENTS INCORPORATED

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD OF THE INVENTION

The present invention relates to the field of systems, apparatus and methods for electronic emulation of audio, and more particularly, to systems, apparatus and methods for producing spectral values of successive sample points for complex audio wave shapes, and converting these values to audio signals as the computations of these values are carried out.

BACKGROUND OF THE INVENTION

Various methods have been proposed to synthesize musical tones with electronic musical instruments. One of the proposed methods is a technique taught in U.S. Pat. No. 3,809,786 entitled "Computor Organ". This patent teaches individually computing the Fourier components (harmonic ingredients) of a musical tone and then summing those components to synthesize a musical tone. This method allows synthesis of a wide range of musical tones, but requires a large number of computation circuits to achieve this range, which results in a complex and costly electronic musical instrument. This method also has technical difficulties that increase with the number of harmonics used for synthesizing a musical tone since each new harmonic requires an expansion of a harmonic coefficient memory for storing a correspondingly increased number of harmonic coefficients and also requires an increased clock frequency for computing the additional harmonics. If the number of harmonics is increased but the clock frequency for computation is unchanged, a parallel processing system must be used which requires additional complexity and cost for the electronic musical instrument.

There is also a prior art method for producing musical tones utilizing a frequency modulation technique taught in U.S. Pat. No. 4,018,121 to Chowning. This prior art method has overcome the above described disadvantage of the Fourier component synthesizing method fairly effectively for it can produce many partial tones or harmonic or unharmonic components. This prior art method is particularly effective for synthesizing percussion instrument sounds (including a piano) and wind instrument sounds. The prior art method is disadvantageous in that the amplitudes of respective partial tones become irregular if a large modulation index is used, so that the method is not very suitable for producing a tone having a relatively smooth spectral composition (e.g. string instrument tones); by respective partial tones becoming irregular, it is meant that irregularity occurs in the spectrum envelope of the musical tone for a large modulation index.

Subsequent to Chowning many prior art apparatus and methods have been developed to extend the results of Chowning. However, there are still unmet needs for additional techniques for producing complex audio waveshape spectral values.

SUMMARY OF THE INVENTION

According to one aspect of the present invention, a method for producing complex audio waveshape spectral values is provided. A method of the present invention preferably receives a predetermined number of input values or data for a desired audio signal, musical sound or tone from which it may be determined which one of a predetermined number of modulator waveforms is selected and which one of a predetermined number carrier waveforms is selected. A portion of the input values are used to generate predetermined control signals which are used in combination with the selected modulation waveform to interpolate stored modulator harmonic spectral values to determine the modulator waveform's harmonic sideband(s). A second portion of the control values that have been generated are used in combination with the selected carrier waveform to then determine the carrier waveform's spectral values. Following this the carrier and modulator spectral values are combined in a preselected manner to provide an appropriate composite signal; preferably, the modulator spectral values representative of the desired harmonics are multiplied by the carrier waveform spectral values to generate a composite carrier and harmonic sidebands waveform. The resulting composite signal is then multiplied by the carrier wave envelope amplitude to obtain the proper amplitude. Random or "white noise" spectral values are then appropriately combined with the composite waveform spectral values to provide an output signal representative of the desired audio signal, musical sound or tone. Preferably, the foregoing steps are repeated for each one of the audio signals, musical sounds or tones (or "voices") that are required to be generated.

The present invention provides an apparatus for production of signals which are representative of complex time varying audio signals or musical waveforms. One apparatus of the present invention is a digital signal processor programmed to perform the above-described method.

The present invention also provides a system for the electronic production of complex time varying audio signals or musical tones. One system of the present invention is a circuit board for synthesizing musical sounds that includes a DSP programmed to perform the above-described method. An alternative system of the present invention is a host computer system that includes such a circuit board with such a programmed DSP.

BRIEF DESCRIPTION OF THE DRAWINGS

For a more complete understanding of the present invention, and the advantages thereof, reference is now made to the following description taken in conjunction with the accompanying drawings, in which:

FIGS. 11A and 11B depict a flow diagram illustrating the control steps for execution of the time multiplexed synthesis process of the present invention.

DETAILED DESCRIPTION OF THE INVENTION

The present invention provides systems for the electronic production of audio signals, musical sounds or tones. As is well known, audio signals or musical sounds typically include periodic components at a fundamental frequency and other generally harmonically related frequencies. The relative amplitudes and phases of these harmonic components determine the tonal quality of the sound. An audio signal or music signal reproduced by a sound system generally consists of an analog voltage having a waveshape (e.g. voltage as a function of time) which is a superposition or composite of the harmonic components of the corresponding sound. Such a complex time varying waveshape may be described mathematically in terms of its harmonic components by well known Fourier equations resulting in Fourier coefficients representing the harmonic components. Thus, such complex time varying audio signals or musical sounds may be represented by (or decomposed into) a carrier wave and a series of Fourier coefficients; this type of representation allows for comparison between two audio signals or musical sounds.

The present invention computes waveshapes and amplitudes for discrete sample points from stored waveform data, and preferably, these waveshapes are converted to audio or musical sounds as additional computations occur. The computations and conversion to audio or musical sounds may occur together (virtually simultaneously) so that the audio or musical sounds are generated in real time without any delay (other than any slight delays needed for the computations and conversion), or the computation results may be stored for later conversion or other use.

Preferably, the present invention is used to emulate frequency modulation (FM) synthesis of musical sounds, such as described in U.S. Pat. No. 4,018,121 to Chowning. Such FM synthesis uses a carrier wave having a carrier frequency and a modulator wave having a modulator frequency. The modulator wave is combined with the carrier wave to produce harmonic components, generally on both sides of the carrier frequency (e.g. above and below the carrier frequency). The number and amplitude of the harmonic components is determined by a modulation index, (MI), while the overall amplitude of the resulting complex waveform is determined by the carrier wave's amplitude or volume.

Figure 1:
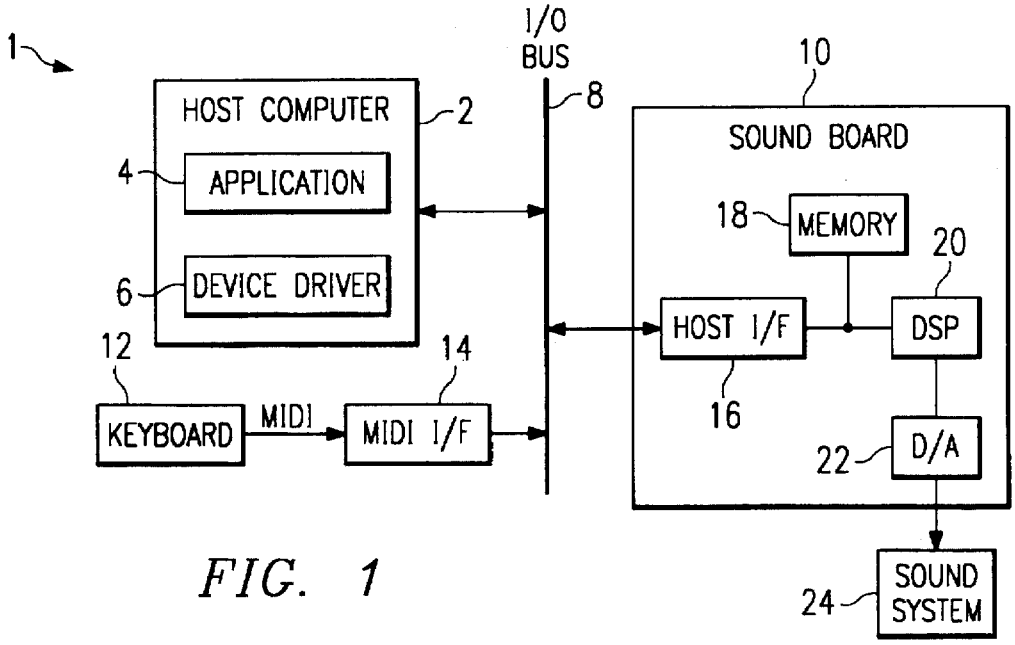
FIG. 1 depicts a block diagram of a system for producing audio signals or musical sounds employing the techniques of the present invention.

Referring now to FIG. 1 there may be seen a simplified block diagram of a system 1 for electronically generating audio or music that employs the techniques of the present invention. More particularly, there may be seen in FIG. 1 a host computer 2, which includes an application program 4 that requires generation of audio or musical sounds and a device driver 6 that supports generating such audio or musical sounds. In addition, there may be seen an input/output (I/O) expansion bus 8 suitable for connecting the host 2 to one or more so-called boards or cards 10 that provide specialized functions to the host computer 2.

FIG. 1 also depicts a musical keyboard 12, whose output signals are in a conventional musical instrument device interface (MIDI) format, connected to a MIDI hardware circuit 14 for interfacing with the I/O bus 8. An audio or music generation board 10 is also depicted in FIG. 1. The audio or music generation board 10 is connected to the I/O bus 8 and generates the audio or musical sounds desired by the application program 4, such as a video game, or the keyboard 12.

As may be seen from FIG. 1, the music (or sound) generation board 10 includes a host interface circuit 16 that is directly connected to the I/O bus 8. The host interface circuit 16 supplies signals to and from the bus 8 to a memory 18 and/or a digital signal processor (DSP) 20. Preferably, the memory 18 is high speed SRAM and the DSP 20 is a TMS320C5x DSP from Texas Instruments. However, memory 18 may be SRAM, RAM or ROM (for static data) and may be on-chip as part of the DSP 20, or off-chip and separate from the DSP 20, or may partially on-chip and partially off-chip. The DSP 20 in turn supplies signals to a digital-to-analog (D/A) circuit 22 which converts the digital signals from the DSP 20 to analog signals which are output to a sound system 24 that may include a suitable amplifier and speakers (not shown).

The DSP 20 preferably uses the methods of the present invention to generate signals representative of desired audio or musical sounds or tones. In accordance with the presently preferred method of the present invention, preferably the DSP 20 receives a predetermined number of input values or data from the application program 4 or keyboard 12. The DSP 20 determines from these input values which one of a predetermined number of carrier waveforms is selected and which one of a predetermined number of modulator waveforms is selected for a desired audio or musical sound or tone.

A portion of the input values may be used by the DSP 20 (or host processor 2) to generate predetermined control signals which are used in combination with the selected modulation waveform to interpolate stored (in memory 18) harmonic spectral values to determine modulator harmonic component(s) or sideband(s). A different portion of the control values that have been generated by the DSP 20 (or host 2) are used in combination with the selected carrier waveform to then determine the carrier waveform's spectral values.

The carrier and modulator spectral values are combined in a preselected manner by the DSP 20 to provide an appropriate composite carrier and modulator waveform. The composite waveform is then adjusted for the carrier envelope's amplitude and appropriately combined with random or "white noise" spectral values, also generated by the DSP 20, to provide an output signal representative of the desired audio or musical sound or tone. Alternatively, the composite waveform may be used as the output signal representative of the desired audio signal, musical sound or tone.

Preferably, the harmonic waveform outputs representative of the desired harmonics are generated by the DSP 20 as a function of the modulation index (MI) and selected modulator waveform. The harmonic series waveform outputs are then preferably added with the carrier waveform amplitude by the DSP 20, and the results are preferably multiplied by the carrier waveform spectral values (representative of a carrier at a desired carrier frequency) in the DSP 20. The DSP 20 then multiplies this result by the carrier wave envelope amplitude to obtain the proper amplitude for the composite signal. Then, spectral values representative of white noise, generated by the DSP 20, are appropriately scaled or mixed with the amplitude adjusted composite signal, based on the desired amount of feedback, to provide the final output spectral values representative of the desired musical sound or tone. Preferably, the DSP 20 repeats the foregoing process for each one of the audio signals, musical sounds or tones (or "voices") that are desired to be generated. Thus, the present invention provides a method for producing spectral values representative of complex time varying audio or musical waveshapes.

A further system of the present invention is a circuit board 10 for generating audio or musical sounds that includes a DSP 20 programmed to perform the above-described method.

The present invention also provides an apparatus 20 for production of signals which are representative of audio signals or musical sounds or tones. Such an apparatus of the present invention is a digital signal processor 20 programmed to perform the above-described method or circuitry designed to perform the above-described method steps in hardware.

Figure 2A:
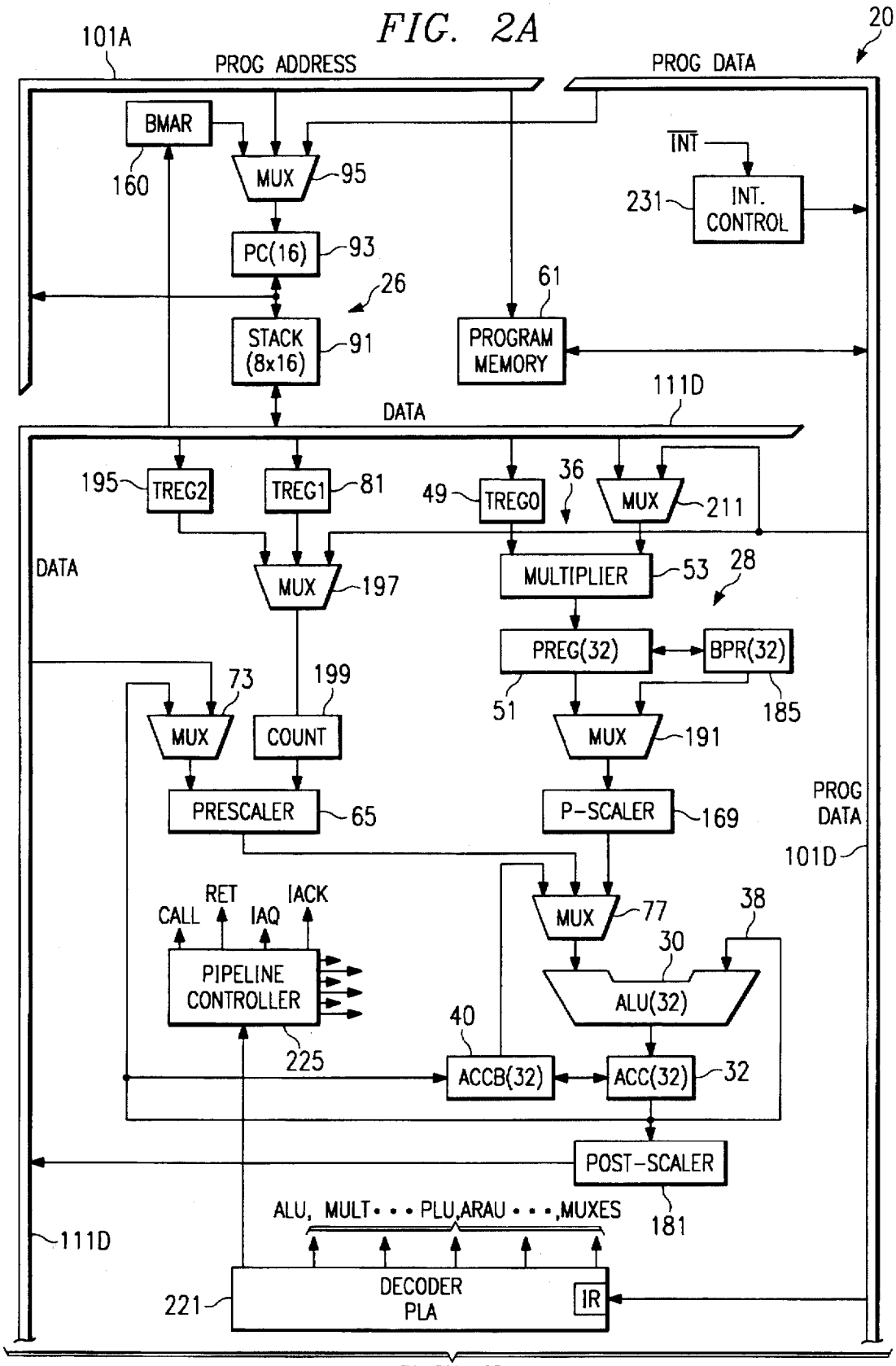
FIGS. 2A and 2B depict a block diagram of a Texas Instruments 320C5x DSP, suitable for practicing methods of the present invention.
Figure 2B:
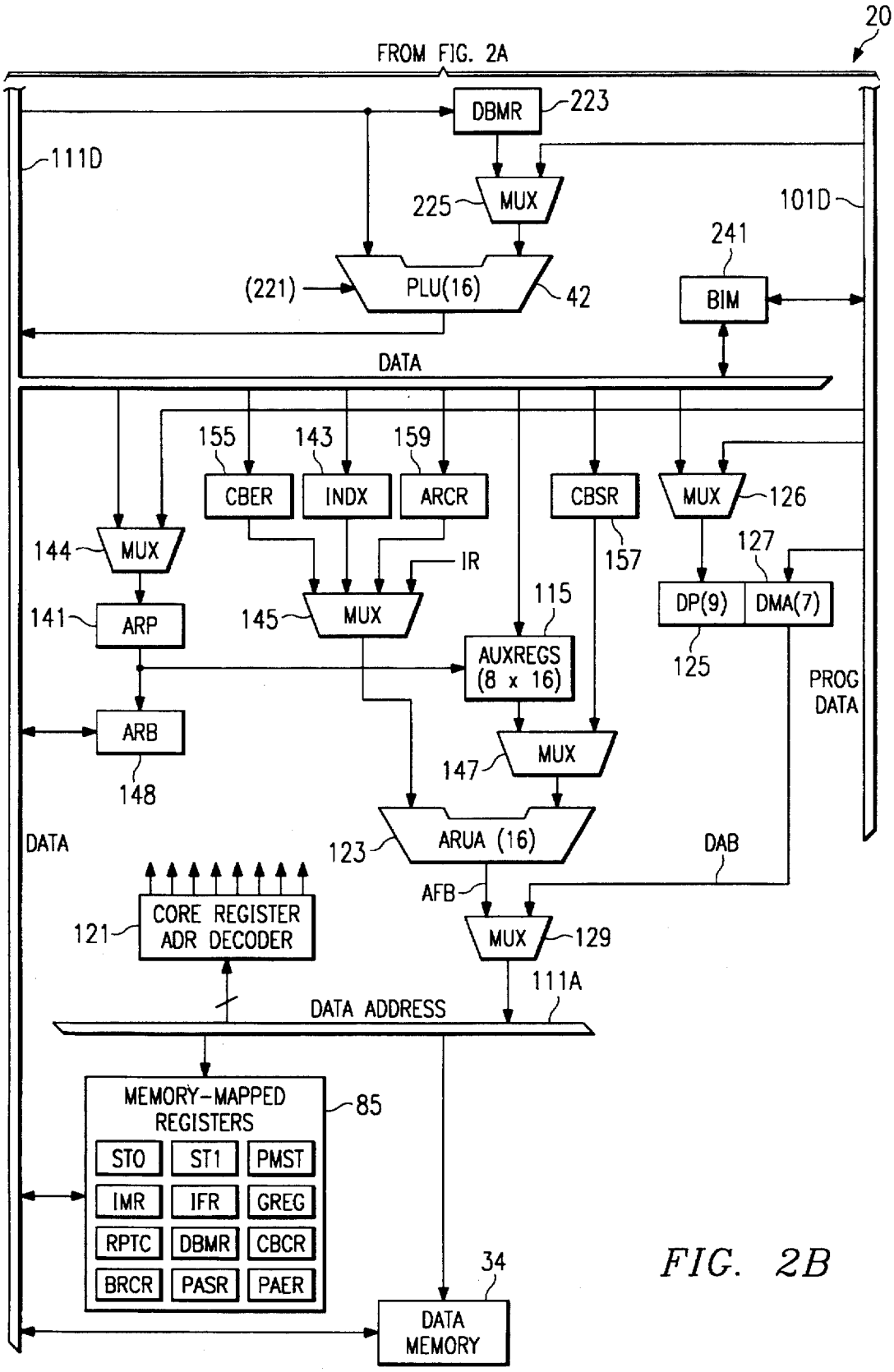

FIGS. 2A and 2B depict an architectural overview of the presently preferred Texas Instruments TMS320C5x digital signal processing device 20. The functional block diagram depicted in FIGS. 2A and 2B outlines the principal blocks and data paths within the processor 20. The preferred digital signal processing device 20 of FIGS. 2A and 2B implements a Harvard-type architecture that maximizes processing power by maintaining two separate memory bus structures, program and data, for full-speed execution. Instructions are included to provide data transfers between the two bus structures.

The processor architecture is built around two major buses, a program bus 101A and 101D, and a data bus 111A and 111D. The program bus carries the instruction code and immediate operands from a program memory 61 on program data bus 101D. Program memory 61 is connected at addressing inputs to the program address bus 101A and addresses to program memory 61 are supplied on the program address bus 101A. Program memory 61 is connected at its read/write input/output to the program data bus 101D. The data bus 111 includes a data address bus 111A and a data data bus 111D. The data data bus 111D interconnects various elements, such as an Arithmetic Logic Unit (ALU) 30 and an auxiliary register file 115 and registers 85 to the data memory 34. Together, the program and data buses 101 and 111 can carry data from on-chip data memory 34 and internal or external program memory 61 to a multiplier 36 in a single cycle for multiply/accumulate operations. Data memory 34 and registers 85 are addressed via data address bus 111A. A core register address decoder 121 is connected to data address bus 111A for addressing registers 85 and all other addressable CPU core registers.

The device 20 has a program addressing circuit 26 and an electronic computation circuit 28. The computation circuit 28 performs two's-complement arithmetic using a 32 bit ALU 30 and accumulator 32. The ALU 30 is a general-purpose arithmetic logic unit that operates using 16-bit words taken from a data memory 34 of FIG. 2B, or derived from immediate instructions, or using a 32-bit result of the multiplier 36. In addition to executing arithmetic instructions, the ALU 30 can perform Boolean operations. The accumulator 32 stores the output from the ALU 30 and provides a second input to the ALU 30 via a path 38. The accumulator 32 is illustratively 32 bits in length and is divided into a high-order word (bits 31 through 16) and a low-order word (bits 15 through 0). Instructions are provided for storing the high and low order accumulator words in data memory 34. For fast, temporary storage of the accumulator 32 there is a 32-bit accumulator buffer ACCB 40.

In addition to the main ALU 30 there is a Peripheral Logic Unit (PLU) 42 in FIG. 2B that provides logic operations on memory locations without affecting the contents of the accumulator 32. The PLU 42 provides extensive bit manipulation ability for high-speed control purposes and simplifies bit setting, clearing, and testing associated with control and status register operations.

The device 20 has a high degree of parallelism; e.g., while the data is being operated upon by the ALU 30, arithmetic operations may also be advantageously implemented in an Auxiliary Register Arithmetic Unit (ARAU) 123. Such parallelism results in a powerful set of arithmetic, logic, and bit manipulation operations that may all be performed in a single machine cycle. The device 20 also contains internal hardware for single-cycle 16-bit×16-bit multiplication, data shifting and address manipulation.

The multiplier 36 of FIG. 2A performs a 16×16 bit two's-complement multiplication with a 32-bit result in a single instruction cycle. The multiplier consists of three elements: a temporary TREG0 transfer 49, product register PREG 51 and multiplier array 53. The 16-bit TREG0 register 49 temporarily stores the multiplicand; the PREG register 51 stores the 32-bit product. Multiplier values either come from data memory 34, from program memory 61 when using the MAC/MACD instructions, or are derived immediately from the MPYK (multiply immediate) instruction word. The fast on-chip multiplier 36 allows the device 20 to efficiently perform fundamental DSP operations such as convolution, correlation, and filtering.

A processor scaling shifter 65 has a 16-bit input connected to a data bus 111D via a multiplexer (MUX) 73, and a 32-bit output connected to the ALU 30 via a multiplexer 77. The scaling shifter 65 produces a left-shift of 0 to 16 bits on the input data, as programmed by instruction or defined in a shift count register (TREG1) 81. The LSBs (least significant bits) of the output are filled with zeros, and the MSBs (most significant bits) may be either filled with zeros or sign-extended, depending upon the state of the sign-extension mode bit SXM of the status register ST1 in a set of registers 85 of FIG. 2B. Additional shift capabilities enable the processor 20 to perform numerical scaling, bit extraction, extended arithmetic, and overflow prevention.

Up to eight levels of a hardware stack 91 are provided for saving the contents of a program counter 93 during interrupts and subroutine calls. Program counter 93 is selectively loaded upon a context change via a MUX 95 from program address bus 101A or program data bus 101D. The PC 93 is written to address bus 101A or pushed onto stack 91. On interrupts, certain strategic registers (accumulator 32, product register 51, TREG0 49, TREG1 81, TREG2 195, and selected registers in register set 85) are pushed onto a one deep stack, and are popped upon interrupt return to provide a zero-overhead, interrupt context switch. The interrupts operative to save the contents of these registers are maskable.

Figure 3:
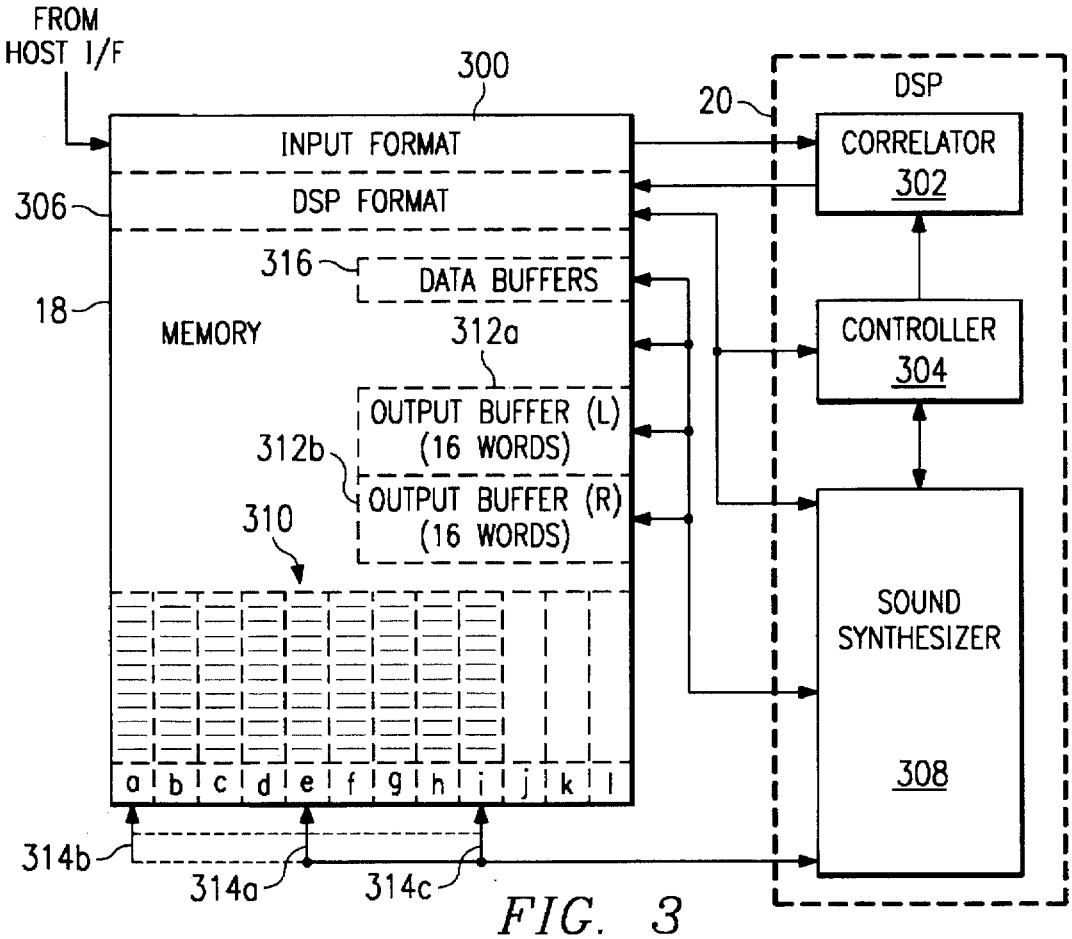
FIG. 3 depicts major functional blocks residing in portions of the apparatus of FIG. 1 for practicing methods of the present invention.

The methods of the present invention will now be briefly described. FIG. 3 depicts the major functional blocks residing in the memory 18 and DSP 20 for practicing the methods of the present invention.

An application program 4 (shown in FIG. 1) with an embedded audio signal or musical control output, or a keyboard 12, (i.e. hardware and/or application software requiring audio or sound generation) produces output values that are representative of certain desired audio signals, musical sounds or tones (or "voices"). These output values are typically organized in a specific predetermined register format and the information in this register format may then be used by an audio or sound generation card 10 connected to and serving the host interface process or processor 2.

Preferably, this processor 2 moves or copies the register's output values into a portion of memory 18, designated input format 300 in FIG. 3. Memory 18 is again associated with and used by a digital signal processor 20, which uses the methods of the present invention to generate audio signals or musical sounds using the information in the register format 300. Memory 18 may be SRAM, RAM or ROM (for static data such as the waveform tables) and may be on-chip as part of the DSP 20, or off-chip and separate from the DSP 20, or may be partially on-chip and partially off-chip.

A correlator, or correlation process, 302 (preferably in the DSP 20), under control of a controller, or control process, 304 (also in the DSP 20), is then applied to the values in the input format 300 (the register output values format) by the DSP 20; alternatively, the host processor 2 may contain and perform the correlation process 302 or a circuit may perform this process 302. The output of the correlation process 302 is a set of control parameters or control words and selector values in a DSP format 306 stored in memory 18 which are subsequently used by the sound synthesis process 308 of the present invention, which is also in the DSP 20. The correlation process 302 effectively converts the register's values from the register format 300 to a DSP format 306.

That is, the correlation process 302 converts the input format 300 or register values into process control parameters and selector values suitable for use by the synthesis process 308 of the present invention. The correlation process 302 is used to convert the real time asynchronous input format 300 values into synthesis control parameters synchronous with a DSP 20 internal clock or other clock. In a preferred embodiment of the present invention, the correlation process 302 is applied to the register values 300 by the control process 304 only once during any given time interval corresponding to the time the DSP is using to calculate a frame of data.

Preferably, a frame includes sixteen time sequenced words of data for both the right and left channels of sound for a specific application and a word is a sixteen bit signed value. For the presently preferred TI 320C5x DSPs the slowest clock frequency allows for computing up to sixteen data words before approaching a time interval long enough to be audibly detected. The size in number of data words in a frame is determined by the speed and throughput of the DSP 20 and the sound digitization frequency or rate, which is typically about twenty-two kilohertz. If the digitization rate changes, then adjustments may be made in the frame size. A frame with sixteen data words allows sufficient time (about 725 microseconds) for the DSP 20 to compute the words for sixteen sequential in time data values for the desired number of sounds or voices and perform various other tasks. If the DSP is fast enough, it may be preferable to use a frame with one word of data and essentially perform the synthesis computations on an instantaneous basis.

The audio or sound synthesis process 308 of the present invention generates values representative of an audio signal based upon these control parameters and selector values 306 preferably using a DSP 20. The final values representative of the audio signal are stored as 16 words in output buffers 312*a*, 312*b* in the memory 18. As noted later herein, the process 308 also uses various data buffers 316 during portions of the synthesis process. The audio or sound synthesis process 308 of the present invention may also update certain of the control parameters, as a function of time, stored in the DSP format 306; this may be necessary to insure an accurate emulation of a conventional FM music synthesis process or other music generation or synthesis processes.

The audio or sound synthesis process 308 of the present invention uses various time domain harmonic spectra stored as contiguous and addressable data tables 310 in a memory 18 that are organized by modulator waveform type and indexed by values of FM modulation indices, or that are organized by carrier waveform type and indexed by control information. Alternatively, each of the tables, whether harmonic spectra or carrier spectra, may be indexed by control information. The tables 310 in FIG. 3 are depicted as columns a–l, with columns a–i representative of tables containing harmonic data which include multiple waveforms in each table and columns j–l representative of tables containing carrier waveform entries which include a single waveform in each table. The members of columns (or tables) of each type in FIG. 3 are illustrative only.

Preferably, the correct table of harmonic spectra 310 *a–i* is selected based on certain register selector values 300/306 representative of a desired type of modulation waveform; these selector values 300/306 identify the table containing harmonic spectra associated with the type of modulator waveform desired (sine, cosine, rectified, etc.), for example table 310*e*. Again, other control information may be used to make these selections. These time domain harmonic spectra or waveforms are one-sided harmonic spectra, similar to the one-sided frequency spectra depicted in the dotted line box 400 of FIG. 4 and exclude the carrier frequency 402 and any mirror-image sideband 404 or any reflected sideband waveforms (not shown). Similarly, the correct table of carrier spectra 310*j–l* is selected based on certain register selector values 300/306 representative of a desired type of carrier waveform; these selector values 300/306 identify the table containing carrier waveform spectra associated with the type of carrier waveform desired (sine, cosine, rectified, etc.), for example table 310*l*.

In an alternative embodiment, the one-sided harmonic spectra may be generated using a multiplicative harmonic series expansion process or circuit. For example, a plurality of appropriately scaled sine waves having different frequencies but with integer frequency multiples of each other (e.g. f, 2f, 3f, 4f, etc.) are multiplied together in a multiplier circuit to create a harmonic spectra waveform; the more sine waves that are multiplied together, the larger the number of harmonics that are generated. A single sine wave generator may be used to generate each of the sine waves (with their different frequencies) with the number of sine waves generated depending upon the modulation index (MI). Alternatively, multiple sine wave generators may be so employed. Further, periodic waveform other than a sine wave may be so employed and frequencies other than integer multiples may be so employed.

A control word is correlated with the desired modulation index (MI) by the correlation process 302. This control word is then used by an address generator or address generator process (not depicted in FIG. 3) that is part of the synthesis process 308 to access appropriate harmonic spectra in the previously selected table 310*e* (in the example) as a function of the correlated modulation index. That is, the process of the present invention converts amplitude values into an index or pointer value which is used to retrieve data values representative of complex time varying waveform values from a memory 18 for further use by the process 308 of the present invention. This "pointer" is illustrated in FIG. 3 by the arrows 314*a, b, c* pointing at the base of the columns (a–i) of the tables 310 and the dotted lines between the two outside arrows 314*b*, 314*c* illustrate how the pointer 314*b* may move from table to table. The address generator process also generates interpolation coefficients used for interpolating within a waveform and between waveforms for the accessed spectra. That is, the selected modulator wave's spectral values are, if necessary, interpolated between those values representative of a single waveform and then interpolated between two adjacent waveforms in the table to provide more accuracy and better sound fidelity. Also, the various register values representative of pitch, or frequency, are correlated to pitch steps which are used by the address generator process to make changes to the pitch step portions of the address at a rate dependent upon the source of the pitch change.

Various other register selector values are correlated to a desired carrier frequency or pitch and desired type of carrier waveform; these correlated values are used to control generation of the carrier wave. Carrier wave spectral values and amplitude are correlated from register selector values and a table (containing a single waveform representative of the type of carrier waveform selected), also using interpolation coefficients; the interpolation coefficients are derived from the address generator process. That is, the selected carrier wave's spectral values are, if necessary, interpolated between those values in the table to provide more accuracy and better sound fidelity.

In addition, the correlation process 302 generates coefficients used for scaling and summing the spectral components of the carrier and modulator waveforms, as a function of the modulation index, and for scaling other spectral values representative of so-called "white noise", based upon the desired amount of feedback (indicated by values in the register input format which are correlated to values useful by the process of the present invention). The desired amount of feedback may be correlated in a linear or nonlinear manner. Preferably, the correlation is nonlinear since at some threshold value the white noise "swamps" or overshadows the harmonic and carrier signals; this nonlinear correlation is preferably accomplished using a table, also stored in memory 18.

Figure 4:
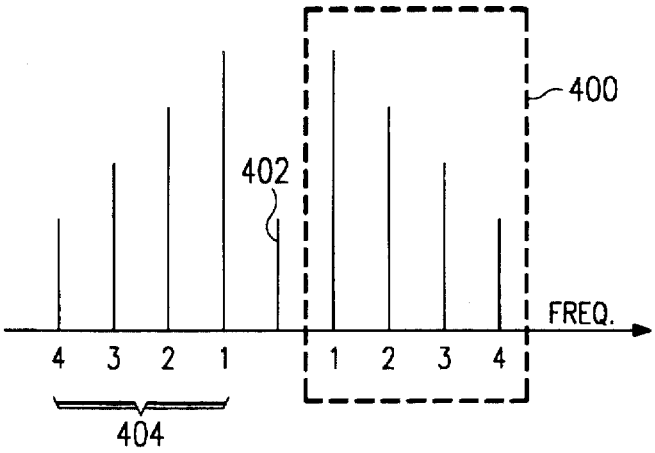
FIG. 4 depicts frequency components representative of a selected carrier wave and its associated sideband harmonics, with the dotted line box portion containing harmonic sideband constituent(s) representative of those stored in a memory and used by methods of the present invention.

Referring now to FIG. 4, which depicts frequency components representative of a selected carrier wave and its associated harmonics, there may be seen the desired one-sided harmonics 400 and carrier waveform 402. The carrier waveform amplitude (the relative height of 402) is summed or added with the selected and interpolated one-sided harmonic spectral values 400. This combination of the carrier amplitude and one-sided waveform are preferably input to a simple multiplier or multiplicative process along with the carrier waveform spectral values which produces a composite waveform of two-sided (or reflected) harmonic modulator waveform plus carrier waveform spectra 400/402/404. The composite waveform spectral values 400/402/404 are then appropriately combined with the desired carrier waveform envelope amplitude to scale the composite waveform 400/402/404. The desired amount of feedback plus other register values are correlated to mixing coefficients for appropriately combining the output of a white noise generator with the composite waveform 400/402/404, as well as biasing of the address generator process for selecting the appropriate harmonic waveform series and interpolation of those waveforms.

In more detail and referring again to FIG. 3, the values representative of selected register contents are read by a correlation process 302 from memory 18 and then the correlation process 302 is applied to these data values. The output of the correlation process 302 is a set of control parameters and selector values specifically generated for use by the synthesis process 308 of the present invention which are stored in memory 18 in a DSP format 306. The synthesis process 308 of the present invention utilizes these control parameters and selector values 306 and memory tables 310 to generate output data (representative of an audio signal) stored in output buffers 312, as a function of the values of the control parameters and selector values 306 and the selected data values in the tables 310. The synthesis process 308 may also update certain control parameters 306 as a function of time, if necessary. For accurate emulation a time varying correlation process 302 may be part of the synthesis process 308 of the present invention.

U.S. Pat. No. 4,108,121 to Chowning describes a well known FM synthesis technique where the component harmonics and corresponding amplitudes are produced by FM synthesis over a modulation index and may be described by Bessel functions. Since human audio perception is based upon the frequency domain characteristics of a time domain source waveform, an FM emulation process need only generate similar spectra over a modulation index, MI, and closely track the amplitude and phase characteristics based upon control register values.

Table 1 illustrates the harmonic content of an FM signal from a sine carrier wave and a sine modulator wave measured via fast Fourier transform (FFT) for nine values of a modulation index MI ranging from 0 to 16. Table 1 also illustrates the carrier amplitude, which is not part of the data stored in the harmonic tables, and the waveform series ($S_i$) corresponding to a modulation index. As shown in Table 1 the harmonic spectra range from the first harmonic to the twentieth harmonic with varying amplitudes for each harmonic. For each predetermined type of modulator waveform (e.g. sine, cosine, rectified, etc.), a set of time-periodic harmonic series waveforms, such as those whose Fourier coefficients are shown in Table 1, are preferably stored in a separate table 310 *a–i* in a memory 18; preferably these tables 310 *a–i* are in a contiguous manner to form organized and structured tables of potential modulator harmonic waveform spectral values.

The values in each table 310 *a–i* are preferably generated by Fourier transforming the desired audio signal or music waveform into its frequency components and then using a summing inverse transformation to generate the actual values or numbers representing the signal or waveform; preferably, at least one cycle of the desired waveform is Fourier transformed. Occasionally, the data representing the waveform must be phase shifted so that the initial table entry starts at zero rather than a non-zero entry. Alternatively, a table may be employed for each pair or set of predetermined carrier and modulator waveform types, or selected sets of the carrier and modulator waveform types.

Each of the preferably nine periodic waveforms, $S_1(n)$, $S_2(n)$, $S_3(n)$, . . . $S_9(n)$, in each table 310 *a–i* is preferably composed of 128 samples representing one period of each waveform. Similarly, each carrier table 310 *j–l* has one waveform composed of 128 samples per waveform, for each of the predetermined carrier waveforms. Preferably, each sample of a waveform is a 16 bit signed word, although other bit lengths may be so employed. Other numbers of waveforms (than nine) in a modulator table and other numbers of waveform samples (than 128) in a table may be selected for different purposes and still be within the scope of the present invention.

For example, although fewer than 128 samples per period for a waveform may be employed to reduce memory requirements, this may result in poorer sound quality; depending upon the interpolation technique used for interpolating between two samples in a waveform (or between waveforms), using fewer than 128 samples/period may result in a coarser interpolation and resulting degradation in sound quality. Similarly, if fewer than 128 samples/period are used with no interpolation, the sound can be expected to be degraded. Further, using more than 128 samples/period results in an improved quality of sound, but at the expense of needing more memory. Preferably, the number of samples per period for the waveforms is selected to be a power of two. However, it is within the scope of the present invention to make such modifications described above to the methods of the present invention.

Similarly, the number of line entries, or number of waveforms, in each modulator waveform table 310 *a–i* is a compromise between memory use and sound fidelity, whose modification is also within the scope of the present invention. For example, using more than nine waveforms in a modulator table 310 *a–i* results in an improved quality of sound, but at the expense of needing more memory. Preferably each waveform in a table 310 will contain the same number of samples (e.g. 128 samples/period); although, for periodic waveforms, it is also possible to reconstruct missing table entries using this known periodicity rather than looking up the values in a table. Similarly, a modulator table 310 *a–i* may be employed for each pair or set of predetermined carrier and modulator waveform types, or selected sets of the carrier and modulator waveform types; the number of tables is also a compromise between memory use and sound fidelity, whose modification is within the scope of the present invention.

The initial portion of the synthesis process of the present invention depicted in FIG. 4 may be represented by the following equation:

$$E_c(n_e)\cdot[C(n_c(\Omega_c(n_w)))\cdot[S(I(n_e), n_m(\Omega_m(n_\Omega)))+A_c(I(n_e))+2\phi]],$$

where $E_c(n_c)$ is the carrier envelope amplitude as a function of the envelope discrete time base $n_e$ and $S[I(n_e), n_m(\Omega_m(n_\Omega))]$ is the harmonic series waveform output as a function of modulation index I and sample $n_m$ as a function of modulation frequency $\Omega_m$ per modulation frequency discrete time base $n_\Omega$. S[I,n] is represented in FIG. 4 as the harmonic series 400 enclosed in the dashed box; the remainder of the FM harmonic series 404, outside the box, is synthesized or generated by the remainder of the process of the present invention. $A_c(I(n_e))$ is the carrier amplitude as a function of modulation index I and $C(n_c(\Omega_c))$ is the carrier waveform output per sample $n_c$ and carrier frequency $\Omega_c$. This equation illustrates how the various carrier and modulator components may be combined to provide an FM signal. However, other different equations using these same components or functions may also be used to describe the initial portion of the synthesis process of the present invention.

Figure 5:
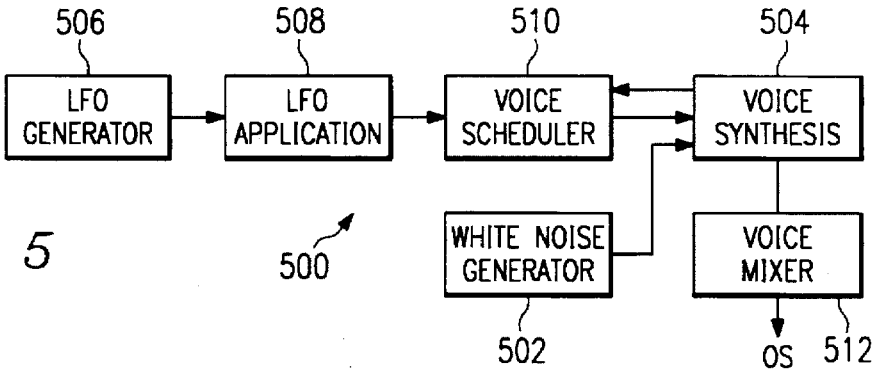
FIG. 5 depicts a block diagram of functional blocks of the presently preferred synthesis method of the present invention.

Referring now to FIG. 5 there may be seen a block diagram of the basic functional blocks of the synthesis process 500 of the present invention. The process 500 includes a white noise generator 502, which generates an output that is supplied to a voice synthesis function 504. An LFO generator 506 supplies information to an LFO application function 508, which may modify voice synthesis control parameters. A voice scheduler function 510 provides time multiplexed control of the voice synthesis function 504. The voice synthesis function 504 is used to generate one or more voices and provides information to voice scheduler 510 for periodic updates of control parameters; the outputs of the voice synthesis function 504 are inputs to the voice mixer function 512 which generates the synthesis process outputs. After the voice mixing portion 512 of FIG. 5, control is passed the operating system (OS) of the DSP 20.

Preferably, the white noise generator 502 is a typical and well-known "exclusive or" type shift register that produces one frame of white noise data, or preferably 16 samples of data each time the synthesis process is run. The last sample generated each frame becomes the input value or seed for the next frame. The white noise data are utilized in subsequent synthesis steps as input data during particular voice processing steps described later herein in reference to voice synthesis function 504.

For each voice to be synthesized, an LFO generator or scheduler/update block 506 contains a generator for generating a pitch LFO and a generator for generating an amplitude LFO. Both of these generators are similar in operation. The pitch LFO generator 506 consists of a table of values representing a sine wave (0–360 degrees) and a circular address generator that generates addresses for entry into the table. However, the amplitude LFO generator 506 consists of a table of values representing a triangular wave and a circular address generator that generates addresses for entry into the table; the pitch LFO generator 506 may also employ a triangular wave instead of a sine wave. Similarly, other types of waves may be employed in either of the generators 506. The initial address is a selected pitch step determined by the correlation process; subsequent addresses are the sum of the previous old address and the selected pitch step. The selected pitch step may be periodically modified or updated as noted later herein. The output of the pitch LFO generator 506 is generated by stepping through the sine table at a constant rate and wrapping around at the end of the table whenever the angle of 360 degrees is exceeded. The generator values from the sine table are appropriately scaled before use in other steps or portions of the methods of the present invention.

The circular address rate for updates is preferably once every sixty-nine frames, which yields new values at the rate of approximately 20 hertz; this is far less than the ideal LFO phase update rate and guarantees that pitch step updates for each voice generator (in the voice synthesis function 504) from LFO cannot occur within one period of any audio signal generated. Other LFO update rates may be employed in the processes of the present invention. The output frequencies generated by the LFO are in the sub-audio band at approximately 4 to 7 hertz.

The pitch LFO output values are used to modify or scale the pitch step values in the voice synthesis 504 block. The architecture of the amplitude LFO generator is the same as the pitch LFO generator described above, however the output values are used to modify or scale the voice's amplitude instead of pitch and the input and output waveforms are triangular rather than a sine wave.

The generation of the modulator waveform and the carrier waveform is determined by the correlation or translation of the input format values into control parameters and selector values suitable for use by the voice synthesis function 504. These control parameters and selector values include specifications of whether or not the carrier and modulation waveforms are individually a sine wave, square wave, rectified wave, etc., as well as the carrier frequency and carrier-to-modulator pitch (or frequency) ratio. In addition, the attack, decay, sustain and release parameters would also be specified for both the carrier and modulator waveforms.

Figure 6:
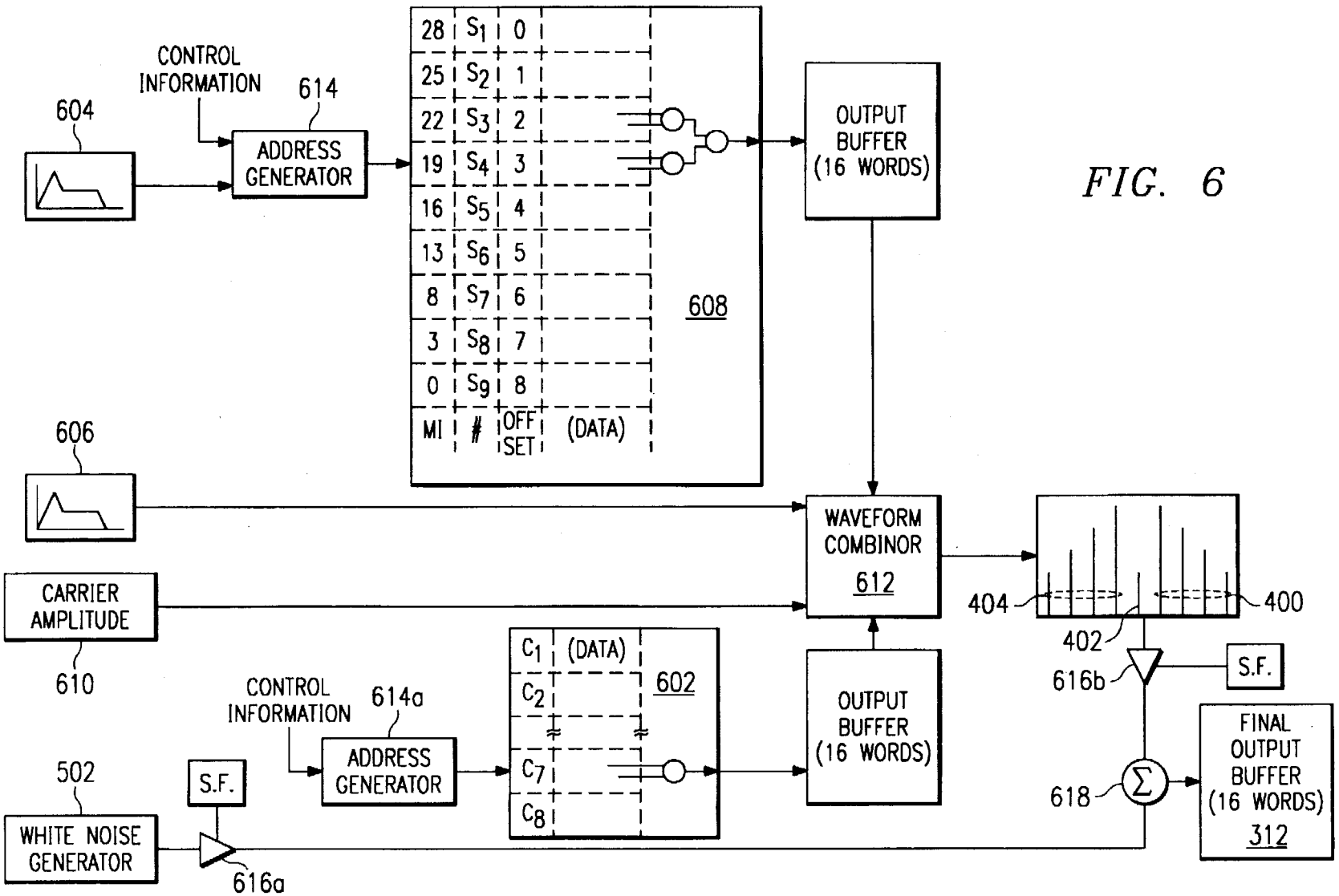
FIG. 6 depicts an expanded block diagram of a portion of the functional blocks of the method of the present invention depicted in FIG. 5.

Referring now to FIG. 6, the carrier waveform generator 602 uses a well known, conventional look up table such as described in an application note in Texas Instruments DSP Applications Volume 1, pages 269–289, entitled "Precision Digital Sine-Wave Generation with the TMS32010", by Domingo Garcia, with a linear type of interpolation between values. Each of the preferably eight carrier look up tables includes a waveform's values having preferably 128 samples per period and is similar to the sine table used by the LFO pitch generator, but is for a specific predetermined carrier waveform type. Linear interpolation is used to compute waveform values falling between the waveform values stored in the table; this technique uses two consecutive table entries as the end points of a line segment and sample points for values between the table values are assumed to be values on the line segment. Other types of interpolation may also be used in the process of the present invention.

Both the modulator envelope generator 604 and carrier envelope generator 606 are conventional ADSR envelope generators, which are also well known in the art, such as described in *A Synthesis Guide to Acoustic Instruments*, by Howard Massey, Alex Nois, and Daniel Shklair (1987, Amsco Publications N.Y., N.Y. 1987) pp 22and 23, and accordingly their operations are not discussed in detail herein.

The process of the present invention emulates FM synthesis by generating comparable spectra and phase components based on a modulation index (or amplitude) and the selections of carrier and modulator source waveforms and their associated frequencies. That is, these components behave similarly over dynamic changes in the effective modulation index or amplitude. One-sided harmonic spectra 400, as shown in FIG. 4, are generated by a modulator harmonic generator 608 which is part of the voice synthesis function 504. The one-sided harmonic spectra are time-varying, periodic waveforms, preferably stored as contiguous tables in a memory and each table preferably includes multiple waveform entries with each entries' data being for a complete waveform cycle or period.

The appropriate correlated FM modulation index (MI) with or without other control information serves as an entry point for each one of these modulator waveform entries which together make up a table of multiple waveforms for a specific type of modulator waveform (i.e. sine, cosine, square, rectified, etc.). That is, at least control information is used by an address generator 614 (see FIG. 6) to select the table, the point of entry into that table and the point of entry into a waveform, as well as appropriate interpolation and mixing coefficients. A portion of the address generator 614*a* may also be used to select the carrier table, the point of entry into that table and the point of entry into the waveform, as well as interpolation coefficients.

There is a table of multiple waveforms ($S_1$–$S_9$ in FIG. 6) for each of the currently used sine, cosine, square wave, rectified wave, etc., modulator waveform types (a single table is illustrated in modulator generator 608) and a table containing an individual waveform for each of the currently used carrier waveform types (a plurality of tables for carrier types $C_1$–$C_8$ is illustrated in carrier generator 602); as new waveform types are identified, new tables may be added. Alternatively, a table of multiple waveforms may be employed for each pair or set of predetermined carrier and modulator waveform types (or selected sets of the carrier and modulator waveform types) in combination with tables each containing an individual waveform for the various carrier waveform types. Presently, there are preferably eight such modulator and eight such carrier waveform types being used.

The modulator harmonic generator 608 effectively behaves as two oscillators with a common phase accumulator capable of dynamically sweeping through any two adjacent waveforms and uses or generates interpolation coefficients to interpolate between the two adjacent waveforms ($S_3$, $S_4$). The modulator harmonic generator 608 initially interpolates within each waveform of the two waveforms (illustrated in generator 608 by the two circles with two unequal lines extending into the dotted line portion of waveforms $S_3$ and $S_4$ representative of data) and then interpolates between those two interpolated waveforms (illustrated in generator 608 by the single circle having an output arrow and with inputs from the previously mentioned two circles). The modulator generator 608 may also adjust or shape the spectral value amplitudes or relative amplitudes and then separately adjust the resulting composite waveform's amplitude. As noted earlier the carrier generator 602 only interpolates between values within a single waveform (illustrated in generator 602 by a single circle with two unequal lines extending into the dotted line portion representing data for carrier type $C_7$ and with an output arrow).

Again, generator 608 includes multiple tables with each table having multiple waveforms ($S_i$) therein and generator 602 includes multiple tables with each table having a single waveform ($C_i$) therein. For the presently preferred linear interpolation within a waveform ($C_i$ or $S_i$) and between the two selected waveforms ($S_i$), the mix coefficients are (a) for one waveform data point or waveform and (1–a) for the adjacent waveform data point or other waveform. Other types of linear or non-linear interpolation may also be employed by the process of the present invention. Thus, the modulator harmonic generator 608 produces harmonics with a continuously changing frequency and phase characteristic over a range of effective modulation indices (MIs) or amplitudes.

The phase of frequency components of the periodic waveforms in the modulation tables must be carefully selected relative to the phase of the frequency components of adjacent periodic waveforms due to their interdependency at intermediate wave boundaries and the physical behavior of reflected side bands for conventional FM synthesis. That is, the phase for each constituent harmonic in the tables are appropriately adjusted so that reflected sidebands combine with non-reflected sidebands in a manner similar to FM synthesis sidebands; for FM synthesis, the lower odd sidebands are opposite in phase to their corresponding upper sideband counterparts, which may result in reductions or additions to certain upper sidebands after sideband reflection.

The synthesis of each voice includes the generation of the modulator envelope amplitude by generator 604 which is used to adjust the amplitude of each of the two selected and interpolated harmonic spectra. The amplitude scaled harmonic spectra waveform is output and then appropriately combined (preferably added), as a function of certain control parameters, with the carrier waveform amplitude from carrier amplitude generator 610 by a waveform combinor 612. Generator 606 generates the carrier wave envelope, again based upon selected control parameters, and supplies the envelope values to the waveform combinor block 612 which then combines the modulator and carrier by mirroring or reflecting the modulator spectral values around the carrier to provide the appropriate composite waveform of modulator and carrier output values, again as a function of selected control parameters. This is illustrated in FIG. 6 by the spectra 400/402/404 being an output from combinor 612. Preferably, the waveform combinor block 612 multiplies the modulator spectral values by the carrier spectral values and adjusts the amplitude of the resulting spectral values based on the carrier envelope amplitude.

Both the modulator generator 608 and carrier generator 602 have the appropriate table entry selected by an address generator 614. However, the address generator 614 for the modulator generator 608 receives inputs of control information and an input from the modulator envelope amplitude generator 604, while the address generator 614*a* of the carrier generator 602 only receives an input of control information.

Continuing to refer to FIG. 6, while also referring to FIG. 5, the white noise generator 502 provides a series of other spectral values which, after scaling (based upon the desired amount of simulated feedback), may be appropriately combined (preferably summed in summer or adder 618) with the composite carrier and modulator waveforms to provide the final desired output waveform data, which is then placed in the output buffer 312. That is, both the noise and amplitude adjusted composite waveform are scaled in multipliers 616 by appropriate scaling factors (S.F.). One scaling factor is a value determined based upon the desired amount of feedback; preferably, the other scaling factor may be determined by subtracting the first scaling factor from one. Other techniques may be so employed. The feedback scaling factor is preferably generated by entry into a table that represents a non-linear feedback scheme. Other feedback schemes may be so employed.

Referring again to FIG. 5, the outputs from each of the potential twenty-three voices are all weighted by an appropriate weighting factor and then summed in voice mixer block 512 to provide the final output spectral values which correspond to 16 words for the left channel and 16 words for the right channel, in a stereo configuration. When a voice is not present, its weighting factor becomes zero and the summation portion of the mixer merely adds a zero for this voice. In this manner, the mixer 512 is always adding all twenty-three possible voices even though not all those voices are being utilized. The output buffer for the mixer 512 is preferably a circular buffer with one half being read while the other half is being loaded with data.

Figure 7:
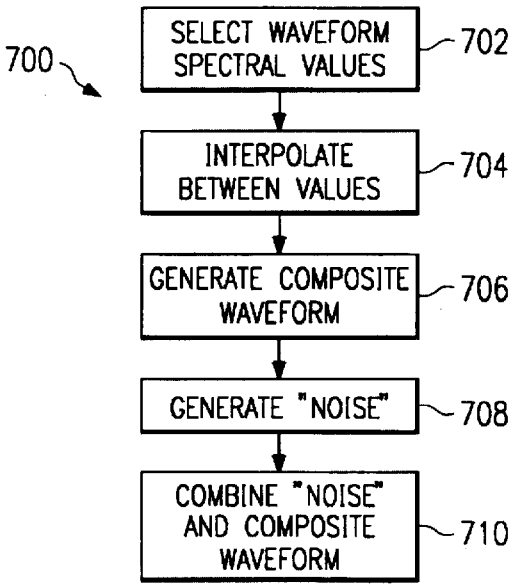
FIG. 7 depicts a flow diagram of the steps for methods of the present invention.

The major steps of methods of the present invention will now be briefly described. In summary of the foregoing description, and referring to FIG. 7, the steps of the methods of the present invention are as follow and are as depicted in FIG. 7. More particularly, the methods generate waveforms representative of audio signals or music sounds by selecting waveform spectral values for carrier and modulator waveforms from tables in a memory 702. As an optional step, the selected spectral values may be interpolated to provide values between the selected spectral values 704. If the waveforms are sufficiently sampled, interpolation may not be required; any interpolation may include interpolation within a waveform for both the modulator and carrier waveforms and between waveforms for the modulator waveforms. Following any interpolation step, the next step generates a composite waveform 706, preferably in the manner described herein before. Concurrent with the generation of the composite waveform 706, or with any of the other preceding steps, "noise" (white noise) spectral values are generated 708. After the composite waveform is generated 706 and the noise is generated 708, they are combined 710 to provide final output spectral values for a desired waveform representative of audio or music. This sequence of steps is repeated for each of the desired member of voices.

Figure 8:
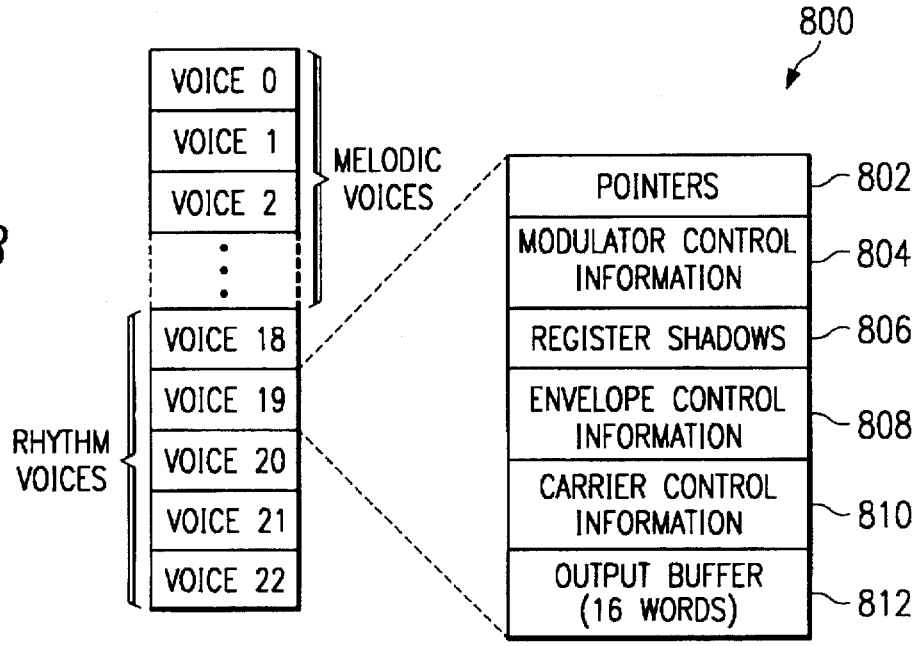
FIG. 8 depicts the presently preferred data structure used by methods of the present invention.

The presently preferred data structure 800 employed by the synthesis process of the present invention is depicted in FIG. 8. More particularly, it may be seen from FIG. 8 that there are preferably 18 melodic voices and preferably 5 rhythm or percussive voices, for a total of 23 possible voices. However, more or fewer voices of either type may be employed in the synthesis process of the present invention. Each one of the voices uses an identical data structure definition within it which is replicated for each voice.

More particularly, each voice's data structure includes pointer references 802 as one block of data and modulator control information or harmonic component generator control data 804 as a second block of data. Register shadows 806 for note updates are a third block of data. Envelope control information or data 808 is a fourth block of data and carrier control information or generator control data 810 is a fifth block of data. A presently preferred sixteen word output buffer 812 is the sixth block of data and contains the output values for the particular voice which have been calculated by the synthesis process of the present invention. The preferred sixteen word output buffer 812 contains the output data for a voice which is then used as one of the inputs for the voice mixer process 512 described herein. The voice mixer 512 replicates the single buffer's values if an additional channel of values is desired; the mixer 512 performs this replication in response to selected control information.

The pointer references block 802 includes periodic wave table addresses and a pointer to the assigned register of the input register format. Melodic voice register assignments are dynamic which means that any voice can be assigned to any input register to support the dynamic voice allocation process.

The register shadows block 806 supports the note update process which is required to allow the control parameters to be updated as a function of time after the voice is allocated and running.

The remaining blocks 804, 808 and 810 are correlated control words or control information used by generators of the synthesis process of the present invention, as described herein with respect to the synthesis process.

The dynamic voice scheduler or allocator 510 selects a run time voice from a pool of voices whenever a "note on" event is detected. A voice selection and correlation is used to setup control parameters for the execution portion of the dynamic voice scheduler block 510 (depicted in FIG. 5). A "note on" starts the voice selection and is a dynamic voice allocation which also includes a correlation from the source register data set in input format 300 to the synthesis process control parameters in the DSP format 306.

Figure 9:
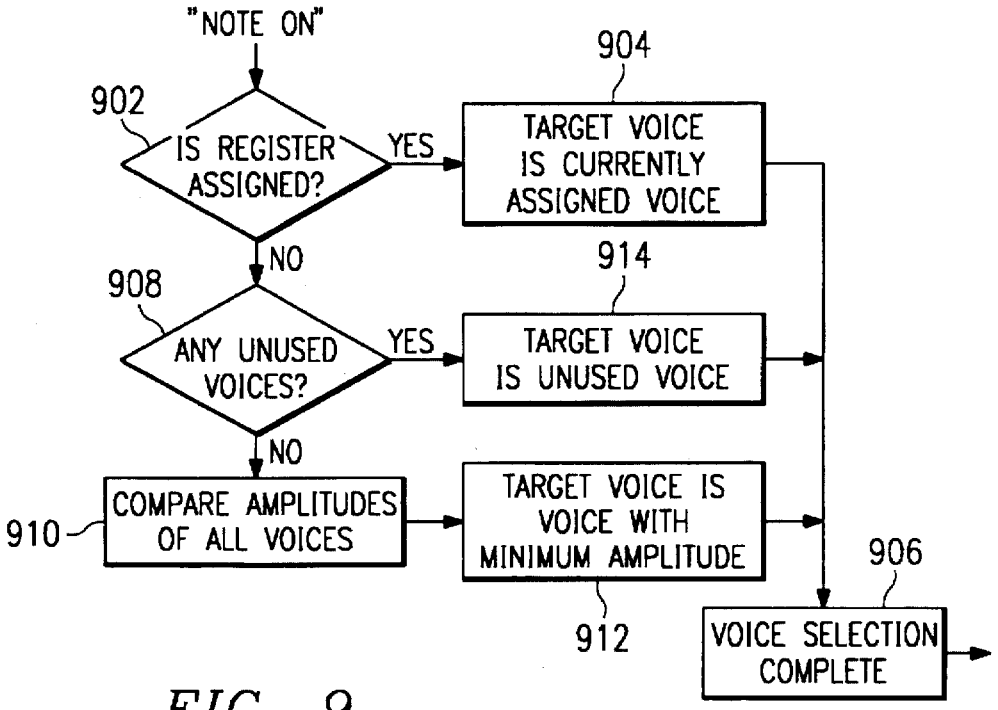
FIG. 9 depicts the voice allocation techniques used by methods of the present invention.

FIG. 9 depicts the details of the dynamic voice selection. For each "note on" the initial step is to determine whether or not the source register in the input format 300 is already assigned to a voice 902; that is, a voice may be assigned but not "on". If the source register is already assigned to a voice, then the target voice is assigned as the currently assigned voice 904 and the voice selection is complete 906. If the source register is not currently assigned to a voice then the inquiry is whether there are any unused voices 908. If there are any unused voices then the target voice becomes an unused voice 914. If there are no unused voices, then preferably the amplitudes of all the voices are compared 910. Preferably, the maximum voice count is fourteen to allow the processor time to perform the synthesis process for all the voices (up to the maximum voice count) and still be able to perform other computations or control activities; however, depending upon the processor speed and throughput, this maximum voice count may be adjusted as a function of the other activities workload. Preferably, the target voice replaces the voice having the maximum amplitude 912. However, other replacement schemes are possible and may be used in the methods of the present invention. This again completes the selection of the voice 906.

Figure 10:
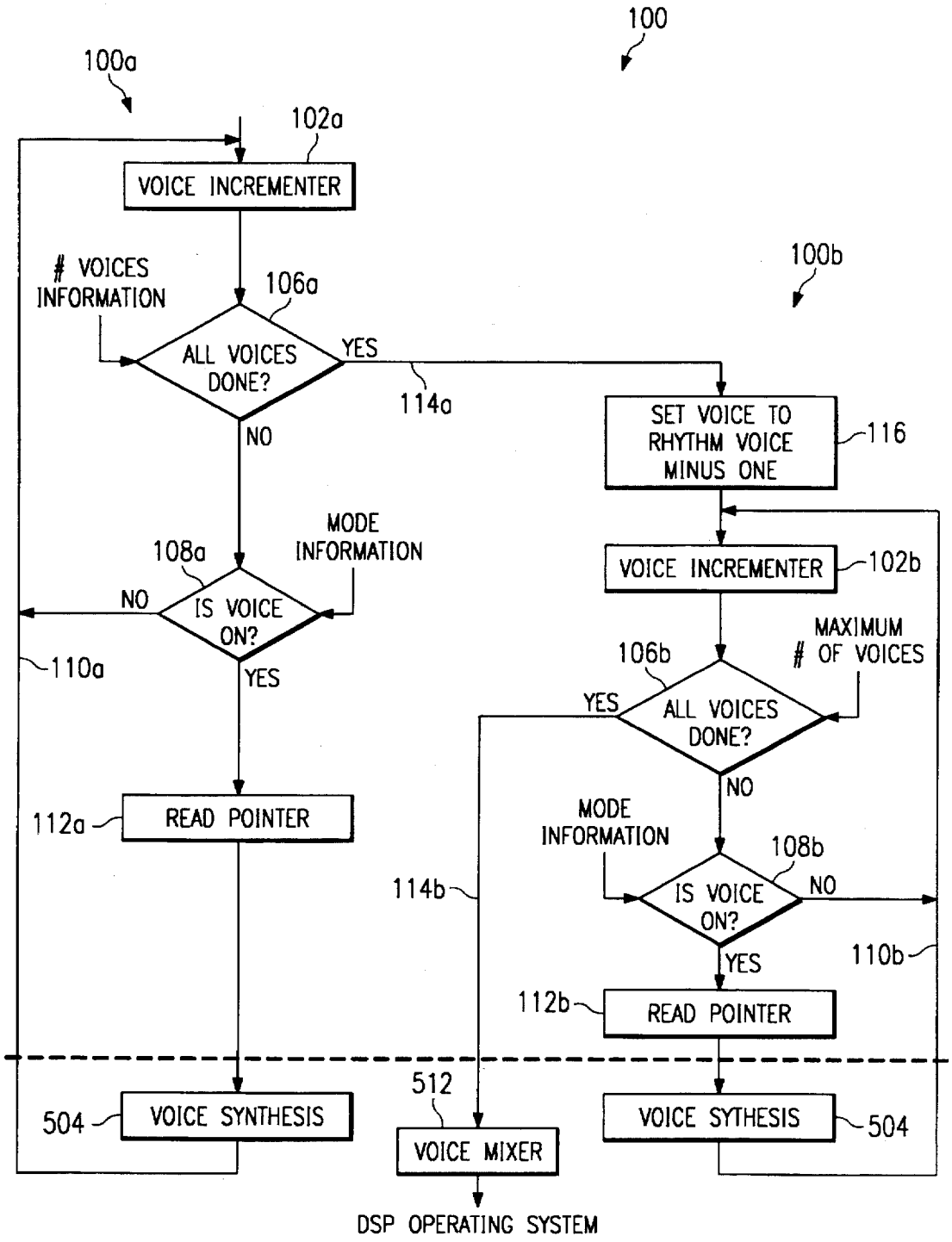
FIG. 10 depicts a flow diagram illustrating the voice scheduler portion of the present invention.

FIG. 10 depicts a flow diagram, above the dotted line, of the voice scheduler 100 portion 510 of FIG. 5. The voice scheduler portion 510 of the synthesis process 500 is as follows. A first loop 100*a* deals with melodic voices. Initially, the first loop 100*a* determines what the old voice number was and adds one to increment to the next melodic voice 102*a*. This new voice is then checked to see if it is an active voice. If it is not an active voice, then the voice count again increments 102*a* and again it is determined if that next voice number is an active voice. If the voice number corresponds to an active voice, it is determined if all of the melodic voices have been calculated 106*a*; preferably, this is based upon number of voices information supplied to this comparison 106*a*. If all the melodic voices have not been calculated, then it is determined whether or not that voice is active and on 108*a*. If the voice is not active and on, then the process loops back 110*a* to the voice count increment block 102*a*.

If the voice is active and on, then the process reads the voice's pointer 112*a* from the pointers block 802 in the data structure (FIG. 8) and executes the synthesis process 504 for that active voice. After generation of the output data for this particular voice, control is again passed back to the voice count plus one block 102*a* to recycle into the first loop 100*a* of the voice scheduler process 100. For ease of illustration purposes, FIG. 10 does not depict the use by synthesis block 504 of white noise from noise generator 502.

When all the melodic voice calculations have been completed 114*a*, then the active voice is set to one less than the first rhythm or percussive voice number 116 and the process enters a rhythmic voice generation loop 100*b*. The rhythmic voice loop 100*b* is similar to the melodic voice loop 100*a* in that it has an initial voice count incrementor 102*b* which determines whether the voice number corresponds to an active voice and if not, the voice count is incremented again 102*b*; if the voice number is active then a determination is made as to whether all rhythmic voices have been calculated 106*b*.

If not all the rhythmic voice calculations are completed, a determination is made as to whether the voice corresponds to an active voice which is in use 108*b*. If the rhythmic voice number is active and in use, then the voice's pointer 112*b* is read from the data structure and the voice is generated using the synthesis process 504 of the present invention. Following completion of the synthesis of this particular rhythmic voice, control is again passed up to the voice count incrementor step 102*b*. If the current rhythmic voice number does not correspond to an active and on voice 108*b*, control is again passed to the voice count incrementor 102*b* for the rhythmic loop 100*b* via 110*b*.

When all rhythmic voices have been calculated 114*b* then the voice mixer portion 512 of FIG. 5 is performed, in which all the outputs from the various melodic and rhythmic voices are possibly replicated, weighted, and summed to provide the final output for the desired voices.

Figure 11B:
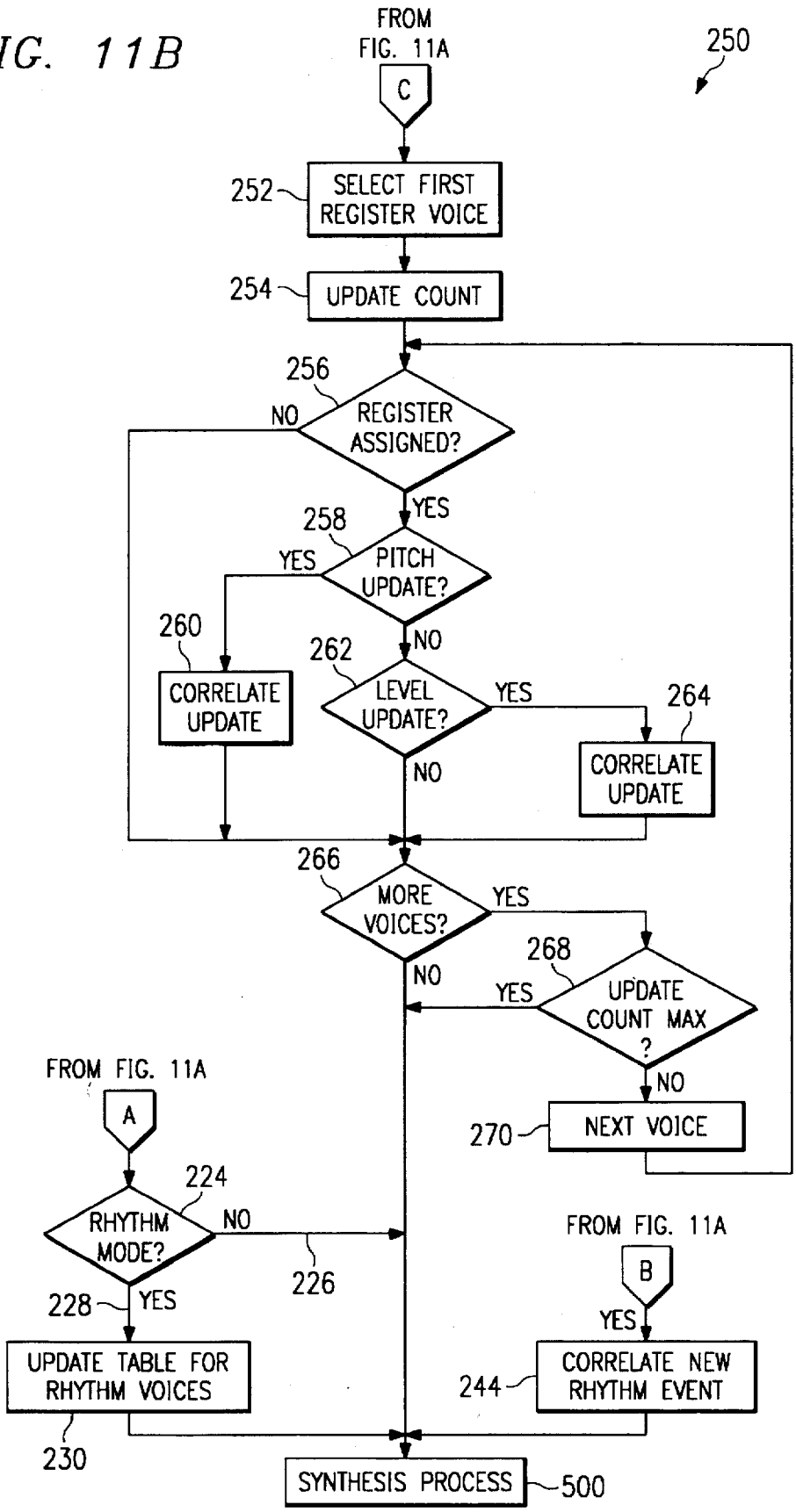

FIGS. 11A and 11B depict a flow diagram of the presently preferred controller (304 of FIG. 3), or control system 200, for the synthesis process of the present invention. The DSP is initialized for the synthesis tasks 202 and upon detection of a key off, the register status table (in memory 18) is updated 204 with the key off data for the eighteen melodic voices. Next, the pointers and registers for the twenty-three voices are setup 206 for the register status table. The register status table includes a block of data for each of the twenty-three voices. The operator addresses for the various operator configurations for each voice are then selected and setup 208 in the register status table. Depending upon the selected operator configuration and selected control bits (based upon correlated input data), appropriate mix coefficients are selected and setup 210 in the table.

The process then selects the first register voice 212 and determines whether there is a new key on event 214 for that voice. It does this by detecting an edge transition from low to high. If there is a new note on event, the operator mode or configuration is determined 216. If "normal" two operator configurations are used then a voice allocation 220 is performed. If "not normal" four operator configurations are used then an additional step 218 determines the appropriate input pointers for four operator configurations and those configurations are allocated voices 220. The voice allocation step was previously described with respect to FIG. 9.

Then the note on data is correlated as a new melodic event 222. The next step is to determine whether this new event is for a "rhythm mode" voice 224. There is an additional branch 226 if the new note on is not for a rhythm mode voice that bypasses any update of the register status table and immediately passes control to the synthesis process 500 (depicted in FIG. 5), shown on FIG. 11B. If the new voice is in rhythm mode 228 then the register status table is updated 230 with the key off data for the five rhythm sounds. Following this, the synthesis process 500 is entered into to generate the requisite number of voices as indicated by the data in the register status table.

At the new key on event detection step 214, if there is no new key on event the control process initially determines if there are any more melodic voices 232. If there are additional melodic voices, then the next voice 234 is selected and it is then subjected to the new key on event detection step 214; this step then loops through all of the melodic voices assigned in the register status table looking for a key on event for any of the melodic voices.

If there are no more melodic voices that have been allocated and no key on events for any of the allocated melodic voices, then the control process determines whether the rhythm mode is in operation 236. If the rhythm mode is in operation, then the register status table is updated 238 with any key off data for all five rhythmic sounds, which is then followed by selection of the first rhythm voice 240; the register status table is then examined for that voice to see if there is a new key on event 242 for that voice. If there is a new key on event for that first rhythm voice then the key on event is correlated 244 with the rhythm voice and control is passed to the synthesis process 500 (depicted in FIG. 5). If there is no new key on event, then the control process determines if there are any more rhythmic voices 246 and if so then it increments the voice number to the next voice 248 and passes through the new key on event inquiry 242 for each "selected" rhythm voice. If there are no more rhythmic voices 246 then control is passed to a fly check process 250. Similarly, in response to the determination of whether rhythm mode is present 236, if rhythm mode is not present, then control is again passed to the fly check process 250.

The fly check process 250 examines the first register voice 252 and then sets an update count number 254 to an initial value of zero, with preferably a maximum permissible update count of three. Following this the process then checks to see whether a register assignment has occurred 256, and if so then the next inquiry is to determine if there has been any pitch update 258. If pitch update is needed, then the maximum count is updated by one and a new pitch is correlated 260 and then passed back into the fly check process 250; if no pitch update is required 258, the next inquiry is whether a level update is required 262. If a level update is needed, then the maximum count is updated by one, a new amplitude is correlated 264 and again is passed back into the fly check process 250. If no level update is required 262, then a determination is made as to whether there are any more voices 266. If no more voices are present then control is passed to the voice synthesis process 500.

If more voices are present, the fly check process 250 determines if the update count is equal to the maximum update count number 268 and if so then it returns control to the synthesis process 500. However, if the update count is not at the maximum value then the next register voice is selected 270; this then feeds back into the register assignment determination step 256 and the subsequent steps discussed above. For the register assignment determination step 256, if a register assignment has not been made, then the process skips the pitch update 258 and the level update 262 steps and immediately determines whether there are any more voices 266.

As noted earlier herein, the correlation process converts the input format values into process control parameters and selector values suitable for use by the synthesis process of the present invention. The correlation process is used to convert the real time asynchronous register input values into synthesis control parameters synchronous with a DSP internal clock or other clock. In a preferred embodiment of the present invention, the correlation process is applied to the register values only once during any given frame. Thus, a maximum of one new voice allocation is allowed per frame and any remaining note on's that are pending are processed in subsequent frames. Because frames are about 725 microseconds long, this does not degrade performance since even for the worst case of several frames, it only represents a slight delay. However, other alternative timings for the correlation process and different voice allocation techniques may be employed and still be within the scope of the present invention.

Further, on-the-fly note updates only occur when there are no note on's pending, as the amount of processor cycles allocated to this function are balanced in the process of the present invention to be no worse than with a note on allocation. However, other alternative timings for the on-the-fly note updates may be employed and still be within the scope of the present invention.

Thus, the controller 200 of FIG. 11 (or 304 of FIG. 3) passes control to the synthesis process of FIG. 5, which synthesizes the desired voices, as described earlier in reference to FIG. 5. After the voice mixing portion 512 of FIG. 5, control is passed the processor's operating system. The operating system in turn calls the controller 200 of FIG. 11 based upon the operating system's internal scheduler.

The present invention is capable of being implemented in software, hardware, or combinations of hardware and software. Although the present invention and its advantages have been described in detail, it should be understood that various changes, substitutions and alterations may be made herein without departing from the spirit and scope of the invention, as defined in the appended claims.

| | | Carrier | Harmonics and Coefficients | | | | | | | | | |
|---|---|---|---|---|---|---|---|---|---|---|---|---|
| MI | Series | Amplitude | 1 | 2 | 3 | 4 | 5 | 6 | 7 | 8 | 9 | 10 |
| 0 | $S_9$ (n) | 32767 | | | | | | | | | | |
| 2 | $S_8$ (n) | 8046 | 18096 | 11015 | 4411 | 1240 | 613 | | | | | |
| 4 | $S_7$ (n) | −12126 | 0 | 11537 | 14089 | 9074 | 4462 | 1980 | 702 | 515 | | |
| 6 | $S_6$ (n) | 4433 | −8635 | −7780 | 3902 | 11394 | 11278 | 7791 | 4287 | 1893 | 860 | 492 |
| 8 | $S_6$ (n) | 5508 | 7302 | −3527 | −9220 | −3701 | 6256 | 10654 | 9900 | 7157 | 4004 | 2050 |
| 10 | $S_4$ (n) | −7540 | 0 | 7936 | 2003 | −7063 | −7365 | 0 | 6950 | 10189 | 9177 | 6487 |
| 12 | $S_3$ (n) | 1553 | −6955 | −2975 | 6267 | 5861 | −2495 | −7680 | −5497 | 1890 | 7232 | 9506 |
| 14 | $S_2$ (n) | 5192 | 4361 | −4794 | −5608 | 2586 | 6863 | 2649 | −4639 | −7400 | −3820 | 3052 |
| 16 | $S_1$ (n) | −5407 | 2849 | 5918 | −1502 | −6501 | −1920 | 5275 | 5637 | 0 | −6032 | −6439 |

| | | Carrier | Harmonics and Coefficients | | | | | | | | | |
|---|---|---|---|---|---|---|---|---|---|---|---|---|
| MI | Series | Amplitude | 11 | 12 | 13 | 14 | 15 | 16 | 17 | 18 | 19 | 20 |
| 0 | $S_9$ (n) | 32767 | | | | | | | | | | |
| 2 | $S_8$ (n) | 8046 | | | | | | | | | | |
| 4 | $S_7$ (n) | −12126 | | | | | | | | | | |
| 6 | $S_6$ (n) | 4433 | | | | | | | | | | |
| 8 | $S_6$ (n) | 5508 | 1064 | 453 | | | | | | | | |
| 10 | $S_4$ (n) | −7540 | 4028 | 2103 | 1047 | 605 | | | | | | |
| 12 | $S_3$ (n) | 1553 | 8517 | 6097 | 3791 | 2150 | 1216 | 551 | | | | |
| 14 | $S_2$ (n) | 5192 | 7395 | 9039 | 8050 | 5822 | 3708 | 2166 | 1183 | 703 | | |
| 16 | $S_1$ (n) | −5407 | −2386 | 3771 | 7586 | 8455 | 7548 | 5695 | 3662 | 2155 | 1302 | 696 |

APPENDIX

08/304017

Blank Page

APPENDIX

Blank Page

APPENDIX

Blank Page

APPENDIX

Blank page

APPENDIX

```
;*************************************************************
;*        TEXAS INSTRUMENTS CONFIDENTIAL              *
;* Copyright 1992, 1993, 1994 TEXAS INSTRUMENTS
        *
;*************************************************************
;* Version: 0.1A
;* Module: sinbuf data segment
;* Component
;*
;*************************************************************
;* History
;*************************************************************
;*  Initial Code:  J. Van Buskirk
;*
;*************************************************************
;*
;*************************************************************
;
      .global SIN128
      .def    TRIANGL,HALFSIN,ABSSIN,CLIPSIN
      .def    CAR_W4,CAR_W5,CAR_W6,CAR_W7
      .def    FBKTABL
      .def    S1,S2,S3,S4,S5,S6,S7,S8,S9
      .def    S1_1,S2_1,S3_1,S4_1,S5_1,S6_1,S7_1,S8_1,S9_1
      .def    S1_2,S2_2,S3_2,S4_2,S5_2,S6_2,S7_2,S8_2,S9_2
      .def    S1_3,S2_3,S3_3,S4_3,S5_3,S6_3,S7_3,S8_3,S9_3
      .def    S1_4,S2_4,S3_4,S4_4,S5_4,S6_4,S7_4,S8_4,S9_4
      .def    S1_5,S2_5,S3_5,S4_5,S5_5,S6_5,S7_5,S8_5,S9_5
      .def    S1_6,S2_6,S3_6,S4_6,S5_6,S6_6,S7_6,S8_6,S9_6
      .def    S1_7,S2_7,S3_7,S4_7,S5_7,S6_7,S7_7,S8_7,S9_7
      .data
      .sect   "sinbuf"
;All periodic tables have a required redundant 129th entry
```

```
;linear to weighted feedback correlation table
FBKTABL     .word     0
    .word     0
    .word     0
    .word     2
    .word     4
    .word     8
    .word     13
    .word     21
    .word     32
    .word     46
    .word     62
    .word     83
    .word     108
    .word     137
    .word     171
    .word     211
    .word     256
    .word     307
    .word     364
    .word     429
    .word     500
    .word     579
    .word     665
    .word     760
    .word     864
    .word     977
    .word     1098
    .word     1230
    .word     1372
    .word     1524
    .word     1687
    .word     1862
    .word     2048
    .word     2246
```

```
.word    2456
.word    2680
.word    2916
.word    3166
.word    3429
.word    3707
.word    4000
.word    4307
.word    4630
.word    4969
.word    5324
.word    5695
.word    6083
.word    6489
.word    6912
.word    7353
.word    7812
.word    8290
.word    8787
.word    9304
.word    9841
.word    10398
.word    10975
.word    11574
.word    12194
.word    12835
.word    13499
.word    14185
.word    14895
.word    15627
.word    16383
.word    17139
.word    17871
.word    18581
.word    19267
```

```
.word    19931
.word    20572
.word    21192
.word    21791
.word    22368
.word    22925
.word    23462
.word    23979
.word    24476
.word    24954
.word    25413
.word    25854
.word    26277
.word    26683
.word    27071
.word    27442
.word    27797
.word    28136
.word    28459
.word    28766
.word    29059
.word    29337
.word    29600
.word    29850
.word    30086
.word    30310
.word    30520
.word    30718
.word    30904
.word    31079
.word    31242
.word    31394
.word    31536
.word    31668
.word    31789
```

```
        .word     31902
        .word     32006
        .word     32101
        .word     32187
        .word     32266
        .word     32337
        .word     32402
        .word     32459
        .word     32510
        .word     32555
        .word     32595
        .word     32629
        .word     32658
        .word     32683
        .word     32704
        .word     32720
        .word     32734
        .word     32745
        .word     32753
        .word     32758
        .word     32762
        .word     32764
        .word     32766
        .word     32766
        .word     32766
;128 point sine table (Q15)*********************************
SIN128  .word     0
        .word     1608
        .word     3212
        .word     4808
        .word     6393
        .word     7962
        .word     9512
        .word     11039
        .word     12539
```

```
.word     14010
.word     15446
.word     16846
.word     18204
.word     19519
.word     20787
.word     22005
.word     23170
.word     24279
.word     25329
.word     26319
.word     27245
.word     28105
.word     28898
.word     29621
.word     30273
.word     30852
.word     31356
.word     31785
.word     32137
.word     32412
.word     32609
.word     32728
.word     32767
.word     32728
.word     32609
.word     32412
.word     32137
.word     31785
.word     31356
.word     30852
.word     30273
.word     29621
.word     28898
.word     28105
```

```
.word     27245
.word     26319
.word     25329
.word     24279
.word     23170
.word     22005
.word     20787
.word     19519
.word     18204
.word     16846
.word     15446
.word     14010
.word     12539
.word     11039
.word     9512
.word     7962
.word     6393
.word     4808
.word     3212
.word     1608
.word     0
.word    -1608
.word    -3212
.word    -4808
.word    -6393
.word    -7962
.word    -9512
.word    -11039
.word    -12539
.word    -14010
.word    -15446
.word    -16846
.word    -18204
.word    -19519
.word    -20787
```

```
.word    -22005
.word    -23170
.word    -24279
.word    -25329
.word    -26319
.word    -27245
.word    -28105
.word    -28898
.word    -29621
.word    -30273
.word    -30852
.word    -31356
.word    -31785
.word    -32137
.word    -32412
.word    -32609
.word    -32728
.word    -32767
.word    -32728
.word    -32609
.word    -32412
.word    -32137
.word    -31785
.word    -31356
.word    -30852
.word    -30273
.word    -29621
.word    -28898
.word    -28105
.word    -27245
.word    -26319
.word    -25329
.word    -24279
.word    -23170
.word    -22005
```

```
        .word      -20787
        .word      -19519
        .word      -18204
        .word      -16846
        .word      -15446
        .word      -14010
        .word      -12539
        .word      -11039
        .word      -9512
        .word      -7962
        .word      -6393
        .word      -4808
        .word      -3212
        .word      -1608
        .word       0            ;129th entry
;128 point negative triangle table Q15**********************
TRIANGL .word  0
        .word  -1024
        .word  -2048
        .word  -3072
        .word  -4096
        .word  -5120
        .word  -6144
        .word  -7168
        .word  -8192
        .word  -9216
        .word  -10240
        .word  -11264
        .word  -12288
        .word  -13312
        .word  -14336
        .word  -15360
        .word  -16384
        .word  -17408
        .word  -18432
```

```
.word  -19456
.word  -20480
.word  -21504
.word  -22528
.word  -23552
.word  -24576
.word  -25600
.word  -26624
.word  -27648
.word  -28672
.word  -29696
.word  -30720
.word  -31744
.word  -30720
.word  -29696
.word  -28672
.word  -27648
.word  -26624
.word  -25600
.word  -24576
.word  -23552
.word  -22528
.word  -21504
.word  -20480
.word  -19456
.word  -18432
.word  -17408
.word  -16384
.word  -15360
.word  -14336
.word  -13312
.word  -12288
.word  -11264
.word  -10240
.word  -9216
```

```
    .word  -8192
    .word  -7168
    .word  -6144
    .word  -5120
    .word  -4096
    .word  -3072
    .word  -2048
    .word  -1024
.word      0
    .word   1024
    .word   0
    .word  -1024
    .word  -2048
    .word  -3072
    .word  -4096
    .word  -5120
    .word  -6144
    .word  -7168
    .word  -8192
    .word  -9216
    .word  -10240
    .word  -11264
    .word  -12288
    .word  -13312
    .word  -14336
    .word  -15360
    .word  -16384
    .word  -17408
    .word  -18432
    .word  -19456
    .word  -20480
    .word  -21504
    .word  -22528
    .word  -23552
    .word  -24576
```

```
.word  -25600
.word  -26624
.word  -27648
.word  -28672
.word  -29696
.word  -30720
.word  -31744
.word  -30720
.word  -29696
.word  -28672
.word  -27648
.word  -26624
.word  -25600
.word  -24576
.word  -23552
.word  -22528
.word  -21504
.word  -20480
.word  -19456
.word  -18432
.word  -17408
.word  -16384
.word  -15360
.word  -14336
.word  -13312
.word  -12288
.word  -11264
.word  -10240
.word  -9216
.word  -8192
.word  -7168
.word  -6144
.word  -5120
.word  -4096
.word  -3072
```

```
        .word  -2048
        .word  -1024
        .word   0
        .word   1024
        .word   0 ;redundant 129th sample
;128 point half sine table (Q15)****************************
;Series Table w11.asm
HALFSIN .word     0
        .word    -306
        .word    -643
        .word    -1034
        .word    -1491
        .word    -2010
        .word    -2577
        .word    -3165
        .word    -3748
        .word    -4304
        .word    -4818
        .word    -5290
        .word    -5732
        .word    -6165
        .word    -6612
        .word    -7091
        .word    -7612
        .word    -8172
        .word    -8757
        .word    -9344
        .word    -9912
        .word    -10448
        .word    -10955
        .word    -11454
        .word    -11987
        .word    -12613
        .word    -13391
        .word    -14378
```

```
.word   -15611
.word   -17095
.word   -18803
.word   -20674
.word   -22617
.word   -24527
.word   -26295
.word   -27826
.word   -29052
.word   -29936
.word   -30478
.word   -30708
.word   -30679
.word   -30453
.word   -30090
.word   -29635
.word   -29116
.word   -28538
.word   -27887
.word   -27138
.word   -26263
.word   -25240
.word   -24057
.word   -22718
.word   -21240
.word   -19651
.word   -17983
.word   -16266
.word   -14524
.word   -12769
.word   -11005
.word   -9229
.word   -7433
.word   -5611
.word   -3761
```

```
.word   -1887
.word    0
.word    1887
.word    3761
.word    5611
.word    7433
.word    9229
.word    11005
.word    12769
.word    14524
.word    16266
.word    17983
.word    19651
.word    21240
.word    22718
.word    24057
.word    25240
.word    26263
.word    27138
.word    27887
.word    28538
.word    29116
.word    29635
.word    30090
.word    30453
.word    30679
.word    30708
.word    30478
.word    29936
.word    29052
.word    27826
.word    26295
.word    24527
.word    22617
.word    20674
```

```
        .word     18803
        .word     17095
        .word     15611
        .word     14378
        .word     13391
        .word     12613
        .word     11987
        .word     11454
        .word     10955
        .word     10448
        .word     9912
        .word     9344
        .word     8757
        .word     8172
        .word     7612
        .word     7091
        .word     6612
        .word     6165
        .word     5732
        .word     5290
        .word     4818
        .word     4304
        .word     3748
        .word     3165
        .word     2577
        .word     2010
        .word     1491
        .word     1034
        .word     643
        .word     306
        .word     0    ;redundant 129th entry
;128 point absolute sine table (Q15)************************
;Series Table w22.asm
ABSSIN  .word     0
        .word    -995
```

```
.word   -2078
.word   -3322
.word   -4769
.word   -6428
.word   -8275
.word   -10261
.word   -12328
.word   -14421
.word   -16500
.word   -18541
.word   -20537
.word   -22488
.word   -24381
.word   -26184
.word   -27830
.word   -29219
.word   -30223
.word   -30708
.word   -30554
.word   -29679
.word   -28065
.word   -25764
.word   -22902
.word   -19660
.word   -16248
.word   -12874
.word   -9707
.word   -6851
.word   -4329
.word   -2086
.word   0
.word   2086
.word   4329
.word   6851
.word   9707
```

```
.word    12874
.word    16248
.word    19660
.word    22902
.word    25764
.word    28065
.word    29679
.word    30554
.word    30708
.word    30223
.word    29219
.word    27830
.word    26184
.word    24381
.word    22488
.word    20537
.word    18541
.word    16500
.word    14421
.word    12328
.word    10261
.word    8275
.word    6428
.word    4769
.word    3322
.word    2078
.word    995
.word    0
.word   -995
.word   -2078
.word   -3322
.word   -4769
.word   -6428
.word   -8275
.word   -10261
```

```
.word   -12328
.word   -14421
.word   -16500
.word   -18541
.word   -20537
.word   -22488
.word   -24381
.word   -26184
.word   -27830
.word   -29219
.word   -30223
.word   -30708
.word   -30554
.word   -29679
.word   -28065
.word   -25764
.word   -22902
.word   -19660
.word   -16248
.word   -12874
.word   -9707
.word   -6851
.word   -4329
.word   -2086
.word   0
.word   2086
.word   4329
.word   6851
.word   9707
.word   12874
.word   16248
.word   19660
.word   22902
.word   25764
.word   28065
```

```
        .word    29679
        .word    30554
        .word    30708
        .word    30223
        .word    29219
        .word    27830
        .word    26184
        .word    24381
        .word    22488
        .word    20537
        .word    18541
        .word    16500
        .word    14421
        .word    12328
        .word    10261
        .word    8275
        .word    6428
        .word    4769
        .word    3322
        .word    2078
        .word    995
        .word    0     ;redundant 129th entry
;128 point clip sine table (Q15)*****************************
;*************************************************************
CLIPSIN .word    0
        .word    1374
        .word    2744
        .word    4108
        .word    5463
        .word    6803
        .word    8128
        .word    9433
        .word    10715
        .word    11972
        .word    13199
```

```
.word   14395
.word   15556
.word   16680
.word   17763
.word   18804
.word   19799
.word   20747
.word   21644
.word   22490
.word   23281
.word   24016
.word   24694
.word   25312
.word   25869
.word   26363
.word   26794
.word   27161
.word   27462
.word   27697
.word   27865
.word   27966
.word   14000
.word   0
.word   0
.word   0
.word   0
.word   0
.word   0
.word   0
.word   0
.word   0
.word   0
.word   0
.word   0
.word   0
```

```
.word   0
.word   0
.word   0
.word   0
.word   0
.word   0
.word   0
.word   0
.word   0
.word   0
.word   0
.word   0
.word   0
.word   0
.word   0
.word   -2744
.word   -1374
.word   0
.word   1374
.word   2744
.word   4108
.word   5463
.word   6803
.word   8128
.word   9433
.word   10715
.word   11972
.word   13199
.word   14395
.word   15556
.word   16680
.word   17763
.word   18804
.word   19799
```

```
.word   20747
.word   21644
.word   22490
.word   23281
.word   24016
.word   24694
.word   25312
.word   25869
.word   26363
.word   26794
.word   27161
.word   27462
.word   27697
.word   27865
.word   27966
.word   14000
.word   0
.word   0
.word   0
.word   0
.word   0
.word   0
.word   0
.word   0
.word   0
.word   0
.word   0
.word   0
.word   0
.word   0
.word   0
.word   0
.word   0
.word   0
.word   0
```

```
        .word   0
        .word   0
        .word   0
        .word   0
        .word   0
        .word   0
        .word   0
        .word   0
        .word   0
        .word   0
        .word   -2744
        .word   -1374
        .word   0 ;redundant 129th entry
;*************************************************************
;Series Table S1_0H.ASM
S1      .word    0
        .word    30708
        .word    4927
        .word   -26935
        .word   -24270
        .word   -6540
        .word    11142
        .word    12573
        .word   -6780
        .word   -14906
        .word   -997
        .word    11754
        .word    12637
        .word    4621
        .word   -1692
        .word   -520
        .word   -7683
        .word   -21196
        .word   -16158
        .word    1570
```

```
.word    13798
.word    23230
.word    24203
.word    10882
.word    1269
.word    3528
.word    6213
.word    7344
.word    10872
.word    13309
.word    11278
.word    7253
.word    4900
.word    2764
.word   -1791
.word   -5719
.word   -6359
.word   -5052
.word   -3035
.word   -2322
.word   -2771
.word   -502
.word    3731
.word    6031
.word    6412
.word    5590
.word    3949
.word    2739
.word    1491
.word   -94
.word   -980
.word   -1471
.word   -2535
.word   -4384
.word   -5432
```

```
.word   -3847
.word   -1854
.word   -2040
.word   -3257
.word   -3976
.word   -2164
.word    1550
.word    1318
.word   -1452
.word    0
.word    1452
.word   -1318
.word   -1550
.word    2164
.word    3976
.word    3257
.word    2040
.word    1854
.word    3847
.word    5432
.word    4384
.word    2535
.word    1471
.word    980
.word    94
.word   -1491
.word   -2739
.word   -3949
.word   -5590
.word   -6412
.word   -6031
.word   -3731
.word    502
.word    2771
.word    2322
```

```
.word    3035
.word    5052
.word    6359
.word    5719
.word    1791
.word   -2764
.word   -4900
.word   -7253
.word   -11278
.word   -13309
.word   -10872
.word   -7344
.word   -6213
.word   -3528
.word   -1269
.word   -10882
.word   -24203
.word   -23230
.word   -13798
.word   -1570
.word    16158
.word    21196
.word    7683
.word    520
.word    1692
.word   -4622
.word   -12637
.word   -11754
.word    997
.word    14906
.word    6780
.word   -12573
.word   -11142
.word    6540
.word    24270
```

```
        .word     26935
        .word    -4927
        .word    -30708
        .word     0    ;redundant 129th entry
;Series Table S2_0H.ASM
S2      .word     0
        .word     30256
        .word     30708
        .word     6956
        .word    -8933
        .word     1162
        .word     21304
        .word     24789
        .word     8018
        .word    -7779
        .word    -5169
        .word     9501
        .word     17688
        .word     12609
        .word     4398
        .word     3697
        .word     7758
        .word     5692
        .word    -6585
        .word    -20828
        .word    -25194
        .word    -15809
        .word     389
        .word     12313
        .word     13859
        .word     8272
        .word     4577
        .word     8717
        .word     17166
        .word     19961
```

```
.word    11200
.word   -3733
.word   -12644
.word   -8634
.word    2849
.word    9383
.word    3716
.word   -9337
.word   -17309
.word   -11203
.word    6624
.word    24308
.word    30314
.word    22704
.word    9642
.word    939
.word   -671
.word    335
.word   -95
.word    27
.word    5364
.word    15292
.word    21783
.word    16756
.word    1153
.word   -14334
.word   -18065
.word   -7359
.word    9419
.word    19852
.word    17243
.word    5312
.word   -5531
.word   -7066
.word    0
```

```
.word    7066
.word    5531
.word   -5312
.word   -17243
.word   -19852
.word   -9419
.word    7359
.word    18065
.word    14333
.word   -1154
.word   -16756
.word   -21783
.word   -15292
.word   -5364
.word   -27
.word    95
.word   -335
.word    671
.word   -939
.word   -9642
.word   -22704
.word   -30314
.word   -24308
.word   -6623
.word    11203
.word    17309
.word    9337
.word   -3716
.word   -9383
.word   -2849
.word    8634
.word    12644
.word    3733
.word   -11200
.word   -19961
```

```
        .word    -17166
        .word    -8717
        .word    -4577
        .word    -8272
        .word    -13859
        .word    -12313
        .word    -389
        .word     15809
        .word     25194
        .word     20828
        .word     6585
        .word    -5692
        .word    -7758
        .word    -3697
        .word    -4398
        .word    -12609
        .word    -17688
        .word    -9501
        .word     5169
        .word     7779
        .word    -8018
        .word    -24789
        .word    -21304
        .word    -1162
        .word     8933
        .word    -6956
        .word    -30709
        .word    -30256
        .word     0   ;redundant 129th entry
;Series Table S3_0H.ASM
S3      .word     0
        .word    -6249
        .word    -6718
        .word     261
        .word     10718
```

```
.word    17502
.word    15670
.word    6990
.word   -558
.word    1088
.word    12828
.word    26491
.word    30708
.word    20133
.word    143
.word   -17136
.word   -22064
.word   -14154
.word   -1048
.word    8346
.word    10218
.word    6926
.word    3286
.word    2233
.word    3328
.word    4288
.word    3460
.word    1192
.word   -502
.word    460
.word    4359
.word    8833
.word    10138
.word    6138
.word   -1311
.word   -7177
.word   -7339
.word   -2496
.word    2138
.word    1715
```

```
.word    -3240
.word    -6874
.word    -3603
.word     6011
.word     15113
.word     16639
.word     9839
.word     798
.word    -3516
.word    -1668
.word     1696
.word     1427
.word    -2438
.word    -4820
.word    -1304
.word     6667
.word     12690
.word     11644
.word     4965
.word    -500
.word     864
.word     7776
.word     13005
.word     10183
.word     0
.word    -10183
.word    -13005
.word    -7775
.word    -864
.word     500
.word    -4965
.word    -11644
.word    -12690
.word    -6667
.word     1304
```

```
.word    4820
.word    2438
.word   -1427
.word   -1696
.word    1668
.word    3516
.word   -798
.word   -9839
.word   -16639
.word   -15113
.word   -6011
.word    3603
.word    6874
.word    3240
.word   -1715
.word   -2138
.word    2496
.word    7339
.word    7177
.word    1311
.word   -6138
.word   -10138
.word   -8833
.word   -4359
.word   -460
.word    502
.word   -1192
.word   -3460
.word   -4288
.word   -3328
.word   -2233
.word   -3286
.word   -6926
.word   -10218
.word   -8346
```

```
        .word     1048
        .word     14154
        .word     22064
        .word     17136
        .word    -143
        .word    -20133
        .word    -30708
        .word    -26491
        .word    -12828
        .word    -1088
        .word     558
        .word    -6990
        .word    -15670
        .word    -17502
        .word    -10718
        .word    -261
        .word     6718
        .word     6249
        .word     0    ;redundant 129th entry
;Series Table s4_0h.asm
S4      .word     0
        .word     19303
        .word     26703
        .word     18634
        .word     2077
        .word    -10829
        .word    -11540
        .word    -699
        .word     13272
        .word     20991
        .word     18906
        .word     11104
        .word     5340
        .word     6801
        .word     14389
```

```
.word    21957
.word    23037
.word    15347
.word    2047
.word   -10616
.word   -17182
.word   -15750
.word   -8282
.word    1147
.word    8728
.word    12634
.word    13436
.word    13303
.word    14450
.word    17568
.word    21054
.word    21669
.word    16485
.word    5112
.word   -9273
.word   -21042
.word   -24984
.word   -19300
.word   -6870
.word    6080
.word    13159
.word    11056
.word    1101
.word   -11552
.word   -20494
.word   -21062
.word   -12390
.word    2259
.word    16963
.word    25773
```

```
.word    25417
.word    16857
.word    4848
.word   -4393
.word   -6319
.word   -327
.word    10068
.word    19255
.word    22569
.word    18650
.word    9884
.word    830
.word   -4357
.word   -4087
.word    0
.word    4087
.word    4357
.word   -830
.word   -9885
.word   -18650
.word   -22569
.word   -19255
.word   -10068
.word    327
.word    6319
.word    4393
.word   -4849
.word   -16857
.word   -25417
.word   -25773
.word   -16963
.word   -2259
.word    12390
.word    21062
.word    20494
```

```
.word    11552
.word   -1101
.word   -11056
.word   -13159
.word   -6080
.word    6870
.word    19300
.word    24984
.word    21042
.word    9273
.word   -5112
.word   -16485
.word   -21669
.word   -21054
.word   -17568
.word   -14450
.word   -13303
.word   -13436
.word   -12634
.word   -8728
.word   -1146
.word    8282
.word    15750
.word    17182
.word    10616
.word   -2047
.word   -15347
.word   -23037
.word   -21957
.word   -14389
.word   -6801
.word   -5340
.word   -11104
.word   -18906
.word   -20991
```

```
        .word    -13272
        .word     699
        .word     11540
        .word     10829
        .word    -2077
        .word    -18634
        .word    -26703
        .word    -19303
        .word     0    ;redundant 129th entry
;Series Table S5_0H.ASM
S5      .word     0
        .word     464
        .word     1065
        .word     2021
        .word     3616
        .word     6031
        .word     9111
        .word     12202
        .word     14213
        .word     13942
        .word     10586
        .word     4239
        .word    -3880
        .word    -11616
        .word    -16487
        .word    -16534
        .word    -11076
        .word    -1083
        .word     11018
        .word     22069
        .word     29191
        .word     30708
        .word     26661
        .word     18721
        .word     9558
```

```
.word    1908
.word   -2320
.word   -2581
.word    281
.word    4480
.word    8002
.word    9308
.word    7795
.word    3873
.word   -1301
.word   -6301
.word   -9915
.word   -11483
.word   -11007
.word   -9019
.word   -6319
.word   -3675
.word   -1593
.word   -220
.word    614
.word    1249
.word    2005
.word    3018
.word    4165
.word    5102
.word    5402
.word    4762
.word    3175
.word    1019
.word   -1012
.word   -2113
.word   -1664
.word    493
.word    3917
.word    7640
```

```
.word    10438
.word    11239
.word    9502
.word    5442
.word    0
.word   -5442
.word   -9502
.word   -11239
.word   -10438
.word   -7640
.word   -3917
.word   -493
.word    1664
.word    2113
.word    1012
.word   -1019
.word   -3175
.word   -4762
.word   -5402
.word   -5102
.word   -4165
.word   -3018
.word   -2005
.word   -1249
.word   -614
.word    220
.word    1593
.word    3675
.word    6319
.word    9019
.word    11007
.word    11483
.word    9915
.word    6301
.word    1301
```

```
        .word    -3873
        .word    -7795
        .word    -9308
        .word    -8002
        .word    -4480
        .word    -281
        .word     2581
        .word     2320
        .word    -1908
        .word    -9558
        .word    -18721
        .word    -26661
        .word    -30708
        .word    -29191
        .word    -22069
        .word    -11018
        .word     1083
        .word     11076
        .word     16534
        .word     16487
        .word     11616
        .word     3880
        .word    -4239
        .word    -10586
        .word    -13942
        .word    -14213
        .word    -12202
        .word    -9111
        .word    -6031
        .word    -3616
        .word    -2021
        .word    -1065
        .word    -464
        .word     0    ;redundant 129th entry
;Series Table s6_0h.asm
```

```
S6      .word    0
        .word    -1119
        .word    -2343
        .word    -3661
        .word    -4879
        .word    -5640
        .word    -5524
        .word    -4203
        .word    -1603
        .word    1994
        .word    5947
        .word    9364
        .word    11299
        .word    10999
        .word    8109
        .word    2802
        .word    -4222
        .word    -11868
        .word    -18877
        .word    -24092
        .word    -26703
        .word    -26405
        .word    -23438
        .word    -18502
        .word    -12587
        .word    -6746
        .word    -1883
        .word    1410
        .word    2931
        .word    2857
        .word    1663
        .word    -14
        .word    -1524
        .word    -2338
        .word    -2143
```

```
.word   -889
.word    1221
.word    3782
.word    6282
.word    8206
.word    9142
.word    8870
.word    7406
.word    5005
.word    2114
.word   -721
.word   -2961
.word   -4195
.word   -4222
.word   -3093
.word   -1106
.word    1268
.word    3489
.word    5060
.word    5641
.word    5116
.word    3613
.word    1470
.word   -846
.word   -2838
.word   -4093
.word   -4362
.word   -3615
.word   -2039
.word    0
.word    2039
.word    3615
.word    4362
.word    4093
.word    2838
```

```
.word    846
.word   -1470
.word   -3613
.word   -5116
.word   -5641
.word   -5060
.word   -3489
.word   -1268
.word    1106
.word    3093
.word    4222
.word    4195
.word    2961
.word    721
.word   -2114
.word   -5005
.word   -7406
.word   -8870
.word   -9142
.word   -8206
.word   -6282
.word   -3782
.word   -1221
.word    889
.word    2143
.word    2338
.word    1524
.word    14
.word   -1663
.word   -2857
.word   -2931
.word   -1410
.word    1883
.word    6746
.word    12587
```

```
        .word    18502
        .word    23438
        .word    26405
        .word    26703
        .word    24092
        .word    18877
        .word    11868
        .word    4222
        .word   -2802
        .word   -8109
        .word   -10999
        .word   -11299
        .word   -9364
        .word   -5947
        .word   -1994
        .word    1603
        .word    4203
        .word    5524
        .word    5640
        .word    4879
        .word    3661
        .word    2343
        .word    1119
        .word    0    ;redundant 129th entry
;Series Table s7_0j.asm
S7      .word    0
        .word    6558
        .word    12476
        .word    17185
        .word    20262
        .word    21468
        .word    20781
        .word    18386
        .word    14655
        .word    10093
```

```
.word    5281
.word    802
.word   -2819
.word   -5176
.word   -6014
.word   -5253
.word   -2978
.word    576
.word    5065
.word    10082
.word    15198
.word    20013
.word    24184
.word    27452
.word    29651
.word    30708
.word    30631
.word    29494
.word    27416
.word    24545
.word    21042
.word    17071
.word    12791
.word    8356
.word    3916
.word   -386
.word   -4410
.word   -8021
.word   -11096
.word   -13528
.word   -15233
.word   -16160
.word   -16293
.word   -15656
.word   -14314
```

```
.word   -12366
.word   -9941
.word   -7186
.word   -4257
.word   -1309
.word    1517
.word    4097
.word    6332
.word    8146
.word    9492
.word    10344
.word    10700
.word    10573
.word    9994
.word    9005
.word    7658
.word    6013
.word    4139
.word    2109
.word    0
.word   -2109
.word   -4139
.word   -6013
.word   -7658
.word   -9005
.word   -9994
.word   -10573
.word   -10700
.word   -10344
.word   -9492
.word   -8146
.word   -6332
.word   -4097
.word   -1517
.word    1309
```

```
.word    4257
.word    7186
.word    9941
.word    12366
.word    14314
.word    15656
.word    16293
.word    16160
.word    15233
.word    13528
.word    11096
.word    8021
.word    4410
.word    386
.word   -3916
.word   -8356
.word   -12791
.word   -17071
.word   -21042
.word   -24545
.word   -27416
.word   -29494
.word   -30631
.word   -30708
.word   -29651
.word   -27452
.word   -24184
.word   -20013
.word   -15198
.word   -10081
.word   -5065
.word   -575
.word    2978
.word    5253
.word    6014
```

```
        .word     5176
        .word     2819
        .word     -802
        .word     -5281
        .word     -10093
        .word     -14655
        .word     -18386
        .word     -20781
        .word     -21468
        .word     -20262
        .word     -17185
        .word     -12476
        .word     -6558
        .word     0    ;redundant 129th entry
;Series Table s8_0i.asm
S8      .word     0
        .word     146
        .word     218
        .word     149
        .word     -124
        .word     -653
        .word     -1476
        .word     -2616
        .word     -4080
        .word     -5857
        .word     -7919
        .word     -10223
        .word     -12711
        .word     -15313
        .word     -17950
        .word     -20539
        .word     -22994
        .word     -25230
        .word     -27167
        .word     -28735
```

```
.word   -29876
.word   -30544
.word   -30708
.word   -30358
.word   -29498
.word   -28148
.word   -26347
.word   -24147
.word   -21611
.word   -18812
.word   -15831
.word   -12750
.word   -9654
.word   -6623
.word   -3733
.word   -1051
.word    1365
.word    3469
.word    5227
.word    6619
.word    7638
.word    8288
.word    8586
.word    8560
.word    8244
.word    7681
.word    6917
.word    6003
.word    4988
.word    3924
.word    2855
.word    1826
.word    874
.word    30
.word   -681
```

```
.word    -1242
.word    -1643
.word    -1880
.word    -1959
.word    -1888
.word    -1684
.word    -1367
.word    -962
.word    -496
.word     0
.word     496
.word     962
.word     1367
.word     1684
.word     1888
.word     1959
.word     1880
.word     1643
.word     1242
.word     681
.word    -30
.word    -874
.word    -1826
.word    -2855
.word    -3924
.word    -4988
.word    -6003
.word    -6917
.word    -7681
.word    -8244
.word    -8560
.word    -8586
.word    -8288
.word    -7638
.word    -6619
```

```
.word   -5227
.word   -3469
.word   -1365
.word    1051
.word    3733
.word    6623
.word    9654
.word    12750
.word    15831
.word    18812
.word    21611
.word    24147
.word    26347
.word    28148
.word    29498
.word    30358
.word    30708
.word    30544
.word    29876
.word    28735
.word    27167
.word    25230
.word    22994
.word    20539
.word    17950
.word    15313
.word    12711
.word    10223
.word    7919
.word    5857
.word    4080
.word    2616
.word    1476
.word    653
.word    124
```

```
        .word    -149
        .word    -218
        .word    -146
        .word     0   ;redundant 129th entry
;*************************************************************
S9      .space    2048          ;128 words 0 filled
        .word       0           ;129th entry
;*************************************************************
;Series Table s1_1h.asm
S1_1    .word     0
        .word     8210
        .word     2908
        .word    -7635
        .word    -8642
        .word    -2310
        .word     840
        .word     2488
        .word     9889
        .word     17409
        .word     13884
        .word     3170
        .word    -865
        .word     3271
        .word     4526
        .word    -78
        .word    -1433
        .word     4567
        .word     11377
        .word     15319
        .word     20533
        .word     26703
        .word     24710
        .word     10873
        .word    -3744
        .word    -5364
```

```
.word    5863
.word    16229
.word    13406
.word   -1045
.word   -13193
.word   -11544
.word   -928
.word    2578
.word   -7070
.word   -16562
.word   -11310
.word    3920
.word    12084
.word    7294
.word   -305
.word   -1980
.word   -927
.word   -2543
.word   -3944
.word    930
.word    10973
.word    18108
.word    16192
.word    7005
.word   -1788
.word   -3510
.word    2015
.word    9372
.word    13448
.word    12820
.word    7762
.word   -1036
.word   -9950
.word   -12731
.word   -6929
```

```
.word     2244
.word     7290
.word     5672
.word     0
.word    -5672
.word    -7290
.word    -2244
.word     6929
.word     12731
.word     9950
.word     1036
.word    -7762
.word    -12820
.word    -13448
.word    -9372
.word    -2015
.word     3510
.word     1788
.word    -7005
.word    -16192
.word    -18108
.word    -10973
.word    -930
.word     3944
.word     2543
.word     927
.word     1980
.word     305
.word    -7294
.word    -12084
.word    -3919
.word     11310
.word     16562
.word     7069
.word    -2578
```

```
        .word     928
        .word     11544
        .word     13193
        .word     1044
        .word    -13406
        .word    -16229
        .word    -5863
        .word     5364
        .word     3743
        .word    -10873
        .word    -24710
        .word    -26703
        .word    -20533
        .word    -15319
        .word    -11377
        .word    -4567
        .word     1433
        .word     78
        .word    -4526
        .word    -3271
        .word     865
        .word    -3170
        .word    -13884
        .word    -17409
        .word    -9889
        .word    -2488
        .word    -840
        .word     2310
        .word     8642
        .word     7635
        .word    -2908
        .word    -8210
        .word     0   ;redundant 129th entry
;Series Table s2_1.asm
S2_1    .word     0
```

```
.word     23789
.word     26703
.word     10376
.word    -5925
.word    -8756
.word    -1871
.word     4810
.word     8976
.word     14376
.word     21119
.word     24299
.word     21299
.word     15094
.word     9411
.word     4674
.word     315
.word    -2315
.word    -1984
.word    -404
.word    -90
.word    -432
.word     1319
.word     5423
.word     8745
.word     8991
.word     7528
.word     6871
.word     7271
.word     7331
.word     6679
.word     6114
.word     5791
.word     5151
.word     4492
.word     4834
```

```
.word     5889
.word     5818
.word     3790
.word     1470
.word     914
.word     1926
.word     2735
.word     2652
.word     2666
.word     3553
.word     4779
.word     5540
.word     5790
.word     5713
.word     5091
.word     3895
.word     2813
.word     2427
.word     2299
.word     1659
.word     724
.word     490
.word     1273
.word     2260
.word     2618
.word     2347
.word     1801
.word     1029
.word     0
.word    -1029
.word    -1801
.word    -2347
.word    -2618
.word    -2260
.word    -1273
```

```
.word    -490
.word    -724
.word    -1659
.word    -2299
.word    -2427
.word    -2813
.word    -3895
.word    -5091
.word    -5713
.word    -5790
.word    -5540
.word    -4779
.word    -3553
.word    -2666
.word    -2652
.word    -2735
.word    -1926
.word    -914
.word    -1470
.word    -3790
.word    -5818
.word    -5889
.word    -4834
.word    -4492
.word    -5151
.word    -5791
.word    -6114
.word    -6680
.word    -7331
.word    -7271
.word    -6871
.word    -7528
.word    -8991
.word    -8745
.word    -5423
```

```
        .word    -1319
        .word     432
        .word     90
        .word     404
        .word     1984
        .word     2315
        .word    -315
        .word    -4674
        .word    -9411
        .word    -15094
        .word    -21299
        .word    -24299
        .word    -21119
        .word    -14376
        .word    -8976
        .word    -4810
        .word     1871
        .word     8756
        .word     5925
        .word    -10376
        .word    -26703
        .word    -23789
        .word     0   ;redundant 129th entry
;Series Table s3_1h.asm
S3_1    .word     0
        .word     2578
        .word     504
        .word    -5461
        .word    -9888
        .word    -8315
        .word    -1169
        .word     7503
        .word     13508
        .word     14088
        .word     7969
```

```
.word    -3460
.word    -14605
.word    -17840
.word    -9908
.word     3685
.word     12562
.word     11125
.word     3943
.word     737
.word     6319
.word     16302
.word     22419
.word     20622
.word     13391
.word     5562
.word    -95
.word    -3196
.word    -3817
.word    -1983
.word     1394
.word     4640
.word     6689
.word     7253
.word     5237
.word    -1441
.word    -12536
.word    -22300
.word    -22178
.word    -8807
.word     10996
.word     25072
.word     26703
.word     20036
.word     14405
.word     14303
```

```
.word     16267
.word     15221
.word     11559
.word     10239
.word     13602
.word     17424
.word     15366
.word     6510
.word    -3013
.word    -6130
.word    -1596
.word     5831
.word     11101
.word     13484
.word     15318
.word     17393
.word     16994
.word     10961
.word     0
.word    -10961
.word    -16994
.word    -17393
.word    -15318
.word    -13483
.word    -11101
.word    -5831
.word     1596
.word     6130
.word     3013
.word    -6510
.word    -15366
.word    -17424
.word    -13602
.word    -10239
.word    -11559
```

```
.word    -15221
.word    -16267
.word    -14303
.word    -14405
.word    -20036
.word    -26703
.word    -25072
.word    -10996
.word     8807
.word     22178
.word     22300
.word     12536
.word     1441
.word    -5237
.word    -7253
.word    -6689
.word    -4640
.word    -1394
.word     1983
.word     3817
.word     3196
.word     95
.word    -5562
.word    -13391
.word    -20622
.word    -22419
.word    -16302
.word    -6319
.word    -737
.word    -3943
.word    -11125
.word    -12562
.word    -3685
.word     9908
.word     17840
```

```
        .word     14605
        .word     3460
        .word    -7969
        .word    -14088
        .word    -13508
        .word    -7503
        .word     1169
        .word     8315
        .word     9888
        .word     5461
        .word    -504
        .word    -2578
        .word     0    ;redundant 129th entry
;Series Table s4_1h.asm
S4_1    .word     0
        .word    -2955
        .word    -5587
        .word    -7982
        .word    -10513
        .word    -13210
        .word    -15194
        .word    -14844
        .word    -10810
        .word    -3227
        .word     5868
        .word     13391
        .word     16935
        .word     16186
        .word     13001
        .word     10047
        .word     8934
        .word     9225
        .word     9024
        .word     6724
        .word     2565
```

```
.word   -1212
.word   -1777
.word    2299
.word    9959
.word    18262
.word    24249
.word    26703
.word    26525
.word    25550
.word    24777
.word    23461
.word    19832
.word    12912
.word    4029
.word   -3288
.word   -5192
.word   -32
.word    10182
.word    20450
.word    25293
.word    21653
.word    10482
.word   -3837
.word   -15779
.word   -21314
.word   -19485
.word   -12302
.word   -3325
.word    4103
.word    8069
.word    8372
.word    6059
.word    2673
.word   -392
.word   -2263
```

```
.word    -2688
.word    -1949
.word    -650
.word     573
.word     1295
.word     1420
.word     1104
.word     579
.word     0
.word    -579
.word    -1104
.word    -1420
.word    -1295
.word    -573
.word     650
.word     1949
.word     2688
.word     2263
.word     392
.word    -2673
.word    -6059
.word    -8372
.word    -8069
.word    -4103
.word     3325
.word     12302
.word     19485
.word     21314
.word     15779
.word     3837
.word    -10482
.word    -21654
.word    -25293
.word    -20450
.word    -10182
```

```
.word     32
.word     5192
.word     3288
.word    -4029
.word    -12912
.word    -19832
.word    -23461
.word    -24777
.word    -25550
.word    -26525
.word    -26703
.word    -24249
.word    -18262
.word    -9959
.word    -2299
.word     1777
.word     1212
.word    -2565
.word    -6724
.word    -9024
.word    -9225
.word    -8934
.word    -10047
.word    -13001
.word    -16186
.word    -16935
.word    -13391
.word    -5868
.word     3227
.word     10810
.word     14844
.word     15194
.word     13210
.word     10513
.word     7982
```

```
        .word     5587
        .word     2955
        .word     0    ;redundant 129th entry
;Series Table S5_1H.ASM
S5_1    .word     0
        .word    -4219
        .word    -7425
        .word    -8929
        .word    -8550
        .word    -6606
        .word    -3715
        .word    -525
        .word     2495
        .word     5107
        .word     7213
        .word     8724
        .word     9510
        .word     9515
        .word     8944
        .word     8360
        .word     8546
        .word     10116
        .word     13075
        .word     16618
        .word     19387
        .word     20113
        .word     18339
        .word     14749
        .word     10857
        .word     8155
        .word     7199
        .word     7226
        .word     6581
        .word     3795
        .word    -1341
```

```
.word    -7378
.word    -11830
.word    -12516
.word    -8882
.word    -2499
.word     3594
.word     6389
.word     4415
.word    -1561
.word    -8997
.word    -14869
.word    -17051
.word    -15038
.word    -9755
.word    -2735
.word     4711
.word     11843
.word     18269
.word     23480
.word     26616
.word     26703
.word     23225
.word     16599
.word     8195
.word    -176
.word    -6987
.word    -11520
.word    -13882
.word    -14590
.word    -14058
.word    -12354
.word    -9349
.word    -5078
.word     0
.word     5078
```

```
.word    9349
.word    12354
.word    14058
.word    14590
.word    13882
.word    11520
.word    6987
.word    176
.word   -8195
.word   -16599
.word   -23225
.word   -26703
.word   -26616
.word   -23480
.word   -18269
.word   -11843
.word   -4711
.word    2735
.word    9755
.word    15038
.word    17051
.word    14869
.word    8997
.word    1561
.word   -4416
.word   -6389
.word   -3594
.word    2499
.word    8882
.word    12516
.word    11830
.word    7378
.word    1341
.word   -3795
.word   -6581
```

```
        .word    -7226
        .word    -7199
        .word    -8155
        .word    -10857
        .word    -14749
        .word    -18339
        .word    -20113
        .word    -19387
        .word    -16618
        .word    -13075
        .word    -10116
        .word    -8546
        .word    -8360
        .word    -8944
        .word    -9515
        .word    -9510
        .word    -8724
        .word    -7213
        .word    -5107
        .word    -2495
        .word     525
        .word     3715
        .word     6606
        .word     8550
        .word     8929
        .word     7425
        .word     4219
        .word     0    ;redundant 129th entry
;Series Table s6_1h.asm
S6_1    .word     0
        .word    -4379
        .word    -7920
        .word    -10224
        .word    -11506
        .word    -12403
```

```
.word   -13525
.word   -15029
.word   -16471
.word   -17038
.word   -16033
.word   -13331
.word   -9524
.word   -5670
.word   -2761
.word   -1222
.word   -733
.word   -472
.word    353
.word    1996
.word    4005
.word    5507
.word    5792
.word    4872
.word    3653
.word    3573
.word    5864
.word    10795
.word    17328
.word    23392
.word    26703
.word    25745
.word    20458
.word    12291
.word    3617
.word   -3222
.word   -6786
.word   -6941
.word   -4671
.word   -1445
.word    1502
```

```
.word    3625
.word    5096
.word    6456
.word    8139
.word    10152
.word    12047
.word    13182
.word    13080
.word    11672
.word    9325
.word    6635
.word    4151
.word    2169
.word    693
.word   -447
.word   -1421
.word   -2277
.word   -2930
.word   -3246
.word   -3146
.word   -2656
.word   -1888
.word   -971
.word    0
.word    971
.word    1888
.word    2656
.word    3146
.word    3246
.word    2930
.word    2277
.word    1421
.word    447
.word   -693
.word   -2169
```

```
.word   -4151
.word   -6635
.word   -9325
.word   -11672
.word   -13080
.word   -13182
.word   -12047
.word   -10152
.word   -8139
.word   -6456
.word   -5096
.word   -3625
.word   -1502
.word    1445
.word    4671
.word    6942
.word    6786
.word    3222
.word   -3617
.word   -12291
.word   -20458
.word   -25745
.word   -26703
.word   -23392
.word   -17328
.word   -10795
.word   -5864
.word   -3573
.word   -3653
.word   -4872
.word   -5792
.word   -5507
.word   -4005
.word   -1996
.word   -353
```

```
        .word     472
        .word     733
        .word     1222
        .word     2761
        .word     5670
        .word     9524
        .word     13331
        .word     16033
        .word     17038
        .word     16471
        .word     15029
        .word     13525
        .word     12403
        .word     11506
        .word     10224
        .word     7920
        .word     4379
        .word     0    ;redundant 129th entry
;Series Table s7_1k.asm
S7_1    .word    -52
        .word     122
        .word     409
        .word     901
        .word     1673
        .word     2777
        .word     4235
        .word     6041
        .word     8156
        .word     10517
        .word     13034
        .word     15604
        .word     18116
        .word     20456
        .word     22522
        .word     24228
```

```
.word    25512
.word    26339
.word    26703
.word    26632
.word    26178
.word    25420
.word    24452
.word    23378
.word    22304
.word    21327
.word    20532
.word    19979
.word    19705
.word    19715
.word    19988
.word    20473
.word    21096
.word    21766
.word    22379
.word    22830
.word    23018
.word    22854
.word    22270
.word    21219
.word    19683
.word    17673
.word    15227
.word    12411
.word    9308
.word    6022
.word    2663
.word   -654
.word   -3816
.word   -6722
.word   -9282
```

```
.word   -11423
.word   -13093
.word   -14261
.word   -14912
.word   -15054
.word   -14707
.word   -13907
.word   -12698
.word   -11132
.word   -9265
.word   -7157
.word   -4866
.word   -2452
.word    25
.word    2505
.word    4927
.word    7230
.word    9353
.word    11232
.word    12807
.word    14018
.word    14811
.word    15139
.word    14966
.word    14272
.word    13052
.word    11320
.word    9113
.word    6488
.word    3521
.word    306
.word   -3049
.word   -6430
.word   -9720
.word   -12806
```

```
.word    -15587
.word    -17980
.word    -19923
.word    -21383
.word    -22355
.word    -22861
.word    -22953
.word    -22706
.word    -22213
.word    -21576
.word    -20904
.word    -20298
.word    -19848
.word    -19624
.word    -19672
.word    -20010
.word    -20624
.word    -21473
.word    -22491
.word    -23589
.word    -24666
.word    -25617
.word    -26337
.word    -26735
.word    -26736
.word    -26292
.word    -25382
.word    -24018
.word    -22239
.word    -20115
.word    -17736
.word    -15207
.word    -12640
.word    -10148
.word    -7833
```

```
        .word    -5777
        .word    -4041
        .word    -2656
        .word    -1624
        .word    -915
        .word    -472
        .word    -216
        .word    -52     ;redundant 129th entry
;Series Table s8_1i.asm
S8_1    .word     18
        .word     1718
        .word     3396
        .word     5031
        .word     6604
        .word     8099
        .word     9502
        .word     10802
        .word     11995
        .word     13076
        .word     14049
        .word     14919
        .word     15695
        .word     16389
        .word     17015
        .word     17589
        .word     18128
        .word     18648
        .word     19164
        .word     19690
        .word     20235
        .word     20808
        .word     21410
        .word     22040
        .word     22693
        .word     23358
```

```
.word    24021
.word    24661
.word    25259
.word    25788
.word    26223
.word    26536
.word    26703
.word    26698
.word    26498
.word    26087
.word    25451
.word    24582
.word    23479
.word    22147
.word    20598
.word    18851
.word    16931
.word    14870
.word    12705
.word    10476
.word    8228
.word    6007
.word    3860
.word    1831
.word   -36
.word   -1702
.word   -3133
.word   -4302
.word   -5188
.word   -5778
.word   -6070
.word   -6068
.word   -5785
.word   -5245
.word   -4477
```

```
.word    -3518
.word    -2411
.word    -1202
.word     57
.word     1314
.word     2519
.word     3619
.word     4570
.word     5327
.word     5854
.word     6123
.word     6110
.word     5802
.word     5196
.word     4295
.word     3111
.word     1666
.word    -12
.word    -1889
.word    -3927
.word    -6081
.word    -8306
.word    -10556
.word    -12784
.word    -14947
.word    -17004
.word    -18918
.word    -20659
.word    -22200
.word    -23523
.word    -24618
.word    -25477
.word    -26105
.word    -26508
.word    -26700
```

```
        .word    -26699
        .word    -26527
        .word    -26209
        .word    -25772
        .word    -25241
        .word    -24644
        .word    -24004
        .word    -23344
        .word    -22682
        .word    -22032
        .word    -21405
        .word    -20807
        .word    -20238
        .word    -19696
        .word    -19173
        .word    -18659
        .word    -18140
        .word    -17601
        .word    -17026
        .word    -16398
        .word    -15702
        .word    -14923
        .word    -14049
        .word    -13071
        .word    -11985
        .word    -10788
        .word    -9482
        .word    -8075
        .word    -6576
        .word    -5000
        .word    -3362
        .word    -1683
        .word     18   ;redundant 129th entry
;*********************************************************
S9_1    .space    2048          ;128 words 0 filled
```

```
        .word       0           ;129th entry
;*************************************************************
;Series Table s1_2.asm
S1_2    .word      0
        .word      1111
        .word     -4510
        .word     -6842
        .word      1479
        .word      10311
        .word      9946
        .word      5083
        .word      3612
        .word      4427
        .word      1723
        .word     -3521
        .word     -4158
        .word     -870
        .word     -2900
        .word     -10339
        .word     -12707
        .word     -6977
        .word      1331
        .word      10615
        .word      20651
        .word      26703
        .word      25025
        .word      14531
        .word     -3135
        .word     -15393
        .word     -6404
        .word      16735
        .word      26288
        .word      10832
        .word     -10244
        .word     -14112
```

```
.word     0
.word     14112
.word     10244
.word    -10832
.word    -26288
.word    -16735
.word     6404
.word     15393
.word     3135
.word    -14531
.word    -25025
.word    -26703
.word    -20651
.word    -10615
.word    -1331
.word     6977
.word     12707
.word     10339
.word     2900
.word     870
.word     4158
.word     3521
.word    -1723
.word    -4427
.word    -3612
.word    -5083
.word    -9946
.word    -10311
.word    -1479
.word     6842
.word     4510
.word    -1111
.word     0
.word     1111
.word    -4510
```

```
.word    -6842
.word     1479
.word     10311
.word     9946
.word     5083
.word     3612
.word     4427
.word     1723
.word    -3521
.word    -4158
.word    -870
.word    -2900
.word    -10339
.word    -12707
.word    -6977
.word     1331
.word     10615
.word     20651
.word     26703
.word     25025
.word     14531
.word    -3135
.word    -15393
.word    -6404
.word     16735
.word     26288
.word     10832
.word    -10244
.word    -14112
.word     0
.word     14112
.word     10244
.word    -10832
.word    -26288
.word    -16735
```

```
        .word     6404
        .word     15393
        .word     3135
        .word    -14531
        .word    -25025
        .word    -26703
        .word    -20651
        .word    -10615
        .word    -1331
        .word     6977
        .word     12707
        .word     10339
        .word     2900
        .word     870
        .word     4158
        .word     3521
        .word    -1723
        .word    -4427
        .word    -3612
        .word    -5083
        .word    -9946
        .word    -10311
        .word    -1479
        .word     6842
        .word     4510
        .word    -1111
        .word     0    ;redundant 129th entry
;Series Table s2_2h.asm
S2_2    .word     0
        .word     4428
        .word     2760
        .word    -4481
        .word    -10456
        .word    -9604
        .word    -3578
```

```
.word    1496
.word    1323
.word   -3934
.word   -10254
.word   -11867
.word   -5081
.word    8492
.word    21979
.word    26703
.word    18684
.word    3676
.word   -7073
.word   -7727
.word   -2298
.word    1854
.word    2531
.word    3674
.word    7711
.word    9668
.word    4669
.word   -1486
.word    312
.word    7263
.word    9412
.word    5310
.word    0
.word   -5310
.word   -9412
.word   -7263
.word   -312
.word    1486
.word   -4669
.word   -9668
.word   -7711
.word   -3674
```

```
.word    -2531
.word    -1854
.word     2298
.word     7727
.word     7073
.word    -3677
.word    -18684
.word    -26703
.word    -21979
.word    -8492
.word     5081
.word     11867
.word     10254
.word     3934
.word    -1323
.word    -1496
.word     3578
.word     9604
.word     10455
.word     4481
.word    -2760
.word    -4428
.word     0
.word     4428
.word     2760
.word    -4481
.word    -10456
.word    -9604
.word    -3578
.word     1496
.word     1323
.word    -3934
.word    -10254
.word    -11867
.word    -5081
```

```
.word    8492
.word    21979
.word    26703
.word    18684
.word    3676
.word   -7073
.word   -7727
.word   -2298
.word    1854
.word    2531
.word    3674
.word    7711
.word    9668
.word    4669
.word   -1486
.word    312
.word    7263
.word    9412
.word    5310
.word    0
.word   -5310
.word   -9412
.word   -7263
.word   -312
.word    1486
.word   -4669
.word   -9668
.word   -7711
.word   -3674
.word   -2531
.word   -1854
.word    2298
.word    7727
.word    7073
.word   -3677
```

```
        .word    -18684
        .word    -26703
        .word    -21979
        .word    -8492
        .word     5081
        .word     11867
        .word     10254
        .word     3934
        .word    -1323
        .word    -1496
        .word     3578
        .word     9604
        .word     10455
        .word     4481
        .word    -2760
        .word    -4428
        .word     0    ;redundant 129th entry
;Series Table s3_2.asm
S3_2    .word     0
        .word    -2577
        .word    -6637
        .word    -12839
        .word    -19539
        .word    -22036
        .word    -15374
        .word    -145
        .word     15107
        .word     19811
        .word     10459
        .word    -6860
        .word    -21890
        .word    -26703
        .word    -19427
        .word    -5960
        .word     2722
```

```
.word    -114
.word    -9506
.word    -14517
.word    -11514
.word    -6722
.word    -4959
.word    -2482
.word     5500
.word     15687
.word     20223
.word     16351
.word     8129
.word     677
.word    -3347
.word    -3210
.word     0
.word     3210
.word     3347
.word    -677
.word    -8129
.word    -16351
.word    -20223
.word    -15687
.word    -5500
.word     2482
.word     4959
.word     6722
.word     11514
.word     14517
.word     9506
.word     114
.word    -2722
.word     5960
.word     19427
.word     26703
```

```
.word    21890
.word    6860
.word   -10459
.word   -19811
.word   -15107
.word    145
.word    15374
.word    22036
.word    19539
.word    12839
.word    6637
.word    2577
.word    0
.word   -2577
.word   -6637
.word   -12839
.word   -19539
.word   -22036
.word   -15374
.word   -145
.word    15107
.word    19811
.word    10459
.word   -6860
.word   -21890
.word   -26703
.word   -19427
.word   -5960
.word    2722
.word   -115
.word   -9506
.word   -14517
.word   -11514
.word   -6722
.word   -4959
```

```
.word   -2482
.word    5500
.word    15687
.word    20223
.word    16351
.word    8129
.word    677
.word   -3347
.word   -3210
.word    0
.word    3210
.word    3347
.word   -677
.word   -8129
.word   -16351
.word   -20223
.word   -15687
.word   -5500
.word    2483
.word    4959
.word    6722
.word    11514
.word    14517
.word    9506
.word    114
.word   -2722
.word    5960
.word    19427
.word    26703
.word    21890
.word    6860
.word   -10459
.word   -19811
.word   -15107
.word    145
```

```
        .word     15374
        .word     22036
        .word     19539
        .word     12839
        .word     6637
        .word     2577
        .word     0    ;redundant 129th entry
;Series Table s4_2.asm
S4_2    .word     0
        .word     3163
        .word     2732
        .word    -2121
        .word    -8841
        .word    -13679
        .word    -14636
        .word    -12141
        .word    -7351
        .word    -1133
        .word     4949
        .word     8343
        .word     7737
        .word     4878
        .word     2871
        .word     3298
        .word     6344
        .word     12441
        .word     20864
        .word     26703
        .word     22983
        .word     8337
        .word    -9190
        .word    -18590
        .word    -15702
        .word    -5128
        .word     6185
```

```
.word    14440
.word    18611
.word    18304
.word    13929
.word    7249
.word    0
.word   -7249
.word   -13929
.word   -18304
.word   -18611
.word   -14440
.word   -6185
.word    5128
.word    15702
.word    18590
.word    9190
.word   -8337
.word   -22983
.word   -26703
.word   -20864
.word   -12441
.word   -6344
.word   -3298
.word   -2871
.word   -4878
.word   -7737
.word   -8343
.word   -4949
.word    1133
.word    7351
.word    12141
.word    14636
.word    13679
.word    8841
.word    2121
```

```
.word    -2732
.word    -3163
.word     0
.word     3163
.word     2732
.word    -2121
.word    -8841
.word    -13679
.word    -14636
.word    -12141
.word    -7351
.word    -1133
.word     4949
.word     8343
.word     7737
.word     4878
.word     2871
.word     3298
.word     6344
.word     12441
.word     20864
.word     26703
.word     22983
.word     8337
.word    -9190
.word    -18590
.word    -15702
.word    -5128
.word     6185
.word     14440
.word     18611
.word     18304
.word     13929
.word     7249
.word     0
```

```
        .word    -7249
        .word    -13929
        .word    -18304
        .word    -18611
        .word    -14440
        .word    -6185
        .word     5128
        .word     15702
        .word     18590
        .word     9189
        .word    -8337
        .word    -22983
        .word    -26703
        .word    -20864
        .word    -12441
        .word    -6344
        .word    -3298
        .word    -2871
        .word    -4878
        .word    -7737
        .word    -8343
        .word    -4949
        .word     1133
        .word     7351
        .word     12141
        .word     14636
        .word     13679
        .word     8841
        .word     2121
        .word    -2732
        .word    -3163
        .word     0    ;redundant 129th entry
;Series Table s5_2.asm
S5_2    .word     0
        .word    -336
```

```
.word    -900
.word    -1193
.word    -191
.word     2651
.word     6653
.word     10165
.word     11552
.word     10025
.word     5796
.word    -172
.word    -6412
.word    -11221
.word    -13182
.word    -11772
.word    -7475
.word    -1193
.word     6401
.word     14700
.word     22307
.word     26703
.word     25489
.word     18489
.word     8690
.word     668
.word    -2468
.word    -1017
.word     2128
.word     4081
.word     3864
.word     2179
.word     0
.word    -2179
.word    -3864
.word    -4081
.word    -2128
```

```
.word    1017
.word    2468
.word   -668
.word   -8690
.word   -18489
.word   -25489
.word   -26703
.word   -22307
.word   -14700
.word   -6401
.word    1193
.word    7475
.word    11772
.word    13182
.word    11221
.word    6412
.word    172
.word   -5796
.word   -10025
.word   -11552
.word   -10165
.word   -6653
.word   -2651
.word    191
.word    1193
.word    900
.word    336
.word    0
.word   -336
.word   -900
.word   -1193
.word   -191
.word    2651
.word    6653
.word    10165
```

```
.word    11552
.word    10025
.word    5796
.word   -172
.word   -6412
.word   -11221
.word   -13182
.word   -11772
.word   -7475
.word   -1193
.word    6401
.word    14700
.word    22307
.word    26703
.word    25489
.word    18489
.word    8690
.word    668
.word   -2468
.word   -1017
.word    2128
.word    4081
.word    3864
.word    2179
.word    0
.word   -2179
.word   -3864
.word   -4081
.word   -2128
.word    1017
.word    2468
.word   -668
.word   -8690
.word   -18489
.word   -25489
```

```
        .word    -26703
        .word    -22307
        .word    -14700
        .word    -6401
        .word     1193
        .word     7475
        .word     11772
        .word     13182
        .word     11221
        .word     6412
        .word     172
        .word    -5796
        .word    -10025
        .word    -11552
        .word    -10165
        .word    -6653
        .word    -2651
        .word     191
        .word     1193
        .word     900
        .word     336
        .word     0    ;redundant 129th entry
;Series Table s6_2.asm
S6_2    .word     0
        .word    -887
        .word    -1570
        .word    -2036
        .word    -2473
        .word    -3090
        .word    -3919
        .word    -4791
        .word    -5507
        .word    -6037
        .word    -6550
        .word    -7240
```

```
.word    -8111
.word    -8944
.word    -9489
.word    -9722
.word    -9894
.word    -10300
.word    -10956
.word    -11462
.word    -11215
.word    -9788
.word    -7149
.word    -3526
.word     945
.word     6366
.word     12777
.word     19537
.word     24964
.word     26703
.word     22860
.word     13264
.word     0
.word    -13264
.word    -22860
.word    -26703
.word    -24964
.word    -19537
.word    -12777
.word    -6366
.word    -945
.word     3526
.word     7149
.word     9788
.word     11215
.word     11462
.word     10956
```

```
.word    10300
.word    9894
.word    9722
.word    9489
.word    8944
.word    8111
.word    7240
.word    6550
.word    6037
.word    5507
.word    4791
.word    3919
.word    3090
.word    2473
.word    2036
.word    1570
.word    887
.word    0
.word   -887
.word   -1570
.word   -2036
.word   -2473
.word   -3090
.word   -3919
.word   -4791
.word   -5507
.word   -6037
.word   -6550
.word   -7240
.word   -8111
.word   -8944
.word   -9489
.word   -9722
.word   -9894
.word   -10300
```

```
.word   -10956
.word   -11462
.word   -11215
.word   -9788
.word   -7149
.word   -3526
.word    945
.word    6366
.word    12777
.word    19537
.word    24964
.word    26703
.word    22860
.word    13264
.word    0
.word   -13264
.word   -22860
.word   -26703
.word   -24964
.word   -19537
.word   -12777
.word   -6366
.word   -945
.word    3526
.word    7149
.word    9788
.word    11215
.word    11462
.word    10956
.word    10300
.word    9894
.word    9722
.word    9489
.word    8944
.word    8111
```

```
        .word     7240
        .word     6550
        .word     6037
        .word     5507
        .word     4791
        .word     3919
        .word     3090
        .word     2473
        .word     2036
        .word     1570
        .word     887
        .word     0    ;redundant 129th entry
;Series Table s7_2i.asm
S7_2    .word    -8
        .word     4166
        .word     8298
        .word     12327
        .word     16155
        .word     19647
        .word     22635
        .word     24927
        .word     26335
        .word     26703
        .word     25934
        .word     24017
        .word     21042
        .word     17203
        .word     12789
        .word     8155
        .word     3690
        .word    -227
        .word    -3274
        .word    -5226
        .word    -5981
        .word    -5575
```

```
.word    -4178
.word    -2076
.word     372
.word     2776
.word     4770
.word     6056
.word     6448
.word     5892
.word     4474
.word     2404
.word    -13
.word    -2422
.word    -4468
.word    -5852
.word    -6367
.word    -5934
.word    -4613
.word    -2596
.word    -185
.word     2252
.word     4325
.word     5678
.word     6030
.word     5218
.word     3210
.word     113
.word    -3840
.word    -8324
.word    -12963
.word    -17367
.word    -21182
.word    -24127
.word    -26009
.word    -26746
.word    -26351
```

```
.word    -24924
.word    -22622
.word    -19633
.word    -16145
.word    -12326
.word    -8306
.word    -4180
.word    -8
.word     4166
.word     8298
.word     12327
.word     16155
.word     19647
.word     22635
.word     24927
.word     26335
.word     26703
.word     25934
.word     24017
.word     21042
.word     17203
.word     12789
.word     8155
.word     3690
.word    -227
.word    -3274
.word    -5226
.word    -5981
.word    -5575
.word    -4178
.word    -2076
.word     372
.word     2776
.word     4770
.word     6056
```

```
.word     6448
.word     5892
.word     4474
.word     2404
.word    -13
.word    -2422
.word    -4468
.word    -5852
.word    -6367
.word    -5934
.word    -4613
.word    -2596
.word    -185
.word     2252
.word     4325
.word     5678
.word     6030
.word     5218
.word     3210
.word     113
.word    -3840
.word    -8324
.word    -12963
.word    -17367
.word    -21182
.word    -24127
.word    -26009
.word    -26746
.word    -26351
.word    -24924
.word    -22622
.word    -19633
.word    -16145
.word    -12326
.word    -8306
```

```
        .word    -4180
        .word    -8    ;redundant 129th entry
;Series Table s8_2i.asm
S8_2    .word    -34
        .word     2650
        .word     5341
        .word     8040
        .word     10735
        .word     13404
        .word     16007
        .word     18490
        .word     20786
        .word     22816
        .word     24498
        .word     25751
        .word     26505
        .word     26703
        .word     26312
        .word     25327
        .word     23771
        .word     21700
        .word     19198
        .word     16377
        .word     13368
        .word     10311
        .word     7352
        .word     4628
        .word     2260
        .word     342
        .word    -1063
        .word    -1929
        .word    -2269
        .word    -2134
        .word    -1610
        .word    -812
```

```
.word     126
.word     1058
.word     1842
.word     2343
.word     2447
.word     2072
.word     1168
.word    -277
.word    -2234
.word    -4638
.word    -7393
.word    -10377
.word    -13451
.word    -16472
.word    -19297
.word    -21797
.word    -23862
.word    -25408
.word    -26382
.word    -26760
.word    -26550
.word    -25787
.word    -24527
.word    -22841
.word    -20812
.word    -18519
.word    -16042
.word    -13446
.word    -10785
.word    -8097
.word    -5405
.word    -2718
.word    -34
.word     2650
.word     5341
```

```
.word    8040
.word    10735
.word    13404
.word    16007
.word    18490
.word    20786
.word    22816
.word    24498
.word    25751
.word    26505
.word    26703
.word    26312
.word    25327
.word    23771
.word    21700
.word    19198
.word    16377
.word    13368
.word    10311
.word    7352
.word    4628
.word    2260
.word    342
.word   -1063
.word   -1929
.word   -2269
.word   -2134
.word   -1610
.word   -812
.word    126
.word    1058
.word    1842
.word    2343
.word    2447
.word    2072
```

```
        .word     1168
        .word    -277
        .word    -2234
        .word    -4638
        .word    -7393
        .word    -10377
        .word    -13451
        .word    -16472
        .word    -19297
        .word    -21797
        .word    -23862
        .word    -25408
        .word    -26382
        .word    -26760
        .word    -26550
        .word    -25787
        .word    -24527
        .word    -22841
        .word    -20812
        .word    -18519
        .word    -16042
        .word    -13446
        .word    -10785
        .word    -8097
        .word    -5405
        .word    -2718
        .word    -34   ;redundant 129th entry
;*********************************************************
S9_2    .space    2048          ;128 words 0 filled
        .word       0           ;129th entry
;*********************************************************
;Series Table S1_3M.ASM
S1_3    .word     0
        .word     2388
        .word     1099
```

```
.word     2089
.word     5924
.word     9525
.word     9133
.word     8270
.word     8493
.word     8652
.word     8986
.word     9954
.word     11581
.word     15105
.word     14906
.word     12588
.word     13345
.word     15704
.word     16598
.word     18176
.word     24173
.word     26703
.word     24488
.word     23041
.word     23081
.word     20127
.word     20875
.word     25840
.word     25334
.word     22509
.word     21239
.word     20727
.word     10027
.word    -534
.word    -1118
.word     2118
.word    -3191
.word    -6228
```

```
.word    -1527
.word    -3405
.word    -3245
.word    -4764
.word    -6658
.word    -9362
.word    -7363
.word    -1937
.word    -970
.word    -723
.word     951
.word     990
.word    -2079
.word    -3062
.word    -349
.word     440
.word     545
.word    -7
.word    -755
.word    -1459
.word    -3264
.word    -4613
.word    -1980
.word     877
.word     882
.word    -1396
.word     0
.word     2388
.word     1099
.word     2089
.word     5924
.word     9525
.word     9133
.word     8270
.word     8493
```

```
.word     8652
.word     8986
.word     9954
.word     11581
.word     15105
.word     14906
.word     12588
.word     13345
.word     15704
.word     16598
.word     18176
.word     24173
.word     26703
.word     24488
.word     23041
.word     23081
.word     20127
.word     20875
.word     25840
.word     25334
.word     22509
.word     21239
.word     20727
.word     10027
.word    -534
.word     3509
.word    -196
.word    -5505
.word    -8542
.word    -370
.word    -1092
.word    -4402
.word    -4764
.word    -6658
.word    -9362
```

```
        .word    -7363
        .word    -1937
        .word    -970
        .word    -723
        .word     951
        .word     990
        .word    -2079
        .word    -3062
        .word    -349
        .word     440
        .word     545
        .word    -7
        .word    -755
        .word    -1459
        .word    -3264
        .word    -4613
        .word    -1980
        .word     877
        .word     882
        .word    -1396
        .word     0    ;redundant 129th entry
;Series Table  2_3M.ASM
S2_3    .word     0
        .word     3622
        .word     4239
        .word     2659
        .word     2615
        .word     3677
        .word     5428
        .word     8255
        .word     9946
        .word     9718
        .word     8282
        .word     7745
        .word     10846
```

```
.word     17516
.word     24131
.word     26678
.word     24552
.word     19933
.word     16678
.word     16715
.word     18386
.word     19976
.word     21287
.word     23219
.word     24958
.word     25706
.word     24865
.word     22649
.word     23718
.word     26627
.word     26703
.word     25580
.word     11661
.word    -2095
.word    -3303
.word     2014
.word     2034
.word     160
.word    -2364
.word    -6259
.word    -1889
.word    -1964
.word    -550
.word     192
.word     1165
.word     2171
.word     1498
.word    -2511
```

```
.word    -7925
.word    -10887
.word    -9214
.word    -3510
.word     2216
.word     4343
.word     2802
.word     336
.word    -948
.word    -334
.word     1397
.word     2036
.word     1972
.word     791
.word    -1935
.word    -2469
.word     0
.word     3622
.word     4239
.word     2659
.word     2615
.word     3677
.word     5428
.word     8255
.word     9946
.word     9718
.word     8282
.word     7745
.word     10846
.word     17516
.word     24131
.word     26678
.word     24552
.word     19933
.word     16678
```

```
.word     16715
.word     18386
.word     19976
.word     21287
.word     23219
.word     24958
.word     25706
.word     24865
.word     22649
.word     23718
.word     26627
.word     26703
.word     25580
.word     11661
.word    -2095
.word     2079
.word    -677
.word    -657
.word    -2531
.word    -1019
.word    -3568
.word    -3234
.word    -1964
.word    -550
.word     192
.word     1165
.word     2171
.word     1498
.word    -2511
.word    -7925
.word    -10887
.word    -9214
.word    -3510
.word     2216
.word     4343
```

```
        .word     2802
        .word     336
        .word    -948
        .word    -334
        .word     1397
        .word     2036
        .word     1972
        .word     791
        .word    -1935
        .word    -2469
        .word     0    ;redundant 129th entry
;Series Table  3_3M.ASM
S3_3    .word     0
        .word     137
        .word    -524
        .word    -1851
        .word    -3031
        .word    -2765
        .word     468
        .word     6602
        .word     12700
        .word     15122
        .word     12809
        .word     7769
        .word     3453
        .word     2962
        .word     6960
        .word     12640
        .word     16020
        .word     15601
        .word     13165
        .word     11546
        .word     12118
        .word     13984
        .word     15633
```

```
.word     17362
.word     20589
.word     24629
.word     26703
.word     25751
.word     23537
.word     21744
.word     20740
.word     20908
.word     11072
.word     1391
.word     1478
.word     5451
.word     915
.word    -4094
.word    -5338
.word    -6163
.word     1315
.word     2821
.word     4057
.word     5166
.word     6446
.word     6387
.word     4093
.word     942
.word    -233
.word     2354
.word     7204
.word     10338
.word     8950
.word     3709
.word    -2285
.word    -5576
.word    -4156
.word     919
```

```
.word     6012
.word     8190
.word     7387
.word     5127
.word     2712
.word     959
.word     0
.word     137
.word    -524
.word    -1851
.word    -3031
.word    -2765
.word     468
.word     6602
.word     12700
.word     15122
.word     12809
.word     7768
.word     3453
.word     2962
.word     6960
.word     12640
.word     16020
.word     15601
.word     13165
.word     11546
.word     12118
.word     13984
.word     15633
.word     17362
.word     20589
.word     24629
.word     26703
.word     25751
.word     23537
```

```
.word     21744
.word     20740
.word     20908
.word     11072
.word     1391
.word     6589
.word     2896
.word    -1640
.word    -6649
.word    -4060
.word    -3608
.word     38
.word     2821
.word     4057
.word     5166
.word     6446
.word     6387
.word     4093
.word     942
.word    -233
.word     2354
.word     7204
.word     10338
.word     8950
.word     3709
.word    -2285
.word    -5576
.word    -4156
.word     919
.word     6012
.word     8190
.word     7387
.word     5127
.word     2712
.word     959
```

```
        .word     0   ;redundant 129th entry
;Series Table  4_3M.ASM
S4_3    .word     0
        .word     2384
        .word     3249
        .word     2923
        .word     2139
        .word     420
        .word     358
        .word     2621
        .word     5687
        .word     9639
        .word     13070
        .word     15379
        .word     15773
        .word     15882
        .word     17909
        .word     19152
        .word     20043
        .word     21410
        .word     23489
        .word     26610
        .word     25433
        .word     20376
        .word     16633
        .word     14413
        .word     14534
        .word     17829
        .word     22224
        .word     25273
        .word     26631
        .word     26703
        .word     25196
        .word     23046
        .word     10422
```

```
.word   -2057
.word   -4283
.word   -1106
.word   -3615
.word   -4888
.word   -2114
.word   -448
.word    6084
.word    4584
.word    1900
.word   -2351
.word   -7960
.word   -9730
.word   -7245
.word   -5839
.word   -5184
.word   -5039
.word   -4577
.word   -3364
.word   -4098
.word   -4575
.word   -3163
.word   -654
.word    2356
.word    4459
.word    5742
.word    4686
.word    1961
.word    160
.word   -1189
.word   -1353
.word    0
.word    2384
.word    3249
.word    2923
```

```
.word    2139
.word    420
.word    358
.word    2621
.word    5687
.word    9640
.word    13070
.word    15379
.word    15773
.word    15882
.word    17909
.word    19152
.word    20043
.word    21410
.word    23489
.word    26610
.word    25433
.word    20376
.word    16633
.word    14413
.word    14534
.word    17829
.word    22224
.word    25273
.word    26631
.word    26703
.word    25196
.word    23046
.word    10422
.word   -2057
.word    527
.word   -3511
.word   -6020
.word   -7293
.word   -912
```

```
        .word     1957
        .word     4881
        .word     4584
        .word     1900
        .word    -2351
        .word    -7960
        .word    -9730
        .word    -7245
        .word    -5839
        .word    -5184
        .word    -5039
        .word    -4577
        .word    -3364
        .word    -4098
        .word    -4575
        .word    -3163
        .word    -654
        .word     2356
        .word     4459
        .word     5742
        .word     4686
        .word     1961
        .word     160
        .word    -1189
        .word    -1353
        .word     0    ;redundant 129th entry
;Series Table  5_3M.ASM
S5_3    .word     0
        .word     893
        .word     1785
        .word     2867
        .word     4410
        .word     6471
        .word     8789
        .word     10930
```

```
.word    12456
.word    13030
.word    12564
.word    11384
.word    10170
.word    9568
.word    9856
.word    11003
.word    12957
.word    15702
.word    19025
.word    22387
.word    25111
.word    26658
.word    26703
.word    25199
.word    22616
.word    20047
.word    18693
.word    18959
.word    20137
.word    21098
.word    21271
.word    20839
.word    10010
.word   -680
.word   -1185
.word    3487
.word    1969
.word    620
.word    622
.word   -3353
.word   -2814
.word   -6953
.word   -8903
```

```
.word    -9346
.word    -8329
.word    -6176
.word    -3424
.word    -747
.word     1315
.word     2551
.word     2948
.word     2455
.word     1043
.word    -1008
.word    -3049
.word    -4400
.word    -4732
.word    -4131
.word    -2931
.word    -1567
.word    -473
.word     94
.word     193
.word     97
.word     0
.word     893
.word     1785
.word     2867
.word     4410
.word     6471
.word     8789
.word     10930
.word     12456
.word     13030
.word     12564
.word     11384
.word     10170
.word     9568
```

```
.word     9856
.word     11003
.word     12957
.word     15702
.word     19025
.word     22387
.word     25111
.word     26658
.word     26703
.word     25199
.word     22616
.word     20047
.word     18693
.word     18959
.word     20137
.word     21098
.word     21271
.word     20839
.word     10010
.word    -680
.word     3435
.word     1177
.word    -341
.word    -1690
.word     1777
.word    -1043
.word    -3968
.word    -6953
.word    -8903
.word    -9346
.word    -8329
.word    -6176
.word    -3424
.word    -747
.word     1315
```

```
        .word     2551
        .word     2948
        .word     2455
        .word     1043
        .word    -1008
        .word    -3049
        .word    -4400
        .word    -4732
        .word    -4131
        .word    -2931
        .word    -1567
        .word    -473
        .word     94
        .word     193
        .word     97
        .word     0    ;redundant 129th entry
;Series Table  6_3M.ASM
S6_3    .word     0
        .word    -385
        .word     107
        .word     1007
        .word     2390
        .word     4213
        .word     5477
        .word     5906
        .word     5779
        .word     5566
        .word     5982
        .word     6513
        .word     6407
        .word     6255
        .word     6541
        .word     7252
        .word     8160
        .word     8610
```

```
.word     8974
.word     9848
.word     10535
.word     11341
.word     13422
.word     16197
.word     18336
.word     19366
.word     20653
.word     23910
.word     26703
.word     26106
.word     24380
.word     22531
.word     9172
.word    -4058
.word    -5974
.word    -3578
.word    -6447
.word    -5969
.word    -2955
.word    -4069
.word    -190
.word     522
.word     2888
.word     4522
.word     4843
.word     5007
.word     5323
.word     5094
.word     4918
.word     5168
.word     5192
.word     4762
.word     3868
```

```
.word     2995
.word     2736
.word     2341
.word     1299
.word     324
.word    -108
.word     280
.word     1218
.word     1707
.word     1706
.word     1292
.word     0
.word    -385
.word     107
.word     1007
.word     2390
.word     4213
.word     5477
.word     5906
.word     5779
.word     5566
.word     5982
.word     6513
.word     6407
.word     6255
.word     6541
.word     7252
.word     8160
.word     8610
.word     8974
.word     9848
.word     10535
.word     11341
.word     13422
.word     16197
```

```
.word     18336
.word     19366
.word     20653
.word     23910
.word     26703
.word     26106
.word     24380
.word     22531
.word     9172
.word    -4058
.word    -1741
.word    -5695
.word    -8564
.word    -8086
.word    -1896
.word    -1952
.word    -1249
.word     522
.word     2888
.word     4522
.word     4843
.word     5007
.word     5323
.word     5094
.word     4918
.word     5168
.word     5192
.word     4762
.word     3868
.word     2995
.word     2736
.word     2341
.word     1299
.word     324
.word    -108
```

```
        .word     280
        .word     1218
        .word     1707
        .word     1706
        .word     1292
        .word     0    ;redundant 129th entry
;Series Table  7_3M.ASM
S7_3    .word     0
        .word    -78
        .word     242
        .word     1190
        .word     2735
        .word     4617
        .word     6472
        .word     7995
        .word     9062
        .word     9751
        .word     10273
        .word     10853
        .word     11621
        .word     12570
        .word     13602
        .word     14606
        .word     15545
        .word     16477
        .word     17526
        .word     18805
        .word     20339
        .word     22036
        .word     23713
        .word     25154
        .word     26182
        .word     26702
        .word     26703
        .word     26229
```

```
.word     25348
.word     24122
.word     22611
.word     20881
.word     9428
.word    -1893
.word    -3692
.word    -966
.word    -4527
.word    -7788
.word    -8511
.word    -10978
.word    -7531
.word    -7968
.word    -6947
.word    -5730
.word    -4531
.word    -3535
.word    -2831
.word    -2391
.word    -2102
.word    -1839
.word    -1542
.word    -1246
.word    -1059
.word    -1080
.word    -1312
.word    -1622
.word    -1787
.word    -1591
.word    -953
.word     2
.word     974
.word     1599
.word     1621
```

```
.word     1010
.word     0
.word    -78
.word     242
.word     1190
.word     2735
.word     4617
.word     6472
.word     7995
.word     9062
.word     9751
.word     10273
.word     10853
.word     11621
.word     12570
.word     13602
.word     14606
.word     15545
.word     16477
.word     17526
.word     18805
.word     20339
.word     22036
.word     23713
.word     25154
.word     26182
.word     26702
.word     26703
.word     26229
.word     25348
.word     24122
.word     22611
.word     20881
.word     9428
.word    -1893
```

```
        .word     659
        .word    -3142
        .word    -6702
        .word    -9964
        .word    -7423
        .word    -8803
        .word    -8618
        .word    -7968
        .word    -6947
        .word    -5730
        .word    -4531
        .word    -3535
        .word    -2831
        .word    -2391
        .word    -2102
        .word    -1839
        .word    -1542
        .word    -1246
        .word    -1059
        .word    -1080
        .word    -1312
        .word    -1622
        .word    -1787
        .word    -1591
        .word    -953
        .word     2
        .word     974
        .word     1599
        .word     1621
        .word     1010
        .word     0    ;redundant 129th entry
;Series Table  8_3M.ASM
S8_3    .word     0
        .word     5859
        .word     8296
```

```
.word    9718
.word    11986
.word    13596
.word    14559
.word    15747
.word    16641
.word    17480
.word    18704
.word    19934
.word    22157
.word    25441
.word    26703
.word    25493
.word    25061
.word    25489
.word    24994
.word    24986
.word    26071
.word    26137
.word    25510
.word    25499
.word    24318
.word    21570
.word    20448
.word    21801
.word    23118
.word    23530
.word    23997
.word    24443
.word    12067
.word   -140
.word    218
.word    6109
.word    3531
.word    1802
```

```
.word    2837
.word   -1445
.word   -446
.word   -3502
.word   -4051
.word   -5266
.word   -5840
.word   -5442
.word   -6185
.word   -7460
.word   -7855
.word   -9153
.word   -11267
.word   -10946
.word   -8640
.word   -7425
.word   -7234
.word   -7076
.word   -7329
.word   -7549
.word   -7496
.word   -7684
.word   -7239
.word   -6148
.word   -5912
.word   -4666
.word    0
.word    5859
.word    8296
.word    9718
.word    11986
.word    13596
.word    14559
.word    15747
.word    16641
```

```
.word     17480
.word     18704
.word     19934
.word     22157
.word     25441
.word     26703
.word     25493
.word     25061
.word     25489
.word     24994
.word     24986
.word     26071
.word     26137
.word     25510
.word     25499
.word     24318
.word     21570
.word     20448
.word     21801
.word     23118
.word     23530
.word     23997
.word     24443
.word     12067
.word    -140
.word     5787
.word     3324
.word     746
.word    -982
.word     4229
.word     1340
.word    -1838
.word    -3502
.word    -4051
.word    -5266
```

```
        .word    -5840
        .word    -5442
        .word    -6185
        .word    -7460
        .word    -7855
        .word    -9153
        .word    -11267
        .word    -10946
        .word    -8640
        .word    -7425
        .word    -7234
        .word    -7076
        .word    -7329
        .word    -7549
        .word    -7496
        .word    -7684
        .word    -7239
        .word    -6148
        .word    -5912
        .word    -4666
        .word     0   ;redundant 129th entry
;*********************************************************
S9_3    .space    2048          ;128 words 0 filled
        .word       0           ;129th entry
;*********************************************************
;_____________________________________________________________
_____
;4-op waveforms follow
;_____________________________________________________________
_____
;carrier wave select=4
;Series Table w43.asm
CAR_W4  .word     0
        .word    -1169
        .word    -2341
```

```
.word    -3514
.word    -4678
.word    -5818
.word    -6920
.word    -7980
.word    -9014
.word    -10060
.word    -11177
.word    -12438
.word    -13910
.word    -15638
.word    -17625
.word    -19823
.word    -22135
.word    -24420
.word    -26522
.word    -28290
.word    -29609
.word    -30415
.word    -30708
.word    -30547
.word    -30027
.word    -29265
.word    -28363
.word    -27396
.word    -26394
.word    -25344
.word    -24203
.word    -22917
.word    -21441
.word    -19759
.word    -17889
.word    -15884
.word    -13817
.word    -11761
```

```
.word    -9772
.word    -7869
.word    -6033
.word    -4208
.word    -2319
.word    -293
.word     1918
.word     4318
.word     6862
.word     9452
.word     11959
.word     14237
.word     16150
.word     17593
.word     18501
.word     18857
.word     18684
.word     18034
.word     16975
.word     15572
.word     13886
.word     11961
.word     9835
.word     7539
.word     5108
.word     2579
.word     0
.word    -2579
.word    -5108
.word    -7539
.word    -9835
.word    -11961
.word    -13886
.word    -15572
.word    -16975
```

```
.word    -18034
.word    -18684
.word    -18857
.word    -18501
.word    -17593
.word    -16150
.word    -14237
.word    -11959
.word    -9452
.word    -6862
.word    -4318
.word    -1918
.word     293
.word     2319
.word     4208
.word     6033
.word     7869
.word     9772
.word     11761
.word     13817
.word     15884
.word     17889
.word     19759
.word     21441
.word     22917
.word     24203
.word     25344
.word     26394
.word     27396
.word     28363
.word     29265
.word     30027
.word     30547
.word     30708
.word     30415
```

```
        .word     29609
        .word     28290
        .word     26522
        .word     24420
        .word     22135
        .word     19823
        .word     17625
        .word     15638
        .word     13910
        .word     12438
        .word     11177
        .word     10060
        .word     9014
        .word     7980
        .word     6920
        .word     5818
        .word     4678
        .word     3514
        .word     2341
        .word     1169
        .word     0    ;redundant 129th entry
;carrier wave select=5
;Series Table w53.asm
CAR_W5  .word     0
        .word     68
        .word     207
        .word     482
        .word     950
        .word     1656
        .word     2628
        .word     3882
        .word     5417
        .word     7217
        .word     9255
        .word     11487
```

```
.word    13858
.word    16299
.word    18727
.word    21047
.word    23158
.word    24950
.word    26322
.word    27182
.word    27460
.word    27121
.word    26166
.word    24641
.word    22631
.word    20260
.word    17675
.word    15032
.word    12483
.word    10156
.word    8145
.word    6501
.word    5235
.word    4318
.word    3699
.word    3318
.word    3121
.word    3080
.word    3198
.word    3514
.word    4096
.word    5029
.word    6395
.word    8251
.word    10610
.word    13425
.word    16582
```

```
.word    19902
.word    23158
.word    26096
.word    28467
.word    30055
.word    30708
.word    30357
.word    29026
.word    26829
.word    23952
.word    20628
.word    17105
.word    13608
.word    10312
.word    7320
.word    4652
.word    2251
.word    0
.word   -2251
.word   -4652
.word   -7320
.word   -10312
.word   -13608
.word   -17105
.word   -20628
.word   -23952
.word   -26829
.word   -29026
.word   -30357
.word   -30708
.word   -30055
.word   -28467
.word   -26096
.word   -23158
.word   -19902
```

```
.word   -16582
.word   -13425
.word   -10610
.word   -8251
.word   -6395
.word   -5029
.word   -4096
.word   -3514
.word   -3198
.word   -3080
.word   -3121
.word   -3318
.word   -3699
.word   -4318
.word   -5235
.word   -6501
.word   -8145
.word   -10156
.word   -12483
.word   -15032
.word   -17675
.word   -20260
.word   -22631
.word   -24641
.word   -26166
.word   -27121
.word   -27460
.word   -27182
.word   -26322
.word   -24950
.word   -23158
.word   -21047
.word   -18727
.word   -16299
.word   -13858
```

```
        .word    -11487
        .word    -9255
        .word    -7217
        .word    -5417
        .word    -3882
        .word    -2628
        .word    -1656
        .word    -950
        .word    -482
        .word    -207
        .word    -68
        .word     0    ;redundant 129th entry
;carrier wave select=6
CAR_W6  .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
        .word   32767
```

```
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
.word   32767
```

```
.word   32767
.word   32767
.word   32767
.word   32767
.word   32767
.word   32767
.word   32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
```

```
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
.word  -32767
```

```
        .word  -32767
        .word   32767 ;redundant 129th entry
;carrier wave select=7
CAR_W7  .word   32767
        .word   30056
        .word   27570
        .word   25289
        .word   23197
        .word   21278
        .word   19518
        .word   17903
        .word   16422
        .word   15064
        .word   13818
        .word   12675
        .word   11626
        .word   10664
        .word   9782
        .word   8973
        .word   8231
        .word   7550
        .word   6925
        .word   6352
        .word   5827
        .word   5345
        .word   4903
        .word   4497
        .word   4125
        .word   3784
        .word   3471
        .word   3184
        .word   2920
        .word   2679
        .word   2457
        .word   2254
```

```
.word   2067
.word   1896
.word   1740
.word   1596
.word   1464
.word   1343
.word   1232
.word   1130
.word   1036
.word   950
.word   872
.word   800
.word   734
.word   673
.word   617
.word   566
.word   519
.word   476
.word   437
.word   401
.word   368
.word   337
.word   309
.word   284
.word   260
.word   239
.word   219
.word   201
.word   184
.word   169
.word   155
.word   142
.word  -142
.word  -155
.word  -169
```

```
.word  -184
.word  -201
.word  -219
.word  -239
.word  -260
.word  -284
.word  -309
.word  -337
.word  -368
.word  -401
.word  -437
.word  -476
.word  -519
.word  -566
.word  -617
.word  -673
.word  -734
.word  -800
.word  -872
.word  -950
.word  -1036
.word  -1130
.word  -1232
.word  -1343
.word  -1464
.word  -1596
.word  -1740
.word  -1896
.word  -2067
.word  -2254
.word  -2457
.word  -2679
.word  -2920
.word  -3184
.word  -3471
```

```
        .word  -3784
        .word  -4125
        .word  -4497
        .word  -4903
        .word  -5345
        .word  -5827
        .word  -6352
        .word  -6925
        .word  -7550
        .word  -8231
        .word  -8973
        .word  -9782
        .word  -10664
        .word  -11626
        .word  -12675
        .word  -13818
        .word  -15064
        .word  -16422
        .word  -17903
        .word  -19518
        .word  -21278
        .word  -23197
        .word  -25289
        .word  -27570
        .word  -30056
        .word  -32767
        .word   32767 ;redundant 129th entry
;*********************************************************************
;4-OP MODULATOR SERIES WAVEFORMS FOLLOW
;Series Table w4_630.asm
S1_4    .word     0
        .word    -1956
        .word    -4862
        .word    -390
        .word     1517
```

```
.word     2599
.word     6455
.word     1882
.word     3044
.word     10117
.word     3285
.word    -1509
.word    -77
.word    -3602
.word     1871
.word     8306
.word     3784
.word     3145
.word    -687
.word    -13358
.word    -15657
.word    -6625
.word    -210
.word    -2721
.word    -3502
.word     8924
.word     15618
.word     7041
.word     607
.word    -6287
.word    -14546
.word    -11549
.word    -10794
.word    -20705
.word    -21428
.word    -11330
.word    -12289
.word    -25549
.word    -26970
.word    -16859
```

```
.word    -20942
.word    -30708
.word    -24787
.word    -19711
.word    -26292
.word    -26682
.word    -18347
.word    -13696
.word    -12331
.word    -9619
.word    -7200
.word    -1931
.word     5593
.word     3070
.word    -478
.word     9873
.word     13007
.word     7421
.word     18883
.word     24861
.word     8810
.word     2405
.word     2111
.word    -5195
.word     0
.word     5195
.word    -2111
.word    -2405
.word    -8810
.word    -24861
.word    -18883
.word    -7421
.word    -13007
.word    -9873
.word     478
```

```
.word    -3070
.word    -5593
.word     1931
.word     7200
.word     9619
.word     12331
.word     13696
.word     18347
.word     26682
.word     26292
.word     19711
.word     24787
.word     30708
.word     20942
.word     16859
.word     26970
.word     25549
.word     12289
.word     11330
.word     21428
.word     20705
.word     10794
.word     11549
.word     14546
.word     6287
.word    -607
.word    -7041
.word    -15618
.word    -8923
.word     3502
.word     2721
.word     210
.word     6625
.word     15657
.word     13358
```

```
        .word     687
        .word    -3145
        .word    -3784
        .word    -8306
        .word    -1871
        .word     3602
        .word     77
        .word     1509
        .word    -3285
        .word    -10117
        .word    -3044
        .word    -1882
        .word    -6455
        .word    -2599
        .word    -1517
        .word     390
        .word     4862
        .word     1956
        .word     0   ;redundant 129th entry
;Series Table w4_610.asm
S2_4    .word     0
        .word     4881
        .word     3371
        .word    -12614
        .word    -16513
        .word    -4168
        .word     4629
        .word     8277
        .word    -1272
        .word    -15325
        .word    -19290
        .word    -18544
        .word    -1246
        .word     15638
        .word     3293
```

```
.word     875
.word     16481
.word     4984
.word    -12755
.word     1672
.word     14525
.word    -7320
.word    -17501
.word     12322
.word     18712
.word    -5467
.word    -5743
.word    -9906
.word    -28154
.word    -18859
.word    -8983
.word    -11832
.word    -5179
.word    -13698
.word    -30708
.word    -23011
.word    -10907
.word    -10939
.word    -5181
.word     11521
.word     14963
.word    -414
.word    -3364
.word    -916
.word    -12788
.word    -14843
.word    -11996
.word    -13310
.word    -1345
.word    -5707
```

```
.word    -24634
.word    -7688
.word     15391
.word     8545
.word     1751
.word     6346
.word     12713
.word     6793
.word    -13699
.word    -8898
.word     16967
.word     15319
.word     5026
.word     8684
.word     0
.word    -8684
.word    -5026
.word    -15319
.word    -16967
.word     8898
.word     13699
.word    -6793
.word    -12713
.word    -6346
.word    -1751
.word    -8545
.word    -15391
.word     7688
.word     24634
.word     5707
.word     1345
.word     13310
.word     11996
.word     14843
.word     12788
```

```
.word     916
.word     3364
.word     414
.word    -14963
.word    -11521
.word     5181
.word     10939
.word     10907
.word     23011
.word     30708
.word     13698
.word     5179
.word     11832
.word     8983
.word     18859
.word     28154
.word     9906
.word     5743
.word     5467
.word    -18712
.word    -12322
.word     17501
.word     7320
.word    -14526
.word    -1672
.word     12755
.word    -4984
.word    -16481
.word    -875
.word    -3293
.word    -15638
.word     1246
.word     18544
.word     19290
.word     15325
```

```
        .word     1272
        .word    -8277
        .word    -4629
        .word     4168
        .word     16513
        .word     12614
        .word    -3371
        .word    -4881
        .word     0    ;redundant 129th entry
;Series Table w4_600.asm
S3_4    .word     0
        .word     9816
        .word     12296
        .word     9550
        .word     3531
        .word     4872
        .word     5262
        .word    -8110
        .word    -11218
        .word    -200
        .word     7881
        .word     13866
        .word     8608
        .word     5638
        .word     18577
        .word     6583
        .word    -18907
        .word    -10019
        .word    -795
        .word    -10659
        .word    -5659
        .word     1378
        .word    -3435
        .word     6269
        .word     24007
```

```
.word    19642
.word    3809
.word    812
.word   -1241
.word   -9889
.word   -3995
.word    10206
.word    11568
.word    11637
.word    17310
.word    14415
.word    6805
.word    8835
.word    11854
.word    4506
.word    1712
.word    6601
.word    981
.word   -7860
.word   -10659
.word   -13620
.word   -6972
.word    2748
.word   -3316
.word   -8712
.word   -3034
.word   -1313
.word   -6868
.word   -10905
.word   -3804
.word    4758
.word   -2244
.word   -6628
.word    6313
.word    11192
```

```
.word    -5136
.word    -12740
.word     12494
.word     30708
.word     0
.word    -30708
.word    -12493
.word     12740
.word     5136
.word    -11192
.word    -6313
.word     6628
.word     2244
.word    -4758
.word     3804
.word     10905
.word     6868
.word     1313
.word     3034
.word     8712
.word     3316
.word    -2748
.word     6972
.word     13620
.word     10659
.word     7860
.word    -982
.word    -6601
.word    -1712
.word    -4506
.word    -11854
.word    -8835
.word    -6805
.word    -14415
.word    -17310
```

```
        .word    -11637
        .word    -11568
        .word    -10206
        .word     3995
        .word     9889
        .word     1241
        .word    -812
        .word    -3809
        .word    -19642
        .word    -24007
        .word    -6269
        .word     3435
        .word    -1378
        .word     5659
        .word     10659
        .word     795
        .word     10019
        .word     18907
        .word    -6583
        .word    -18577
        .word    -5637
        .word    -8608
        .word    -13866
        .word    -7881
        .word     200
        .word     11218
        .word     8110
        .word    -5262
        .word    -4872
        .word    -3531
        .word    -9550
        .word    -12296
        .word    -9816
        .word     0   ;redundant 129th entry
;Series Table w4_580.asm
```

```
S4_4    .word    0
        .word    -12311
        .word    -13664
        .word    -7768
        .word    -4225
        .word    -3154
        .word    2374
        .word    8213
        .word    4663
        .word    -2157
        .word    -2665
        .word    -77
        .word    -1073
        .word    -4364
        .word    948
        .word    13654
        .word    16445
        .word    10556
        .word    8402
        .word    7824
        .word    7126
        .word    6994
        .word    4534
        .word    1640
        .word    611
        .word    1951
        .word    3909
        .word    5730
        .word    8946
        .word    1911
        .word    -12636
        .word    -6560
        .word    10246
        .word    10671
        .word    6062
```

```
.word    2312
.word   -1491
.word    8258
.word    15246
.word    2622
.word   -2126
.word    15292
.word    30708
.word    26232
.word    11492
.word    5668
.word    12156
.word    19139
.word    13875
.word   -2597
.word   -10383
.word   -4108
.word   -1181
.word   -2106
.word    3617
.word    7880
.word    156
.word   -6531
.word    7518
.word    26350
.word    19648
.word    765
.word   -2728
.word    1791
.word    0
.word   -1791
.word    2728
.word   -765
.word   -19648
.word   -26350
```

```
.word   -7518
.word    6531
.word   -156
.word   -7880
.word   -3617
.word    2106
.word    1181
.word    4108
.word    10383
.word    2597
.word   -13875
.word   -19139
.word   -12156
.word   -5668
.word   -11492
.word   -26232
.word   -30708
.word   -15292
.word    2126
.word   -2622
.word   -15246
.word   -8258
.word    1491
.word   -2312
.word   -6062
.word   -10671
.word   -10246
.word    6560
.word    12636
.word   -1911
.word   -8946
.word   -5730
.word   -3909
.word   -1951
.word   -611
```

```
        .word    -1640
        .word    -4534
        .word    -6994
        .word    -7126
        .word    -7824
        .word    -8402
        .word    -10556
        .word    -16445
        .word    -13654
        .word    -948
        .word     4364
        .word     1073
        .word     77
        .word     2665
        .word     2157
        .word    -4663
        .word    -8213
        .word    -2374
        .word     3154
        .word     4225
        .word     7768
        .word     13664
        .word     12311
        .word     0    ;redundant 129th entry
;Series Table w4_550.asm
S5_4    .word     0
        .word    -1525
        .word    -3483
        .word    -2149
        .word     1036
        .word    -3332
        .word    -10296
        .word    -8140
        .word    -4006
        .word    -3627
```

```
.word   -331
.word    6989
.word    13987
.word    12624
.word    2109
.word    12
.word    13686
.word    25450
.word    21094
.word    8949
.word    4091
.word    4325
.word    3453
.word    9654
.word    22750
.word    25290
.word    5946
.word   -22099
.word   -28620
.word   -8000
.word    14364
.word    21781
.word    10270
.word   -10353
.word   -14897
.word   -2104
.word    9358
.word    14010
.word    11859
.word    10985
.word    20931
.word    30708
.word    30046
.word    19961
.word    6073
```

```
.word    6355
.word    22543
.word    27778
.word    13404
.word   -3010
.word   -12380
.word   -18565
.word   -21788
.word   -18671
.word   -12964
.word   -8004
.word   -789
.word    5395
.word    6294
.word    3368
.word   -6306
.word   -18894
.word   -19785
.word   -9515
.word    0
.word    9516
.word    19785
.word    18894
.word    6306
.word   -3368
.word   -6294
.word   -5395
.word    789
.word    8004
.word    12964
.word    18671
.word    21788
.word    18565
.word    12380
.word    3010
```

```
.word   -13404
.word   -27778
.word   -22543
.word   -6355
.word   -6073
.word   -19961
.word   -30046
.word   -30708
.word   -20931
.word   -10985
.word   -11859
.word   -14010
.word   -9358
.word   2105
.word   14897
.word   10353
.word   -10270
.word   -21781
.word   -14364
.word   8000
.word   28620
.word   22099
.word   -5946
.word   -25290
.word   -22750
.word   -9654
.word   -3453
.word   -4325
.word   -4091
.word   -8950
.word   -21094
.word   -25450
.word   -13686
.word   -12
.word   -2109
```

```
        .word    -12624
        .word    -13987
        .word    -6989
        .word     331
        .word     3627
        .word     4006
        .word     8140
        .word     10296
        .word     3332
        .word    -1036
        .word     2149
        .word     3483
        .word     1525
        .word     0    ;redundant 129th entry
;Series Table w4_520.asm
S6_4    .word     0
        .word    -2180
        .word    -2095
        .word     1728
        .word     5212
        .word     9636
        .word     14449
        .word     12203
        .word     6289
        .word     394
        .word    -6825
        .word    -7372
        .word    -590
        .word     4713
        .word     9225
        .word     12191
        .word     8845
        .word     2704
        .word    -683
        .word     1392
```

```
.word    8420
.word    13787
.word    10264
.word   -644
.word   -7351
.word   -1830
.word    10113
.word    17871
.word    16627
.word    11302
.word    9335
.word    9385
.word    9755
.word    12149
.word    11952
.word    8751
.word    12109
.word    23281
.word    30708
.word    25591
.word    12497
.word    858
.word   -7554
.word   -12790
.word   -11035
.word   -1568
.word    10477
.word    18291
.word    19188
.word    14263
.word    5149
.word   -4348
.word   -12033
.word   -16079
.word   -11312
```

```
.word    -2725
.word    -552
.word    -1969
.word    -3300
.word    -5491
.word    -5151
.word    -3224
.word    -3328
.word    -2829
.word     0
.word     2829
.word     3328
.word     3224
.word     5151
.word     5491
.word     3300
.word     1969
.word     552
.word     2725
.word     11312
.word     16079
.word     12033
.word     4348
.word    -5149
.word    -14263
.word    -19188
.word    -18291
.word    -10477
.word     1568
.word     11035
.word     12790
.word     7554
.word    -858
.word    -12498
.word    -25591
```

```
.word    -30708
.word    -23281
.word    -12109
.word    -8751
.word    -11952
.word    -12148
.word    -9755
.word    -9385
.word    -9335
.word    -11302
.word    -16627
.word    -17871
.word    -10113
.word     1830
.word     7351
.word     644
.word    -10264
.word    -13787
.word    -8420
.word    -1392
.word     683
.word    -2704
.word    -8845
.word    -12191
.word    -9225
.word    -4713
.word     590
.word     7372
.word     6825
.word    -394
.word    -6289
.word    -12203
.word    -14449
.word    -9636
.word    -5212
```

```
        .word    -1728
        .word     2095
        .word     2180
        .word     0    ;redundant 129th entry
;Series Table w4_472.asm
S7_4    .word     0
        .word    -2076
        .word    -3486
        .word    -3721
        .word    -2551
        .word    -83
        .word     3259
        .word     6821
        .word     9863
        .word     11720
        .word     11945
        .word     10406
        .word     7305
        .word     3136
        .word    -1431
        .word    -5696
        .word    -9073
        .word    -11205
        .word    -12022
        .word    -11722
        .word    -10700
        .word    -9416
        .word    -8271
        .word    -7483
        .word    -7031
        .word    -6652
        .word    -5915
        .word    -4338
        .word    -1533
        .word     2663
```

```
.word     8101
.word     14306
.word     20531
.word     25884
.word     29500
.word     30708
.word     29184
.word     25025
.word     18757
.word     11250
.word     3571
.word    -3201
.word    -8168
.word    -10754
.word    -10801
.word    -8570
.word    -4673
.word     57
.word     4732
.word     8562
.word     10986
.word     11745
.word     10891
.word     8736
.word     5762
.word     2512
.word    -517
.word    -2945
.word    -4553
.word    -5280
.word    -5195
.word    -4447
.word    -3216
.word    -1680
.word     0
```

```
.word    1680
.word    3216
.word    4447
.word    5195
.word    5280
.word    4553
.word    2945
.word    517
.word   -2512
.word   -5762
.word   -8736
.word   -10891
.word   -11745
.word   -10986
.word   -8562
.word   -4732
.word   -57
.word    4673
.word    8570
.word    10801
.word    10754
.word    8168
.word    3201
.word   -3571
.word   -11250
.word   -18757
.word   -25025
.word   -29184
.word   -30708
.word   -29500
.word   -25884
.word   -20531
.word   -14306
.word   -8101
.word   -2663
```

```
        .word     1533
        .word     4338
        .word     5915
        .word     6652
        .word     7031
        .word     7483
        .word     8271
        .word     9416
        .word     10700
        .word     11722
        .word     12022
        .word     11205
        .word     9073
        .word     5696
        .word     1431
        .word    -3136
        .word    -7305
        .word    -10406
        .word    -11945
        .word    -11720
        .word    -9863
        .word    -6821
        .word    -3259
        .word     83
        .word     2551
        .word     3721
        .word     3486
        .word     2076
        .word     0   ;redundant 129th entry
;Series Table w4_393.asm
S8_4    .word     0
        .word     1504
        .word     2998
        .word     4472
        .word     5916
```

```
.word     7319
.word     8669
.word     9956
.word     11165
.word     12285
.word     13301
.word     14203
.word     14977
.word     15612
.word     16100
.word     16431
.word     16603
.word     16613
.word     16463
.word     16159
.word     15711
.word     15133
.word     14444
.word     13665
.word     12824
.word     11949
.word     11073
.word     10229
.word     9451
.word     8774
.word     8231
.word     7853
.word     7666
.word     7693
.word     7952
.word     8453
.word     9198
.word     10185
.word     11401
.word     12827
```

```
.word    14433
.word    16185
.word    18041
.word    19953
.word    21870
.word    23735
.word    25492
.word    27082
.word    28449
.word    29541
.word    30308
.word    30708
.word    30707
.word    30278
.word    29404
.word    28080
.word    26309
.word    24109
.word    21504
.word    18530
.word    15235
.word    11671
.word    7899
.word    3985
.word    0
.word   -3985
.word   -7899
.word   -11671
.word   -15235
.word   -18530
.word   -21504
.word   -24109
.word   -26309
.word   -28080
.word   -29404
```

```
.word    -30278
.word    -30707
.word    -30708
.word    -30308
.word    -29541
.word    -28449
.word    -27082
.word    -25492
.word    -23735
.word    -21870
.word    -19953
.word    -18041
.word    -16185
.word    -14433
.word    -12827
.word    -11401
.word    -10185
.word    -9198
.word    -8453
.word    -7952
.word    -7693
.word    -7666
.word    -7853
.word    -8231
.word    -8774
.word    -9451
.word    -10229
.word    -11073
.word    -11949
.word    -12824
.word    -13665
.word    -14444
.word    -15133
.word    -15711
.word    -16159
```

```
        .word    -16463
        .word    -16613
        .word    -16603
        .word    -16431
        .word    -16099
        .word    -15612
        .word    -14977
        .word    -14203
        .word    -13301
        .word    -12285
        .word    -11165
        .word    -9956
        .word    -8669
        .word    -7319
        .word    -5916
        .word    -4472
        .word    -2998
        .word    -1504
        .word     0    ;redundant 129th entry
;*************************************************************
S9_4    .space    2048          ;128 words 0 filled
        .word       0           ;129th entry
;*************************************************************

;Series Table w5_630.asm
S1_5    .word     0
        .word     402
        .word     7554
        .word     8811
        .word     4772
        .word     5314
        .word     2002
        .word    -918
        .word     4179
        .word    -2140
```

```
.word    -12616
.word    -7951
.word    -7865
.word    -12258
.word    -4582
.word    -564
.word    -6433
.word    -8673
.word     1518
.word     14694
.word     9499
.word     6176
.word     20496
.word     18023
.word     12338
.word     27539
.word     24350
.word     7989
.word     12060
.word     17465
.word     21008
.word     30708
.word     30078
.word     27132
.word     30179
.word     19802
.word    -858
.word    -6571
.word    -58
.word    -2960
.word    -7251
.word    -680
.word    -1771
.word    -10784
.word    -11895
```

```
.word    -10864
.word    -6449
.word    -1011
.word    -7817
.word    -10324
.word     2313
.word     10304
.word     8043
.word     5025
.word     6842
.word     12661
.word     17146
.word     19935
.word     20141
.word     17888
.word     15114
.word     7422
.word     1191
.word     2145
.word     0
.word    -2145
.word    -1191
.word    -7422
.word    -15114
.word    -17888
.word    -20141
.word    -19935
.word    -17146
.word    -12661
.word    -6842
.word    -5025
.word    -8043
.word    -10304
.word    -2313
.word     10324
```

```
.word     7817
.word     1011
.word     6449
.word     10864
.word     11895
.word     10783
.word     1771
.word     680
.word     7251
.word     2960
.word     58
.word     6571
.word     858
.word    -19802
.word    -30179
.word    -27132
.word    -30078
.word    -30708
.word    -21008
.word    -17465
.word    -12060
.word    -7989
.word    -24350
.word    -27539
.word    -12338
.word    -18023
.word    -20496
.word    -6176
.word    -9499
.word    -14694
.word    -1518
.word     8673
.word     6433
.word     564
.word     4582
```

```
        .word     12258
        .word     7865
        .word     7952
        .word     12616
        .word     2140
        .word    -4179
        .word     918
        .word    -2002
        .word    -5314
        .word    -4772
        .word    -8811
        .word    -7554
        .word    -402
        .word     0   ;redundant 129th entry
;Series Table w5_610.asm
S2_5    .word     0
        .word     424
        .word     1194
        .word    -881
        .word     114
        .word     923
        .word    -3549
        .word    -3674
        .word     499
        .word    -1595
        .word    -9239
        .word    -10495
        .word    -5286
        .word    -3017
        .word     3760
        .word     7104
        .word    -4681
        .word     763
        .word     16422
        .word     6304
```

```
.word     5542
.word     20716
.word     12510
.word     4232
.word     9488
.word     9073
.word     12575
.word     17623
.word     20943
.word     27866
.word     23801
.word     15543
.word     14076
.word     15012
.word     25141
.word     30708
.word     24830
.word     21886
.word     7817
.word    -5588
.word     4466
.word     4601
.word    -8229
.word    -5352
.word     68
.word     5337
.word     17773
.word     15271
.word    -223
.word     12
.word     7802
.word     430
.word    -635
.word     14944
.word     12554
```

```
.word     1534
.word     8472
.word     9278
.word     2249
.word     1287
.word    -4493
.word    -4407
.word     1199
.word    -1947
.word     0
.word     1947
.word    -1199
.word     4407
.word     4493
.word    -1287
.word    -2249
.word    -9278
.word    -8472
.word    -1534
.word    -12554
.word    -14944
.word     635
.word    -430
.word    -7802
.word    -12
.word     223
.word    -15271
.word    -17773
.word    -5336
.word    -68
.word     5352
.word     8229
.word    -4601
.word    -4466
.word     5588
```

```
.word    -7817
.word    -21886
.word    -24830
.word    -30708
.word    -25141
.word    -15012
.word    -14076
.word    -15543
.word    -23801
.word    -27866
.word    -20943
.word    -17623
.word    -12575
.word    -9073
.word    -9488
.word    -4232
.word    -12510
.word    -20716
.word    -5542
.word    -6304
.word    -16422
.word    -763
.word     4681
.word    -7104
.word    -3760
.word     3017
.word     5286
.word     10495
.word     9239
.word     1595
.word    -499
.word     3674
.word     3549
.word    -923
.word    -114
```

```
        .word     881
        .word    -1194
        .word    -424
        .word     0   ;redundant 129th entry
;Series Table w5_600.asm
S3_5    .word     0
        .word     17961
        .word     1471
        .word    -10774
        .word     165
        .word     3561
        .word    -5205
        .word    -11116
        .word    -11013
        .word    -8492
        .word    -12410
        .word    -12034
        .word     943
        .word     2703
        .word    -1687
        .word     1984
        .word    -8854
        .word    -22603
        .word    -18751
        .word    -15959
        .word    -4652
        .word     19029
        .word     20467
        .word     4158
        .word    -2393
        .word     4833
        .word     7172
        .word    -13853
        .word    -19537
        .word     11839
```

```
.word     16001
.word    -11374
.word    -5683
.word     17015
.word     13943
.word     2077
.word    -2242
.word    -6264
.word    -10948
.word    -17421
.word    -23051
.word    -9603
.word     8497
.word    -8890
.word    -30708
.word    -14830
.word    -4735
.word    -16242
.word    -13961
.word    -13475
.word    -19902
.word    -3121
.word     16915
.word     13320
.word     5049
.word     5820
.word     7371
.word     8364
.word     7620
.word    -6021
.word    -16262
.word    -2441
.word     2322
.word    -9751
.word     0
```

```
.word     9751
.word    -2322
.word     2441
.word     16262
.word     6021
.word    -7620
.word    -8364
.word    -7371
.word    -5820
.word    -5049
.word    -13320
.word    -16915
.word     3121
.word     19902
.word     13475
.word     13961
.word     16242
.word     4735
.word     14830
.word     30708
.word     8890
.word    -8497
.word     9604
.word     23051
.word     17421
.word     10948
.word     6264
.word     2242
.word    -2077
.word    -13943
.word    -17015
.word     5683
.word     11374
.word    -16001
.word    -11839
```

```
        .word     19537
        .word     13853
        .word    -7172
        .word    -4833
        .word     2393
        .word    -4158
        .word    -20467
        .word    -19029
        .word     4652
        .word     15959
        .word     18751
        .word     22603
        .word     8854
        .word    -1984
        .word     1687
        .word    -2703
        .word    -943
        .word     12034
        .word     12410
        .word     8492
        .word     11013
        .word     11116
        .word     5205
        .word    -3561
        .word    -165
        .word     10775
        .word    -1471
        .word    -17961
        .word     0    ;redundant 129th entry
;Series Table w5_580.asm
S4_5    .word     0
        .word    -9573
        .word    -4607
        .word     4588
        .word     4605
```

```
.word     3816
.word     5459
.word     2639
.word     468
.word     32
.word    -1683
.word    -2520
.word    -4128
.word     1182
.word     14715
.word     14974
.word    -2027
.word    -19228
.word    -21561
.word    -8891
.word    -10256
.word    -28365
.word    -22307
.word     671
.word    -2798
.word    -25753
.word    -30708
.word    -8766
.word     8725
.word     2426
.word    -56
.word     7254
.word    -1606
.word    -11767
.word    -4442
.word    -1602
.word    -9756
.word    -16652
.word    -23100
.word    -18482
```

```
.word     3048
.word     10451
.word    -6606
.word    -16589
.word    -12844
.word    -7247
.word     4689
.word     10373
.word    -3771
.word    -14425
.word    -5680
.word     7000
.word     7081
.word    -6569
.word    -17927
.word    -13682
.word    -3014
.word    -1177
.word    -3202
.word     7128
.word     16653
.word     6749
.word     2202
.word     9449
.word     0
.word    -9449
.word    -2202
.word    -6749
.word    -16653
.word    -7127
.word     3202
.word     1177
.word     3014
.word     13682
.word     17927
```

```
.word     6569
.word    -7081
.word    -6999
.word     5680
.word     14425
.word     3771
.word    -10373
.word    -4689
.word     7247
.word     12844
.word     16589
.word     6606
.word    -10451
.word    -3048
.word     18482
.word     23100
.word     16652
.word     9756
.word     1602
.word     4442
.word     11767
.word     1606
.word    -7254
.word     56
.word    -2426
.word    -8725
.word     8766
.word     30708
.word     25753
.word     2798
.word    -671
.word     22307
.word     28365
.word     10256
.word     8892
```

```
        .word     21561
        .word     19228
        .word     2027
        .word    -14974
        .word    -14715
        .word    -1182
        .word     4128
        .word     2520
        .word     1683
        .word    -32
        .word    -468
        .word    -2639
        .word    -5459
        .word    -3816
        .word    -4605
        .word    -4588
        .word     4607
        .word     9573
        .word     0   ;redundant 129th entry
;Series Table w5_550.asm
S5_5    .word     0
        .word    -300
        .word     5860
        .word     12095
        .word     14134
        .word     13081
        .word     8434
        .word     2768
        .word     1477
        .word     4120
        .word     4748
        .word     3432
        .word     5620
        .word     10178
        .word     12190
```

```
.word    5667
.word   -13117
.word   -29451
.word   -26292
.word   -11967
.word   -1135
.word    1473
.word   -8512
.word   -25739
.word   -30708
.word   -17212
.word   -3731
.word   -5021
.word   -14764
.word   -18830
.word   -7330
.word    10308
.word    11989
.word    4156
.word    4758
.word    3320
.word   -3198
.word   -1498
.word   -310
.word   -9454
.word   -18979
.word   -20730
.word   -15694
.word   -10113
.word   -5651
.word   -592
.word   -2514
.word   -11025
.word   -15682
.word   -16642
```

```
.word    -12616
.word    -1199
.word     9258
.word     14618
.word     11526
.word    -2865
.word    -13884
.word    -10458
.word    -1807
.word     493
.word    -6700
.word    -11168
.word     32
.word     10039
.word     0
.word    -10039
.word    -32
.word     11168
.word     6700
.word    -493
.word     1807
.word     10458
.word     13884
.word     2865
.word    -11526
.word    -14618
.word    -9258
.word     1199
.word     12616
.word     16642
.word     15682
.word     11025
.word     2514
.word     592
.word     5651
```

```
.word     10113
.word     15694
.word     20730
.word     18979
.word     9454
.word     310
.word     1498
.word     3198
.word    -3320
.word    -4758
.word    -4157
.word    -11989
.word    -10308
.word     7330
.word     18830
.word     14764
.word     5021
.word     3731
.word     17212
.word     30708
.word     25739
.word     8511
.word    -1473
.word     1135
.word     11968
.word     26292
.word     29451
.word     13117
.word    -5667
.word    -12190
.word    -10177
.word    -5620
.word    -3432
.word    -4748
.word    -4120
```

```
        .word    -1477
        .word    -2768
        .word    -8434
        .word    -13081
        .word    -14134
        .word    -12095
        .word    -5860
        .word     300
        .word     0    ;redundant 129th entry
;Series Table w5_520.asm
S6_5    .word     0
        .word     496
        .word    -998
        .word    -1024
        .word     1518
        .word     5778
        .word     11267
        .word     14471
        .word     13470
        .word     11627
        .word     10732
        .word     9477
        .word     12710
        .word     23447
        .word     27348
        .word     16128
        .word     3613
        .word    -3229
        .word    -6156
        .word    -2206
        .word     1597
        .word    -630
        .word     103
        .word     4699
        .word     5661
```

```
.word    3076
.word    486
.word    72
.word    988
.word    4017
.word    11609
.word    16365
.word    12210
.word    4302
.word   -4513
.word   -11148
.word   -10081
.word   -1624
.word    13148
.word    27770
.word    30708
.word    23458
.word    12515
.word    80
.word   -4764
.word    2840
.word    11805
.word    12279
.word    7055
.word    5810
.word    13883
.word    22793
.word    20410
.word    9939
.word    2525
.word   -1004
.word   -3635
.word   -3217
.word    99
.word    4004
```

```
.word     7742
.word     10144
.word     11257
.word     8869
.word     0
.word    -8869
.word    -11257
.word    -10144
.word    -7742
.word    -4004
.word    -99
.word     3217
.word     3635
.word     1004
.word    -2525
.word    -9939
.word    -20410
.word    -22792
.word    -13883
.word    -5810
.word    -7055
.word    -12279
.word    -11805
.word    -2840
.word     4764
.word    -80
.word    -12515
.word    -23458
.word    -30708
.word    -27770
.word    -13148
.word     1624
.word     10081
.word     11148
.word     4513
```

```
        .word    -4302
        .word    -12210
        .word    -16365
        .word    -11609
        .word    -4017
        .word    -988
        .word    -72
        .word    -486
        .word    -3076
        .word    -5661
        .word    -4699
        .word    -103
        .word     630
        .word    -1597
        .word     2206
        .word     6156
        .word     3229
        .word    -3613
        .word    -16128
        .word    -27348
        .word    -23447
        .word    -12710
        .word    -9477
        .word    -10732
        .word    -11627
        .word    -13470
        .word    -14471
        .word    -11267
        .word    -5778
        .word    -1518
        .word     1024
        .word     998
        .word    -496
        .word     0    ;redundant 129th entry
;Series Table w5_471.asm
```

```
S7_5    .word    0
        .word    9166
        .word    17187
        .word    23082
        .word    26173
        .word    26178
        .word    23249
        .word    17941
        .word    11126
        .word    3857
        .word   -2785
        .word   -7853
        .word   -10668
        .word   -10908
        .word   -8641
        .word   -4301
        .word    1396
        .word    7577
        .word    13352
        .word    17957
        .word    20864
        .word    21854
        .word    21031
        .word    18783
        .word    15699
        .word    12455
        .word    9688
        .word    7885
        .word    7307
        .word    7949
        .word    9556
        .word    11680
        .word    13769
        .word    15270
        .word    15733
```

```
.word    14884
.word    12669
.word    9257
.word    5002
.word    377
.word   -4105
.word   -7972
.word   -10858
.word   -12544
.word   -12959
.word   -12169
.word   -10335
.word   -7660
.word   -4349
.word   -578
.word    3521
.word    7846
.word    12301
.word    16763
.word    21054
.word    24923
.word    28055
.word    30097
.word    30708
.word    29620
.word    26691
.word    21953
.word    15630
.word    8129
.word    0
.word   -8129
.word   -15630
.word   -21953
.word   -26691
.word   -29620
```

```
.word   -30708
.word   -30097
.word   -28055
.word   -24923
.word   -21054
.word   -16763
.word   -12301
.word   -7846
.word   -3521
.word    578
.word    4349
.word    7660
.word    10335
.word    12169
.word    12959
.word    12544
.word    10858
.word    7972
.word    4105
.word   -377
.word   -5002
.word   -9257
.word   -12669
.word   -14884
.word   -15733
.word   -15270
.word   -13769
.word   -11680
.word   -9556
.word   -7949
.word   -7307
.word   -7885
.word   -9688
.word   -12455
.word   -15699
```

```
        .word    -18783
        .word    -21031
        .word    -21854
        .word    -20864
        .word    -17957
        .word    -13352
        .word    -7577
        .word    -1396
        .word     4301
        .word     8641
        .word     10908
        .word     10668
        .word     7853
        .word     2785
        .word    -3857
        .word    -11126
        .word    -17941
        .word    -23249
        .word    -26178
        .word    -26173
        .word    -23082
        .word    -17187
        .word    -9166
        .word     0    ;redundant 129th entry
;Series Table w5_391.asm
S8_5    .word     0
        .word     2906
        .word     5715
        .word     8331
        .word     10665
        .word     12636
        .word     14173
        .word     15215
        .word     15720
        .word     15656
```

```
.word    15012
.word    13791
.word    12016
.word    9725
.word    6973
.word    3828
.word    373
.word   -3301
.word   -7094
.word   -10903
.word   -14621
.word   -18145
.word   -21380
.word   -24235
.word   -26635
.word   -28518
.word   -29838
.word   -30571
.word   -30708
.word   -30264
.word   -29271
.word   -27780
.word   -25858
.word   -23585
.word   -21054
.word   -18363
.word   -15612
.word   -12903
.word   -10332
.word   -7984
.word   -5936
.word   -4245
.word   -2954
.word   -2086
.word   -1645
```

```
.word   -1613
.word   -1956
.word   -2622
.word   -3546
.word   -4651
.word   -5852
.word   -7064
.word   -8200
.word   -9180
.word   -9930
.word   -10392
.word   -10521
.word   -10290
.word   -9688
.word   -8726
.word   -7430
.word   -5846
.word   -4032
.word   -2057
.word    0
.word    2057
.word    4032
.word    5846
.word    7430
.word    8726
.word    9688
.word    10290
.word    10521
.word    10392
.word    9930
.word    9180
.word    8200
.word    7064
.word    5852
.word    4651
```

```
.word    3546
.word    2622
.word    1956
.word    1613
.word    1645
.word    2086
.word    2954
.word    4245
.word    5936
.word    7984
.word    10332
.word    12903
.word    15612
.word    18363
.word    21054
.word    23585
.word    25858
.word    27780
.word    29271
.word    30264
.word    30708
.word    30571
.word    29838
.word    28518
.word    26635
.word    24235
.word    21380
.word    18145
.word    14621
.word    10903
.word    7094
.word    3301
.word   -373
.word   -3828
.word   -6973
```

```
        .word    -9725
        .word    -12016
        .word    -13791
        .word    -15012
        .word    -15656
        .word    -15720
        .word    -15215
        .word    -14173
        .word    -12636
        .word    -10665
        .word    -8331
        .word    -5715
        .word    -2906
        .word     0    ;redundant 129th entry
;*************************************************************
S9_5    .space    2048          ;128 words 0 filled
        .word       0           ;129th entry
;*************************************************************

;Series Table w6_630.asm
S1_6    .word     0
        .word    -1009
        .word     1149
        .word     7716
        .word     7764
        .word     4299
        .word     5583
        .word     4270
        .word     5106
        .word     12210
        .word     11317
        .word     3333
        .word    -972
        .word    -3009
        .word    -2828
```

```
.word    2390
.word    8297
.word    9840
.word    10933
.word    14364
.word    15605
.word    17422
.word    18437
.word    11345
.word    11039
.word    23788
.word    28493
.word    25651
.word    28283
.word    30708
.word    27889
.word    20843
.word    15353
.word    16919
.word    17327
.word    13153
.word    9359
.word    6004
.word    5724
.word    6241
.word    4311
.word    5691
.word    5601
.word    1274
.word    1846
.word    2923
.word    1332
.word    2182
.word   -432
.word   -5169
```

```
.word   -5571
.word   -7897
.word   -9678
.word   -3043
.word    4056
.word    4328
.word    2706
.word    3367
.word    4160
.word    3730
.word    3764
.word    3071
.word    379
.word   -1166
.word    0
.word    1166
.word   -379
.word   -3071
.word   -3764
.word   -3730
.word   -4160
.word   -3367
.word   -2706
.word   -4328
.word   -4056
.word    3043
.word    9678
.word    7897
.word    5571
.word    5169
.word    432
.word   -2182
.word   -1332
.word   -2923
.word   -1846
```

```
.word    -1274
.word    -5601
.word    -5691
.word    -4311
.word    -6241
.word    -5724
.word    -6004
.word    -9359
.word    -13153
.word    -17327
.word    -16918
.word    -15353
.word    -20843
.word    -27889
.word    -30708
.word    -28283
.word    -25651
.word    -28493
.word    -23788
.word    -11039
.word    -11345
.word    -18437
.word    -17422
.word    -15605
.word    -14364
.word    -10933
.word    -9840
.word    -8297
.word    -2390
.word     2828
.word     3009
.word     972
.word    -3333
.word    -11317
.word    -12210
```

```
        .word    -5106
        .word    -4270
        .word    -5583
        .word    -4299
        .word    -7764
        .word    -7716
        .word    -1149
        .word     1009
        .word     0   ;redundant 129th entry
;Series Table w6_610.asm
S2_6    .word     0
        .word     1021
        .word    -4455
        .word    -2918
        .word    -3841
        .word    -12089
        .word    -9699
        .word     262
        .word     2822
        .word    -1356
        .word    -2457
        .word    -1575
        .word    -7799
        .word    -13894
        .word    -15743
        .word    -17462
        .word    -11461
        .word    -7871
        .word    -14459
        .word    -10874
        .word    -3848
        .word    -9720
        .word    -17314
        .word    -19556
        .word    -11130
```

```
.word    2849
.word    6944
.word    11092
.word    15411
.word    9437
.word    9821
.word    18079
.word    20930
.word    17791
.word    7503
.word    3007
.word    7922
.word    3854
.word   -2903
.word   -8303
.word   -22189
.word   -30708
.word   -26703
.word   -17415
.word   -8838
.word   -12162
.word   -16641
.word   -10201
.word   -9451
.word   -15700
.word   -18036
.word   -17920
.word   -12072
.word   -3838
.word   -3660
.word   -4877
.word    767
.word    2062
.word   -7172
.word   -8153
```

```
.word    -1201
.word    -7464
.word    -10282
.word     537
.word     0
.word    -537
.word     10282
.word     7464
.word     1201
.word     8153
.word     7172
.word    -2062
.word    -767
.word     4877
.word     3660
.word     3838
.word     12072
.word     17920
.word     18036
.word     15700
.word     9451
.word     10201
.word     16641
.word     12162
.word     8838
.word     17416
.word     26703
.word     30708
.word     22189
.word     8303
.word     2903
.word    -3854
.word    -7922
.word    -3007
.word    -7504
```

```
        .word    -17791
        .word    -20930
        .word    -18079
        .word    -9821
        .word    -9437
        .word    -15411
        .word    -11092
        .word    -6944
        .word    -2849
        .word     11130
        .word     19556
        .word     17314
        .word     9720
        .word     3848
        .word     10874
        .word     14459
        .word     7871
        .word     11461
        .word     17462
        .word     15743
        .word     13894
        .word     7799
        .word     1575
        .word     2457
        .word     1356
        .word    -2822
        .word    -262
        .word     9699
        .word     12089
        .word     3841
        .word     2918
        .word     4455
        .word    -1021
        .word     0    ;redundant 129th entry
;Series Table w6_600.asm
```

```
S3_6    .word    0
        .word    5020
        .word    1954
        .word    5576
        .word    7705
        .word    2744
        .word   -398
        .word   -4889
        .word   -5856
        .word   -1341
        .word    3477
        .word    9281
        .word    3934
        .word   -7251
        .word   -5068
        .word   -3483
        .word   -5688
        .word    1646
        .word    5100
        .word    1641
        .word    5648
        .word    12222
        .word    7550
        .word   -7663
        .word   -16426
        .word   -14663
        .word   -14795
        .word   -17415
        .word   -21929
        .word   -24238
        .word   -18222
        .word   -21333
        .word   -30708
        .word   -23788
        .word   -18769
```

```
.word    -26072
.word    -23484
.word    -14081
.word    -10232
.word    -7843
.word    -3904
.word     4756
.word     17974
.word     24313
.word     16722
.word     9450
.word     12887
.word     10466
.word     1753
.word     2008
.word     1152
.word     153
.word     8803
.word     10505
.word     3762
.word    -1252
.word    -7325
.word    -7329
.word    -793
.word     5553
.word     10509
.word     4371
.word    -3843
.word    -918
.word     0
.word     918
.word     3843
.word    -4371
.word    -10509
.word    -5553
```

```
.word    793
.word    7329
.word    7325
.word    1252
.word   -3762
.word   -10505
.word   -8803
.word   -153
.word   -1152
.word   -2008
.word   -1753
.word   -10466
.word   -12887
.word   -9450
.word   -16722
.word   -24313
.word   -17974
.word   -4756
.word    3904
.word    7843
.word    10232
.word    14082
.word    23484
.word    26072
.word    18769
.word    23788
.word    30708
.word    21333
.word    18222
.word    24238
.word    21929
.word    17415
.word    14795
.word    14663
.word    16426
```

```
        .word     7663
        .word    -7550
        .word    -12222
        .word    -5648
        .word    -1641
        .word    -5100
        .word    -1646
        .word     5688
        .word     3483
        .word     5068
        .word     7251
        .word    -3934
        .word    -9281
        .word    -3477
        .word     1341
        .word     5856
        .word     4889
        .word     398
        .word    -2744
        .word    -7705
        .word    -5576
        .word    -1954
        .word    -5020
        .word     0    ;redundant 129th entry
;Series Table w6_580.asm
S4_6    .word     0
        .word     2425
        .word    -4225
        .word    -2955
        .word     3562
        .word     1330
        .word    -7175
        .word    -14135
        .word    -12255
        .word    -3930
```

```
.word     322
.word    -6106
.word    -14689
.word    -7943
.word    -241
.word    -7092
.word    -5107
.word     790
.word    -7670
.word    -8710
.word    -4469
.word    -10681
.word    -11661
.word    -7950
.word    -7110
.word    -256
.word     11958
.word     23975
.word     29432
.word     27789
.word     24897
.word     18220
.word     16786
.word     24996
.word     27928
.word     29750
.word     30708
.word     21461
.word     13713
.word     6022
.word    -4299
.word    -6689
.word    -9783
.word    -9080
.word    -1494
```

```
.word    -6603
.word    -7024
.word     5234
.word     2129
.word    -2340
.word     4154
.word     463
.word    -4880
.word     2484
.word     11803
.word     11251
.word     1475
.word    -2344
.word     4050
.word     9137
.word     6629
.word    -2990
.word    -5647
.word     1318
.word     0
.word    -1318
.word     5647
.word     2990
.word    -6629
.word    -9137
.word    -4049
.word     2344
.word    -1475
.word    -11251
.word    -11803
.word    -2484
.word     4880
.word    -463
.word    -4154
.word     2340
```

```
.word   -2130
.word   -5234
.word    7024
.word    6603
.word    1494
.word    9080
.word    9783
.word    6689
.word    4299
.word   -6022
.word   -13713
.word   -21461
.word   -30708
.word   -29750
.word   -27928
.word   -24996
.word   -16786
.word   -18220
.word   -24897
.word   -27789
.word   -29432
.word   -23975
.word   -11958
.word    256
.word    7110
.word    7950
.word    11661
.word    10681
.word    4469
.word    8710
.word    7670
.word   -790
.word    5107
.word    7092
.word    241
```

```
        .word     7943
        .word     14689
        .word     6106
        .word    -322
        .word     3930
        .word     12255
        .word     14135
        .word     7175
        .word    -1330
        .word    -3562
        .word     2955
        .word     4225
        .word    -2425
        .word     0    ;redundant 129th entry
;Series Table w6_550.asm
S5_6    .word     0
        .word     1297
        .word     4696
        .word     229
        .word    -3911
        .word    -2507
        .word    -2229
        .word     975
        .word     3735
        .word     1604
        .word     1719
        .word     898
        .word    -2713
        .word    -3683
        .word    -5280
        .word    -6296
        .word    -2779
        .word     1159
        .word     2965
        .word     1219
```

```
.word    -1387
.word     823
.word     2650
.word    -809
.word    -4450
.word    -5879
.word    -7896
.word    -11318
.word    -13331
.word    -14073
.word    -15868
.word    -16700
.word    -18630
.word    -22619
.word    -21496
.word    -21336
.word    -29172
.word    -30708
.word    -23347
.word    -22143
.word    -24716
.word    -20443
.word    -12971
.word    -9148
.word    -8114
.word    -8305
.word    -10397
.word    -11690
.word    -10806
.word    -9877
.word    -7859
.word    -6411
.word    -8052
.word    -8676
.word    -8715
```

```
.word    -9802
.word    -7166
.word    -3345
.word    -3434
.word    -3796
.word    -1324
.word     3385
.word     7361
.word     6108
.word     0
.word    -6108
.word    -7361
.word    -3385
.word     1324
.word     3796
.word     3434
.word     3345
.word     7166
.word     9802
.word     8715
.word     8676
.word     8052
.word     6411
.word     7859
.word     9877
.word     10806
.word     11690
.word     10397
.word     8305
.word     8114
.word     9148
.word     12971
.word     20443
.word     24716
.word     22143
```

```
.word     23347
.word     30708
.word     29172
.word     21336
.word     21496
.word     22619
.word     18630
.word     16700
.word     15868
.word     14073
.word     13331
.word     11318
.word     7896
.word     5879
.word     4450
.word     809
.word    -2650
.word    -823
.word     1387
.word    -1219
.word    -2965
.word    -1159
.word     2779
.word     6296
.word     5280
.word     3683
.word     2713
.word    -898
.word    -1719
.word    -1604
.word    -3735
.word    -975
.word     2229
.word     2507
.word     3911
```

```
        .word    -229
        .word    -4696
        .word    -1297
        .word     0    ;redundant 129th entry
;Series Table w6_520.asm
S6_6    .word     0
        .word    -1962
        .word     584
        .word     1046
        .word     1641
        .word     1254
        .word     340
        .word     5877
        .word     9284
        .word     9137
        .word     11373
        .word     6752
        .word    -186
        .word     211
        .word    -94
        .word     281
        .word     6931
        .word     11726
        .word     8507
        .word     3472
        .word     4722
        .word     7138
        .word     5764
        .word     2103
        .word    -7596
        .word    -12312
        .word    -6102
        .word    -11069
        .word    -22443
        .word    -22942
```

```
.word    -25562
.word    -30708
.word    -30568
.word    -28616
.word    -21029
.word    -16412
.word    -17284
.word    -8571
.word    -3739
.word    -10957
.word    -11599
.word    -7248
.word    -2638
.word     2966
.word     162
.word    -3372
.word     2518
.word     5520
.word    -2092
.word    -10908
.word    -11782
.word    -11120
.word    -11555
.word    -1889
.word     6041
.word    -1349
.word    -5226
.word    -2745
.word    -6447
.word    -6433
.word    -1509
.word    -2997
.word    -5276
.word    -2686
.word     0
```

```
.word     2686
.word     5276
.word     2997
.word     1509
.word     6433
.word     6447
.word     2745
.word     5226
.word     1349
.word    -6041
.word     1889
.word     11555
.word     11120
.word     11782
.word     10908
.word     2092
.word    -5520
.word    -2518
.word     3372
.word    -162
.word    -2966
.word     2638
.word     7248
.word     11599
.word     10957
.word     3739
.word     8571
.word     17284
.word     16412
.word     21029
.word     28616
.word     30568
.word     30708
.word     25562
.word     22942
```

```
        .word     22443
        .word     11069
        .word     6102
        .word     12312
        .word     7596
        .word    -2103
        .word    -5764
        .word    -7138
        .word    -4722
        .word    -3472
        .word    -8507
        .word    -11726
        .word    -6931
        .word    -281
        .word     94
        .word    -211
        .word     186
        .word    -6752
        .word    -11373
        .word    -9137
        .word    -9284
        .word    -5877
        .word    -340
        .word    -1254
        .word    -1641
        .word    -1046
        .word    -584
        .word     1962
        .word     0   ;redundant 129th entry
;Series Table w6_471.asm
S7_6    .word     0
        .word     657
        .word     1313
        .word     1952
        .word     2535
```

```
.word     2991
.word     3227
.word     3140
.word     2628
.word     1623
.word     96
.word    -1918
.word    -4327
.word    -6979
.word    -9686
.word    -12247
.word    -14468
.word    -16200
.word    -17345
.word    -17880
.word    -17845
.word    -17337
.word    -16493
.word    -15461
.word    -14376
.word    -13348
.word    -12446
.word    -11697
.word    -11101
.word    -10637
.word    -10293
.word    -10073
.word    -10010
.word    -10172
.word    -10646
.word    -11521
.word    -12868
.word    -14713
.word    -17015
.word    -19661
```

```
.word    -22468
.word    -25200
.word    -27598
.word    -29424
.word    -30492
.word    -30708
.word    -30090
.word    -28768
.word    -26972
.word    -24999
.word    -23160
.word    -21733
.word    -20910
.word    -20761
.word    -21213
.word    -22057
.word    -22973
.word    -23578
.word    -23490
.word    -22385
.word    -20059
.word    -16461
.word    -11712
.word    -6090
.word     0
.word     6090
.word     11712
.word     16461
.word     20059
.word     22385
.word     23490
.word     23578
.word     22973
.word     22057
.word     21213
```

```
.word     20761
.word     20910
.word     21733
.word     23160
.word     24999
.word     26972
.word     28768
.word     30090
.word     30708
.word     30492
.word     29424
.word     27598
.word     25200
.word     22468
.word     19661
.word     17015
.word     14713
.word     12868
.word     11521
.word     10646
.word     10172
.word     10010
.word     10073
.word     10293
.word     10637
.word     11101
.word     11697
.word     12446
.word     13348
.word     14376
.word     15461
.word     16493
.word     17337
.word     17845
.word     17880
```

```
        .word     17345
        .word     16200
        .word     14468
        .word     12247
        .word     9686
        .word     6979
        .word     4327
        .word     1918
        .word    -96
        .word    -1623
        .word    -2628
        .word    -3140
        .word    -3227
        .word    -2991
        .word    -2535
        .word    -1952
        .word    -1313
        .word    -657
        .word     0   ;redundant 129th entry
;Series Table w6_391.asm
S8_6    .word     0
        .word    -4475
        .word    -8744
        .word    -12609
        .word    -15894
        .word    -18446
        .word    -20151
        .word    -20929
        .word    -20745
        .word    -19606
        .word    -17560
        .word    -14696
        .word    -11132
        .word    -7017
        .word    -2514
```

```
.word     2200
.word     6949
.word     11563
.word     15890
.word     19796
.word     23177
.word     25957
.word     28096
.word     29582
.word     30438
.word     30708
.word     30463
.word     29787
.word     28772
.word     27515
.word     26107
.word     24631
.word     23152
.word     21720
.word     20363
.word     19087
.word     17880
.word     16712
.word     15538
.word     14306
.word     12960
.word     11447
.word     9722
.word     7751
.word     5520
.word     3036
.word     325
.word    -2561
.word    -5550
.word    -8554
```

```
.word    -11467
.word    -14178
.word    -16571
.word    -18536
.word    -19971
.word    -20795
.word    -20944
.word    -20385
.word    -19113
.word    -17155
.word    -14568
.word    -11438
.word    -7876
.word    -4015
.word     0
.word     4015
.word     7876
.word     11438
.word     14568
.word     17155
.word     19113
.word     20385
.word     20944
.word     20795
.word     19971
.word     18536
.word     16571
.word     14178
.word     11467
.word     8554
.word     5550
.word     2561
.word    -325
.word    -3036
.word    -5520
```

```
.word    -7751
.word    -9722
.word    -11447
.word    -12960
.word    -14306
.word    -15538
.word    -16712
.word    -17880
.word    -19087
.word    -20363
.word    -21720
.word    -23152
.word    -24631
.word    -26107
.word    -27515
.word    -28772
.word    -29787
.word    -30463
.word    -30708
.word    -30438
.word    -29582
.word    -28096
.word    -25957
.word    -23177
.word    -19796
.word    -15890
.word    -11563
.word    -6949
.word    -2200
.word     2514
.word     7017
.word     11132
.word     14696
.word     17560
.word     19606
```

```
        .word     20745
        .word     20929
        .word     20151
        .word     18446
        .word     15894
        .word     12609
        .word     8744
        .word     4475
        .word     0    ;redundant 129th entry
;*************************************************************
S9_6    .space    2048          ;128 words 0 filled
        .word       0           ;129th entry
;*************************************************************

;Series Table w7_630.asm
S1_7    .word     0
        .word     5330
        .word     11002
        .word     9169
        .word     4217
        .word     4661
        .word     4353
        .word     1605
        .word     2845
        .word     4908
        .word     5313
        .word     6039
        .word     3570
        .word    -1712
        .word    -5406
        .word    -7545
        .word    -8045
        .word    -8230
        .word    -10566
        .word    -12406
```

```
.word    -10398
.word    -5084
.word     30
.word     1782
.word    -887
.word    -6184
.word    -5781
.word     1199
.word     1316
.word    -7172
.word    -16894
.word    -27372
.word    -30708
.word    -23995
.word    -19318
.word    -15817
.word    -7522
.word    -204
.word     3930
.word     6235
.word     6344
.word     4702
.word     3246
.word     7507
.word     15665
.word     22260
.word     29669
.word     29789
.word     15669
.word     3115
.word    -1357
.word    -6033
.word    -9056
.word    -8206
.word    -5534
```

```
.word   -2438
.word   -3039
.word   -5800
.word   -5177
.word   -3445
.word   -6160
.word   -9743
.word   -4427
.word    3308
.word    0
.word   -3308
.word    4427
.word    9743
.word    6160
.word    3445
.word    5177
.word    5800
.word    3039
.word    2438
.word    5534
.word    8206
.word    9056
.word    6033
.word    1357
.word   -3115
.word   -15669
.word   -29789
.word   -29669
.word   -22260
.word   -15665
.word   -7507
.word   -3246
.word   -4702
.word   -6344
.word   -6235
```

```
.word   -3930
.word    204
.word    7522
.word    15817
.word    19318
.word    23995
.word    30708
.word    27372
.word    16894
.word    7172
.word   -1316
.word   -1199
.word    5781
.word    6184
.word    887
.word   -1782
.word   -30
.word    5084
.word    10398
.word    12406
.word    10566
.word    8230
.word    8045
.word    7545
.word    5406
.word    1712
.word   -3570
.word   -6039
.word   -5313
.word   -4908
.word   -2845
.word   -1605
.word   -4353
.word   -4661
.word   -4217
```

```
        .word    -9169
        .word    -11002
        .word    -5330
        .word     0    ;redundant 129th entry
;Series Table w7_610.asm
S2_7    .word     0
        .word    -6091
        .word     8242
        .word     7412
        .word    -2246
        .word     4623
        .word     4699
        .word    -3514
        .word     328
        .word    -7580
        .word    -29369
        .word    -18066
        .word     8811
        .word     8194
        .word     15104
        .word     30708
        .word     13838
        .word    -4154
        .word    -9749
        .word    -17073
        .word    -3334
        .word     4794
        .word     115
        .word     22047
        .word     23926
        .word    -757
        .word     7454
        .word     7263
        .word    -21571
        .word    -25122
```

```
.word   -7422
.word    5626
.word    3898
.word   -5943
.word   -6395
.word   -12043
.word   -17572
.word   -16428
.word   -27448
.word   -15675
.word    9642
.word   -6444
.word   -11664
.word    14539
.word    8723
.word   -10833
.word   -3876
.word    10704
.word    7425
.word   -6679
.word   -2406
.word    3939
.word   -431
.word    10436
.word    9080
.word   -4803
.word    6313
.word    952
.word   -17907
.word   -1949
.word    12610
.word    10845
.word    12516
.word    7025
.word    0
```

```
.word    -7025
.word    -12516
.word    -10845
.word    -12609
.word     1949
.word     17907
.word    -952
.word    -6313
.word     4803
.word    -9080
.word    -10436
.word     431
.word    -3939
.word     2406
.word     6679
.word    -7425
.word    -10704
.word     3876
.word     10833
.word    -8723
.word    -14539
.word     11664
.word     6444
.word    -9642
.word     15675
.word     27448
.word     16428
.word     17572
.word     12043
.word     6395
.word     5943
.word    -3898
.word    -5626
.word     7422
.word     25122
```

```
        .word     21571
        .word    -7263
        .word    -7454
        .word     757
        .word    -23926
        .word    -22047
        .word    -115
        .word    -4795
        .word     3334
        .word     17073
        .word     9749
        .word     4154
        .word    -13838
        .word    -30708
        .word    -15104
        .word    -8194
        .word    -8811
        .word     18066
        .word     29369
        .word     7580
        .word    -328
        .word     3514
        .word    -4699
        .word    -4623
        .word     2246
        .word    -7412
        .word    -8242
        .word     6091
        .word     0   ;redundant 129th entry
;Series Table w7_600.asm
S3_7    .word     0
        .word     4702
        .word     4594
        .word    -1931
        .word    -9493
```

```
.word    -12879
.word    -9851
.word    -4460
.word    -5765
.word    -10145
.word    -9100
.word    -6284
.word    -4508
.word    -4190
.word    -9512
.word    -16118
.word    -13484
.word    -1524
.word     6993
.word     4757
.word     3063
.word     9857
.word     15691
.word     13677
.word     9449
.word     12088
.word     17245
.word     10756
.word     1207
.word     6704
.word     16231
.word     9908
.word    -10736
.word    -23815
.word    -11074
.word     7098
.word     3081
.word    -5854
.word    -1050
.word     2176
```

```
.word    -649
.word     2319
.word     4338
.word    -4319
.word    -8452
.word     7484
.word     28683
.word     30708
.word     10756
.word    -13397
.word    -20398
.word    -7529
.word     6558
.word     9361
.word     3898
.word    -3674
.word    -6413
.word    -1877
.word     2408
.word     757
.word    -2914
.word    -4893
.word    -6614
.word    -6089
.word     0
.word     6089
.word     6614
.word     4893
.word     2914
.word    -757
.word    -2408
.word     1877
.word     6413
.word     3674
.word    -3898
```

```
.word    -9361
.word    -6558
.word     7529
.word     20398
.word     13397
.word    -10756
.word    -30708
.word    -28683
.word    -7484
.word     8452
.word     4319
.word    -4338
.word    -2319
.word     649
.word    -2176
.word     1050
.word     5854
.word    -3082
.word    -7098
.word     11074
.word     23815
.word     10736
.word    -9908
.word    -16231
.word    -6704
.word    -1207
.word    -10756
.word    -17245
.word    -12088
.word    -9449
.word    -13677
.word    -15691
.word    -9857
.word    -3063
.word    -4757
```

```
        .word    -6993
        .word     1524
        .word     13484
        .word     16118
        .word     9512
        .word     4190
        .word     4508
        .word     6284
        .word     9100
        .word     10145
        .word     5765
        .word     4460
        .word     9851
        .word     12879
        .word     9493
        .word     1931
        .word    -4594
        .word    -4702
        .word     0   ;redundant 129th entry
;Series Table w7_580.asm
S4_7    .word     0
        .word    -594
        .word     2852
        .word     3577
        .word     8185
        .word     11895
        .word     8143
        .word     4861
        .word    -4822
        .word    -14982
        .word    -12751
        .word    -11240
        .word    -6165
        .word     7314
        .word     10202
```

```
.word    6726
.word    1601
.word   -12043
.word   -20660
.word   -19215
.word   -10945
.word    3910
.word    8554
.word    1934
.word    579
.word    4791
.word    14255
.word    23709
.word    19966
.word    10857
.word    9654
.word    12657
.word    12231
.word    8747
.word    5109
.word   -971
.word   -1415
.word    13654
.word    25299
.word    16305
.word   -3806
.word   -23388
.word   -30708
.word   -21174
.word   -8639
.word   -873
.word    6641
.word    14946
.word    19450
.word    17592
```

```
.word    13881
.word    8606
.word    1757
.word    2364
.word    7697
.word    10847
.word    17154
.word    20850
.word    12495
.word   -1719
.word   -16373
.word   -27367
.word   -27479
.word   -16640
.word    0
.word    16640
.word    27479
.word    27367
.word    16373
.word    1719
.word   -12495
.word   -20850
.word   -17154
.word   -10847
.word   -7697
.word   -2364
.word   -1757
.word   -8606
.word   -13881
.word   -17592
.word   -19450
.word   -14946
.word   -6641
.word    873
.word    8639
```

```
.word    21174
.word    30708
.word    23388
.word    3806
.word   -16305
.word   -25299
.word   -13654
.word    1415
.word    971
.word   -5109
.word   -8747
.word   -12231
.word   -12657
.word   -9654
.word   -10857
.word   -19966
.word   -23709
.word   -14255
.word   -4791
.word   -579
.word   -1934
.word   -8554
.word   -3910
.word    10945
.word    19215
.word    20660
.word    12043
.word   -1601
.word   -6726
.word   -10202
.word   -7314
.word    6165
.word    11240
.word    12751
.word    14982
```

```
        .word     4822
        .word    -4861
        .word    -8143
        .word    -11895
        .word    -8185
        .word    -3577
        .word    -2852
        .word     594
        .word     0    ;redundant 129th entry
;Series Table w7_550.asm
S5_7    .word     0
        .word     4230
        .word     6999
        .word     7217
        .word     4219
        .word     651
        .word     473
        .word     3425
        .word     6684
        .word     8083
        .word     5530
        .word    -1155
        .word    -8121
        .word    -11610
        .word    -11230
        .word    -7755
        .word    -3517
        .word    -1207
        .word     763
        .word     3755
        .word     5496
        .word     5035
        .word     2060
        .word    -1863
        .word    -1391
```

```
.word     3615
.word     7786
.word     8397
.word     5308
.word     224
.word    -4290
.word    -5142
.word    -762
.word     1357
.word    -4549
.word    -11743
.word    -16547
.word    -18061
.word    -11220
.word    -1293
.word     4543
.word     10923
.word     18250
.word     21203
.word     18863
.word     11199
.word     776
.word    -7862
.word    -13110
.word    -13390
.word    -10268
.word    -10294
.word    -15243
.word    -19285
.word    -18749
.word    -19107
.word    -25209
.word    -30708
.word    -27694
.word    -17001
```

```
.word    -5414
.word     1259
.word     3600
.word     3410
.word     0
.word    -3410
.word    -3600
.word    -1259
.word     5414
.word     17001
.word     27694
.word     30708
.word     25209
.word     19107
.word     18749
.word     19285
.word     15243
.word     10294
.word     10268
.word     13390
.word     13110
.word     7862
.word    -776
.word    -11200
.word    -18863
.word    -21203
.word    -18250
.word    -10923
.word    -4543
.word     1293
.word     11220
.word     18061
.word     16547
.word     11743
.word     4549
```

```
        .word    -1357
        .word     762
        .word     5142
        .word     4290
        .word    -224
        .word    -5308
        .word    -8397
        .word    -7786
        .word    -3615
        .word     1391
        .word     1863
        .word    -2060
        .word    -5035
        .word    -5496
        .word    -3755
        .word    -763
        .word     1207
        .word     3517
        .word     7755
        .word     11230
        .word     11610
        .word     8121
        .word     1155
        .word    -5530
        .word    -8083
        .word    -6684
        .word    -3425
        .word    -473
        .word    -651
        .word    -4219
        .word    -7217
        .word    -6999
        .word    -4230
        .word     0    ;redundant 129th entry
;Series Table w7_520.asm
```

```
S6_7    .word    0
        .word   -1424
        .word   -314
        .word   -2269
        .word   -819
        .word    744
        .word   -2701
        .word   -861
        .word    2865
        .word    6149
        .word    12931
        .word    12730
        .word    9444
        .word    12634
        .word    13960
        .word    12641
        .word    11288
        .word    9267
        .word    9166
        .word    7560
        .word    7013
        .word    8276
        .word    3625
        .word    1139
        .word    538
        .word   -7157
        .word   -8608
        .word   -6653
        .word   -13773
        .word   -14695
        .word   -9841
        .word   -11570
        .word   -10021
        .word   -6450
        .word   -7346
```

```
.word    -1607
.word     7955
.word     10163
.word     14264
.word     25625
.word     30708
.word     27538
.word     26099
.word     22935
.word     17541
.word     17725
.word     15343
.word     7801
.word     8467
.word     12170
.word     6499
.word    -1063
.word    -832
.word     1282
.word    -3657
.word    -7510
.word    -925
.word     4930
.word     4359
.word     6088
.word     9119
.word     8432
.word     4865
.word     1121
.word     0
.word    -1121
.word    -4865
.word    -8432
.word    -9119
.word    -6088
```

```
.word   -4359
.word   -4930
.word   925
.word   7510
.word   3657
.word   -1282
.word   832
.word   1063
.word   -6499
.word   -12170
.word   -8467
.word   -7801
.word   -15343
.word   -17725
.word   -17541
.word   -22936
.word   -26099
.word   -27538
.word   -30708
.word   -25625
.word   -14264
.word   -10163
.word   -7955
.word   1607
.word   7346
.word   6450
.word   10021
.word   11570
.word   9841
.word   14695
.word   13773
.word   6653
.word   8608
.word   7157
.word   -538
```

```
        .word    -1139
        .word    -3625
        .word    -8276
        .word    -7013
        .word    -7560
        .word    -9166
        .word    -9267
        .word    -11288
        .word    -12641
        .word    -13960
        .word    -12634
        .word    -9444
        .word    -12730
        .word    -12931
        .word    -6149
        .word    -2865
        .word     861
        .word     2701
        .word    -744
        .word     819
        .word     2269
        .word     314
        .word     1424
        .word     0    ;redundant 129th entry
;Series Table w7_471.asm
S7_7    .word     0
        .word    -185
        .word    -378
        .word    -582
        .word    -793
        .word    -995
        .word    -1166
        .word    -1283
        .word    -1324
        .word    -1282
```

```
.word   -1165
.word   -1006
.word   -857
.word   -788
.word   -877
.word   -1191
.word   -1781
.word   -2655
.word   -3777
.word   -5055
.word   -6344
.word   -7458
.word   -8184
.word   -8309
.word   -7648
.word   -6069
.word   -3519
.word   -41
.word    4225
.word    9040
.word    14093
.word    19022
.word    23456
.word    27050
.word    29528
.word    30708
.word    30529
.word    29054
.word    26464
.word    23039
.word    19122
.word    15082
.word    11273
.word    7991
.word    5447
```

```
.word    3746
.word    2882
.word    2749
.word    3160
.word    3880
.word    4662
.word    5280
.word    5564
.word    5416
.word    4822
.word    3849
.word    2627
.word    1325
.word    124
.word   -819
.word   -1389
.word   -1537
.word   -1288
.word   -728
.word    0
.word    728
.word    1288
.word    1537
.word    1389
.word    819
.word   -124
.word   -1325
.word   -2627
.word   -3849
.word   -4822
.word   -5416
.word   -5564
.word   -5280
.word   -4662
.word   -3880
```

```
.word   -3160
.word   -2749
.word   -2882
.word   -3746
.word   -5447
.word   -7991
.word   -11273
.word   -15082
.word   -19122
.word   -23039
.word   -26464
.word   -29054
.word   -30529
.word   -30708
.word   -29528
.word   -27050
.word   -23456
.word   -19022
.word   -14093
.word   -9040
.word   -4225
.word   41
.word   3519
.word   6069
.word   7648
.word   8309
.word   8184
.word   7458
.word   6344
.word   5055
.word   3777
.word   2655
.word   1781
.word   1191
.word   877
```

```
        .word     788
        .word     857
        .word     1006
        .word     1165
        .word     1282
        .word     1324
        .word     1283
        .word     1166
        .word     995
        .word     793
        .word     582
        .word     378
        .word     185
        .word     0    ;redundant 129th entry
;Series Table w7_391.asm
S8_7    .word     0
        .word     -1567
        .word     -3015
        .word     -4229
        .word     -5110
        .word     -5570
        .word     -5546
        .word     -4998
        .word     -3910
        .word     -2295
        .word     -189
        .word     2346
        .word     5230
        .word     8364
        .word     11641
        .word     14944
        .word     18160
        .word     21178
        .word     23897
        .word     26233
```

```
.word    28118
.word    29506
.word    30370
.word    30708
.word    30540
.word    29901
.word    28846
.word    27441
.word    25762
.word    23886
.word    21893
.word    19858
.word    17847
.word    15916
.word    14108
.word    12452
.word    10963
.word    9640
.word    8474
.word    7443
.word    6517
.word    5666
.word    4854
.word    4051
.word    3229
.word    2371
.word    1464
.word    509
.word   -484
.word   -1495
.word   -2497
.word   -3455
.word   -4330
.word   -5084
.word   -5677
```

```
.word   -6076
.word   -6254
.word   -6195
.word   -5890
.word   -5346
.word   -4580
.word   -3619
.word   -2504
.word   -1280
.word    0
.word    1280
.word    2504
.word    3619
.word    4580
.word    5346
.word    5890
.word    6195
.word    6254
.word    6076
.word    5677
.word    5084
.word    4330
.word    3455
.word    2497
.word    1495
.word    484
.word   -509
.word   -1464
.word   -2371
.word   -3229
.word   -4051
.word   -4854
.word   -5666
.word   -6517
.word   -7443
```

```
.word   -8474
.word   -9640
.word   -10963
.word   -12452
.word   -14108
.word   -15916
.word   -17847
.word   -19858
.word   -21894
.word   -23886
.word   -25762
.word   -27441
.word   -28846
.word   -29901
.word   -30540
.word   -30708
.word   -30370
.word   -29506
.word   -28118
.word   -26233
.word   -23897
.word   -21178
.word   -18160
.word   -14944
.word   -11641
.word   -8364
.word   -5230
.word   -2346
.word   189
.word   2295
.word   3910
.word   4998
.word   5546
.word   5570
.word   5110
```

```
        .word     4229
        .word     3015
        .word     1567
        .word     0    ;redundant 129th entry
;*************************************************************
S9_7    .space    2048          ;128 words 0 filled
        .word       0           ;129th entry
;*************************************************************


*****************************************************************
*************
* TMS320C5x Voice Runtime Data Rev 0.1A
* Jim Van Buskirk
                    *
*****************************************************************
*************

      .include "..\dspos.inc"
    .mmregs
      .global Voice0,AmpCarS0,OutModT,OutCarT,Noiz,LPanVce0
      .global Voice17,Voice18,Voice19,Voice20,Voice21,Voice22
      .global outVoic0,SpecTab0,AtkTabl,DkyTabl,Log64,EMode1
      .global SpecTab1,SpecTab2,SpecTab3,SpecTab4,SpecTab5
      .global SpecTab6,SpecTab7
      .global EMode4,EModeP1,EModePS,EModePT,EModePC,EModePH
      .global Log64C,RPanVce0
      .ref    SIN128,S1,S2,S3,S4,S5,S6,S7,S8,S9
   .ref ABSSIN,CLIPSIN,HALFSIN
      .ref    S1_1,S2_1,S3_1,S4_1,S5_1,S6_1,S7_1,S8_1,S9_1
      .ref    S1_2,S2_2,S3_2,S4_2,S5_2,S6_2,S7_2,S8_2,S9_2
      .ref    S1_3,S2_3,S3_3,S4_3,S5_3,S6_3,S7_3,S8_3,S9_3
      .ref    S1_4,S2_4,S3_4,S4_4,S5_4,S6_4,S7_4,S8_4,S9_4
      .ref    S1_5,S2_5,S3_5,S4_5,S5_5,S6_5,S7_5,S8_5,S9_5
      .ref    S1_6,S2_6,S3_6,S4_6,S5_6,S6_6,S7_6,S8_6,S9_6
```

```
        .ref    S1_7,S2_7,S3_7,S4_7,S5_7,S6_7,S7_7,S8_7,S9_7
     .ref MULTI,FRQ_L,A_Reg_0
        .ref    A_Rhy_0,A_Rhy_1,A_Rhy_2,A_Rhy_3,A_Rhy_4

*****************************************************************
*************
          .data
          .sect "runvoice"

Noiz     .space 16*(FRAMESIZ-1)          ; Noiz data buffer
Seed     .word   1                        ; seed for random gen.
function

;Amplitude of Carrier per Series # (sinusoidal 2-op FM Emulation)
;AmpCarS0  .word                  2714      ;S1  CARRIER  AMPLITUDE
0.8*(amp*0.5*scale)
AmpCarS0  .word                   6063      ;S1  CARRIER  AMPLITUDE
0.8*(amp*0.5*scale)
;AmpCarSS  .word                  2000      ;S0  CARRIER  AMPLITUDE
0.8*(amp*0.5*scale)
;AmpCarS1  .word                   905      ;S2  CARRIER  AMPLITUDE
0.8*(amp*0.5*scale)
AmpCarS1  .word                  4500      ;S2  CARRIER  AMPLITUDE
0.8*(amp*0.5*scale)
;AmpCarS2  .word                  1176      ;S3  CARRIER  AMPLITUDE
0.8*(amp*0.5*scale)
AmpCarS2  .word                 -3800      ;S3  CARRIER  AMPLITUDE
0.8*(amp*0.5*scale)
;AmpCarS3  .word                 -2986      ;S4  CARRIER  AMPLITUDE
0.8*(amp*0.5*scale)
AmpCarS3  .word                  4063      ;S4  CARRIER  AMPLITUDE
0.8*(amp*0.5*scale)
AmpCarS4  .word                  6795      ;S5  CARRIER  AMPLITUDE
0.8*(amp*0.5*scale)
AmpCarS5  .word                  6063      ;S6  CARRIER  AMPLITUDE
```

```
0.8*(amp*0.5*scale)
AmpCarS6  .word                    4429      ;S7  CARRIER  AMPLITUDE
0.8*(amp*0.5*scale)
AmpCarS7  .word                    6063      ;S8  CARRIER  AMPLITUDE
0.8*(amp*0.5*scale)
AmpCarS8 .word  24000 ;15000  ;S9 CARRIER AMPLITUDE 0.8*(amp*0.5*scale)
;AmpCarS9  .word                   15107      ;S9  CARRIER  AMPLITUDE
0.8*(amp*0.5*scale)

;Sinusoidal FM 2-op Series Table
;SpecTab0 .word  S00                    ;Base address Series Feedback
(FSerOff)
;          .word  S0                    ;Base address Series Feedback
(FSerOff)
SpecTab0 .word  S1                 ;Base address Series Range 0
       .word    S2          ;Base address Series Range 1
       .word    S3          ;Base address Series Range 2
       .word    S4          ;Base address Series Range 3
       .word    S5          ;Base address Series Range 4
       .word    S6          ;Base address Series Range 5
       .word    S7          ;Base address Series Range 6
       .word    S8          ;Base address Series Range 7
       .word    S9          ;Base address Series Range 8
          ;HALF RECTIFIED SINE SPECTRA (WAVE SELECT=1)
SpecTab1 .word  S1_1               ;Base address Series Range 0
         .word  S2_1               ;Base address Series Range 1
         .word  S3_1               ;Base address Series Range 2
         .word  S4_1               ;Base address Series Range 3
         .word  S5_1               ;Base address Series Range 4
         .word  S6_1               ;Base address Series Range 5
         .word  S7_1               ;Base address Series Range 6
         .word  S8_1               ;Base address Series Range 7
         .word  S9_1               ;Base address Series Range 8
          ;FULL RECTIFIED SINE SPECTRA (WAVE SELECT=2)
SpecTab2 .word  S1_2               ;Base address Series Range 0
```

```
          .word  S2_2          ;Base address Series Range 1
          .word  S3_2          ;Base address Series Range 2
          .word  S4_2          ;Base address Series Range 3
          .word  S5_2          ;Base address Series Range 4
          .word  S6_2          ;Base address Series Range 5
          .word  S7_2          ;Base address Series Range 6
          .word  S8_2          ;Base address Series Range 7
          .word  S9_2          ;Base address Series Range 8
          ;'SHARK' SINE SPECTRA (WAVE SELECT=3)
SpecTab3  .word  S1_3          ;Base address Series Range 0
          .word  S2_3          ;Base address Series Range 1
          .word  S3_3          ;Base address Series Range 2
          .word  S4_3          ;Base address Series Range 3
          .word  S5_3          ;Base address Series Range 4
          .word  S6_3          ;Base address Series Range 5
          .word  S7_3          ;Base address Series Range 6
          .word  S8_3          ;Base address Series Range 7
          .word  S9_3          ;Base address Series Range 8
          ;SINE IN HALF PERIOD SPECTRA (WAVE SELECT=4)
SpecTab4  .word  S1_4          ;Base address Series Range 0
          .word  S2_4          ;Base address Series Range 1
          .word  S3_4          ;Base address Series Range 2
          .word  S4_4          ;Base address Series Range 3
          .word  S5_4          ;Base address Series Range 4
          .word  S6_4          ;Base address Series Range 5
          .word  S7_4          ;Base address Series Range 6
          .word  S8_4          ;Base address Series Range 7
          .word  S9_4          ;Base address Series Range 8
          ;FULL RECTIFIED SINE IN HALF PERIOD SPECTRA (WAVE
SELECT=5)
SpecTab5  .word  S1_5          ;Base address Series Range 0
          .word  S2_5          ;Base address Series Range 1
          .word  S3_5          ;Base address Series Range 2
          .word  S4_5          ;Base address Series Range 3
          .word  S5_5          ;Base address Series Range 4
```

```
          .word  S6_5            ;Base address Series Range 5
          .word  S7_5            ;Base address Series Range 6
          .word  S8_5            ;Base address Series Range 7
          .word  S9_5            ;Base address Series Range 8
           ;SQUARE SPECTRA (WAVE SELECT=6)
SpecTab6  .word  S1_6            ;Base address Series Range 0
          .word  S2_6            ;Base address Series Range 1
          .word  S3_6            ;Base address Series Range 2
          .word  S4_6            ;Base address Series Range 3
          .word  S5_6            ;Base address Series Range 4
          .word  S6_6            ;Base address Series Range 5
          .word  S7_6            ;Base address Series Range 6
          .word  S8_6            ;Base address Series Range 7
          .word  S9_6            ;Base address Series Range 8
           ;Log SPECTRA (WAVE SELECT=7)
SpecTab7  .word  S1_7            ;Base address Series Range 0
          .word  S2_7            ;Base address Series Range 1
          .word  S3_7            ;Base address Series Range 2
          .word  S4_7            ;Base address Series Range 3
          .word  S5_7            ;Base address Series Range 4
          .word  S6_7            ;Base address Series Range 5
          .word  S7_7            ;Base address Series Range 6
          .word  S8_7            ;Base address Series Range 7
          .word  S9_7            ;Base address Series Range 8
*****************************************************************
*************
;  running voice control data and voice buffer
*****************************************************************
*************
;  pointer references
Voice0:
      .word      A_Reg_0    ;( 0)A_Vce_St (address of voice status
table)
      .word      SpecTab0   ;( 1)pSpecSer (ptr to Spectral Series
Tbl)
```

```
        .word   FRQ_L+0         ;( 2)V_Frq_L (voice FRQ_L register
address)
        .word   MULTI+0         ;( 3)P_Multi (percussive voice
MULTI address)
        .word   FRQ_L+0         ;( 4)P_Frq_L (percussive voice
FRQ_L address)
      .word     0       ;( 5)pEm pointer to Mod. Envelope address
        .word   EMode1          ;( 6)EModFunc Engine Mode Func.
address
; running voice control data - Mode, Spectral Mod., Noise, Mix
      .word     0         ;( 7)EMode (eng. 1-mel,2-perc1,3-perc3)

;xlat
        .word   0306h           ;( 8)Nom_Pch nominal pitch (input
to LFO)
        .word   0306h           ;( 9)Pch_Step runnung pitch step
{ Q9 frac. portion
used }
      .word     OutModT   ;(10)Out_Ptr pointer to top of voice
output buffer
      .word     S8        ;(11)Tabl_Ptr running pointer to wave
table (AR4)
        .word   0               ;(12)Run_Val running wave value {
Q9 },
TableOffset.Frac
      .word     S8        ;(13)TblBase Address for the 129 sample
wave
table
      .word     7FFFh           ;(14)MaskMSB used in AND when
sending
sample to DAC
      .word outVoic0      ;(15)pointer to voice output buffer
        .word 0                 ;(16)ZMin1
        .word 0                 ;(17)Feedbk reg. feedback value
        .word 0                 ;(18)Fbk engine feedback factor
```

```
        .word 7FFFh                ;(19)MFbk (1-FBK)
      .word 0          ;(20)Em (EnvMSB_M * Level_M)
      .word 7FFFh          ;(21)One
      .word 7          ;(22)MCoeff_
      .word 7          ;(23)SRange (dynamic Series Range 0-8)
      .word 3330h          ;(24)AmpCar (dynamic Amp. of Car.)
      .word 0          ;(25)PanL
      .word 0          ;(26)PanR
      .word 0          ;(27)Ec (EnvMSB_C * Level_C)
;  register shadows for Note Update Logic
        .word 0                    ;(28)SFrq_L reg. shadow
        .word 0                    ;(29)SOn_OctF reg. shadow
        .word 0                    ;(30)MMulti reg. shadow
        .word 0                    ;(31)CMulti reg. shadow
        .word 0                    ;(32)MLevel reg. shadow
        .word 0                    ;(33)CLevel reg. shadow
;  envelope control data
        .word   7FFFh              ;(34)Level_M (modulator envelope
level scale)
      .word     0000h            ;(35)EnvMSB_M (modulator running
envelope)
      .word     0000h            ;(36)EnvLSB_M (modulator running
envelope)
      .word    0            ;(37)M_Rnge (modulator envelope range)
      .word     07eh          ;(38)A_SlpeM (modulator attack slope)
(Q4)
      .word     04eh          ;(39)D_SlpeM (modulator decay slope)
(Q4)
        .word  0                   ;(40)S_SlpeM (modulator sustain
slope) (Q4)
      .word     3FFFh              ;(41)S_LevlM (modulator sustain
level)
      .word     00a0h              ;(42)R_SlpeM (modulator release
slope)
(Q4)
```

```
        .word    7FFFh              ;(43)Level_C (carrier envelope
level scale)
        .word    7FFFh              ;(44)EnvMSB_C (carrier running
envelope)
        .word   0                   ;(45)EnvLSB_C (carrier running
envelope)
        .word   0                    ;(46)C_Rnge (carrier envelope
range)
      .word    7FFFh           ;(47)A_SlpeC (carrier attack slope)
  (Q4)
      .word   04eh      ;(48)D_SlpeC (carrier decay slope)    (Q4)
        .word   0                   ;(49)S_SlpeC (carrier sustain
slope)   (Q4)
        .word   0                   ;(50)S_LevlC (carrier sustain
level)
      .word    0370h          ;(51)R_SlpeC (carrier release slope)
 (Q4)
;Carrier Oscillator control data
      .word     0183h           ;(52)Nom_PchC nominal pitch (input
to
LFO)
      .word     0183h           ;(53)Pch_StpC runnung pitch step {
Q9 frac.
portion used }
      .word     OutCarT     ;(54)Out_PtrC pointer to top of voice
output
buffer
      .word      SIN128     ;(55)Tbl_PtrC running pointer to wave
table (AR4)
      .word     0         ;(56)Run_ValC running wave value { Q9 },
TableOffset.Frac
      .word     SIN128    ;(57)TblBaseC Address for the 129 sample
wave
table
      .word     7FFFh           ;(58)MaskMSBC used in AND when
```

```
sending sample to DAC
;16 word voice output buffer
outVoic0 .space 16*FRAMESIZ      ;(59)outVoice Synthesizer's voice
out buffer
                        ;(75)
*****************************************************************
*************
;  pointer references
Voice1:
      .word      A_Reg_0    ;( 0)A_Vce_St (address of voice status
table)
      .word      SpecTab0   ;( 1)pSpecSer (ptr to Spectral Series
Tbl)
         .word   FRQ_L+0         ;( 2)V_Frq_L (voice FRQ_L register
address)
         .word    MULTI+0            ;( 3)P_Multi (percussive voice
MULTI address)
         .word    FRQ_L+0            ;( 4)P_Frq_L (percussive voice
FRQ_L address)
      .word       0        ;( 5)pEm pointer to Mod. Envelope address
         .word   EMode1       ;( 6)EModFunc Engine Mode Func. address
; running voice control data - Mode, Spectral Mod., Noise, Mix
      .word      0          ;( 7)EMode (eng. 1-mel,2-perc1,3-perc3)

;xlat
      .word     03CFh          ;( 8)Nom_Pch nominal pitch (input to
LFO)
      .word     03CFh           ;( 9)Pch_Step runnung pitch step {
Q9 frac.
portion used }
      .word      OutModT    ;(10)Out_Ptr pointer to top of voice
output buffer
      .word      S8         ;(11)Tabl_Ptr running pointer to wave
table (AR4)
         .word   0                ;(12)Run_Val running wave value {
```

```
Q9 },
TableOffset.Frac
      .word     S8          ;(13)TblBase Address for the 129 sample
wave
table
      .word     7FFFh                ;(14)MaskMSB used in AND when
sending
sample to DAC
      .word outVoic1        ;(15)pointer to voice output buffer
         .word 0                  ;(16)ZMin1
         .word 0                  ;(17)Feedbk reg. feedback value
         .word 0                  ;(18)Fbk engine feedback factor
         .word 7FFFh              ;(19)MFbk (1-FBK)
      .word 0          ;(20)Em (EnvMSB_M * Level_M)
      .word 7FFFh          ;(21)One
      .word 7          ;(22)MCoeff_
      .word 7          ;(23)SRange (dynamic Series Range 0-8)
      .word 0          ;(24)AmpCar (dynamic Amp. of Car.)
      .word 0          ;(25)PanL
      .word 0          ;(26)PanR
      .word 0          ;(27)Ec (EnvMSB_C * Level_C)
;  register shadows for Note Update Logic
         .word 0                  ;(28)SFrq_L reg. shadow
         .word 0                  ;(29)SOn_OctF reg. shadow
         .word 0                  ;(30)MMulti reg. shadow
         .word 0                  ;(31)CMulti reg. shadow
         .word 0                  ;(32)MLevel reg. shadow
         .word 0                  ;(33)CLevel reg. shadow
;  envelope control data
         .word   7FFFh            ;(34)Level_M (modulator envelope
level scale)
      .word     0000h          ;(35)EnvMSB_M (modulator running
envelope)
      .word     0000h          ;(36)EnvLSB_M (modulator running
envelope)
```

```
        .word    0          ;(37)M_Rnge (modulator envelope range)
        .word    05eh        ;(38)A_SlpeM (modulator attack slope)
(Q4)
        .word    05eh        ;(39)D_SlpeM (modulator decay slope)
(Q4)
          .word  0                ;(40)S_SlpeM (modulator sustain
slope) (Q4)
        .word    3FFFh             ;(41)S_LevlM (modulator sustain
level)
        .word    0070h             ;(42)R_SlpeM (modulator release
slope)
(Q4)
          .word   7FFFh             ;(43)Level_C (carrier envelope
level scale)
          .word   7FFFh             ;(44)EnvMSB_C (carrier running
envelope)
          .word  0                  ;(45)EnvLSB_C (carrier running
envelope)
          .word  0                   ;(46)C_Rnge (carrier envelope
range)
        .word   7FFFh           ;(47)A_SlpeC (carrier attack slope)
  (Q4)
        .word    03eh        ;(48)D_SlpeC (carrier decay slope)
(Q4)
          .word  0                   ;(49)S_SlpeC (carrier sustain
slope)   (Q4)
          .word  0                   ;(50)S_LevlC (carrier sustain
level)
        .word   0270h           ;(51)R_SlpeC (carrier release slope)
 (Q4)
;Carrier Oscillator control data
        .word    01e8h           ;(52)Nom_PchC nominal pitch (input
to
LFO)
        .word    01e8h           ;(53)Pch_StpC runnung pitch step {
```

```
Q9 frac.
portion used }
      .word      OutCarT     ;(54)Out_PtrC pointer to top of voice
output
buffer
      .word      SIN128      ;(55)Tbl_PtrC running pointer to wave
table (AR4)
      .word     0          ;(56)Run_ValC running wave value { Q9 },
TableOffset.Frac
      .word     SIN128     ;(57)TblBaseC Address for the 129 sample
wave
table
      .word     7FFFh           ;(58)MaskMSBC used in AND when
sending sample to DAC
;16 word voice output buffer
outVoic1 .space 16*FRAMESIZ     ;(59)outVoice Synthesizer's voice
out buffer
                     ;(75)
*****************************************************************
*************
;  pointer references
Voice2:
      .word      A_Reg_0    ;( 0)A_Vce_St (address of voice status
table)
      .word      SpecTab0   ;( 1)pSpecSer (ptr to Spectral Series
Tbl)
         .word   FRQ_L+0         ;( 2)V_Frq_L (voice FRQ_L register
address)
         .word    MULTI+0           ;( 3)P_Multi (percussive voice
MULTI address)
         .word    FRQ_L+0           ;( 4)P_Frq_L (percussive voice
FRQ_L address)
      .word       0       ;( 5)pEm pointer to Mod. Envelope address
         .word     EMode1           ;( 6)EModFunc Engine Mode Func.
address
```

```
; running voice control data - Mode, Spectral Mod., Noise, Mix
      .word     0          ;( 7)EMode (eng. 1-mel,2-perc1,3-perc3)
;xlat
         .word   0306h          ;( 8)Nom_Pch nominal pitch (input
to LFO)
         .word   0306h          ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
         .word   0                ;(12)Run_Val running wave value {
Q9 },
TableOffset.Frac
      .word      S8         ;(13)TblBase Address for the 129 sample
wave
table
      .word      7FFFh                ;(14)MaskMSB used in AND when
sending
sample to DAC
      .word outVoic2       ;(15)pointer to voice output buffer
         .word 0                ;(16)ZMin1
         .word 0                ;(17)Feedbk reg. feedback value
         .word 0                ;(18)Fbk engine feedback factor
         .word 7FFFh            ;(19)MFbk (1-FBK)
      .word 0          ;(20)Em (EnvMSB_M * Level_M)
      .word 7FFFh          ;(21)One
      .word 7          ;(22)MCoeff_
      .word 7          ;(23)SRange (dynamic Series Range 0-8)
      .word 0          ;(24)AmpCar (dynamic Amp. of Car.)
      .word 0          ;(25)PanL
      .word 0          ;(26)PanR
      .word 0          ;(27)Ec (EnvMSB_C * Level_C)
```

```
;  register shadows for Note Update Logic
        .word 0                    ;(28)SFrq_L reg. shadow
        .word 0                    ;(29)SOn_OctF reg. shadow
        .word 0                    ;(30)MMulti reg. shadow
        .word 0                    ;(31)CMulti reg. shadow
        .word 0                    ;(32)MLevel reg. shadow
        .word 0                    ;(33)CLevel reg. shadow
;  envelope control data
        .word   7FFFh              ;(34)Level_M (modulator envelope
level scale)
        .word   0000h              ;(35)EnvMSB_M (modulator running
envelope)
        .word   0000h              ;(36)EnvLSB_M (modulator running
envelope)
        .word   0                  ;(37)M_Rnge (modulator envelope range)
        .word   07eh               ;(38)A_SlpeM (modulator attack slope)
(Q4)
        .word   04eh               ;(39)D_SlpeM (modulator decay slope)
(Q4)
        .word   0                  ;(40)S_SlpeM (modulator sustain
slope) (Q4)
        .word   3FFFh              ;(41)S_LevlM (modulator sustain
level)
        .word   00a0h              ;(42)R_SlpeM (modulator release
slope)
(Q4)
        .word   7FFFh              ;(43)Level_C (carrier envelope
level scale)
        .word   7FFFh              ;(44)EnvMSB_C (carrier running
envelope)
        .word   0                  ;(45)EnvLSB_C (carrier running
envelope)
        .word   0                  ;(46)C_Rnge (carrier envelope
range)
        .word   7FFFh              ;(47)A_SlpeC (carrier attack slope)
```

```
(Q4)
        .word    04eh          ;(48)D_SlpeC (carrier decay slope)
(Q4)
        .word   0
slope)  (Q4)                   ;(49)S_SlpeC (carrier sustain
        .word   0
level)                         ;(50)S_LevlC (carrier sustain
        .word    0370h         ;(51)R_SlpeC (carrier release slope)
(Q4)
;Carrier Oscillator control data
        .word    0183h         ;(52)Nom_PchC nominal pitch (input
to
LFO)
        .word    0183h         ;(53)Pch_StpC runnung pitch step {
Q9 frac.
portion used }
        .word    OutCarT       ;(54)Out_PtrC pointer to top of voice
output
buffer
        .word    SIN128        ;(55)Tbl_PtrC running pointer to wave
table (AR4)
        .word    0             ;(56)Run_ValC running wave value { Q9 },
TableOffset.Frac
        .word    SIN128        ;(57)TblBaseC Address for the 129 sample
wave
table
        .word    7FFFh         ;(58)MaskMSBC used in AND when
sending sample to DAC
;16 word voice output buffer
outVoic2 .space 16*FRAMESIZ    ;(59)outVoice Synthesizer's voice
out buffer
                        ;(75)
*****************************************************************
*************
;  pointer references
```

```
Voice3:
        .word       A_Reg_0     ;( 0)A_Vce_St (address of voice status
table)
        .word       SpecTab0    ;( 1)pSpecSer (ptr to Spectral Series
Tbl)
            .word   FRQ_L+0         ;( 2)V_Frq_L (voice FRQ_L register
address)
            .word   MULTI+0             ;( 3)P_Multi (percussive voice
MULTI address)
            .word   FRQ_L+0             ;( 4)P_Frq_L (percussive voice
FRQ_L address)
        .word       0       ;( 5)pEm pointer to Mod. Envelope address
            .word   EMode1              ;( 6)EModFunc Engine Mode Func.
address
; running voice control data - Mode, Spectral Mod., Noise, Mix
        .word       0           ;( 7)EMode (eng. 1-mel,2-perc1,3-perc3)
;xlat
            .word   0306h           ;( 8)Nom_Pch nominal pitch (input
to LFO)
            .word   0306h           ;( 9)Pch_Step runnung pitch step
{ Q9 frac. portion
used }
        .word       OutModT     ;(10)Out_Ptr pointer to top of voice
output buffer
        .word       S8          ;(11)Tabl_Ptr running pointer to wave
table (AR4)
            .word   0               ;(12)Run_Val running wave value {
Q9 },
TableOffset.Frac
        .word       S8          ;(13)TblBase Address for the 129 sample
wave
table
        .word       7FFFh               ;(14)MaskMSB used in AND when
sending
```

```
sample to DAC
        .word outVoic3          ;(15)pointer to voice output buffer
            .word 0                     ;(16)ZMin1
            .word 0                     ;(17)Feedbk reg. feedback value
            .word 0                     ;(18)Fbk engine feedback factor
            .word 7FFFh                 ;(19)MFbk (1-FBK)
        .word 0             ;(20)Em (EnvMSB_M * Level_M)
        .word 7FFFh             ;(21)One
        .word 7             ;(22)MCoeff_
        .word 7             ;(23)SRange (dynamic Series Range 0-8)
        .word 3330h             ;(24)AmpCar (dynamic Amp. of Car.)
        .word 0             ;(25)PanL
        .word 0             ;(26)PanR
        .word 0             ;(27)Ec (EnvMSB_C * Level_C)
;  register shadows for Note Update Logic
            .word 0                     ;(28)SFrq_L reg. shadow
            .word 0                     ;(29)SOn_OctF reg. shadow
            .word 0                     ;(30)MMulti reg. shadow
            .word 0                     ;(31)CMulti reg. shadow
            .word 0                     ;(32)MLevel reg. shadow
            .word 0                     ;(33)CLevel reg. shadow
;  envelope control data
            .word   7FFFh               ;(34)Level_M (modulator envelope
level scale)
        .word     0000h             ;(35)EnvMSB_M (modulator running
envelope)
        .word     0000h             ;(36)EnvLSB_M (modulator running
envelope)
        .word     0             ;(37)M_Rnge (modulator envelope range)
        .word     07eh            ;(38)A_SlpeM (modulator attack slope)
(Q4)
        .word     04eh            ;(39)D_SlpeM (modulator decay slope)
(Q4)
        .word  0                    ;(40)S_SlpeM (modulator sustain
slope) (Q4)
```

```
      .word     3FFFh              ;(41)S_LevlM (modulator sustain
level)
      .word     00a0h              ;(42)R_SlpeM (modulator release
slope)
(Q4)
         .word   7FFFh             ;(43)Level_C (carrier envelope
level scale)
         .word   7FFFh             ;(44)EnvMSB_C (carrier running
envelope)
         .word  0                  ;(45)EnvLSB_C (carrier running
envelope)
         .word  0                  ;(46)C_Rnge (carrier envelope
range)
      .word    7FFFh           ;(47)A_SlpeC (carrier attack slope)
  (Q4)
      .word     04eh        ;(48)D_SlpeC (carrier decay slope)
(Q4)
         .word  0                  ;(49)S_SlpeC (carrier sustain
slope)   (Q4)
         .word  0                  ;(50)S_LevlC (carrier sustain
level)
      .word    0370h          ;(51)R_SlpeC (carrier release slope)
 (Q4)
;Carrier Oscillator control data
      .word     0183h          ;(52)Nom_PchC nominal pitch (input
to
LFO)
      .word     0183h          ;(53)Pch_StpC runnung pitch step {
Q9 frac.
portion used }
      .word     OutCarT     ;(54)Out_PtrC pointer to top of voice
output
buffer
      .word      SIN128     ;(55)Tbl_PtrC running pointer to wave
table (AR4)
```

```
        .word     0          ;(56)Run_ValC running wave value { Q9 },
TableOffset.Frac
        .word     SIN128     ;(57)TblBaseC Address for the 129 sample
wave
table
        .word     7FFFh           ;(58)MaskMSBC used in AND when
sending sample to DAC
;16 word voice output buffer
outVoic3 .space 16*FRAMESIZ      ;(59)outVoice Synthesizer's voice
out buffer
                        ;(75)
*****************************************************************************
;  pointer references
Voice4:
        .word     A_Reg_0    ;( 0)A_Vce_St (address of voice status
table)
        .word     SpecTab0   ;( 1)pSpecSer (ptr to Spectral Series
Tbl)
          .word   FRQ_L+0          ;( 2)V_Frq_L (voice FRQ_L register
address)
          .word   MULTI+0            ;( 3)P_Multi (percussive voice
MULTI address)
          .word   FRQ_L+0            ;( 4)P_Frq_L (percussive voice
FRQ_L address)
        .word     0        ;( 5)pEm pointer to Mod. Envelope address
          .word   EMode1             ;( 6)EModFunc Engine Mode Func.
address
; running voice control data - Mode, Spectral Mod., Noise, Mix
        .word     0          ;( 7)EMode (eng. 1-mel,2-perc1,3-perc3)

;xlat
          .word   0306h            ;( 8)Nom_Pch nominal pitch (input
to LFO)
          .word   0306h            ;( 9)Pch_Step runnung pitch step
{ Q9 frac. portion
```

```
used }
      .word      OutModT    ;(10)Out_Ptr pointer to top of voice
output buffer
      .word      S8         ;(11)Tabl_Ptr running pointer to wave
table (AR4)
         .word   0               ;(12)Run_Val running wave value {
Q9 },
TableOffset.Frac
      .word      S8        ;(13)TblBase Address for the 129 sample
wave
table
      .word      7FFFh              ;(14)MaskMSB used in AND when
sending
sample to DAC
      .word outVoic4       ;(15)pointer to voice output buffer
         .word 0                 ;(16)ZMin1
         .word 0                 ;(17)Feedbk reg. feedback value
         .word 0                 ;(18)Fbk engine feedback factor
         .word 7FFFh             ;(19)MFbk (1-FBK)
      .word 0         ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 3330h          ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
         .word 0                 ;(28)SFrq_L reg. shadow
         .word 0                 ;(29)SOn_OctF reg. shadow
         .word 0                 ;(30)MMulti reg. shadow
         .word 0                 ;(31)CMulti reg. shadow
         .word 0                 ;(32)MLevel reg. shadow
         .word 0                 ;(33)CLevel reg. shadow
;  envelope control data
```

```
        .word   7FFFh           ;(34)Level_M (modulator envelope
level scale)
      .word     0000h          ;(35)EnvMSB_M (modulator running
envelope)
      .word     0000h          ;(36)EnvLSB_M (modulator running
envelope)
      .word    0             ;(37)M_Rnge (modulator envelope range)
      .word     07eh          ;(38)A_SlpeM (modulator attack slope)
(Q4)
      .word     04eh          ;(39)D_SlpeM (modulator decay slope)
(Q4)
        .word  0                ;(40)S_SlpeM (modulator sustain
slope) (Q4)
      .word     3FFFh          ;(41)S_LevlM (modulator sustain
level)
      .word     00a0h          ;(42)R_SlpeM (modulator release
slope)
(Q4)
        .word   7FFFh           ;(43)Level_C (carrier envelope
level scale)
        .word   7FFFh           ;(44)EnvMSB_C (carrier running
envelope)
        .word  0                ;(45)EnvLSB_C (carrier running
envelope)
        .word  0              ;(46)C_Rnge (carrier envelope range)
      .word    7FFFh           ;(47)A_SlpeC (carrier attack slope)
  (Q4)
      .word     04eh         ;(48)D_SlpeC (carrier decay slope)
(Q4)
        .word  0                ;(49)S_SlpeC (carrier sustain
slope)   (Q4)
        .word  0                ;(50)S_LevlC (carrier sustain
level)
      .word    0370h          ;(51)R_SlpeC (carrier release slope)
 (Q4)
```

```
;Carrier Oscillator control data
      .word     0183h          ;(52)Nom_PchC nominal pitch (input
to
LFO)
      .word     0183h          ;(53)Pch_StpC runnung pitch step {
Q9 frac.
portion used }
      .word     OutCarT    ;(54)Out_PtrC pointer to top of voice
output
buffer
      .word     SIN128     ;(55)Tbl_PtrC running pointer to wave
table (AR4)
      .word     0          ;(56)Run_ValC running wave value { Q9 },
TableOffset.Frac
      .word     SIN128     ;(57)TblBaseC Address for the 129 sample
wave
table
      .word     7FFFh          ;(58)MaskMSBC used in AND when
sending sample to DAC
;16 word voice output buffer
outVoic4 .space 16*FRAMESIZ     ;(59)outVoice Synthesizer's voice
out buffer
                    ;(75)
*****************************************************************
*************
;  pointer references
Voice5:
      .word     A_Reg_0    ;( 0)A_Vce_St (address of voice status
table)
      .word     SpecTab0   ;( 1)pSpecSer (ptr to Spectral Series
Tbl)
        .word   FRQ_L+0        ;( 2)V_Frq_L (voice FRQ_L register
address)
        .word   MULTI+0          ;( 3)P_Multi (percussive voice
MULTI address)
```

```
        .word    FRQ_L+0          ;( 4)P_Frq_L (percussive voice
FRQ_L address)
      .word       0       ;( 5)pEm pointer to Mod. Envelope address
        .word     EMode1          ;( 6)EModFunc Engine Mode Func.
address
; running voice control data - Mode, Spectral Mod., Noise, Mix
      .word      0          ;( 7)EMode (eng. 1-mel,2-perc1,3-perc3)

;xlat
        .word   0306h          ;( 8)Nom_Pch nominal pitch (input
to LFO)
        .word   0306h          ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
        .word   0               ;(12)Run_Val running wave value {
Q9 },
TableOffset.Frac
      .word      S8        ;(13)TblBase Address for the 129 sample
wave
table
      .word      7FFFh              ;(14)MaskMSB used in AND when
sending
sample to DAC
      .word outVoic5      ;(15)pointer to voice output buffer
         .word 0                ;(16)ZMin1
         .word 0                ;(17)Feedbk reg. feedback value
         .word 0                ;(18)Fbk engine feedback factor
         .word 7FFFh            ;(19)MFbk (1-FBK)
      .word 0         ;(20)Em (EnvMSB_M * Level_M)
      .word 7FFFh          ;(21)One
      .word 7         ;(22)MCoeff_
```

```
        .word 7          ;(23)SRange (dynamic Series Range 0-8)
        .word 3330h          ;(24)AmpCar (dynamic Amp. of Car.)
        .word 0          ;(25)PanL
        .word 0          ;(26)PanR
        .word 0          ;(27)Ec (EnvMSB_C * Level_C)
;  register shadows for Note Update Logic
          .word 0                    ;(28)SFrq_L reg. shadow
          .word 0                    ;(29)SOn_OctF reg. shadow
          .word 0                    ;(30)MMulti reg. shadow
          .word 0                    ;(31)CMulti reg. shadow
          .word 0                    ;(32)MLevel reg. shadow
          .word 0                    ;(33)CLevel reg. shadow
;  envelope control data
          .word   7FFFh              ;(34)Level_M (modulator envelope
level scale)
      .word     0000h            ;(35)EnvMSB_M (modulator running
envelope)
      .word     0000h            ;(36)EnvLSB_M (modulator running
envelope)
      .word    0            ;(37)M_Rnge (modulator envelope range)
      .word     07eh          ;(38)A_SlpeM (modulator attack slope)
(Q4)
      .word     04eh          ;(39)D_SlpeM (modulator decay slope)
(Q4)
         .word  0                    ;(40)S_SlpeM (modulator sustain
slope) (Q4)
      .word     3FFFh                ;(41)S_LevlM (modulator sustain
level)
      .word     00a0h                ;(42)R_SlpeM (modulator release
slope)
(Q4)
         .word   7FFFh                ;(43)Level_C (carrier envelope
level scale)
         .word   7FFFh                ;(44)EnvMSB_C (carrier running
envelope)
```

```
        .word   0                       ;(45)EnvLSB_C (carrier running
envelope)
        .word   0                       ;(46)C_Rnge (carrier envelope
range)
      .word     7FFFh           ;(47)A_SlpeC (carrier attack slope)
  (Q4)
      .word     04eh          ;(48)D_SlpeC (carrier decay slope)
(Q4)
        .word   0                       ;(49)S_SlpeC (carrier sustain
slope)  (Q4)
        .word   0                       ;(50)S_LevlC (carrier sustain
level)
      .word     0370h           ;(51)R_SlpeC (carrier release slope)
 (Q4)
;Carrier Oscillator control data
      .word     0183h           ;(52)Nom_PchC nominal pitch (input
to
LFO)
      .word     0183h           ;(53)Pch_StpC runnung pitch step {
Q9 frac.
portion used }
      .word     OutCarT     ;(54)Out_PtrC pointer to top of voice
output
buffer
      .word     SIN128      ;(55)Tbl_PtrC running pointer to wave
table (AR4)
      .word     0           ;(56)Run_ValC running wave value { Q9 },
TableOffset.Frac
      .word     SIN128      ;(57)TblBaseC Address for the 129 sample
wave
table
      .word     7FFFh           ;(58)MaskMSBC used in AND when
sending sample to DAC
;16 word voice output buffer
outVoic5 .space 16*FRAMESIZ     ;(59)outVoice Synthesizer's voice
```

```
out buffer
                        ;(75)
*****************************************************************
*************
;  pointer references
Voice6:
        .word       A_Reg_0    ;( 0)A_Vce_St (address of voice status
table)
        .word       SpecTab0   ;( 1)pSpecSer (ptr to Spectral Series
Tbl)
          .word    FRQ_L+0          ;( 2)V_Frq_L (voice FRQ_L register
address)
          .word    MULTI+0            ;( 3)P_Multi (percussive voice
MULTI address)
          .word    FRQ_L+0            ;( 4)P_Frq_L (percussive voice
FRQ_L address)
        .word       0        ;( 5)pEm pointer to Mod. Envelope address
          .word     EMode1           ;( 6)EModFunc Engine Mode Func.
address
; running voice control data - Mode, Spectral Mod., Noise, Mix
        .word       0          ;( 7)EMode (eng. 1-mel,2-perc1,3-perc3)
;xlat
          .word    0306h            ;( 8)Nom_Pch nominal pitch (input
to LFO)
          .word    0306h             ;( 9)Pch_Step runnung pitch step
{ Q9 frac. portion
used }
        .word       OutModT    ;(10)Out_Ptr pointer to top of voice
output buffer
        .word       S8         ;(11)Tabl_Ptr running pointer to wave
table (AR4)
          .word    0                 ;(12)Run_Val running wave value {
Q9 },
TableOffset.Frac
```

```
        .word     S8          ;(13)TblBase Address for the 129 sample
wave
table
        .word     7FFFh                   ;(14)MaskMSB used in AND when
sending
sample to DAC
        .word outVoic6      ;(15)pointer to voice output buffer
            .word 0                 ;(16)ZMin1
            .word 0                 ;(17)Feedbk reg. feedback value
            .word 0                 ;(18)Fbk engine feedback factor
            .word 7FFFh             ;(19)MFbk (1-FBK)
        .word 0         ;(20)Em (EnvMSB_M * Level_M)
        .word 7FFFh         ;(21)One
        .word 7         ;(22)MCoeff_
        .word 7         ;(23)SRange (dynamic Series Range 0-8)
        .word 3330h         ;(24)AmpCar (dynamic Amp. of Car.)
        .word 0         ;(25)PanL
        .word 0         ;(26)PanR
        .word 0         ;(27)Ec (EnvMSB_C * Level_C)
;  register shadows for Note Update Logic
            .word 0                 ;(28)SFrq_L reg. shadow
            .word 0                 ;(29)SOn_OctF reg. shadow
            .word 0                 ;(30)MMulti reg. shadow
            .word 0                 ;(31)CMulti reg. shadow
            .word 0                 ;(32)MLevel reg. shadow
            .word 0                 ;(33)CLevel reg. shadow
;  envelope control data
        .word   7FFFh               ;(34)Level_M (modulator envelope
level scale)
        .word     0000h         ;(35)EnvMSB_M (modulator running
envelope)
        .word     0000h         ;(36)EnvLSB_M (modulator running
envelope)
        .word     0         ;(37)M_Rnge (modulator envelope range)
        .word     07eh          ;(38)A_SlpeM (modulator attack slope)
```

```
(Q4)
        .word     04eh          ;(39)D_SlpeM (modulator decay slope)
(Q4)
          .word   0                     ;(40)S_SlpeM (modulator sustain
slope) (Q4)
        .word     3FFFh                 ;(41)S_LevlM (modulator sustain
level)
        .word     00a0h                 ;(42)R_SlpeM (modulator release
slope)
(Q4)
          .word   7FFFh                 ;(43)Level_C (carrier envelope
level scale)
          .word   7FFFh                 ;(44)EnvMSB_C (carrier running
envelope)
          .word   0                     ;(45)EnvLSB_C (carrier running
envelope)
          .word   0                     ;(46)C_Rnge (carrier envelope
range)
        .word     7FFFh           ;(47)A_SlpeC (carrier attack slope)
  (Q4)
        .word     04eh          ;(48)D_SlpeC (carrier decay slope)
(Q4)
          .word   0                     ;(49)S_SlpeC (carrier sustain
slope)    (Q4)
          .word   0                     ;(50)S_LevlC (carrier sustain
level)
        .word     0370h           ;(51)R_SlpeC (carrier release slope)
 (Q4)
;Carrier Oscillator control data
        .word     0183h           ;(52)Nom_PchC nominal pitch (input
to
LFO)
        .word     0183h           ;(53)Pch_StpC runnung pitch step {
Q9 frac.
portion used }
```

```
      .word      OutCarT     ;(54)Out_PtrC pointer to top of voice
output
buffer
      .word      SIN128      ;(55)Tbl_PtrC running pointer to wave
table (AR4)
      .word      0           ;(56)Run_ValC running wave value { Q9 },
TableOffset.Frac
      .word      SIN128      ;(57)TblBaseC Address for the 129 sample
wave
table
      .word      7FFFh           ;(58)MaskMSBC used in AND when
sending sample to DAC
;16 word voice output buffer
outVoic6 .space 16*FRAMESIZ     ;(59)outVoice Synthesizer's voice
out buffer
                        ;(75)
*****************************************************************
*************
;  pointer references
Voice7:
      .word      A_Reg_0     ;( 0)A_Vce_St (address of voice status
table)
      .word      SpecTab0    ;( 1)pSpecSer (ptr to Spectral Series
Tbl)
         .word   FRQ_L+0         ;( 2)V_Frq_L (voice FRQ_L register
address)
         .word   MULTI+0             ;( 3)P_Multi (percussive voice
MULTI address)
         .word   FRQ_L+0             ;( 4)P_Frq_L (percussive voice
FRQ_L address)
      .word      0           ;( 5)pEm pointer to Mod. Envelope address
         .word   EMode1              ;( 6)EModFunc Engine Mode Func.
address
; running voice control data - Mode, Spectral Mod., Noise, Mix
      .word      0           ;( 7)EMode (eng. 1-mel,2-perc1,3-perc3)
```

```
;xlat
        .word   0306h           ;( 8)Nom_Pch nominal pitch (input
to LFO)
        .word   0306h           ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
        .word   0               ;(12)Run_Val running wave value {
Q9 },
TableOffset.Frac
      .word      S8         ;(13)TblBase Address for the 129 sample
wave
table
      .word      7FFFh              ;(14)MaskMSB used in AND when
sending
sample to DAC
      .word outVoic7       ;(15)pointer to voice output buffer
        .word 0                 ;(16)ZMin1
        .word 0                 ;(17)Feedbk reg. feedback value
        .word 0                 ;(18)Fbk engine feedback factor
        .word 7FFFh             ;(19)MFbk (1-FBK)
      .word 0         ;(20)Em (EnvMSB_M * Level_M)
      .word 7FFFh         ;(21)One
      .word 7         ;(22)MCoeff_
      .word 7         ;(23)SRange (dynamic Series Range 0-8)
      .word 3330h         ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
        .word 0                 ;(28)SFrq_L reg. shadow
```

```
        .word 0                 ;(29)SOn_OctF reg. shadow
        .word 0                 ;(30)MMulti reg. shadow
        .word 0                 ;(31)CMulti reg. shadow
        .word 0                 ;(32)MLevel reg. shadow
        .word 0                 ;(33)CLevel reg. shadow
;  envelope control data
        .word   7FFFh           ;(34)Level_M (modulator envelope
level scale)
      .word     0000h          ;(35)EnvMSB_M (modulator running
envelope)
      .word     0000h          ;(36)EnvLSB_M (modulator running
envelope)
      .word    0            ;(37)M_Rnge (modulator envelope range)
      .word   07eh      ;(38)A_SlpeM (modulator attack slope)  (Q4)
      .word    04eh        ;(39)D_SlpeM (modulator decay slope)
(Q4)
        .word  0                ;(40)S_SlpeM (modulator sustain
slope) (Q4)
      .word    3FFFh            ;(41)S_LevlM (modulator sustain
level)
      .word    00a0h            ;(42)R_SlpeM (modulator release
slope)
(Q4)
        .word   7FFFh            ;(43)Level_C (carrier envelope
level scale)
        .word   7FFFh            ;(44)EnvMSB_C (carrier running
envelope)
        .word  0                 ;(45)EnvLSB_C (carrier running
envelope)
        .word  0                  ;(46)C_Rnge (carrier envelope
range)
      .word   7FFFh           ;(47)A_SlpeC (carrier attack slope)
  (Q4)
      .word    04eh        ;(48)D_SlpeC (carrier decay slope)
(Q4)
```

```
        .word   0                   ;(49)S_SlpeC (carrier sustain
slope)   (Q4)
        .word   0                   ;(50)S_LevlC (carrier sustain
level)
      .word    0370h          ;(51)R_SlpeC (carrier release slope)
 (Q4)
;Carrier Oscillator control data
      .word     0183h          ;(52)Nom_PchC nominal pitch (input
to
LFO)
      .word     0183h          ;(53)Pch_StpC runnung pitch step {
Q9 frac.
portion used }
      .word     OutCarT    ;(54)Out_PtrC pointer to top of voice
output
buffer
      .word     SIN128     ;(55)Tbl_PtrC running pointer to wave
table (AR4)
      .word     0         ;(56)Run_ValC running wave value { Q9 },
TableOffset.Frac
      .word     SIN128    ;(57)TblBaseC Address for the 129 sample
wave
table
      .word     7FFFh          ;(58)MaskMSBC used in AND when
sending sample to DAC
;16 word voice output buffer
outVoic7 .space 16*FRAMESIZ     ;(59)outVoice Synthesizer's voice
out buffer
                     ;(75)
*****************************************************************
*************
;  pointer references
Voice8:
      .word     A_Reg_0   ;( 0)A_Vce_St (address of voice status
table)
```

```
      .word      SpecTab0   ;( 1)pSpecSer (ptr to Spectral Series
Tbl)
         .word   FRQ_L+0         ;( 2)V_Frq_L (voice FRQ_L register
address)
         .word    MULTI+0           ;( 3)P_Multi (percussive voice
MULTI address)
         .word    FRQ_L+0           ;( 4)P_Frq_L (percussive voice
FRQ_L address)
      .word       0       ;( 5)pEm pointer to Mod. Envelope address
         .word     EMode1          ;( 6)EModFunc Engine Mode Func.
address
; running voice control data - Mode, Spectral Mod., Noise, Mix
      .word      0          ;( 7)EMode (eng. 1-mel,2-perc1,3-perc3)

;xlat
         .word   0306h           ;( 8)Nom_Pch nominal pitch (input
to LFO)
         .word   0306h            ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
         .word   0                ;(12)Run_Val running wave value {
Q9 },
TableOffset.Frac
      .word      S8         ;(13)TblBase Address for the 129 sample
wave
table
      .word      7FFFh               ;(14)MaskMSB used in AND when
sending
sample to DAC
      .word outVoic8       ;(15)pointer to voice output buffer
         .word 0                  ;(16)ZMin1
```

```
        .word 0                 ;(17)Feedbk reg. feedback value
        .word 0                 ;(18)Fbk engine feedback factor
        .word 7FFFh             ;(19)MFbk (1-FBK)
      .word 0          ;(20)Em (EnvMSB_M * Level_M)
      .word 7FFFh          ;(21)One
      .word 7          ;(22)MCoeff_
      .word 7          ;(23)SRange (dynamic Series Range 0-8)
      .word 3330h          ;(24)AmpCar (dynamic Amp. of Car.)
      .word 0          ;(25)PanL
      .word 0          ;(26)PanR
      .word 0          ;(27)Ec (EnvMSB_C * Level_C)
;  register shadows for Note Update Logic
        .word 0                 ;(28)SFrq_L reg. shadow
        .word 0                 ;(29)SOn_OctF reg. shadow
        .word 0                 ;(30)MMulti reg. shadow
        .word 0                 ;(31)CMulti reg. shadow
        .word 0                 ;(32)MLevel reg. shadow
        .word 0                 ;(33)CLevel reg. shadow
;  envelope control data
        .word   7FFFh           ;(34)Level_M (modulator envelope
level scale)
      .word     0000h          ;(35)EnvMSB_M (modulator running
envelope)
      .word     0000h          ;(36)EnvLSB_M (modulator running
envelope)
      .word    0           ;(37)M_Rnge (modulator envelope range)
      .word     07eh         ;(38)A_SlpeM (modulator attack slope)
(Q4)
      .word     04eh         ;(39)D_SlpeM (modulator decay slope)
(Q4)
        .word  0                ;(40)S_SlpeM (modulator sustain
slope) (Q4)
      .word     3FFFh          ;(41)S_LevlM (modulator sustain
level)
      .word     00a0h          ;(42)R_SlpeM (modulator release
```

```
slope)
(Q4)
        .word    7FFFh              ;(43)Level_C (carrier envelope
level scale)
        .word  7FFFh        ;(44)EnvMSB_C (carrier running envelope)
        .word   0                   ;(45)EnvLSB_C (carrier running
envelope)
        .word   0                    ;(46)C_Rnge (carrier envelope
range)
      .word    7FFFh            ;(47)A_SlpeC (carrier attack slope)
  (Q4)
      .word     04eh         ;(48)D_SlpeC (carrier decay slope)
(Q4)
        .word   0                   ;(49)S_SlpeC (carrier sustain
slope)   (Q4)
        .word   0                   ;(50)S_LevlC (carrier sustain
level)
      .word    0370h           ;(51)R_SlpeC (carrier release slope)
 (Q4)
;Carrier Oscillator control data
      .word     0183h           ;(52)Nom_PchC nominal pitch (input
to
LFO)
      .word     0183h           ;(53)Pch_StpC runnung pitch step {
Q9 frac.
portion used }
      .word     OutCarT     ;(54)Out_PtrC pointer to top of voice
output
buffer
      .word      SIN128     ;(55)Tbl_PtrC running pointer to wave
table (AR4)
      .word     0         ;(56)Run_ValC running wave value { Q9 },
TableOffset.Frac
      .word     SIN128    ;(57)TblBaseC Address for the 129 sample
wave
```

```
table
      .word     7FFFh           ;(58)MaskMSBC used in AND when
sending sample to DAC
;16 word voice output buffer
outVoic8 .space 16*FRAMESIZ     ;(59)outVoice Synthesizer's voice
out buffer
                    ;(75)
*****************************************************************
*************
;  pointer references
Voice9:
      .word     A_Reg_0    ;( 0)A_Vce_St (address of voice status
table)
      .word     SpecTab0   ;( 1)pSpecSer (ptr to Spectral Series
Tbl)
         .word  FRQ_L+0        ;( 2)V_Frq_L (voice FRQ_L register
address)
         .word  MULTI+0           ;( 3)P_Multi (percussive voice
MULTI address)
         .word  FRQ_L+0           ;( 4)P_Frq_L (percussive voice
FRQ_L address)
      .word     0       ;( 5)pEm pointer to Mod. Envelope address
         .word  EMode1           ;( 6)EModFunc Engine Mode Func.
address
; running voice control data - Mode, Spectral Mod., Noise, Mix
      .word     0          ;( 7)EMode (eng. 1-mel,2-perc1,3-perc3)

;xlat
         .word  0306h           ;( 8)Nom_Pch nominal pitch (input
to LFO)
         .word  0306h            ;( 9)Pch_Step runnung pitch step
{ Q9 frac. portion
used }
      .word     OutModT    ;(10)Out_Ptr pointer to top of voice
output buffer
```

```
      .word      S8          ;(11)Tabl_Ptr running pointer to wave
table (AR4)
         .word   0                ;(12)Run_Val running wave value {
Q9 },
TableOffset.Frac
      .word      S8         ;(13)TblBase Address for the 129 sample
wave
table
      .word      7FFFh                ;(14)MaskMSB used in AND when
sending
sample to DAC
      .word outVoic9       ;(15)pointer to voice output buffer
         .word 0                  ;(16)ZMin1
         .word 0                  ;(17)Feedbk reg. feedback value
         .word 0                  ;(18)Fbk engine feedback factor
         .word 7FFFh              ;(19)MFbk (1-FBK)
      .word 0         ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 3330h          ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
         .word 0                  ;(28)SFrq_L reg. shadow
         .word 0                  ;(29)SOn_OctF reg. shadow
         .word 0                  ;(30)MMulti reg. shadow
         .word 0                  ;(31)CMulti reg. shadow
         .word 0                  ;(32)MLevel reg. shadow
         .word 0                  ;(33)CLevel reg. shadow
;  envelope control data
         .word   7FFFh            ;(34)Level_M (modulator envelope
level scale)
      .word      0000h          ;(35)EnvMSB_M (modulator running
```

```
envelope)
      .word     0000h          ;(36)EnvLSB_M (modulator running
envelope)
      .word    0          ;(37)M_Rnge (modulator envelope range)
      .word     07eh        ;(38)A_SlpeM (modulator attack slope)
(Q4)
      .word     04eh        ;(39)D_SlpeM (modulator decay slope)
(Q4)
         .word  0                ;(40)S_SlpeM (modulator sustain
slope) (Q4)
      .word     3FFFh             ;(41)S_LevlM (modulator sustain
level)
      .word     00a0h             ;(42)R_SlpeM (modulator release
slope)
(Q4)
         .word   7FFFh             ;(43)Level_C (carrier envelope
level scale)
         .word   7FFFh             ;(44)EnvMSB_C (carrier running
envelope)
         .word  0                  ;(45)EnvLSB_C (carrier running
envelope)
         .word  0                   ;(46)C_Rnge (carrier envelope
range)
      .word    7FFFh           ;(47)A_SlpeC (carrier attack slope)
  (Q4)
      .word     04eh        ;(48)D_SlpeC (carrier decay slope)
(Q4)
         .word  0                   ;(49)S_SlpeC (carrier sustain
slope)   (Q4)
         .word  0                   ;(50)S_LevlC (carrier sustain
level)
      .word    0370h          ;(51)R_SlpeC (carrier release slope)
 (Q4)
;Carrier Oscillator control data
      .word     0183h          ;(52)Nom_PchC nominal pitch (input
```

```
to
LFO)
      .word     0183h          ;(53)Pch_StpC runnung pitch step {
Q9 frac.
portion used }
      .word     OutCarT    ;(54)Out_PtrC pointer to top of voice
output
buffer
      .word     SIN128     ;(55)Tbl_PtrC running pointer to wave
table (AR4)
      .word     0         ;(56)Run_ValC running wave value { Q9 },
TableOffset.Frac
      .word     SIN128    ;(57)TblBaseC Address for the 129 sample
wave
table
      .word     7FFFh          ;(58)MaskMSBC used in AND when
sending sample to DAC
;16 word voice output buffer
outVoic9 .space 16*FRAMESIZ     ;(59)outVoice Synthesizer's voice
out buffer
                    ;(75)
*****************************************************************
*************
;  pointer references
Voice10:
      .word     A_Reg_0   ;( 0)A_Vce_St (address of voice status
table)
      .word     SpecTab0  ;( 1)pSpecSer (ptr to Spectral Series
Tbl)
        .word   FRQ_L+0        ;( 2)V_Frq_L (voice FRQ_L register
address)
        .word   MULTI+0          ;( 3)P_Multi (percussive voice
MULTI address)
        .word   FRQ_L+0          ;( 4)P_Frq_L (percussive voice
FRQ_L address)
```

```
      .word      0        ;( 5)pEm pointer to Mod. Envelope address
         .word    EMode1          ;( 6)EModFunc Engine Mode Func.
address
; running voice control data - Mode, Spectral Mod., Noise, Mix
      .word     0          ;( 7)EMode (eng. 1-mel,2-perc1,3-perc3)

;xlat
         .word   0306h           ;( 8)Nom_Pch nominal pitch (input
to LFO)
         .word   0306h           ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
         .word   0               ;(12)Run_Val running wave value {
Q9 },
TableOffset.Frac
      .word     S8        ;(13)TblBase Address for the 129 sample
wave
table
      .word     7FFFh               ;(14)MaskMSB used in AND when
sending
sample to DAC
      .word outVce10      ;(15)pointer to voice output buffer
         .word 0                 ;(16)ZMin1
         .word 0                 ;(17)Feedbk reg. feedback value
         .word 0                 ;(18)Fbk engine feedback factor
         .word 7FFFh             ;(19)MFbk (1-FBK)
      .word 0         ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 3330h          ;(24)AmpCar (dynamic Amp. of Car.)
```

```
        .word 0          ;(25)PanL
        .word 0          ;(26)PanR
        .word 0          ;(27)Ec (EnvMSB_C * Level_C)
;  register shadows for Note Update Logic
            .word 0                  ;(28)SFrq_L reg. shadow
            .word 0                  ;(29)SOn_OctF reg. shadow
            .word 0                  ;(30)MMulti reg. shadow
            .word 0                  ;(31)CMulti reg. shadow
            .word 0                  ;(32)MLevel reg. shadow
            .word 0                  ;(33)CLevel reg. shadow
;  envelope control data
            .word   7FFFh            ;(34)Level_M (modulator envelope
level scale)
        .word     0000h          ;(35)EnvMSB_M (modulator running
envelope)
        .word     0000h          ;(36)EnvLSB_M (modulator running
envelope)
        .word    0           ;(37)M_Rnge (modulator envelope range)
        .word     07eh        ;(38)A_SlpeM (modulator attack slope)
(Q4)
        .word     04eh        ;(39)D_SlpeM (modulator decay slope)
(Q4)
            .word  0                 ;(40)S_SlpeM (modulator sustain
slope) (Q4)
        .word     3FFFh              ;(41)S_LevlM (modulator sustain
level)
        .word     00a0h              ;(42)R_SlpeM (modulator release
slope)
(Q4)
            .word   7FFFh             ;(43)Level_C (carrier envelope
level scale)
            .word   7FFFh             ;(44)EnvMSB_C (carrier running
envelope)
            .word  0                  ;(45)EnvLSB_C (carrier running
envelope)
```

```
        .word   0                   ;(46)C_Rnge (carrier envelope
range)
      .word    7FFFh            ;(47)A_SlpeC (carrier attack slope)
  (Q4)
      .word     04eh          ;(48)D_SlpeC (carrier decay slope)
(Q4)
        .word   0                   ;(49)S_SlpeC (carrier sustain
slope)   (Q4)
        .word   0                   ;(50)S_LevlC (carrier sustain
level)
      .word    0370h           ;(51)R_SlpeC (carrier release slope)
 (Q4)
;Carrier Oscillator control data
      .word     0183h           ;(52)Nom_PchC nominal pitch (input
to
LFO)
      .word     0183h           ;(53)Pch_StpC runnung pitch step {
Q9 frac.
portion used }
      .word     OutCarT     ;(54)Out_PtrC pointer to top of voice
output
buffer
      .word      SIN128     ;(55)Tbl_PtrC running pointer to wave
table (AR4)
      .word     0          ;(56)Run_ValC running wave value { Q9 },
TableOffset.Frac
      .word     SIN128    ;(57)TblBaseC Address for the 129 sample
wave
table
      .word     7FFFh           ;(58)MaskMSBC used in AND when
sending sample to DAC
;16 word voice output buffer
outVce10 .space 16*FRAMESIZ     ;(59)outVoice Synthesizer's voice
out buffer
                    ;(75)
```

```
*****************************************************************
*************
;  pointer references
Voice11:
      .word      A_Reg_0    ;( 0)A_Vce_St (address of voice status
table)
      .word      SpecTab0   ;( 1)pSpecSer (ptr to Spectral Series
Tbl)
         .word   FRQ_L+0         ;( 2)V_Frq_L (voice FRQ_L register
address)
         .word    MULTI+0           ;( 3)P_Multi (percussive voice
MULTI address)
         .word    FRQ_L+0           ;( 4)P_Frq_L (percussive voice
FRQ_L address)
      .word       0       ;( 5)pEm pointer to Mod. Envelope address
         .word     EMode1          ;( 6)EModFunc Engine Mode Func.
address
; running voice control data - Mode, Spectral Mod., Noise, Mix
      .word      0          ;( 7)EMode (eng. 1-mel,2-perc1,3-perc3)

;xlat
         .word   0306h           ;( 8)Nom_Pch nominal pitch (input
to LFO)
         .word   0306h            ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
         .word   0               ;(12)Run_Val running wave value {
Q9 },
TableOffset.Frac
      .word      S8        ;(13)TblBase Address for the 129 sample
wave
```

```
table
      .word     7FFFh                ;(14)MaskMSB used in AND when
sending
sample to DAC
      .word outVce11       ;(15)pointer to voice output buffer
         .word 0                   ;(16)ZMin1
         .word 0                   ;(17)Feedbk reg. feedback value
         .word 0                   ;(18)Fbk engine feedback factor
         .word 7FFFh               ;(19)MFbk (1-FBK)
      .word 0         ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 3330h          ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
         .word 0                   ;(28)SFrq_L reg. shadow
         .word 0                   ;(29)SOn_OctF reg. shadow
         .word 0                   ;(30)MMulti reg. shadow
         .word 0                   ;(31)CMulti reg. shadow
         .word 0                   ;(32)MLevel reg. shadow
         .word 0                   ;(33)CLevel reg. shadow
;  envelope control data
         .word   7FFFh             ;(34)Level_M (modulator envelope
level scale)
      .word     0000h           ;(35)EnvMSB_M (modulator running
envelope)
      .word     0000h           ;(36)EnvLSB_M (modulator running
envelope)
      .word    0           ;(37)M_Rnge (modulator envelope range)
      .word     07eh         ;(38)A_SlpeM (modulator attack slope)
(Q4)
      .word     04eh         ;(39)D_SlpeM (modulator decay slope)
```

```
(Q4)
        .word   0                   ;(40)S_SlpeM (modulator sustain
slope) (Q4)
      .word     3FFFh               ;(41)S_LevlM (modulator sustain
level)
      .word     00a0h               ;(42)R_SlpeM (modulator release
slope)
(Q4)
        .word   7FFFh               ;(43)Level_C (carrier envelope
level scale)
        .word   7FFFh               ;(44)EnvMSB_C (carrier running
envelope)
        .word   0                   ;(45)EnvLSB_C (carrier running
envelope)
        .word   0                   ;(46)C_Rnge (carrier envelope
range)
      .word    7FFFh            ;(47)A_SlpeC (carrier attack slope)
  (Q4)
      .word     04eh          ;(48)D_SlpeC (carrier decay slope)
(Q4)
        .word   0                   ;(49)S_SlpeC (carrier sustain
slope)   (Q4)
        .word   0                   ;(50)S_LevlC (carrier sustain
level)
      .word    0370h           ;(51)R_SlpeC (carrier release slope)
 (Q4)
;Carrier Oscillator control data
      .word     0183h           ;(52)Nom_PchC nominal pitch (input
to
LFO)
      .word     0183h           ;(53)Pch_StpC runnung pitch step {
Q9 frac.
portion used }
      .word     OutCarT     ;(54)Out_PtrC pointer to top of voice
output
```

```
buffer
      .word      SIN128     ;(55)Tbl_PtrC running pointer to wave
table (AR4)
      .word     0          ;(56)Run_ValC running wave value { Q9 },
TableOffset.Frac
      .word     SIN128     ;(57)TblBaseC Address for the 129 sample
wave
table
      .word     7FFFh           ;(58)MaskMSBC used in AND when
sending sample to DAC
;16 word voice output buffer
outVcell .space 16*FRAMESIZ     ;(59)outVoice Synthesizer's voice
out buffer
                     ;(75)
*****************************************************************
*************
;  pointer references
Voice12:
      .word      A_Reg_0    ;( 0)A_Vce_St (address of voice status
table)
      .word      SpecTab0   ;( 1)pSpecSer (ptr to Spectral Series
Tbl)
         .word   FRQ_L+0         ;( 2)V_Frq_L (voice FRQ_L register
address)
         .word    MULTI+0           ;( 3)P_Multi (percussive voice
MULTI address)
         .word    FRQ_L+0           ;( 4)P_Frq_L (percussive voice
FRQ_L address)
      .word       0       ;( 5)pEm pointer to Mod. Envelope address
         .word     EMode1          ;( 6)EModFunc Engine Mode Func.
address
; running voice control data - Mode, Spectral Mod., Noise, Mix
      .word      0          ;( 7)EMode (eng. 1-mel,2-perc1,3-perc3)

;xlat
```

```
      .word     03CFh          ;( 8)Nom_Pch nominal pitch (input to
LFO)
      .word     03CFh          ;( 9)Pch_Step runnung pitch step {
Q9 frac.
portion used }
      .word      OutModT    ;(10)Out_Ptr pointer to top of voice
output buffer
      .word      S8         ;(11)Tabl_Ptr running pointer to wave
table (AR4)
         .word   0               ;(12)Run_Val running wave value {
Q9 },
TableOffset.Frac
      .word     S8         ;(13)TblBase Address for the 129 sample
wave
table
      .word     7FFFh              ;(14)MaskMSB used in AND when
sending
sample to DAC
      .word outVce12       ;(15)pointer to voice output buffer
         .word 0                 ;(16)ZMin1
         .word 0                 ;(17)Feedbk reg. feedback value
         .word 0                 ;(18)Fbk engine feedback factor
         .word 7FFFh             ;(19)MFbk (1-FBK)
      .word 0         ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 0         ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
         .word 0                 ;(28)SFrq_L reg. shadow
         .word 0                 ;(29)SOn_OctF reg. shadow
         .word 0                 ;(30)MMulti reg. shadow
```

```
        .word 0                 ;(31)CMulti reg. shadow
        .word 0                 ;(32)MLevel reg. shadow
        .word 0                 ;(33)CLevel reg. shadow
;  envelope control data
        .word   7FFFh           ;(34)Level_M (modulator envelope
level scale)
      .word     0000h          ;(35)EnvMSB_M (modulator running
envelope)
      .word     0000h          ;(36)EnvLSB_M (modulator running
envelope)
      .word    0           ;(37)M_Rnge (modulator envelope range)
      .word     05eh        ;(38)A_SlpeM (modulator attack slope)
(Q4)
      .word     05eh        ;(39)D_SlpeM (modulator decay slope)
(Q4)
        .word  0                ;(40)S_SlpeM (modulator sustain
slope) (Q4)
      .word     3FFFh           ;(41)S_LevlM (modulator sustain
level)
      .word     0070h           ;(42)R_SlpeM (modulator release
slope)
(Q4)
        .word   7FFFh           ;(43)Level_C (carrier envelope
level scale)
        .word   7FFFh           ;(44)EnvMSB_C (carrier running
envelope)
        .word  0                ;(45)EnvLSB_C (carrier running
envelope)
        .word  0                ;(46)C_Rnge (carrier envelope
range)
      .word    7FFFh          ;(47)A_SlpeC (carrier attack slope)
  (Q4)
      .word     03eh        ;(48)D_SlpeC (carrier decay slope)
(Q4)
        .word  0                ;(49)S_SlpeC (carrier sustain
```

```
slope)   (Q4)
         .word   0                    ;(50)S_LevlC (carrier sustain
level)
      .word    0270h          ;(51)R_SlpeC (carrier release slope)
 (Q4)
;Carrier Oscillator control data
      .word     01e8h           ;(52)Nom_PchC nominal pitch (input
to
LFO)
      .word     01e8h           ;(53)Pch_StpC runnung pitch step {
Q9 frac.
portion used }
      .word     OutCarT     ;(54)Out_PtrC pointer to top of voice
output
buffer
      .word      SIN128     ;(55)Tbl_PtrC running pointer to wave
table (AR4)
      .word     0         ;(56)Run_ValC running wave value { Q9 },
TableOffset.Frac
      .word     SIN128    ;(57)TblBaseC Address for the 129 sample
wave
table
      .word     7FFFh           ;(58)MaskMSBC used in AND when
sending sample to DAC
;16 word voice output buffer
outVce12 .space 16*FRAMESIZ     ;(59)outVoice Synthesizer's voice
out buffer
                     ;(75)
*****************************************************************
*************
;  pointer references
Voice13:
      .word   A_Reg_0  ;( 0)A_Vce_St (address of voice status table)
      .word      SpecTab0  ;( 1)pSpecSer (ptr to Spectral Series
Tbl)
```

```
        .word   FRQ_L+0         ;( 2)V_Frq_L (voice FRQ_L register
address)
        .word    MULTI+0          ;( 3)P_Multi (percussive voice
MULTI address)
        .word    FRQ_L+0          ;( 4)P_Frq_L (percussive voice
FRQ_L address)
      .word       0       ;( 5)pEm pointer to Mod. Envelope address
        .word     EMode1          ;( 6)EModFunc Engine Mode Func.
address
; running voice control data - Mode, Spectral Mod., Noise, Mix
      .word      0          ;( 7)EMode (eng. 1-mel,2-perc1,3-perc3)

;xlat
        .word   0306h           ;( 8)Nom_Pch nominal pitch (input
to LFO)
        .word   0306h           ;( 9)Pch_Step runnung pitch step
{ Q9 frac. portion
used }
      .word       OutModT    ;(10)Out_Ptr pointer to top of voice
output buffer
      .word      S8         ;(11)Tabl_Ptr running pointer to wave
table (AR4)
        .word   0               ;(12)Run_Val running wave value {
Q9 },
TableOffset.Frac
      .word      S8        ;(13)TblBase Address for the 129 sample
wave
table
      .word      7FFFh              ;(14)MaskMSB used in AND when
sending
sample to DAC
      .word outVce13      ;(15)pointer to voice output buffer
        .word 0                 ;(16)ZMin1
        .word 0                 ;(17)Feedbk reg. feedback value
        .word 0                 ;(18)Fbk engine feedback factor
```

```
        .word 7FFFh                ;(19)MFbk (1-FBK)
      .word 0          ;(20)Em (EnvMSB_M * Level_M)
      .word 7FFFh          ;(21)One
      .word 7          ;(22)MCoeff_
      .word 7          ;(23)SRange (dynamic Series Range 0-8)
      .word 0          ;(24)AmpCar (dynamic Amp. of Car.)
      .word 0          ;(25)PanL
      .word 0          ;(26)PanR
      .word 0          ;(27)Ec (EnvMSB_C * Level_C)
;  register shadows for Note Update Logic
        .word 0                    ;(28)SFrq_L reg. shadow
        .word 0                    ;(29)SOn_OctF reg. shadow
        .word 0                    ;(30)MMulti reg. shadow
        .word 0                    ;(31)CMulti reg. shadow
        .word 0                    ;(32)MLevel reg. shadow
        .word 0                    ;(33)CLevel reg. shadow
;  envelope control data
        .word   7FFFh              ;(34)Level_M (modulator envelope
level scale)
      .word     0000h          ;(35)EnvMSB_M (modulator running
envelope)
      .word     0000h          ;(36)EnvLSB_M (modulator running
envelope)
      .word    0          ;(37)M_Rnge (modulator envelope range)
      .word     07eh        ;(38)A_SlpeM (modulator attack slope)
(Q4)
      .word     04eh        ;(39)D_SlpeM (modulator decay slope)
(Q4)
        .word  0                   ;(40)S_SlpeM (modulator sustain
slope) (Q4)
      .word     3FFFh              ;(41)S_LevlM (modulator sustain
level)
      .word     00a0h              ;(42)R_SlpeM (modulator release
slope)
(Q4)
```

```
        .word    7FFFh              ;(43)Level_C (carrier envelope
level scale)
        .word    7FFFh              ;(44)EnvMSB_C (carrier running
envelope)
        .word   0                   ;(45)EnvLSB_C (carrier running
envelope)
        .word   0                    ;(46)C_Rnge (carrier envelope
range)
      .word    7FFFh           ;(47)A_SlpeC (carrier attack slope)
  (Q4)
      .word     04eh        ;(48)D_SlpeC (carrier decay slope)
(Q4)
        .word   0                    ;(49)S_SlpeC (carrier sustain
slope)   (Q4)
        .word   0                    ;(50)S_LevlC (carrier sustain
level)
      .word    0370h          ;(51)R_SlpeC (carrier release slope)
 (Q4)
;Carrier Oscillator control data
      .word     0183h           ;(52)Nom_PchC nominal pitch (input
to
LFO)
      .word     0183h           ;(53)Pch_StpC runnung pitch step {
Q9 frac.
portion used }
      .word     OutCarT     ;(54)Out_PtrC pointer to top of voice
output
buffer
      .word      SIN128     ;(55)Tbl_PtrC running pointer to wave
table (AR4)
      .word     0         ;(56)Run_ValC running wave value { Q9 },
TableOffset.Frac
      .word     SIN128    ;(57)TblBaseC Address for the 129 sample
wave
table
```

```
      .word     7FFFh          ;(58)MaskMSBC used in AND when
sending sample to DAC
;16 word voice output buffer
outVce13 .space 16*FRAMESIZ     ;(59)outVoice Synthesizer's voice
out buffer
                    ;(75)
*****************************************************************
*************
;  pointer references
Voice14:
      .word     A_Reg_0    ;( 0)A_Vce_St (address of voice status
table)
      .word     SpecTab0   ;( 1)pSpecSer (ptr to Spectral Series
Tbl)
         .word  FRQ_L+0        ;( 2)V_Frq_L (voice FRQ_L register
address)
         .word  MULTI+0          ;( 3)P_Multi (percussive voice
MULTI address)
         .word  FRQ_L+0          ;( 4)P_Frq_L (percussive voice
FRQ_L address)
      .word     0       ;( 5)pEm pointer to Mod. Envelope address
         .word   EMode1          ;( 6)EModFunc Engine Mode Func.
address
; running voice control data - Mode, Spectral Mod., Noise, Mix
      .word     0          ;( 7)EMode (eng. 1-mel,2-perc1,3-perc3)

;xlat
         .word  0306h           ;( 8)Nom_Pch nominal pitch (input
to LFO)
         .word  0306h            ;( 9)Pch_Step runnung pitch step
{ Q9 frac. portion
used }
      .word     OutModT    ;(10)Out_Ptr pointer to top of voice
output buffer
      .word     S8         ;(11)Tabl_Ptr running pointer to wave
```

```
table (AR4)
        .word   0               ;(12)Run_Val running wave value {
Q9 },
TableOffset.Frac
      .word     S8        ;(13)TblBase Address for the 129 sample
wave
table
      .word     7FFFh               ;(14)MaskMSB used in AND when
sending
sample to DAC
      .word outVce14      ;(15)pointer to voice output buffer
         .word 0                 ;(16)ZMin1
         .word 0                 ;(17)Feedbk reg. feedback value
         .word 0                 ;(18)Fbk engine feedback factor
         .word 7FFFh             ;(19)MFbk (1-FBK)
      .word 0         ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 3330h          ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
         .word 0                 ;(28)SFrq_L reg. shadow
         .word 0                 ;(29)SOn_OctF reg. shadow
         .word 0                 ;(30)MMulti reg. shadow
         .word 0                 ;(31)CMulti reg. shadow
         .word 0                 ;(32)MLevel reg. shadow
         .word 0                 ;(33)CLevel reg. shadow
;  envelope control data
         .word   7FFFh           ;(34)Level_M (modulator envelope
level scale)
      .word     0000h          ;(35)EnvMSB_M (modulator running
envelope)
```

```
        .word     0000h          ;(36)EnvLSB_M (modulator running
envelope)
        .word     0            ;(37)M_Rnge (modulator envelope range)
        .word     07eh          ;(38)A_SlpeM (modulator attack slope)
(Q4)
        .word     04eh          ;(39)D_SlpeM (modulator decay slope)
(Q4)
          .word   0                  ;(40)S_SlpeM (modulator sustain
slope) (Q4)
        .word     3FFFh              ;(41)S_LevlM (modulator sustain
level)
        .word     00a0h              ;(42)R_SlpeM (modulator release
slope)
(Q4)
          .word   7FFFh              ;(43)Level_C (carrier envelope
level scale)
          .word   7FFFh              ;(44)EnvMSB_C (carrier running
envelope)
          .word   0                  ;(45)EnvLSB_C (carrier running
envelope)
          .word   0                  ;(46)C_Rnge (carrier envelope
range)
        .word     7FFFh            ;(47)A_SlpeC (carrier attack slope)
  (Q4)
        .word     04eh          ;(48)D_SlpeC (carrier decay slope)
(Q4)
          .word   0                  ;(49)S_SlpeC (carrier sustain
slope)   (Q4)
          .word   0                  ;(50)S_LevlC (carrier sustain
level)
        .word     0370h           ;(51)R_SlpeC (carrier release slope)
 (Q4)
;Carrier Oscillator control data
        .word     0183h           ;(52)Nom_PchC nominal pitch (input
to
```

```
LFO)
        .word     0183h          ;(53)Pch_StpC runnung pitch step {
Q9 frac.
portion used }
        .word     OutCarT     ;(54)Out_PtrC pointer to top of voice
output
buffer
        .word     SIN128      ;(55)Tbl_PtrC running pointer to wave
table (AR4)
        .word     0          ;(56)Run_ValC running wave value { Q9 },
TableOffset.Frac
        .word     SIN128     ;(57)TblBaseC Address for the 129 sample
wave
table
        .word     7FFFh          ;(58)MaskMSBC used in AND when
sending sample to DAC
;16 word voice output buffer
outVce14 .space 16*FRAMESIZ     ;(59)outVoice Synthesizer's voice
out buffer
                        ;(75)
*****************************************************************
*************
;  pointer references
Voice15:
        .word     A_Reg_0    ;( 0)A_Vce_St (address of voice status
table)
        .word     SpecTab0   ;( 1)pSpecSer (ptr to Spectral Series
Tbl)
          .word   FRQ_L+0         ;( 2)V_Frq_L (voice FRQ_L register
address)
          .word   MULTI+0            ;( 3)P_Multi (percussive voice
MULTI address)
          .word   FRQ_L+0            ;( 4)P_Frq_L (percussive voice
FRQ_L address)
        .word     0        ;( 5)pEm pointer to Mod. Envelope address
```

```
        .word     EMode1              ;( 6)EModFunc Engine Mode Func.
address
; running voice control data - Mode, Spectral Mod., Noise, Mix
      .word      0              ;( 7)EMode (eng. 1-mel,2-perc1,3-perc3)
;xlat
        .word   0306h             ;( 8)Nom_Pch nominal pitch (input
to LFO)
        .word   0306h             ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
        .word   0                 ;(12)Run_Val running wave value {
Q9 },
TableOffset.Frac
      .word      S8         ;(13)TblBase Address for the 129 sample
wave
table
      .word      7FFFh              ;(14)MaskMSB used in AND when
sending
sample to DAC
      .word outVce15       ;(15)pointer to voice output buffer
         .word 0                 ;(16)ZMin1
         .word 0                 ;(17)Feedbk reg. feedback value
         .word 0                 ;(18)Fbk engine feedback factor
         .word 7FFFh             ;(19)MFbk (1-FBK)
     .word 0          ;(20)Em (EnvMSB_M * Level_M)
     .word 7FFFh          ;(21)One
     .word 7          ;(22)MCoeff_
     .word 7          ;(23)SRange (dynamic Series Range 0-8)
     .word 3330h          ;(24)AmpCar (dynamic Amp. of Car.)
     .word 0          ;(25)PanL
```

```
        .word 0          ;(26)PanR
        .word 0          ;(27)Ec (EnvMSB_C * Level_C)
;  register shadows for Note Update Logic
          .word 0                    ;(28)SFrq_L reg. shadow
          .word 0                    ;(29)SOn_OctF reg. shadow
          .word 0                    ;(30)MMulti reg. shadow
          .word 0                    ;(31)CMulti reg. shadow
          .word 0                    ;(32)MLevel reg. shadow
          .word 0                    ;(33)CLevel reg. shadow
;  envelope control data
          .word   7FFFh              ;(34)Level_M (modulator envelope
level scale)
       .word      0000h            ;(35)EnvMSB_M (modulator running
envelope)
       .word      0000h            ;(36)EnvLSB_M (modulator running
envelope)
       .word     0            ;(37)M_Rnge (modulator envelope range)
       .word     07eh          ;(38)A_SlpeM (modulator attack slope)
(Q4)
       .word     04eh          ;(39)D_SlpeM (modulator decay slope)
(Q4)
          .word  0                   ;(40)S_SlpeM (modulator sustain
slope) (Q4)
       .word     3FFFh              ;(41)S_LevlM (modulator sustain
level)
       .word     00a0h              ;(42)R_SlpeM (modulator release
slope)
(Q4)
          .word   7FFFh              ;(43)Level_C (carrier envelope
level scale)
          .word   7FFFh              ;(44)EnvMSB_C (carrier running
envelope)
          .word  0                   ;(45)EnvLSB_C (carrier running
envelope)
          .word  0                   ;(46)C_Rnge (carrier envelope
```

```
range)
        .word    7FFFh            ;(47)A_SlpeC (carrier attack slope)
  (Q4)
        .word    04eh           ;(48)D_SlpeC (carrier decay slope)
(Q4)
          .word  0                     ;(49)S_SlpeC (carrier sustain
slope)   (Q4)
          .word  0                     ;(50)S_LevlC (carrier sustain
level)
        .word    0370h           ;(51)R_SlpeC (carrier release slope)
 (Q4)
;Carrier Oscillator control data
        .word    0183h            ;(52)Nom_PchC nominal pitch (input
to
LFO)
        .word    0183h            ;(53)Pch_StpC runnung pitch step {
Q9 frac.
portion used }
        .word    OutCarT     ;(54)Out_PtrC pointer to top of voice
output
buffer
        .word    SIN128      ;(55)Tbl_PtrC running pointer to wave
table (AR4)
        .word    0          ;(56)Run_ValC running wave value { Q9 },
TableOffset.Frac
        .word    SIN128     ;(57)TblBaseC Address for the 129 sample
wave
table
        .word    7FFFh           ;(58)MaskMSBC used in AND when
sending sample to DAC
;16 word voice output buffer
outVce15 .space 16*FRAMESIZ      ;(59)outVoice Synthesizer's voice
out buffer
                    ;(75)
*******************************************************************
```

```
*************
;  pointer references
Voice16:
      .word      A_Reg_0    ;( 0)A_Vce_St (address of voice status
table)
      .word      SpecTab0   ;( 1)pSpecSer (ptr to Spectral Series
Tbl)
         .word   FRQ_L+0         ;( 2)V_Frq_L (voice FRQ_L register
address)
         .word    MULTI+0           ;( 3)P_Multi (percussive voice
MULTI address)
         .word    FRQ_L+0           ;( 4)P_Frq_L (percussive voice
FRQ_L address)
      .word       0       ;( 5)pEm pointer to Mod. Envelope address
         .word     EMode1          ;( 6)EModFunc Engine Mode Func.
address
; running voice control data - Mode, Spectral Mod., Noise, Mix
      .word      0          ;( 7)EMode (eng. 1-mel,2-perc1,3-perc3)

;xlat
         .word   0306h           ;( 8)Nom_Pch nominal pitch (input
to LFO)
         .word   0306h            ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
         .word   0               ;(12)Run_Val running wave value {
Q9 },
TableOffset.Frac
      .word      S8        ;(13)TblBase Address for the 129 sample
wave
table
```

```
        .word      7FFFh                ;(14)MaskMSB used in AND when
sending
sample to DAC
        .word outVce16       ;(15)pointer to voice output buffer
           .word 0                  ;(16)ZMin1
           .word 0                  ;(17)Feedbk reg. feedback value
           .word 0                  ;(18)Fbk engine feedback factor
           .word 7FFFh              ;(19)MFbk (1-FBK)
        .word 0          ;(20)Em (EnvMSB_M * Level_M)
        .word 7FFFh          ;(21)One
        .word 7          ;(22)MCoeff_
        .word 7          ;(23)SRange (dynamic Series Range 0-8)
        .word 3330h          ;(24)AmpCar (dynamic Amp. of Car.)
        .word 0          ;(25)PanL
        .word 0          ;(26)PanR
        .word 0          ;(27)Ec (EnvMSB_C * Level_C)
;  register shadows for Note Update Logic
           .word 0                  ;(28)SFrq_L reg. shadow
           .word 0                  ;(29)SOn_OctF reg. shadow
           .word 0                  ;(30)MMulti reg. shadow
           .word 0                  ;(31)CMulti reg. shadow
           .word 0                  ;(32)MLevel reg. shadow
           .word 0                  ;(33)CLevel reg. shadow
;  envelope control data
           .word   7FFFh            ;(34)Level_M (modulator envelope
level scale)
        .word      0000h          ;(35)EnvMSB_M (modulator running
envelope)
        .word      0000h          ;(36)EnvLSB_M (modulator running
envelope)
        .word     0           ;(37)M_Rnge (modulator envelope range)
        .word      07eh          ;(38)A_SlpeM (modulator attack slope)
(Q4)
        .word      04eh          ;(39)D_SlpeM (modulator decay slope)
(Q4)
```

```
        .word   0                   ;(40)S_SlpeM (modulator sustain
slope) (Q4)
      .word    3FFFh          ;(41)S_LevlM (modulator sustain level)
      .word     00a0h               ;(42)R_SlpeM (modulator release
slope)
(Q4)
        .word    7FFFh               ;(43)Level_C (carrier envelope
level scale)
        .word    7FFFh               ;(44)EnvMSB_C (carrier running
envelope)
        .word   0                    ;(45)EnvLSB_C (carrier running
envelope)
        .word   0                     ;(46)C_Rnge (carrier envelope
range)
      .word    7FFFh            ;(47)A_SlpeC (carrier attack slope)
  (Q4)
      .word     04eh         ;(48)D_SlpeC (carrier decay slope)
(Q4)
        .word   0                     ;(49)S_SlpeC (carrier sustain
slope)   (Q4)
        .word   0                     ;(50)S_LevlC (carrier sustain
level)
      .word    0370h           ;(51)R_SlpeC (carrier release slope)
 (Q4)
;Carrier Oscillator control data
      .word     0183h            ;(52)Nom_PchC nominal pitch (input
to
LFO)
      .word     0183h            ;(53)Pch_StpC runnung pitch step {
Q9 frac.
portion used }
      .word     OutCarT     ;(54)Out_PtrC pointer to top of voice
output
buffer
      .word     SIN128      ;(55)Tbl_PtrC running pointer to wave
```

```
table (AR4)
        .word     0          ;(56)Run_ValC running wave value { Q9 },
TableOffset.Frac
        .word     SIN128     ;(57)TblBaseC Address for the 129 sample
wave
table
        .word     7FFFh            ;(58)MaskMSBC used in AND when
sending sample to DAC
;16 word voice output buffer
outVce16 .space 16*FRAMESIZ      ;(59)outVoice Synthesizer's voice
out buffer
                        ;(75)
*****************************************************************
*************
;  pointer references
Voice17:
        .word     A_Reg_0    ;( 0)A_Vce_St (address of voice status
table)
        .word     SpecTab0   ;( 1)pSpecSer (ptr to Spectral Series
Tbl)
          .word   FRQ_L+0          ;( 2)V_Frq_L (voice FRQ_L register
address)
          .word   MULTI+0            ;( 3)P_Multi (percussive voice
MULTI address)
          .word   FRQ_L+0            ;( 4)P_Frq_L (percussive voice
FRQ_L address)
        .word     0        ;( 5)pEm pointer to Mod. Envelope address
          .word   EMode1             ;( 6)EModFunc Engine Mode Func.
address
; running voice control data - Mode, Spectral Mod., Noise, Mix
        .word     0          ;( 7)EMode (eng. 1-mel,2-perc1,3-perc3)

;xlat
          .word   0306h            ;( 8)Nom_Pch nominal pitch (input
to LFO)
```

```
        .word   0306h           ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
        .word   0               ;(12)Run_Val running wave value {
Q9 },
TableOffset.Frac
      .word      S8         ;(13)TblBase Address for the 129 sample
wave
table
      .word      7FFFh              ;(14)MaskMSB used in AND when
sending
sample to DAC
      .word outVce17       ;(15)pointer to voice output buffer
         .word 0                 ;(16)ZMin1
         .word 0                 ;(17)Feedbk reg. feedback value
         .word 0                 ;(18)Fbk engine feedback factor
         .word 7FFFh             ;(19)MFbk (1-FBK)
      .word 0         ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 3330h          ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
        .word 0                 ;(28)SFrq_L reg. shadow
        .word 0                 ;(29)SOn_OctF reg. shadow
        .word 0                 ;(30)MMulti reg. shadow
        .word 0                 ;(31)CMulti reg. shadow
        .word 0                 ;(32)MLevel reg. shadow
```

```
        .word 0                          ;(33)CLevel reg. shadow
;  envelope control data
        .word   7FFFh                    ;(34)Level_M (modulator envelope
level scale)
        .word     0000h                  ;(35)EnvMSB_M (modulator running
envelope)
        .word     0000h                  ;(36)EnvLSB_M (modulator running
envelope)
        .word     0                      ;(37)M_Rnge (modulator envelope range)
        .word     07eh                   ;(38)A_SlpeM (modulator attack slope)
(Q4)
        .word     04eh                   ;(39)D_SlpeM (modulator decay slope)
(Q4)
        .word  0                         ;(40)S_SlpeM (modulator sustain
slope) (Q4)
        .word     3FFFh                  ;(41)S_LevlM (modulator sustain
level)
        .word     00a0h                  ;(42)R_SlpeM (modulator release
slope)
(Q4)
        .word   7FFFh                    ;(43)Level_C (carrier envelope
level scale)
        .word   7FFFh                    ;(44)EnvMSB_C (carrier running
envelope)
        .word  0                         ;(45)EnvLSB_C (carrier running
envelope)
        .word  0                         ;(46)C_Rnge (carrier envelope
range)
        .word   7FFFh                    ;(47)A_SlpeC (carrier attack slope)
(Q4)
        .word     04eh                   ;(48)D_SlpeC (carrier decay slope)
(Q4)
        .word  0                         ;(49)S_SlpeC (carrier sustain
slope)  (Q4)
        .word  0                         ;(50)S_LevlC (carrier sustain
```

```
level)
        .word    0370h              ;(51)R_SlpeC (carrier release slope)
 (Q4)
;Carrier Oscillator control data
        .word     0183h              ;(52)Nom_PchC nominal pitch (input
to
LFO)
        .word     0183h              ;(53)Pch_StpC runnung pitch step {
Q9 frac.
portion used }
        .word     OutCarT     ;(54)Out_PtrC pointer to top of voice
output
buffer
        .word     SIN128      ;(55)Tbl_PtrC running pointer to wave
table (AR4)
        .word     0           ;(56)Run_ValC running wave value { Q9 },
TableOffset.Frac
        .word     SIN128      ;(57)TblBaseC Address for the 129 sample
wave
table
        .word     7FFFh              ;(58)MaskMSBC used in AND when
sending sample to DAC
;16 word voice output buffer
outVce17 .space 16*FRAMESIZ          ;(59)outVoice Synthesizer's voice
out buffer

                        ;(75)
*****************************************************************
*************
;  pointer references                ;KICK DRUM
Voice18:
        .word    A_Rhy_0            ;( 0)A_Vce_St (address of voice
status table)
        .word     SpecTab0    ;( 1)pSpecSer (ptr to Spectral Series
Tbl)
        .word    FRQ_L+0            ;( 2)V_Frq_L (voice FRQ_L register
```

```
address)
        .word    MULTI+0          ;( 3)P_Multi (percussive voice
MULTI address)
        .word    FRQ_L+0          ;( 4)P_Frq_L (percussive voice
FRQ_L address)
      .word       0       ;( 5)pEm pointer to Mod. Envelope address
        .word     EModeP1         ;( 6)EModFunc Engine Mode Func.
address
; running voice control data - Mode, Spectral Mod., Noise, Mix
      .word      0          ;( 7)EMode (eng. 1-mel,2-perc1,3-perc3)

;xlat
        .word   0306h          ;( 8)Nom_Pch nominal pitch (input
to LFO)
        .word   0306h           ;( 9)Pch_Step runnung pitch step
{ Q9 frac. portion
used }
      .word       OutModT    ;(10)Out_Ptr pointer to top of voice
output buffer
      .word      S8          ;(11)Tabl_Ptr running pointer to wave
table (AR4)
        .word   0               ;(12)Run_Val running wave value {
Q9 },
TableOffset.Frac
      .word      S8         ;(13)TblBase Address for the 129 sample
wave
table
      .word      7FFFh               ;(14)MaskMSB used in AND when
sending
sample to DAC
      .word outVce18       ;(15)pointer to voice output buffer
        .word 0                ;(16)ZMin1
        .word 0                ;(17)Feedbk reg. feedback value
        .word 0                ;(18)Fbk engine feedback factor
        .word 7FFFh            ;(19)MFbk (1-FBK)
```

```
        .word 0          ;(20)Em (EnvMSB_M * Level_M)
        .word 7FFFh          ;(21)One
        .word 7          ;(22)MCoeff_
        .word 7          ;(23)SRange (dynamic Series Range 0-8)
        .word 3330h          ;(24)AmpCar (dynamic Amp. of Car.)
        .word 0          ;(25)PanL
        .word 0          ;(26)PanR
        .word 0          ;(27)Ec (EnvMSB_C * Level_C)
;  register shadows for Note Update Logic
          .word 0                ;(28)SFrq_L reg. shadow
          .word 0                ;(29)SOn_OctF reg. shadow
          .word 0                ;(30)MMulti reg. shadow
          .word 0                ;(31)CMulti reg. shadow
          .word 0                ;(32)MLevel reg. shadow
          .word 0                ;(33)CLevel reg. shadow
;  envelope control data
          .word   7FFFh          ;(34)Level_M (modulator envelope
level scale)
        .word     0000h         ;(35)EnvMSB_M (modulator running
envelope)
        .word     0000h         ;(36)EnvLSB_M (modulator running
envelope)
        .word    0          ;(37)M_Rnge (modulator envelope range)
        .word     07eh        ;(38)A_SlpeM (modulator attack slope)
(Q4)
        .word     04eh        ;(39)D_SlpeM (modulator decay slope)
(Q4)
          .word  0                ;(40)S_SlpeM (modulator sustain
slope) (Q4)
        .word     3FFFh          ;(41)S_LevlM (modulator sustain
level)
        .word     00a0h          ;(42)R_SlpeM (modulator release
slope)
(Q4)
          .word   7FFFh           ;(43)Level_C (carrier envelope
```

```
level scale)
        .word   7FFFh           ;(44)EnvMSB_C (carrier running
envelope)
        .word   0               ;(45)EnvLSB_C (carrier running
envelope)
        .word   0               ;(46)C_Rnge (carrier envelope
range)
      .word    7FFFh          ;(47)A_SlpeC (carrier attack slope)
  (Q4)
      .word    04eh         ;(48)D_SlpeC (carrier decay slope)
(Q4)
        .word   0               ;(49)S_SlpeC (carrier sustain
slope)   (Q4)
        .word   0               ;(50)S_LevlC (carrier sustain
level)
      .word    0370h         ;(51)R_SlpeC (carrier release slope)
 (Q4)
;Carrier Oscillator control data
      .word    0183h          ;(52)Nom_PchC nominal pitch (input
to
LFO)
      .word    0183h          ;(53)Pch_StpC runnung pitch step {
Q9 frac.
portion used }
      .word    OutCarT     ;(54)Out_PtrC pointer to top of voice
output
buffer
      .word    SIN128      ;(55)Tbl_PtrC running pointer to wave
table (AR4)
      .word    0         ;(56)Run_ValC running wave value { Q9 },
TableOffset.Frac
      .word    SIN128    ;(57)TblBaseC Address for the 129 sample
wave
table
      .word    7FFFh          ;(58)MaskMSBC used in AND when
```

```
sending sample to DAC
;16 word voice output buffer
outVce18 .space 16*FRAMESIZ     ;(59)outVoice Synthesizer's voice
out buffer
                    ;(75)
*****************************************************************
*************
;  pointer references            ;SNARE
Voice19:
        .word   A_Rhy_1          ;( 0)A_Vce_St (address of voice
status table)
      .word      SpecTab0   ;( 1)pSpecSer (ptr to Spectral Series
Tbl)
        .word   FRQ_L+0         ;( 2)V_Frq_L (voice FRQ_L register
address)
        .word   MULTI+0          ;( 3)P_Multi (percussive voice
MULTI address)
        .word   FRQ_L+0          ;( 4)P_Frq_L (percussive voice
FRQ_L address)
      .word      0        ;( 5)pEm pointer to Mod. Envelope address
      .word      EModePS  ;( 6)EModFunc Engine Mode Func. address
; running voice control data - Mode, Spectral Mod., Noise, Mix
      .word     0          ;( 7)EMode (eng. 1-mel,2-perc1,3-perc3)

;xlat
        .word   0306h           ;( 8)Nom_Pch nominal pitch (input
to LFO)
        .word   0306h            ;( 9)Pch_Step runnung pitch step
{ Q9 frac. portion
used }
      .word      OutModT    ;(10)Out_Ptr pointer to top of voice
output buffer
      .word      S8         ;(11)Tabl_Ptr running pointer to wave
table (AR4)
        .word   0               ;(12)Run_Val running wave value {
```

```
Q9 },
TableOffset.Frac
      .word     S8          ;(13)TblBase Address for the 129 sample
wave
table
      .word     7FFFh                ;(14)MaskMSB used in AND when
sending
sample to DAC
      .word outVce19        ;(15)pointer to voice output buffer
         .word 0                  ;(16)ZMin1
         .word 0                  ;(17)Feedbk reg. feedback value
         .word 0                  ;(18)Fbk engine feedback factor
         .word 7FFFh              ;(19)MFbk (1-FBK)
      .word 0          ;(20)Em (EnvMSB_M * Level_M)
      .word 7FFFh           ;(21)One
      .word 7          ;(22)MCoeff_
      .word 7          ;(23)SRange (dynamic Series Range 0-8)
      .word 3330h           ;(24)AmpCar (dynamic Amp. of Car.)
      .word 0          ;(25)PanL
      .word 0          ;(26)PanR
      .word 0          ;(27)Ec (EnvMSB_C * Level_C)
;  register shadows for Note Update Logic
         .word 0                  ;(28)SFrq_L reg. shadow
         .word 0                  ;(29)SOn_OctF reg. shadow
         .word 0                  ;(30)MMulti reg. shadow
         .word 0                  ;(31)CMulti reg. shadow
         .word 0                  ;(32)MLevel reg. shadow
         .word 0                  ;(33)CLevel reg. shadow
;  envelope control data
         .word   7FFFh            ;(34)Level_M (modulator envelope
level scale)
      .word     0000h          ;(35)EnvMSB_M (modulator running
envelope)
      .word     0000h          ;(36)EnvLSB_M (modulator running
envelope)
```

```
        .word     0            ;(37)M_Rnge (modulator envelope range)
        .word     07eh          ;(38)A_SlpeM (modulator attack slope)
(Q4)
        .word     04eh          ;(39)D_SlpeM (modulator decay slope)
(Q4)
          .word   0                  ;(40)S_SlpeM (modulator sustain
slope) (Q4)
        .word     3FFFh              ;(41)S_LevlM (modulator sustain
level)
        .word     00a0h              ;(42)R_SlpeM (modulator release
slope)
(Q4)
          .word   7FFFh               ;(43)Level_C (carrier envelope
level scale)
          .word   7FFFh               ;(44)EnvMSB_C (carrier running
envelope)
          .word   0                   ;(45)EnvLSB_C (carrier running
envelope)
          .word   0                    ;(46)C_Rnge (carrier envelope
range)
        .word    7FFFh            ;(47)A_SlpeC (carrier attack slope)
  (Q4)
        .word     04eh         ;(48)D_SlpeC (carrier decay slope)
(Q4)
          .word   0                    ;(49)S_SlpeC (carrier sustain
slope)    (Q4)
          .word   0                    ;(50)S_LevlC (carrier sustain
level)
        .word    0370h           ;(51)R_SlpeC (carrier release slope)
 (Q4)
;Carrier Oscillator control data
        .word     0183h            ;(52)Nom_PchC nominal pitch (input
to
LFO)
        .word     0183h            ;(53)Pch_StpC runnung pitch step {
```

```
Q9 frac.
portion used }
      .word      OutCarT     ;(54)Out_PtrC pointer to top of voice
output
buffer
      .word      SIN128      ;(55)Tbl_PtrC running pointer to wave
table (AR4)
      .word      0           ;(56)Run_ValC running wave value { Q9 },
TableOffset.Frac
      .word      SIN128      ;(57)TblBaseC Address for the 129 sample
wave
table
      .word      7FFFh           ;(58)MaskMSBC used in AND when
sending sample to DAC
;16 word voice output buffer
outVce19 .space 16*FRAMESIZ      ;(59)outVoice Synthesizer's voice
out buffer
                        ;(75)
*****************************************************************
*************
;  pointer references              ;TOM
Voice20:
         .word    A_Rhy_2           ;( 0)A_Vce_St (address of voice
status table)
      .word       SpecTab0   ;( 1)pSpecSer (ptr to Spectral Series
Tbl)
         .word    FRQ_L+0          ;( 2)V_Frq_L (voice FRQ_L register
address)
         .word    MULTI+0            ;( 3)P_Multi (percussive voice
MULTI address)
         .word    FRQ_L+0            ;( 4)P_Frq_L (percussive voice
FRQ_L address)
      .word       0        ;( 5)pEm pointer to Mod. Envelope address
      .word       EModePT  ;( 6)EModFunc Engine Mode Func. address
; running voice control data - Mode, Spectral Mod., Noise, Mix
```

```
      .word      0          ;( 7)EMode (eng. 1-mel,2-perc1,3-perc3)

;xlat
         .word   0306h          ;( 8)Nom_Pch nominal pitch (input
to LFO)
         .word   0306h           ;( 9)Pch_Step runnung pitch step
{ Q9 frac. portion
used }
      .word      OutModT    ;(10)Out_Ptr pointer to top of voice
output buffer
      .word      SIN128     ;(11)Tabl_Ptr running pointer to wave
table (AR4)
         .word   0              ;(12)Run_Val running wave value {
Q9 },
TableOffset.Frac
      .word     SIN128    ;(13)TblBase Address for the 129 sample
wave
table
      .word    7FFFh          ;(14)MaskMSB used in AND when sending
sample to DAC
         .word outVce20             ;(15)pointer to voice output
buffer
         .word 0                ;(16)ZMin1
         .word 0                ;(17)Feedbk reg. feedback value
         .word 0                ;(18)Fbk engine feedback factor
         .word 7FFFh            ;(19)MFbk (1-FBK)
      .word 0         ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 3330h          ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
```

```
        .word 0                 ;(28)SFrq_L reg. shadow
        .word 0                 ;(29)SOn_OctF reg. shadow
        .word 0                 ;(30)MMulti reg. shadow
        .word 0                 ;(31)CMulti reg. shadow
        .word 0                 ;(32)MLevel reg. shadow
        .word 0                 ;(33)CLevel reg. shadow
;  envelope control data
        .word   7FFFh           ;(34)Level_M (modulator envelope
level scale)
      .word     0000h          ;(35)EnvMSB_M (modulator running
envelope)
      .word     0000h          ;(36)EnvLSB_M (modulator running
envelope)
      .word    0           ;(37)M_Rnge (modulator envelope range)
      .word     07eh         ;(38)A_SlpeM (modulator attack slope)
(Q4)
      .word   04eh      ;(39)D_SlpeM (modulator decay slope)   (Q4)
        .word  0                ;(40)S_SlpeM (modulator sustain
slope) (Q4)
      .word     3FFFh           ;(41)S_LevlM (modulator sustain
level)
      .word     00a0h           ;(42)R_SlpeM (modulator release
slope)
(Q4)
        .word   7FFFh            ;(43)Level_C (carrier envelope
level scale)
        .word   7FFFh            ;(44)EnvMSB_C (carrier running
envelope)
        .word  0                 ;(45)EnvLSB_C (carrier running
envelope)
        .word  0                  ;(46)C_Rnge (carrier envelope
range)
      .word    7FFFh          ;(47)A_SlpeC (carrier attack slope)
  (Q4)
      .word     04eh        ;(48)D_SlpeC (carrier decay slope)
```

```
(Q4)
        .word   0                   ;(49)S_SlpeC (carrier sustain
slope)   (Q4)
        .word   0                   ;(50)S_LevlC (carrier sustain
level)
      .word    0370h          ;(51)R_SlpeC (carrier release slope)
 (Q4)
;Carrier Oscillator control data
      .word     0183h           ;(52)Nom_PchC nominal pitch (input
to
LFO)
      .word     0183h           ;(53)Pch_StpC runnung pitch step {
Q9 frac.
portion used }
      .word     OutCarT     ;(54)Out_PtrC pointer to top of voice
output
buffer
      .word      SIN128     ;(55)Tbl_PtrC running pointer to wave
table (AR4)
      .word     0          ;(56)Run_ValC running wave value { Q9 },
TableOffset.Frac
      .word     SIN128     ;(57)TblBaseC Address for the 129 sample
wave
table
      .word     7FFFh           ;(58)MaskMSBC used in AND when
sending sample to DAC
;16 word voice output buffer
outVce20 .space 16*FRAMESIZ      ;(59)outVoice Synthesizer's voice
out buffer
                    ;(75)
*****************************************************************
*************
;  pointer references             ;CYMBAL
Voice21:
        .word   A_Rhy_3          ;( 0)A_Vce_St (address of voice
```

```
status table)
      .word      SpecTab0  ;( 1)pSpecSer (ptr to Spectral Series
Tbl)
         .word   FRQ_L+0        ;( 2)V_Frq_L (voice FRQ_L register
address)
         .word    MULTI+0          ;( 3)P_Multi (percussive voice
MULTI address)
         .word    FRQ_L+0          ;( 4)P_Frq_L (percussive voice
FRQ_L address)
      .word      0       ;( 5)pEm pointer to Mod. Envelope address
      .word      EModePC  ;( 6)EModFunc Engine Mode Func. address
; running voice control data - Mode, Spectral Mod., Noise, Mix
      .word      0          ;( 7)EMode (eng. 1-mel,2-perc1,3-perc3)

;xlat
         .word   0306h           ;( 8)Nom_Pch nominal pitch (input
to LFO)
         .word   0306h           ;( 9)Pch_Step runnung pitch step
{ Q9 frac. portion
used }
      .word      OutModT    ;(10)Out_Ptr pointer to top of voice
output buffer
      .word      CLIPSIN    ;(11)Tabl_Ptr running pointer to wave
table (AR4)
         .word   0               ;(12)Run_Val running wave value {
Q9 },
TableOffset.Frac
      .word      CLIPSIN   ;(13)TblBase Address for the 129 sample
wave
table
      .word      7FFFh              ;(14)MaskMSB used in AND when
sending
sample to DAC
         .word outVce21             ;(15)pointer to voice output
buffer
```

```
        .word 0                 ;(16)ZMin1
        .word 0                 ;(17)Feedbk reg. feedback value
        .word 0                 ;(18)Fbk engine feedback factor
        .word 7FFFh             ;(19)MFbk (1-FBK)
      .word 0         ;(20)Em (EnvMSB_M * Level_M)
      .word 7FFFh         ;(21)One
      .word 7         ;(22)MCoeff_
      .word 7         ;(23)SRange (dynamic Series Range 0-8)
      .word 3330h         ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
        .word 0                 ;(28)SFrq_L reg. shadow
        .word 0                 ;(29)SOn_OctF reg. shadow
        .word 0                 ;(30)MMulti reg. shadow
        .word 0                 ;(31)CMulti reg. shadow
        .word 0                 ;(32)MLevel reg. shadow
        .word 0                 ;(33)CLevel reg. shadow
;  envelope control data
        .word   7FFFh           ;(34)Level_M (modulator envelope
level scale)
      .word     0000h         ;(35)EnvMSB_M (modulator running
envelope)
      .word     0000h         ;(36)EnvLSB_M (modulator running
envelope)
      .word    0          ;(37)M_Rnge (modulator envelope range)
      .word     07eh        ;(38)A_SlpeM (modulator attack slope)
(Q4)
      .word     04eh        ;(39)D_SlpeM (modulator decay slope)
(Q4)
        .word  0                ;(40)S_SlpeM (modulator sustain
slope) (Q4)
      .word     3FFFh           ;(41)S_LevlM (modulator sustain
level)
```

```
        .word     00a0h              ;(42)R_SlpeM (modulator release
slope)
(Q4)
          .word    7FFFh             ;(43)Level_C (carrier envelope
level scale)
          .word    7FFFh             ;(44)EnvMSB_C (carrier running
envelope)
          .word 0            ;(45)EnvLSB_C (carrier running envelope)
          .word  0                    ;(46)C_Rnge (carrier envelope
range)
        .word     7FFFh            ;(47)A_SlpeC (carrier attack slope)
  (Q4)
        .word     04eh         ;(48)D_SlpeC (carrier decay slope)
(Q4)
          .word  0                    ;(49)S_SlpeC (carrier sustain
slope)   (Q4)
          .word  0                    ;(50)S_LevlC (carrier sustain
level)
        .word    0370h           ;(51)R_SlpeC (carrier release slope)
 (Q4)
;Carrier Oscillator control data
        .word     0183h            ;(52)Nom_PchC nominal pitch (input
to
LFO)
        .word     0183h            ;(53)Pch_StpC runnung pitch step {
Q9 frac.
portion used }
        .word     OutCarT     ;(54)Out_PtrC pointer to top of voice
output
buffer
        .word     S2          ;(55)Tbl_PtrC running pointer to wave
table (AR4)
        .word     0          ;(56)Run_ValC running wave value { Q9 },
TableOffset.Frac
        .word     S2         ;(57)TblBaseC Address for the 129 sample
```

```
wave
table
      .word     7FFFh          ;(58)MaskMSBC used in AND when
sending sample to DAC
;16 word voice output buffer
outVce21 .space 16*FRAMESIZ      ;(59)outVoice Synthesizer's voice
out buffer
                    ;(75)
*************************************************************
*************
;  pointer references            ;HI HAT
Voice22:
         .word   A_Rhy_4          ;( 0)A_Vce_St (address of voice
status table)
      .word      SpecTab0   ;( 1)pSpecSer (ptr to Spectral Series
Tbl)
         .word   FRQ_L+0        ;( 2)V_Frq_L (voice FRQ_L register
address)
         .word   MULTI+0          ;( 3)P_Multi (percussive voice
MULTI address)
         .word   FRQ_L+0          ;( 4)P_Frq_L (percussive voice
FRQ_L address)
      .word      0       ;( 5)pEm pointer to Mod. Envelope address
      .word      EModePH  ;( 6)EModFunc Engine Mode Func. address
; running voice control data - Mode, Spectral Mod., Noise, Mix
      .word     0          ;( 7)EMode (eng. 1-mel,2-perc1,3-perc3)

;xlat
         .word   0306h           ;( 8)Nom_Pch nominal pitch (input
to LFO)
         .word   0306h           ;( 9)Pch_Step runnung pitch step
{ Q9 frac. portion
used }
      .word      OutModT    ;(10)Out_Ptr pointer to top of voice
output buffer
```

```
      .word      S1_1              ;(11)Tabl_Ptr running pointer to
wave table (AR4)
         .word   0                ;(12)Run_Val running wave value {
Q9 },
TableOffset.Frac
      .word      S1_1              ;(13)TblBase Address for the 129
sample wave
table
      .word      7FFFh               ;(14)MaskMSB used in AND when
sending
sample to DAC
         .word outVce22             ;(15)pointer to voice output
buffer
         .word 0                  ;(16)ZMin1
         .word 0                  ;(17)Feedbk reg. feedback value
         .word 0                  ;(18)Fbk engine feedback factor
         .word 7FFFh              ;(19)MFbk (1-FBK)
         .word 0                  ;(20)Em (EnvMSB_M * Level_M)
      .word 7FFFh          ;(21)One
      .word 7         ;(22)MCoeff_
      .word 7         ;(23)SRange (dynamic Series Range 0-8)
      .word 3330h          ;(24)AmpCar (dynamic Amp. of Car.)
      .word 0         ;(25)PanL
      .word 0         ;(26)PanR
      .word 0         ;(27)Ec (EnvMSB_C * Level_C)
;  register shadows for Note Update Logic
         .word 0                  ;(28)SFrq_L reg. shadow
         .word 0                  ;(29)SOn_OctF reg. shadow
         .word 0                  ;(30)MMulti reg. shadow
         .word 0                  ;(31)CMulti reg. shadow
         .word 0                  ;(32)MLevel reg. shadow
         .word 0                  ;(33)CLevel reg. shadow
;  envelope control data
         .word   7FFFh            ;(34)Level_M (modulator envelope
level scale)
```

```
      .word     0000h          ;(35)EnvMSB_M (modulator running
envelope)
      .word     0000h          ;(36)EnvLSB_M (modulator running
envelope)
      .word    0          ;(37)M_Rnge (modulator envelope range)
      .word     07eh        ;(38)A_SlpeM (modulator attack slope)
(Q4)
      .word     04eh        ;(39)D_SlpeM (modulator decay slope)
(Q4)
         .word  0                 ;(40)S_SlpeM (modulator sustain
slope) (Q4)
      .word     3FFFh             ;(41)S_LevlM (modulator sustain
level)
      .word     00a0h             ;(42)R_SlpeM (modulator release
slope)
(Q4)
         .word   7FFFh             ;(43)Level_C (carrier envelope
level scale)
         .word   7FFFh             ;(44)EnvMSB_C (carrier running
envelope)
         .word  0                  ;(45)EnvLSB_C (carrier running
envelope)
         .word  0                   ;(46)C_Rnge (carrier envelope
range)
      .word    7FFFh           ;(47)A_SlpeC (carrier attack slope)
  (Q4)
      .word     04eh        ;(48)D_SlpeC (carrier decay slope)
(Q4)
         .word  0                   ;(49)S_SlpeC (carrier sustain
slope)   (Q4)
         .word  0                   ;(50)S_LevlC (carrier sustain
level)
      .word    0370h          ;(51)R_SlpeC (carrier release slope)
 (Q4)
;Carrier Oscillator control data
```

```
      .word     0183h          ;(52)Nom_PchC nominal pitch (input
to
LFO)
      .word     0183h          ;(53)Pch_StpC runnung pitch step {
Q9 frac.
portion used }
      .word     OutCarT    ;(54)Out_PtrC pointer to top of voice
output
buffer
      .word      SIN128     ;(55)Tbl_PtrC running pointer to wave
table (AR4)
      .word     0         ;(56)Run_ValC running wave value { Q9 },
TableOffset.Frac
      .word     SIN128    ;(57)TblBaseC Address for the 129 sample
wave
table
      .word     7FFFh          ;(58)MaskMSBC used in AND when
sending sample to DAC
;16 word voice output buffer
outVce22 .space 16*FRAMESIZ      ;(59)outVoice Synthesizer's voice
out buffer
                     ;(75)
*****************************************************************
*************
*****************************************************************
*************
     .sect     "OutModT"
OutModT .space 16*FRAMESIZ          ; voice temporary buffer

     .sect     "OutCarT"
OutCarT .space 16*FRAMESIZ          ; voice temporary buffer

      .sect    "PanCoef"
LPanVce0 .word 1FFFh                ;Left Pan/Level Coefficient
LPanVce1 .word 1FFFh                ;Left Pan/Level Coefficient
```

```
LPanVce2 .word 1FFFh                ;Left Pan/Level Coefficient
LPanVce3 .word 1FFFh                ;Left Pan/Level Coefficient
LPanVce4 .word 1FFFh                ;Left Pan/Level Coefficient
LPanVce5 .word 1FFFh                ;Left Pan/Level Coefficient
LPanVce6 .word 1FFFh                ;Left Pan/Level Coefficient
LPanVce7 .word 1FFFh                ;Left Pan/Level Coefficient
LPanVce8 .word 1FFFh                ;Left Pan/Level Coefficient
LPanVce9 .word 1FFFh                ;Left Pan/Level Coefficient
LPanVc10 .word 1FFFh                ;Left Pan/Level Coefficient
LPanVc11 .word 1FFFh                ;Left Pan/Level Coefficient
LPanVc12 .word 1FFFh                ;Left Pan/Level Coefficient
LPanVc13 .word 1FFFh                ;Left Pan/Level Coefficient
LPanVc14 .word 1FFFh                ;Left Pan/Level Coefficient
LPanVc15 .word 1FFFh                ;Left Pan/Level Coefficient
LPanVc16 .word  1FFFh                  ;Left Pan/Level Coefficient
LPanVc17 .word  1FFFh                  ;Left Pan/Level Coefficient
LPanVc18 .word  1FFFh    ;kick         ;Left Pan/Level Coefficient
(percus)
LPanVc19 .word  1FFFh                  ;Left Pan/Level Coefficient
(percus)
LPanVc20 .word  1FFFh                  ;Left Pan/Level Coefficient
(percus)
LPanVc21 .word  1FFFh                  ;Left Pan/Level Coefficient
(percus)
LPanVc22 .word  1FFFh                  ;Left Pan/Level Coefficient
(percus)

RPanVce0 .word 1FFFh                ;Right Pan/Level Coefficient
RPanVce1 .word 1FFFh                ;Right Pan/Level Coefficient
RPanVce2 .word 1FFFh                ;Right Pan/Level Coefficient
RPanVce3 .word 1FFFh                ;Right Pan/Level Coefficient
RPanVce4 .word 1FFFh                ;Right Pan/Level Coefficient
RPanVce5 .word 1FFFh                ;Right Pan/Level Coefficient
RPanVce6 .word 1FFFh                ;Right Pan/Level Coefficient
RPanVce7 .word 1FFFh                ;Right Pan/Level Coefficient
```

```
RPanVce8 .word 1FFFh                ;Right Pan/Level Coefficient
RPanVce9 .word 1FFFh                ;Right Pan/Level Coefficient
RPanVc10 .word 1FFFh                ;Right Pan/Level Coefficient
RPanVc11 .word 1FFFh                ;Right Pan/Level Coefficient
RPanVc12 .word 1FFFh                ;Right Pan/Level Coefficient
RPanVc13 .word 1FFFh                ;Right Pan/Level Coefficient
RPanVc14 .word 1FFFh                ;Right Pan/Level Coefficient
RPanVc15 .word 1FFFh                ;Right Pan/Level Coefficient
RPanVc16 .word   1FFFh                          ;Right Pan/Level
Coefficient
RPanVc17 .word   1FFFh                          ;Right Pan/Level
Coefficient
RPanVc18 .word   1FFFh     ;kick                ;Right Pan/Level
Coefficient (percus)
RPanVc19 .word   1FFFh                          ;Right Pan/Level
Coefficient (percus)
RPanVc20 .word   1FFFh                          ;Right Pan/Level
Coefficient (percus)
RPanVc21 .word   1FFFh                          ;Right Pan/Level
Coefficient (percus)
RPanVc22 .word   1FFFh                          ;Right Pan/Level
Coefficient (percus)

;OutTmpE .bes  16*FRAMESIZ          ; Pong side of DAC buffer
*****************************************************************
*************
     .data

        ;32768 produces Attack time=0

AtkTabl .word    135       ; 0
        .word     135     ; 1
        .word     135     ; 2
        .word     135     ; 3
        .word     135     ; 4
```

```
    .word     169     ; 5
    .word     202     ; 6
    .word     238     ; 7
    .word     269     ; 8
    .word     338     ; 9
    .word     404     ; 10
    .word     482     ; 11
    .word     539     ; 12
    .word     676     ; 13
    .word     808     ; 14
    .word     953     ; 15
    .word     1077     ; 16
    .word     1352     ; 17
    .word     1616     ; 18
    .word     1906     ; 19
    .word     2153     ; 20
    .word     2703     ; 21
    .word     3232     ; 22
    .word     3812     ; 23
    .word     4310     ; 24
    .word     5407     ; 25
    .word     6464     ; 26
    .word     7625     ; 27
.word        8000      ; 28
    .word     8800      ; 29
    .word     9500      ; 30
    .word    10000      ; 31
    .word    10500      ; 32
    .word    11500      ; 33
    .word    12500      ; 34
    .word    13500      ; 35
    .word    13700      ; 36
    .word    13800      ; 37
    .word    13900      ; 38
    .word    14000      ; 39
```

```
    .word    32768    ; 40
    .word    32768    ; 41
    .word    32768    ; 42
    .word    32768    ; 43
.word        32768    ; 44
.word        32768    ; 45
.word        32768    ; 46
.word        32768    ; 47
.word        32768    ; 48
.word        32768    ; 49
.word        32768    ; 50
.word        32768    ; 51
.word        32768    ; 52
.word        32768    ; 53
.word        32768    ; 54
.word        32768    ; 55
.word        32768    ; 56
.word        32768    ; 57
.word        32768    ; 58
.word        32768    ; 59
.word        32768    ; 60
.word        32768    ; 61
.word        32768    ; 62
.word        32768    ; 63
.word        32768    ; 64
.word        32768    ; 65
.word        32768    ; 66
.word        32768    ; 67
.word        32768    ; 68
.word        32768    ; 69
.word        32768    ; 70
.word        32768    ; 71
.word        32768    ; 72
.word        32768    ; 73
.word        32768    ; 74
```

```
      .word       32768      ; 75
*****************************************************************
*************
DkyTabl .word      46         ; 0
        .word      46         ; 1
        .word      46         ; 2
        .word      46         ; 3
        .word      46         ; 4
        .word      58         ; 5
        .word      69         ; 6
        .word      80         ; 7
        .word      93         ; 8
        .word      116        ; 9
        .word      138        ; 10
        .word      161        ; 11
        .word      185        ; 12
        .word      232        ; 13
        .word      276        ; 14
        .word      322        ; 15
        .word      371        ; 16
        .word      463        ; 17
        .word      553        ; 18
        .word      644        ; 19
        .word      742        ; 20
        .word      926        ; 21
        .word      1105       ; 22
        .word      1287       ; 23
        .word      1483       ; 24
        .word      1853       ; 25
        .word      2211       ; 26
        .word      2575       ; 27
        .word      2966       ; 28
        .word      3705       ; 29
        .word      4422       ; 30
        .word      5149       ; 31
```

```
    .word     5338     ; 32  ; * 0.9  and following
    .word     6669     ; 33
    .word     7958     ; 34
    .word     9268     ; 35
    .word     10678    ; 36
.word         13339    ; 37 ; last * 0.9
.word         14149    ; 38 ; 1st  * 0.8
.word         16476    ; 39
.word         18984    ; 40 ;last * 0.8
.word         20749    ; 41 ; 1st * 0.7
.word         20750    ; 42 ;last * 0.7
.word         20750    ; 43
.word         20750    ; 44
.word         20750    ; 45
.word         20750    ; 46
.word         20750    ; 47
    .word     29643    ; 48
    .word     29643    ; 49
    .word     29643    ; 50
    .word     29643    ; 51
    .word     29643    ; 52
    .word     29643    ; 53
    .word     29643    ; 54
    .word     29643    ; 55
    .word     29643    ; 56
    .word     29643    ; 57
    .word     29643    ; 58
    .word     29643    ; 59
    .word     29643    ; 60
    .word     29643    ; 61
    .word     29643    ; 62
    .word     29643    ; 63
    .word     29643    ; 64
    .word     29643    ; 65
    .word     29643    ; 66
```

```
        .word     29643     ; 67
        .word     29643     ; 68
        .word     29643     ; 69
        .word     29643     ; 70
        .word     29643     ; 71
        .word     29643     ; 72
        .word     29643     ; 73
        .word     29643     ; 74
        .word     29643     ; 75
*****************************************************************
*************
;TOTAL LEVEL AMPLITUDE
FACTORS*****************************************
; x=32767.0 * 10^(-0.62 * n / 20.0)
Log64   .word   32767     ; 0
        .word   30510     ; 1
        .word   28408     ; 2
        .word   26451     ; 3
        .word   24628     ; 4
        .word   22932     ; 5
        .word   21352     ; 6
        .word   19881     ; 7
        .word   18511     ; 8
        .word   17236     ; 9
        .word   16049     ; 10
        .word   14943     ; 11
        .word   13914     ; 12
        .word   12955     ; 13
        .word   12062     ; 14
        .word   11231     ; 15
        .word   10458     ; 16
        .word   9737     ; 17
        .word   9066     ; 18
        .word   8442     ; 19
        .word   7860     ; 20
```

```
.word   7319    ; 21
.word   6815    ; 22
.word   6345    ; 23
.word   5908    ; 24
.word   5501    ; 25
.word   5122    ; 26
.word   4769    ; 27
.word   4441    ; 28
.word   4135    ; 29
.word   3850    ; 30
.word   3585    ; 31
.word   3338    ; 32
.word   3108    ; 33
.word   2894    ; 34
.word   2694    ; 35
.word   2509    ; 36
.word   2336    ; 37
.word   2175    ; 38
.word   2025    ; 39
.word   1886    ; 40
.word   1756    ; 41
.word   1635    ; 42
.word   1522    ; 43
.word   1417    ; 44
.word   1320    ; 45
.word   1229    ; 46
.word   1144    ; 47
.word   1065    ; 48
.word   992     ; 49
.word   923     ; 50
.word   860     ; 51
.word   801     ; 52
.word   745     ; 53
.word   694     ; 54
.word   646     ; 55
```

```
        .word   402     ; 56
        .word   260     ; 57
        .word   122     ; 58
        .word   86      ; 59
        .word   45      ; 60
        .word   20      ; 61
        .word   10      ; 62
        .word   0       ; 63
;*****************************************************************
*************
;Carrier amplitude scale
; x=32767.0 * 10^(-0.75 * n / 20.0)
Log64C  .word   32767   ; 0
        .word   30056   ; 1
        .word   27570   ; 2
        .word   25289   ; 3
        .word   23197   ; 4
        .word   21278   ; 5
        .word   19518   ; 6
        .word   17903   ; 7
        .word   16422   ; 8
        .word   15064   ; 9
        .word   13818   ; 10
        .word   12675   ; 11
        .word   11626   ; 12
        .word   10664   ; 13
        .word   9782    ; 14
        .word   8973    ; 15
        .word   8231    ; 16
        .word   7550    ; 17
        .word   6925    ; 18
        .word   6352    ; 19
        .word   5827    ; 20
        .word   5345    ; 21
        .word   4903    ; 22
```

```
.word   4497   ; 23
.word   4125   ; 24
.word   3784   ; 25
.word   3471   ; 26
.word   3184   ; 27
.word   2920   ; 28
.word   2679   ; 29
.word   2457   ; 30
.word   2254   ; 31
.word   2067   ; 32
.word   1896   ; 33
.word   1740   ; 34
.word   1596   ; 35
.word   1464   ; 36
.word   1343   ; 37
.word   1232   ; 38
.word   1130   ; 39
.word   1036   ; 40
.word   950    ; 41
.word   872    ; 42
.word   800    ; 43
.word   734    ; 44
.word   673    ; 45
.word   617    ; 46
.word   566    ; 47
.word   519    ; 48
.word   476    ; 49
.word   437    ; 50
.word   401    ; 51
.word   368    ; 52
.word   337    ; 53
.word   309    ; 54
.word   284    ; 55
.word   260    ; 56
.word   239    ; 57
```

```
        .word    219    ; 58
        .word    201    ; 59
        .word    184    ; 60
        .word    169    ; 61
        .word    15     ; 62
        .word    0      ; 63
;*****************************************************************
*************
```

```
;*************************************************************
******
;SYNTHESIZER CONTROL REGISTER ARRAY 0
;      M      I      S      C      .                O      P      L
REGISTERS*****************************************************
opl2Regs    .space  16              ;00 DUMMY SPACE HOLDER
TEST        .space  16              ;01 TEST/WAVE SELECT ENABLE
TIMER1      .space  16              ;02 TIMER1 DATA
TIMER2      .space  16              ;03 TIMER2 DATA
TIMCTL      .space  16              ;04 TIMER CONTROL
            .space  48              ;05-07   not defined
RSPLIT      .space  16              ;08 KEYBOARD RATE SCALE SPLIT
POINT

            .space 368              ;09-1F   not defined
;OPERATOR CONTROL
DATA**************************************************
MULTI               .space  352                                ;20-35
AM/VIB/EG-TYPE/KSR/MULTIPLY
            .space 160              ;36-3F   not defined
LEVEL       .space 352              ;40-55 KSL/OUTPUT LEVEL
            .space 160              ;56-5F   not defined
ATK_DKY     .space 352              ;60-75 ATTACK/DECAY RATE
            .space 160              ;76-7F   not defined
SUS_REL     .space 352              ;80-95 SUSTAIN/RELEASE RATE
            .space 160              ;96-9F   not defined
;    V    O    I    C    E          C    O    N    T    R    O    L
DATA**************************************************
FRQ_L       .space 144              ;A0-A8 FREQUENCY (LOW)
            .space 112              ;A9-AF   not defined
ON_OCTF      .space 144                ;B0-B8 KEY-ON/OCTAVE/FREQ.
(HIGH)

            .space  64              ;B9-BC   not defined
D_RHYTH     .space  16              ;BD
DEPTH(VIB)/RHYTHM(BD,SD,TOM,TC,HH)
            .space  32              ;BE-BF   not defined
```

```
FEED_C      .space 144                  ;C0-C8 FEEDBACK/CONNECTION
            .space 368                  ;C9-DF   not defined
;    O    P    E    R    A    T    O    R              W    A    V    E
SELECT*****************************************************
WAVSEL      .space 352                  ;E0-F5 WAVE SELECT
;*****************************************************************
******

            .space 160                  ;F6-FF not defined
;*****************************************************************
******
;*****************************************************************
******
;SYNTHESIZER CONTROL REGISTER ARRAY 1
;       M      I      S      C      .                    O      P      L
REGISTERS*****************************************************
opl3Regs    .space  16                  ;00 DUMMY SPACE HOLDER
TESTH         .space  16                ;01 TEST/WAVE SELECT ENABLE
TIMER1H     .space  16                  ;02 TIMER1 DATA
TIMER2H     .space  16                  ;03 TIMER2 DATA
TIMCTLH     .space  16                  ;04 TIMER CONTROL
            .space  48                  ;05-07   not defined
RSPLITH     .space  16                  ;08 KEYBOARD RATE SCALE SPLIT
POINT

            .space 368                  ;09-1F   not defined
;OPERATOR CONTROL
DATA*************************************************
MULTIH        .space 352                ;20-35
AM/VIB/EG-TYPE/KSR/MULTIPLY
            .space 160                  ;36-3F   not defined
LEVELH        .space 352                ;40-55 KSL/OUTPUT LEVEL
            .space 160                  ;56-5F   not defined
ATK_DKYH    .space 352                  ;60-75 ATTACK/DECAY RATE
            .space 160                  ;76-7F   not defined
SUS_RELH    .space 352                  ;80-95 SUSTAIN/RELEASE RATE
            .space 160                  ;96-9F   not defined
```

```
;    V    O    I    C    E                C    O    N    T    R    O    L
DATA*****************************************************
FRQ_LH          .space 144                ;A0-A8 FREQUENCY (LOW)
                .space 112                  ;A9-AF   not defined
ON_OCTFH        .space 144               ;B0-B8 KEY-ON/OCTAVE/FREQ. (HIGH)
                .space  64                  ;B9-BC   not defined
D_RHYTHH        .space  16                ;BD
DEPTH(VIB)/RHYTHM(BD,SD,TOM,TC,HH)
                .space  32                  ;BE-BF   not defined
FEED_CH         .space 144               ;C0-C8 FEEDBACK/CONNECTION
                .space 368                  ;C9-DF   not defined
;    O    P    E    R    A    T    O    R              W    A    V    E
SELECT*****************************************************
WAVSELH         .space 352               ;E0-F5 WAVE SELECT
;*****************************************************************
******

                .space 160                  ;F6-FF not defined
;*****************************************************************
******
```

```
        .title  "TMS320C5x FM Music Synthesis Emulation Task 0.1A"

*****************************************************************
*************
* TMS320C5x Game Music Synthesis DSP Task Synthesis Engine
* (c) 1993 Texas Instruments, Inc.
* Author:   James E. Van Buskirk

      *
* Prelim. Coding: Jeffrey S. Hayes  9/24/93
*
*****************************************************************
*************

        .include "..\dspos.inc"
        .include "..\itc.inc"
        .include "voiceds.inc"
     .mmregs

     .global SYNTH_ENG,EMode1,EMode4,EModeP1,EModePS,EModePT
     .global EModePC,EModePH
;       .global smpl_max
        .ref    SIN128,S1,S2,S3,S4,S5,S6,S7,S8,FBKTABL
     .refTRIANGL,MULTI,FRQ_L,Voice0,AmpCarS0,OutCarT,OutModT,Noiz
        .ref    Voice17,NewBit
     .ref LPanVce0,outVoic0,A_Reg_0
        .ref    RPanVce0
        .ref    outSynthPing, outSynthEnd
        .def    Max_Vce,Max_Mel,Rhy_Mode
*****************************************************************
*************
synthData: .data

; @21.781kHz - Dev't EVM sampling rate
```

```
;-----------------------
; Mixer  buffer pointer
Mix_Ptr   .word    outSynthPing    ;pointer to top of Synth output
buffer
;Voice control variables
pVoiceds .word   Voice0          ;address of active voiceds
Actv_Vce .word   0               ;active voice#
Max_Mel  .word   12              ;Total Max # of mel. voices (MUST
BE 3<=x<=18)
Max_Vce  .word   12             ;Max # of melodic voices (running)
                                 ;dependant on rhythm mode
Rhy_Mode .word   0               ;Rhythm mode on=1, off=0
;-----------------------
;Pitch LFO Data ---------------------------------------------
LFOApply    .word  0                 ;LFO application count (0-17)
[1/frame]
LFOSked      .word  0                   ;LFO schedule count (0-69)
[1/69frame]
LFOPeriod  .word  69               ;# of 726uS frames/ LFO update
LFOSinTbl  .word  SIN128           ;LFO Sine Table Address
;LFOStep    .word  4CEAh            ;step=38.457 (Q9) => 6Hz
LFOStep    .word  4000h     ;step=32.008 (Q9) => 5Hz
LFORunOff  .word  0                 ;LFO running TableOffset.Frac
(Q9)
LFOMask    .word  0FFFFh           ;LFO mask
LFOPDepth1 .word  262              ;LFO pitch depth high (Q15)
LFOPDepth0 .word  142              ;LFO pitch depth low (Q15)
LFOUnity   .word  32768            ;1.0 (Q15)
LFOP1      .word  32767            ;LFO Pitch scale high output
LFOUnity2  .word  32768            ;1.0 (Q15)
LFOP0      .word  32767            ;LFO Pitch scale low output
;Amplitude LFO Data ----------------------------------------
ALFOApply    .word  0               ;LFO application count (0-17)
[1/frame]
ALFOSked      .word  1                  ;LFO schedule count (0-69)
```

```
[1/69frame]
ALFOPeriod  .word  35            ;# of 726uS frames/ LFO update
ALFOSinTbl  .word  TRIANGL       ;LFO Sine Table Address
ALFOStep    .word  0c00h    ;step=6.00  (Q9) => xHz
ALFORunOff  .word  0            ;LFO running TableOffset.Frac (Q9)
ALFOMask    .word  0FFFFh        ;LFO mask
ALFOPDepth1 .word  3000h   ;LFO ampl. depth high (Q15)
ALFOPDepth0 .word  1800h   ;LFO ampl. depth low (Q15)
ALFOUnity   .word  32768    ;1.0 (Q15)
ALFOP1        .word  32767       ;LFO Ampl. scale high output
ALFOUnity2  .word  32768    ;1.0 (Q15)
ALFOP0        .word  32767       ;LFO Ampl. scale low output
;------------------------

NoizF0   .word   0              ;noise feedback factor (Q15)
NoizF1   .word   0              ;noise feedback factor (Q15)
NoizF2   .word   0              ;noise feedback factor (Q15)
NoizF3   .word   0              ;noise feedback factor (Q15)
NoizF4   .word   0              ;noise feedback factor (Q15)
NoizF5   .word   0080h ;0080h   ;noise feedback factor (Q15)
NoizF6   .word   3FFFh  ;6FFF   ;noise feedback factor (Q15)
NoizF7   .word   7FFFh          ;noise feedback factor (Q15)

*****************************************************************
*************
; NOTE: Wave Address = TableOffset.Frac + TblBase
*****************************************************************
*************
        .sect "engine"
SYNTH_ENG
        ldp      #0                 ; used only for memory mapped
register,
                                 ; data section will be accessed
indirectly,
                                 ; with no dependency on dp.
```

```
        ;setup machine state
        clrc    SXM             ; clear sign extended mode for ACC
        setc    OVM             ; set overflow mode for ACC
        spm     1               ; set product register mode for
shift 1

        ;call noise generator function (16 noise samples)
        CALL    NOIZ

        ;call LFO scheduler and update LFO output if due for update
        CALL    LFO             ;LFO scheduler/update

        ;call LFO application routine - update 1 voice, update
LFOApply
        CALL    LFOA

     ;initialize voiceds addr. pointer, and voice control
     lar  AR0,#Voice0     ; AR0= voiceds ptr
     LAR  AR1,#Actv_Vce   ; AR1=addr of active voice count
     MAR  *,AR1           ;ARP=>AR1
     LACL #0          ;ACC=0
     SACL *           ;Actv_Vce=0
     BD   VceStrt     ;Go start first voice check
     SPLK #blok,INDX      ;INDX=voiceds block size

Eng_Loop:
; Voice loop branch control
     SPLK #blok,INDX          ;INDX=voiceds block size
SkipVce LACL   #1             ;ACC=1
     LAR  AR1,#Actv_Vce       ;AR1=addr of active voice count
     MAR  *,AR1               ;ARP=>AR1
     ADD  *               ;ACCL=new voice count
     SACL *+              ;Actv_Vce=new count,AR1=pMax_Vce
     SUB  *,0,AR0         ;ACC= Actv_Vce - Max_Vce
        BCNDD   RhyEng,GEQ             ;branch if all voices done
```

```
     MAR  *0+,AR1          ;AR0=updated voiceds ptr
VceStrt LAR    AR1,AR0          ;AR1=updated voiceds ptr
     ADRK #EMode                ;AR1=pEMode
        LACL    *-                          ;ACC=EMode, AR1=pEModFunc
        BCNDD   SkipVce,EQ                     ;skip voice if EMode=0
(off)
        LACL     *+                                        ;ACCL=addr of
EModFunc,AR1=pEMode
        NOP
Eng_Strt:
        BACC                                ;Branch to voice's Engine
Mode Func.

RhyEng:
        ;check for rhythmic voices
        LAR     AR1,#Rhy_Mode               ;AR1=addr of Rhy_Mode
     MAR  *,AR1                  ;ARP=>AR1
        LACL    *                           ;ACCL=Rhy_Mode value
        BCNDD   Mixer,EQ                    ;branch if rhytm mode=off
     LAR  AR1,#Actv_Vce  ; AR1=addr of active voice count
        LACL    #17              ;ACC=17
        SACL    *                ;Actv_Vce=17
        LAR     AR0,#Voice17     ;AR0=pVoiceds

RhyLoop:
; Voice loop branch control
     SPLK #blok,INDX            ;INDX=voiceds block size
SkipPVc LACL    #1                          ;ACC=1
     LAR  AR1,#Actv_Vce         ;AR1=addr of active voice count
     MAR  *,AR1                 ;ARP=>AR1
     ADD  *                ;ACCL=new voice count
        SACL      *,0,AR0                                   ;Actv_Vce=new
count,AR1=pMax_Vce
        SUB     #23                         ;ACC= Actv_Vce - (1 past
last voice)
```

```
        BCNDD     Mixer,GEQ        ;branch if all voices done
        MAR  *0+,AR1          ;AR0=updated voiceds ptr
           LAR     AR1,AR0                  ;AR1=updated voiceds ptr
        ADRK #EMode                 ;AR1=pEMode
           LACL    *-                       ;ACC=EMode, AR1=pEModFunc
           BCNDD    SkipPVc,EQ                ;skip voice if EMode=0
(off)
           LACL      *+                                  ;ACCL=addr of
EModFunc,AR1=pEMode
           NOP
Per_Strt:
           BACC                             ;Branch to voice's Engine
Mode Func.

;*****************************************************************
************

           ;EMode = 1 (Connect=0 two operator, melodic)
EMode1:
           call    ModEnv                   ;Modulation Envelope
           call     SpecMod0                   ;Spectral Modulation,
connect=0
           call    SerOsc                   ;Series Oscillator
           call     CarEnvOsc                     ;Carrier Envelope,
Oscillator
           call    SynConn0                 ;Synth Function, Connect=0
           B       Eng_Loop                 ;branch to Next Voice


           ;EMode = 4 (Connect=1 two operator, melodic)
EMode4:
           call    ModEnv                   ;Modulation Envelope
           call     SpecMod1                   ;Spectral Modulation,
conn=1 weighting
           call    SerOsc                   ;Series Oscillator
```

```
        call      CarEnvOsc                    ;Carrier Envelope,
Oscillator
        call    SynConn1                 ;Synth Function, Connect=1
        B       Eng_Loop                  ;branch to Next Voice

                    ;  R  h  y  t  h  m        M  o  d  e
Functions*******************************************
        ;EMode = 1 (Connect=0 two operator, Kick)
EModeP1:
        call    ModEnv                    ;Modulation Envelope
        call    SpecMod0                 ;Kick Spectral Modulation,
connect=0
        call    SerOsc                    ;Series Oscillator
        call      CarEnvOsc                    ;Carrier Envelope,
Oscillator
        call    SynConn0                 ;Synth Function, Connect=0
        B       RhyLoop                    ;branch to Next Rhythmic
Voice


     ;(one operator, Snare)
EModePS:
        call      CarEnvOsc                    ;Carrier Envelope,
Oscillator
     call SynConnS       ;Synth Function, Snare
        B       RhyLoop                    ;branch to Next Rhythmic
Voice

     ;(one operator, Tom)
EModePT:
        call    ModEnv                    ;Modulation Envelope
     call UpdtEm              ;Update Em coeff.
     call ModOsc              ;Modulator, Oscillator
     call SynConnT       ;Synth Function, Tom
        B       RhyLoop                    ;branch to Next Rhythmic
```

```
Voice

     ;(one operator, Cymbal)
EModePC:
        call      CarEnvOsc                    ;Carrier Envelope,
Oscillator
     call SynConnC        ;Synth Function, Snare
        B        RhyLoop                   ;branch to Next Rhythmic
Voice

     ;(one operator, Hat)
EModePH:
        call     ModEnv                    ;Modulation Envelope
     call UpdtEm              ;Update Em coeff.
     call ModOsc              ;Modulator, Oscillator
     call SynConnH        ;Synth Function, Tom
        B        RhyLoop                   ;branch to Next Rhythmic
Voice
;*****************************************************************
************


;*****************************************************************
************
;Mixer - Produces 16 left and 16 right samples
; NewBit=0 - (copied) from left channel coefficients.
; NewBit=1 - left and right coefficients used.
; LPanVce0 is addr of 1st Voice Left Coeff.
; For single cycle, Pan Coeffs. must be in on-chip program memory
when
; voice buffers are off-chip.
; AR0= voiceds ptr
;*****************************************************************
```

```
************
Mixer:
     SETC OVM              ;set overflow mode for ACC
        ;chek NewBit to see if mono or stereo
        LAR     AR1,#NewBit              ;AR1=addr of NewBit value
        MAR     *,AR1                    ;ARp=>AR1
        BIT     *,15                     ;test NewBit value ->TC
        BCND    STEREOX,TC              ;do stereo mix if NewBit=1

                                          ;    m    o    n    o
mix-----------------------------------------------------------
MONOX:
     SPLK #LPanVce0,BMAR       ;BMAR program address of 1st Coeff.
     SPLK #blok,INDX           ;INDX=voice control block size
     LAR  AR1, #outVoic0       ;[AR1]=pOutVoic0
     LAR  AR3, #Mix_Ptr        ;AR3=addr of Synth output buff ptr
        MAR     *,AR3                    ;ARP=>AR3
        LAR     AR2, *,AR4               ;[AR2]=pOutSynthPing/Pong
(synth mixer
buffer)

        lacc    #15                     ; ACC = 15
        samm    BRCR                    ; BRCR = 15, for repeat of
block 16 times
        RPTB ENDMIX - 1                 ; Begin repeat block
                                                          ;
*****************************************************************
     LAR  AR4,AR1          ;AR4=(addr of voice sample n+1)
        RPTZ    #22                      ;23 VOICES (18 melodic, 5
percuss)
     MADS *0+              ;[PanVcexx * (voicexx output)] summed
     APAC                  ;final accumulate
     MAR  *,AR2                ;ARP=>AR2
        SACH    *+,0,AR2                     ;save Left output to
OutSynthPing/Pong
```

```
        SACH     *+,0,AR1                    ;save Right output to
OutSynthPing/Pong
     MAR  *+,AR4                ;point to next sample
ENDMIX:
                                                                ;
*****************************************************************
        B        PUPDAT

       ;stereo mix
STEREOX:
                                          ;    l    e    f    t
channel-------------------------------------------------------
     SPLK #LPanVce0,BMAR        ;BMAR program address of 1st Coeff.
     SPLK #blok,INDX            ;INDX=voice control block size
     LAR  AR1, #outVoic0        ;[AR1]=pOutVoic0
     LAR  AR3, #Mix_Ptr         ;AR3=addr of Synth output buff ptr
        MAR      *,AR3                    ;ARP=>AR3
        LAR      AR2, *,AR4               ;[AR2]=pOutSynthPing/Pong
(synth mixer
buffer)

        lacc     #15                     ; ACC = 15
        samm     BRCR                    ; BRCR = 15, for repeat of
block 16 times
        RPTB ENDMIXL - 1                  ; Begin repeat block
                                                                ;
*****************************************************************
     LAR  AR4,AR1          ;AR4=(addr of voice sample n+1)
        RPTZ     #22                      ;23 VOICES (18 melodic, 5
percuss)
     MADS *0+              ;[PanVcexx * (voicexx output)] summed
     APAC                  ;final accumulate
     MAR  *,AR2                ;ARP=>AR2
        SACH     *+,0,AR2                    ;save Left output to
OutSynthPing/Pong
```

```
        MAR      *+,AR1                    ;skip Right output to
OutSynthPing/Pong
     MAR  *+,AR4              ;point to next sample
ENDMIXL:
                                                          ;
*****************************************************************

                                    ;    r    i    g    h    t
channel-----------------------------------------------------
        SPLK     #RPanVce0,BMAR          ;BMAR program address of
1st Coeff.
     SPLK #blok,INDX          ;INDX=voice control block size
     LAR  AR1, #outVoic0      ;[AR1]=pOutVoic0
     LAR  AR3, #Mix_Ptr       ;AR3=addr of Synth output buff ptr
        MAR      *,AR3                   ;ARP=>AR3
        LAR      AR2, *,AR4              ;[AR2]=pOutSynthPing/Pong
(synth mixer
buffer)

        lacc     #15                     ; ACC = 15
        samm     BRCR                    ; BRCR = 15, for repeat of
block 16 times
        RPTB ENDMIXR - 1                 ; Begin repeat block
                                                          ;
*****************************************************************
     LAR  AR4,AR1        ;AR4=(addr of voice sample n+1)
        RPTZ     #22                     ;23 VOICES (18 melodic, 5
percuss)
     MADS *0+            ;[PanVcexx * (voicexx output)] summed
     APAC                ;final accumulate
     MAR  *,AR2               ;ARP=>AR2
        MAR      *+,AR2                  ;skip Left output to
OutSynthPing/Pong
        SACH     *+,0,AR1                ;save Right output to
OutSynthPing/Pong
```

```
     MAR  *+,AR4                ;point to next sample
ENDMIXR:
                                                                ;
*****************************************************************
; Manual Modulo Update
; Check if pointer is past end of buffer (outSynthEnd)
;
PUPDAT:
        mar     *,AR3                   ;\
        lamm    AR2                    ; | Is current pointer pass
the end of
        sub     #outSynthEnd            ; |  buffer (outSynthEnd)
?
        nop                             ;/
        xc      2,GEQ                   ; Yes then set pointer to
start of buff
        lar     AR2,#outSynthPing       ;
        nop                              ; <- protect pipeline if
short immed.

PONG:
        lar     AR3, #Mix_Ptr            ; AR3 = address of mixer
pointer
        sar     AR2, *                  ; update mix_ptr
;*************************************************************
************

    ;   LACL    #1                      ;accl=1
    ;   SACL    TEMP1                   ;temp1=1
    ;   OUT     TEMP1,0ch              ;send 'flush opl buffer' to
h/w

        b       OSRTN                   ; return to OS

*************************************************************
```

```
*************


*****************************************************************
*************

        .sect "romeng"


;*****************************************************************
******
;NOIZ - noise generator routine - generate 16 white noise samples
;*****************************************************************
******
NOIZ:   LAR     AR5,#Noiz               ;AR5=pNoiz
        MAR     *,AR5                   ;ARP=>AR5
        ADRK     #15                        ;AR5=pNoiz + 15 (last
value)
        LACL    *                       ;ACCL=last noise sample
        SBRK    #15                     ;AR5=pNoiz
        SPLK    #0E1B8h,TEMP1           ;TEMP1=noise mask
        SPLK    #14,BRCR                ;BRCR = 14, for repeat of
block 15 times
;   *   *   *   *   *   *   *   b   e   g   i   n       1   s   t
sample*************************************************
        ROR                            ;ACC shift right LSB->Carry
        NOP                             ;XC pipeline prot.
        XC      1,C                     ;if carry is set
        XOR     TEMP1                   ;then apply noise mask
        SACL     *+                        ;write sample to noiz
buffer
        RPTB ENDNOIZ - 1                ;Begin repeat block
```

```
; * * * * * * * g e n e r a t e    n e x t    1 5
samples*************************************
        ROR                          ;ACC shift right LSB->Carry
        NOP                            ;XC pipeline prot.
        XC      1,C                    ;if carry is set
        XOR     TEMP1                  ;then apply noise mask
        SACL    *+                        ;write sample to noiz
buffer
;*****************************************************************
******
ENDNOIZ:
        RETD                         ;return to calling function
        NOP                            ;pipeline prot. for RETD
        NOP                            ;pipeline prot. for RETD
;*****************************************************************
******


;*****************************************************************
******
;LFO - update LFO if it is due for an update
;*****************************************************************
******
LFO:    clrc    OVM                     ;clear overflow mode for
ACC
        LAR     AR5,#LFOSked           ;AR5=pLFOSked (726uS frame
count)
        MAR     *,AR5                   ;ARP=>AR5
        LACL    #1                      ;ACCL=1
        ADD     *                       ;ACCL=1 + LFOSked
        SACL    *+                      ;LFOSked updated
        SUB     *-                      ;ACCL=LFOSked - LFOPeriod
    BCNDD     AmpLFO,NEQ          ;branch if not due for pitchLFO
update
        LACL    #0                      ;ACCL=0
```

```
        nop                                  ;delayed branch pipeline
prot
LFOUpdat:
        SACL    *+                          ;LFOSked=0,AR5=pLFOPeriod
        MAR     *+                          ;AR5=pLFOSinTbl
        LAR     AR3,*+                        ;AR3=base addr of sine
table
        LACL        *+
;ACCL=LFOStep,AR5=pLFORunOff
        ADDS    *                           ;ACCL=new LFORunOff
        SACL        *+                                      ;update
LFORunOff,AR5=pLFOMASK
        AND     *+                         ;clear ACCH,AR5=pLFOPDepth1
        SACH    INDX,7                        ;INDX=new integer table
offset
        LT              *+,AR3
;TREG0=LFODepth1,AR5=pLFODepth0
        nop                                  ;indx pipeline
        MAR     *0+                        ;AR3=p(new LFO table lookup
value)
        MPY     *,AR5                         ;(LFODepth1 * LFO lookup
value)
        LTP         *+
;TREG0=LFOPDepth0,AR5=pLFOUnity
        ADD     *+,16,AR5                  ;ACCH=1.0+(LFOPDepth1 * LFO
lookup) q15
        SACH    *+,0,AR3                    ;update LFOP1 (q15)
        MPY     *,AR5                        ;(LFODepth0 * LFO lookup
value)
        PAC                                    ;ACCH=(LFODepth0 * LFO
lookup value) q15
        ADD     *+,16,AR5                  ;ACCH=1.0+(LFOPDepth0 * LFO
lookup) q15
        SACH    *                           ;update LFOP0 (q15)
        RETD                               ;return to calling function
```

```
        setc    OVM                     ;set overflow mode for ACC
        NOP

     ;Amplitude LFO update
AmpLFO: clrc   OVM              ;clear overflow mode for ACC
     LAR  AR5,#ALFOSked         ;AR5=pLFOSked (726uS frame count)
        MAR     *,AR5                   ;ARP=>AR5
        LACL    #1                      ;ACCL=1
        ADD     *                       ;ACCL=1 + LFOSked
        SACL    *+                      ;LFOSked updated
        SUB     *-                      ;ACCL=LFOSked - LFOPeriod
     BCNDD     ALFOUpdat,EQ         ;branch if due for an update
        LACL    #0                      ;ACCL=0
        nop                              ;delayed branch pipeline
prot
        RETD                          ;return to calling function
        setc    OVM                    ;set overflow mode for ACC
        NOP                             ;pipeline prot. for RETD
ALFOUpdat:
     SACL *+              ;ALFOSked=0,AR5=pLFOPeriod
        MAR     *+                      ;AR5=pLFOSinTbl
        LAR     AR3,*+                     ;AR3=base addr of sine
table
        LACL        *+
;ACCL=LFOStep,AR5=pLFORunOff
        ADDS    *                       ;ACCL=new LFORunOff
        SACL       *+                                      ;update
LFORunOff,AR5=pLFOMASK
        AND     *+                    ;clear ACCH,AR5=pLFOPDepth1
        SACH    INDX,7                   ;INDX=new integer table
offset
        LT              *+,AR3
;TREG0=LFODepth1,AR5=pLFODepth0
        nop                             ;indx pipeline
        MAR     *0+                   ;AR3=p(new LFO table lookup
```

```
value)
        MPY     *,AR5                   ;(LFODepth1 * LFO lookup
value)
     LTP  *+                ;TREG0=LFOPDepth0,AR5=pLFOUnity
        ADD     *+,16,AR5               ;ACCH=1.0+(LFOPDepth1 * LFO
lookup) q15
        SACH    *+,0,AR3                ;update LFOP1 (q15)
        MPY     *,AR5                   ;(LFODepth0 * LFO lookup
value)
        PAC                             ;ACCH=(LFODepth0 * LFO
lookup value) q15
        ADD     *+,16,AR5               ;ACCH=1.0+(LFOPDepth0 * LFO
lookup) q15
        SACH    *                       ;update LFOP0 (q15)
        RETD                            ;return to calling function
        setc    OVM                     ;set overflow mode for ACC
        NOP
;*****************************************************************
******

;*****************************************************************
******
;LFOA - apply LFO to next voice, update LFOApply
;    toggle between pitch/Amplitude LFO every 18 frames
;*****************************************************************
******

LFOA:   spm     0                       ;set product register mode
for shift 0
        LAR     AR5,#LFOSked            ;AR5=pLFOSked LFO update
schedule
        MAR     *,AR5                   ;ARP=>AR5
        LACL    *                       ;ACCL=LFOSked value
        BCNDD   VibDone,EQ              ;no update if LFO updated
this frame
```

```
        LAR     AR5,#LFOApply           ;AR5=pLFOApply ('voice to
update' count)
     LACL *                 ;LFOApply
        SUB     #18                     ;ACCL=LFOApply - 18
     BCND AmpLFOA,GEQ           ;branch if Amplitude LFO active
LFOAVce:                    ;do pitch lfo apply
        LACC    #blok                   ;ACCL=Voiceds blok size
        SACL    TREG0                   ;TREG0=Voiceds blok size
        MPY     *,AR3                   ;blok * LFOApply
        SPL     INDX                    ;INDX=blok * LFOApply
        LAR     AR3,#Voice0             ;AR3=pVoiceds voice0
     MAR  *0+,AR5           ;AR3=pVoiceds
     LACL *                 ;LFOApply
     ADD  #1                ;ACCL=1 + LFOApply
     SACL *,0,AR3           ;LFOApply updated
        SPM     1                      ;set product register mode
for shift 1
        SAR     AR3,AR0                 ;AR0=pVoiceds
        SAR     AR3,AR2                 ;AR2=pVoiceds
        ADRK    #LFOCtl                 ;AR3=pLFOCtl word
        BIT      *,15                      ;test for mod Vibrato
on/off
        BCNDD   CkCrVib,NTC            ;branch if mod Vibrato off
ModVib:
        BIT     *,13                    ;check Vibrato depth
        NOP                             ;pipeline
        BCNDD   HLModV,TC               ;branch if high vibrato
        LAR     AR5,#LFOP1              ;AR5=pLFOP1
        LAR     AR5,#LFOP0              ;AR5=pLFOP0
HLModV  MAR     *,AR0                   ;ARP=>AR0
        ADRK    #Nom_Pch                ;AR0=pNom_Pch
        LT      *+,AR5                  ;TREG0=Nom_Pch
        MPYU    *,AR0                   ;PREG=Nom_Pch * LFOPx
        SPH     *                       ;Pch_Step updated
        SBRK    #Pch_Step               ;AR0=pVoiceds
```

```
        MAR     *,AR3                   ;ARP=>AR3
CkCrVib:
        BIT      *,14                       ;test for car Vibrato
on/off
        BCNDD   VibDone,NTC            ;branch if car Vibrato off
CarVib:
        BIT     *,13                    ;check Vibrato depth
        NOP                             ;pipeline
        BCNDD   HLCarV,TC               ;branch if high vibrato
        LAR     AR5,#LFOP1              ;AR5=pLFOP1
        LAR     AR5,#LFOP0              ;AR5=pLFOP0
HLCarV  MAR     *,AR2                   ;ARP=>AR2
        ADRK    #Nom_PchC               ;AR2=pNom_PchC
        LT      *+,AR5                  ;TREG0=Nom_PchC
        MPYU    *,AR2                   ;PREG=Nom_PchC * LFOPx
        SPH     *,AR3                   ;Pch_StpC updated
VibDone:
        RETD                           ;return to calling function
        SPM     1                       ;set product register mode
for shift 1
        nop                             ;pipeline prot
;-------------------------
AmpLFOA:
     spm  0              ;set product register mode for shift 0
     LAR  AR5,#ALFOSked       ;AR5=pLFOSked LFO update schedule
        MAR     *,AR5                   ;ARP=>AR5
        LACL    *                       ;ACCL=LFOSked value
        BCNDD   VibDone,EQ              ;no update if LFO updated
this frame
     LAR  AR5,#ALFOApply       ;AR5=pLFOApply ('voice to update'
count)
     LACL *              ;ACCL=LFOApply
     SUB  #17            ;ACCL=LFOApply - 17
     BCNDD     ALFOAVce,NEQ        ;branch if Amplitude LFO active
     LACL #0             ;ACCL=0
```

```
     nop                    ;delayed branch
     SACL *                 ;ALFOApply=0
     LAR   AR5,#LFOApply          ;AR5=pLFOApply ('voice to update'
count)
     SACL *                 ;LFOApply=0
     BD   ALFO17
     LAR   AR5,#ALFOApply         ;AR5=pLFOApply ('voice to update'
count)
ALFOAVce:
        LACL    #1                        ;ACCL=1
        ADD     *                         ;ACCL=1 + LFOApply
     SACL *                 ;LFOApply updated
ALFO17    LACC #blok                 ;ACCL=Voiceds blok size
        SACL    TREG0                     ;TREG0=Voiceds blok size
        MPY     *,AR3                     ;blok * LFOApply
        SPL     INDX                      ;INDX=blok * LFOApply
        LAR     AR3,#Voice0               ;AR3=pVoiceds voice0
        MAR     *0+                       ;AR3=pVoiceds
        SPM     1                        ;set product register mode
for shift 1
        SAR     AR3,AR0                   ;AR0=pVoiceds
        SAR     AR3,AR2                   ;AR2=pVoiceds
        ADRK    #LFOCtl                   ;AR3=pLFOCtl word
     BIT  *,12              ;test for mod Tremolo on/off
     BCNDD     CkCrTrm,NTC          ;branch if mod Tremolo off
ModTrm:
     BIT  *,10              ;check Tremolo depth
        NOP                               ;pipeline
     BCNDD     HLModT,TC        ;branch if high tremolo
      ; LAR    AR5,#ALFOP1          ;AR5=pLFOP1
     LAR   AR5,#ALFOP0             ;for mod case to reduce noise
artifacts
     LAR  AR5,#ALFOP0          ;AR5=pLFOP0
HLModT    MAR  *,AR0                ;ARP=>AR0
     ADRK #Level_MN        ;AR0=pLevel_MN
```

```
     LT   *,AR5                ;TREG0=Level_MN
     MPYU *,AR0                ;PREG=Level_MN * LFOPx
     ADRK #31             ;AR0=pLevel_M
     SPH  *               ;Level_M updated
     SBRK #Level_M        ;AR0=pVoiceds
        MAR     *,AR3                    ;ARP=>AR3
CkCrTrm:
     BIT  *,11            ;test for car Tremolo on/off
     BCNDD     TrmDone,NTC          ;branch if car Tremolo off
CarTrm:
     BIT  *,10            ;check Tremolo depth
        NOP                               ;pipeline
     BCNDD     HLCarT,TC       ;branch if high vibrato
     LAR  AR5,#ALFOP1          ;AR5=pLFOP1
     LAR  AR5,#ALFOP0          ;AR5=pLFOP0
HLCarT    MAR  *,AR2                ;ARP=>AR2
     ADRK #Level_CN       ;AR2=pLevel_CN
     LT   *,AR5                ;TREG0=Level_CN
     MPYU *,AR2                ;PREG=Level_CN * LFOPx
     ADRK #39             ;AR2=pLevel_C
     SPH  *,AR3                ;Level_C updated
TrmDone:
        RETD                          ;return to calling function
        SPM     1                      ;set product register mode
for shift 1
        nop                               ;pipeline prot
;*****************************************************************
******


;*****************************************************************
************
; Mod Envelope, Spectral Series update, and Series Oscillator
; 16 full amplitude samples into buffer pointed to by Out_Ptr
```

```
;*****************************************************************
************

ModEnv:
;*****************************************************************
************
; Modulator Envelope Update, register note-off check carrier/modulator
; AR0= Voiceds pointer, DP=0
;*****************************************************************
************
     CLRC OVM            ;saturation=off
     ;chek for note-off in register status
     MAR  *,AR3                ;ARP=>AR3
     LAR  AR3,AR0        ;AR3=voiceds ptr
     ADRK #C_Rnge        ;AR3=pC_Rnge
     SAR  AR3,AR2        ;AR2=pC_Rnge
     SBRK #9             ;AR3=pM_Rnge
     LACL #3             ;ACCL=3 (release env range=3)
     MAR  *,AR0                ;ARP=>AR0
     LAR  AR5,*,AR5      ;AR5=A_Reg_St (addr of reg. status)
     CPL  #01Fh,*,AR3          ;check for noteoff (1Fh),ARP=>AR3
        SAR     AR3,AR1                  ;AR1=pM_Rnge
     XC   2,TC           ;if reg. status=note-off then:
     SACL *,0,AR2        ;     M_Rnge=3 (release)
     SACL *,0,AR3        ;     C_Rnge=3 (release)
     SBRK #2             ;AR3=pEnvMSB_M
        SAR     AR3,AR2                  ;AR2=pEnvMSB_M
        LACC    *+, 16                   ;ACCH=EnvMSB_M
        ADD     *+                      ;ACCL=EnvLSB_M,AR3=pM_Rnge
        lar     AR5, *,AR5               ;AR5=M_Rnge
     BANZD     MRnge1,*-,AR3        ;AR5=M_Rnge-1
MRnge0  MAR     *+, AR5                  ;AR3=pA_SlpeM
        nop                               ;Delayed Branch pipeline
_______
        MAR     *,AR3                    ;ARP=>AR3
```

```
     ADD  *+, 12, AR2          ;ACC=new Envelope,AR3=pD_SlpeM
     BCND AtkTopM,LT           ;Check for 'top of attack'
        RETD                              ;stay in attack
        SACH    *+                        ;Save EnvMSB_M
     SACL *-              ;Save EnvMSB_L,AR2=pEnvMSB_M
AtkTopM SPLK   #7FFFh,*,AR1        ;Env_MSB_M=7FFFh
        RETD                             ;Switch to Range 1 (decay)
     LACL #1              ;ACC=1
     SACL *               ;M_Rnge=1, Envelope=> Decay
MRnge1    BANZD     MRnge2,*-,AR3       ;AR5=M_Rnge-2
        MAR     *+, AR5                 ;AR3=pD_SlpeM
        nop                              ;Delayed Branch pipeline
_______
        MAR     *,AR3                   ;ARP=>AR3
        SUB         *+,  12,  AR2                        ;ACC=new
Envelope,AR3=pS_SlpeM
        BCNDD   ZipEnvM,LEQ            ;Branch to clear Env if <=
0
        SACH    *+                      ;Save EnvMSB_M
        SACL        *-,  0,  AR3                          ;Save
EnvMSB_L,AR2=pEnvMSB_M
        MAR     *+                      ;AR3=pS_LevlM
        SUB     *, 16, AR1              ;ACCH=Envelope-S_LevlM
        RETC     GT                             ;Branch to Series
Modulation if >0
        RETD                                   ;Switch to Range 2
(sustain)
        LACL    #2                      ;ACC=2
        SACL     *                          ;M_Rnge=2, Envelope=>
Sustain
MRnge2    BANZD     MRnge3,*-,AR3       ;AR5=M_Rnge-3
        MAR     *+                      ;AR3=pS_SlpeM
        MAR     *+, AR5                  ;AR3=pS_LevlM
_______
     MAR  *, AR3              ;ARp=>AR3
```

```
     MAR  *-              ;AR3=pS_SlpeM (EG Type- 1=sustain)
     LACL *,AR1                ;ACCL=EG Type
        RETC    GT                        ;branch if sustain=on
        RETD                                     ;Switch to Range 3
(release)
     LACL #3              ;ACC=3
     SACL *               ;M_Rnge=3, Envelope=> release
MRnge3    BANZD     ZipEnvM,*-, AR3      ;AR5=M_Rnge-4
     MAR  *+              ;AR3=pR_SlpeM
        nop                                ;Delayed Branch pipeline
_______
        SUB          *+,  12,  AR2                          ;ACC=new
Envelope,AR3=pS_SlpeM
     BCND ZipEnvM,LEQ          ;Branch to clear Env if <= 0
        RETD                            ;Done
        SACH    *+                      ;Save EnvMSB_M
     SACL *-              ;Save EnvMSB_L,AR2=pEnvMSB_M
ZipEnvM MAR     *,AR2                   ;ARP=>AR2
        ZAP                             ;ACC=0
        SACH    *+                      ;zero EnvMSB_M
        SACL    *+                     ;zero EnvLSB_M,AR2=pM_Rnge
        LACL    #4                      ;ACC=4
        RETD
     SACL *-              ;M_Rnge=4, Envelope=OFF
     MAR  *-              ;AR2=pEnvMSB_M
;*****************************************************************
************


SpecMod0:
;*****************************************************************
************
;Harmonic Series Spectral Modulation, connect=0
; AR0= Voiceds pointer, AR2=pEnvMSB_M, DP=0, PM=1
;*****************************************************************
```

```
************
;First, update Mod. Envelope Coefficients.
     MAR  *,AR2                ;ARP=>AR2
     LT   *-              ;TREG0=EnvMSB_M, AR2=pLevel_M
     MPY  *, AR3               ;(Level_M * EnvMSB_M),ARP=>AR3
     LAR  AR3,AR0         ;AR3=pVoiceds
        ADRK    #FSerOff                ;AR3=pFSerOff
        SAR     AR3,AR2                 ;AR2=pFSerOff
        ADRK    #4                        ;AR3=pEm (addr. of env.
coefficient)
        SPH     *+                      ;save Em,AR3=pOne
        ;lookup/calculate noise factor per FEEDBK
        SETC    OVM                     ;set overflow mode
        SAR     AR3,AR5                 ;AR5=pOne
        SBRK    #4                      ;AR3=pFeedbk reg value
        LACL    *+,AR4                  ;ACCL=Feedbk,AR3=pFbk
        SACL    INDX                    ;INDX=Feedbk
        LAR     AR4,#NoizF0             ;AR4=pNoizF0
        SPH     TREG0                   ;TREG0=Em
      ; PAC                             ;ACC=Em
      ; ADD     #4096,15                ;ACC=Em + feedback offset
w/ sat.
      ; SACH    TREG0                  ;TREG0=Em + feedback offset
      ; SQRA    TREG0                   ;P=Em**2
      ; SPH     TREG0                   ;TREG0=Em**2
      ; SQRA    TREG0                   ;P=Em**4
      ; SPH     TREG0                   ;TREG0=Em**4
        MAR     *0+                     ;AR4=pNoizf(FEEDBK)
        MPY     *                       ;Noizf(FEEDBK) * Em
        ;use 'hysteresis' xfer function to convert linear pre-Fbk
product
        CLRC    OVM                     ;reset overflow mode
        PAC                             ;ACCH=Noizf(FEEDBK) * Em
        BSAR    9                           ;ACCH,1=FBKTABL index
(0-7F)
```

```
        SACH    INDX,1                  ;ACCH=FBKTABL index (0-7F)
        AND       #7FFFh                          ;ACCL=frac  for
interpolation (Q15)
        SACL      TREG0                           ;TREG0=frac  for
interpolation (Q15)
        LAR     AR4,#FBKTABL            ;AR4=FBKTABL base address
        MAR     *0+                     ;AR4=pFBKTABL(PFbk)
        ;interpolate Fbk Coeff.
        LACC *, 16              ; Zero ACCL and load ACCH with x(n)
     MPY  *+                   ; PREG=x(n)*frac(n*p)
        MPYS *,AR3                  ; ACC =x(n) - x(n)*frac(n*p);
PREG=x(n+1)*frac(n*p)
     APAC                          ; ACC =x(n) - x(n)*frac(n*p) +
x(n+1)*frac(n*p)
        SACH * ,AR5             ; save Fbk
        LACC    *,16,AR3                ;ACCH=One
        SUB     *+,16                   ;ACCH=One-Fbk,AR3=pMFbk
        SACH    *+                      ;save MFbk,AR3=pEm
     ;  MAR     *+                      ;AR3=pOne
     ;calculate series range # and mix coefficient
        ;AR3=pEm,ARP=>AR3,SXM=0,AR2=pFSerOff
        LACC    #4000h,4                ;ACC=8.0 (q15)
     ;  SACB                            ;ACCB=8.0 (q15)
     ;  LACC    *-, 3, AR3              ;ACC=One*8.0 (Q15)
        SUB       *+, 3, AR2                    ;ACC=(One-Em)*8.0
(Q15),AR3=pOne
     ;  ADD     *,2,AR2                 ;Add Nom_Pch offset (anti
alias)
     ;  ADRK    #8                      ;AR2=pFSerOff
        ; Feedback Series offset subtract
        SUB     *,2,AR3                ;add Feedback Series Offset
(FSerOff)
        NOP                             ;XC pipeline
        XC      1,LT                    ;check for ACC < 0
        LACL    #0                       ;ACC=minimum boundary if
```

```
ACC < 0
      ; CRLT                                  ;ACC=upper boundary (8.0
q15)
Range   SACH    INDX, 1                       ;INDX=new series range #
(0-8)
     AND  *                  ;ACCL=(mixCoefficient)
     SACL TREG0                   ;TREG0=(mixCoefficient)
     SUB  *+                 ;ACCL=(mixCoefficient-1),AR3=pMCoeff_
     NEG                     ;ACCL=(1-mixCoefficient)
     SACL *+                 ;update MCoeff_, AR3=pSRange
     ;Update SRange, TblBase, Tabl_Ptr
     SAR  AR0,AR5            ;AR5=pVoiceds
     SAR  AR0,AR2            ;AR2=pVoiceds
        LACL    INDX                          ;ACCL=new series range#
(0-9)
     SACL *+,0,AR5           ;SRange updated,AR3=pAmpCar
     ADRK #pSpecSer          ;AR5=p(pSpecSer)
     LAR  AR5,*                   ;AR5=pSpecSer
     MAR  *0+                ;AR5=pTblBase(SRange)
     LACC *,15,AR2           ;ACC=new TblBase
        ADRK    #Tabl_Ptr                 ;AR2=pTabl_Ptr
        SACH    TEMP1,1                   ;TEMP1= new TblBase
        LACL      *                                ;ACCL=Tabl_Ptr
(TableAddress)
        ADRK    #2                        ;AR2=pTblBase
        SUB     *                         ;ACCL=(TableOffset)
        ADD        TEMP1                                  ;ACCL=new
Tabl_Ptr(TableAddress)
        SBRK    #2                        ;AR2=pTabl_Ptr
        SACL    *                         ;update Tabl_Ptr
        ADRK    #2                        ;AR2=pTblBase
        LACL    TEMP1                     ;ACCL=new TblBase
        SACL    *,AR5                     ;update TblBase
       ;Update Carrier Amplitude per MixCoefficent
       ;TREG0=MixCoefficent, AR3=pAmpCar, ARP=>AR5, INDX=SRange
```

```
CarrAmp LAR     AR5,#AmpCarS0           ;AR5=pAmpCarS0
     MAR  *0+            ;AR5=pAmpCarS(INDX+1)
     LACC *, 16     ; Zero ACCL and load ACCH with a(n)
     MPY  *+   ; PREG=a(n)*frac(n*p)
     MPYS   *,AR3                ;   ACC   =a(n)-a(n)*frac(n*p);
PREG=a(n+1)*frac(n*p)
        RETD            ; return to calling function
     APAC      ; ACCH=interpolated Amplitude of carrier
     SACH *          ; Store a(n+p) AmpCar
;*****************************************************************
*************
*


SerOsc:

;*****************************************************************
*******
       ;Harmonic Series Oscillator
       ; AR0= voiceds ptr, DP=0

;*****************************************************************
*******
       ;setup registers for series oscillator loop
     MAR  *, AR5          ; ARP=>AR5
     LAR  AR5,AR0   ; AR5=pVoiceds
     SAR  AR0,AR3   ; AR3=pVoiceds
        ADRK    #MCoeff_        ; AR5=pMCoeff_
        MAR     *, AR3          ; ARP=>AR3
        ADRK    #Pch_Step       ; AR3=Pch_Step address
        lacc    *+, 16          ; ACCH = Pch_Step,AR3=pOut_ptr
        sach    TEMP3           ; TEMP3= Pch_Step
        lar        AR2,  *+               ;  AR2  =   pointer  to
OscOutBuff,AR3=pTabl_ptr
```

```
        lar          AR4,  *+                    ;  AR4  =>  Wave
TableAddress,AR3=pRun_val
        LACL    *                ; ACCL = .Frac(Q15)
        SACL      TREG0                  ;  TREG0=  .Frac(Q15)  (for
interpolation)
        LACC    AR4,15           ; ACCH,1=Wave TableAddress
        ADD           *+                                  ;  ACC   =
TableAddress.Frac(Q15),AR3=pTblBaseC
        SUB     *,15             ; ACC = TableOffset.Frac(Q15)
     SACB            ; ACCB=  TableOffset.Frac (Q15)
        LACL    *+,AR4           ; ACCL= TableBase, AR3 = pMaskMSB
     SACL INDX       ; INDX=TableBase
     LACL #7Fh       ; TEMPORARY for modulo 128
     SACL DBMR       ; DBMR=modulo mask
     lacc    #15              ; ACC = 15
     samm   BRCR           ; BRCR = 15, for repeat of block 16 times
        RPTB ENDBLOCK - 1        ; Begin repeat block
;*****************************************************************
*********
; ACCB=TableOffset.Frac(Q15), AR2=pOscOutBuff, AR3=pMaskMSB,
AR4=TableAddress
; TREG0=.Frac(Q15), TEMP3=PitchInt.PitchFrac(Q10), DP=0, ARP=4, SXM
= 0,
PM = 1
; INDX=TableBase, AR5=pMCoeff_, DBMR=modulo mask
;*****************************************************************
*********
LOOP    LACC *, 16       ; Zero ACCL and load ACCH with x1(n)
        MPY  *+          ; PREG=x1(n)*frac(n*p)
        MPYS  *                    ;  ACC  =x1(n)-x1(n)*frac(n*p);
PREG=x1(n+1)*frac(n*p)
        ADRK #128          ; AR4 =address of x2(n), 128=> 0 phase
shift
        MPYA *           ; ACCH=x1(n+p),PREG=frac(n*p)*x2(n)
        SACH TEMP1       ; Temp save x1(n+p)
```

```
        LACC *+, 16      ; Zero ACCL and load ACCH with x2(n)
        MPYS  *,AR5                ;  ACC  =x2(n)-x2(n)*frac(n*p);
PREG=x2(n+1)*frac(n*p)
        LTA  *,AR2       ; ACCH=x2(n+p),TREG=(1-MixCoefficient)
        SACH TEMP2       ; Temp save x2(n+p)
        MPY  TEMP2       ; PREG=(1-MixCoefficient)*x2(n+p)
        MPYS TEMP1       ;
ACC=x2(n+p)-(1-MixCoeff)*x2(n+p);PREG=x1(n+p)*(1-MixCoeff)
        APAC             ; ACCH=one-sided spectra output
        SACH *+,AR3      ; Store x(n+p) integer (output value)
        LACC TEMP3,5     ; ACC = PitchInt.PitchFrac (Q15)
        ADDB                                          ;   ACC   =
TableOffset.Frac+PitchInt.PitchFrac(Q15)
        SACH AR4,1       ; AR4 = new TableOffset w/ spillovers
        SACB             ; ACCB= new TableOffset.Frac w/ spillovers
(Q15)
        AND  *, AR4      ; ACCL= Frac for interpolation (positive
Q15)
        APL  AR4         ; AR4 = clean TableOffset (manual modulo)
        SACL TREG0       ; TREG = Frac for interpolation (positive
Q15)
        nop              ; pipeline (MM write to AR4)
        MAR  *0+         ; (add input waveform TableBase - manual
modulo)
ENDBLOCK:
;*****************************************************************
*********
     mar  *,AR3                ;ARP=>AR3
     lar  AR3,AR0         ;AR3=pVoiceds
        ADRK    #Tabl_Ptr                ;AR3=pTabl_Ptr
        LACL    TREG0                    ;ACCL= .Frac (Q15)
        RETD                                  ;return (delayed) to
calling function
        SAR             AR4,  *+
;Tbl_PtrC=TableAddress,AR3=pRun_ValC
```

```
        SACL    *                          ;Run_ValC=.Frac (Q15)
;*****************************************************************
************


SpecMod1:
;*****************************************************************
************
;Harmonic Series Spectral Modulation, connect=0
; AR0= Voiceds pointer, AR2=pEnvMSB_M, DP=0, PM=1
;*****************************************************************
************
;First, update Mod. Envelope Coefficients.
     MAR  *,AR2                ;ARP=>AR2
     LT   *-              ;TREG0=EnvMSB_M, AR2=pLevel_M
     MPY  *, AR3               ;(Level_M * EnvMSB_M),ARP=>AR3
     LAR  AR3,AR0         ;AR3=pVoiceds
        ADRK    #FSerOff                ;AR3=pFSerOff
        SAR     AR3,AR2                 ;AR2=pFSerOff
        ADRK    #4                        ;AR3=pEm (addr. of env.
coefficient)
        SPH     *+                      ;save Em,AR3=pOne
        ;lookup/calculate noise factor per FEEDBK
        SAR     AR3,AR5                 ;AR5=pOne
        SBRK    #4                      ;AR3=pFeedbk reg value
        LACL    *+,AR4                  ;ACCL=Feedbk,AR3=pFbk
        SACL    INDX                    ;INDX=Feedbk
        LAR     AR4,#NoizF0             ;AR4=pNoizF0
        SPH     TREG0                   ;TREG0=Em
     ; PAC                              ;ACC=Em
     ; ADD     #4096,15                 ;ACC=Em + feedback offset
     ; SACH    TREG0                   ;TREG0=Em + feedback offset
     ; SQRA    TREG0                     ;P=Em**2
     ; SPH     TREG0                     ;TREG0=Em**2
```

```
; SQRA    TREG0                    ;P=Em**4
; SPH     TREG0                    ;TREG0=Em**4
  MAR     *0+                      ;AR4=pNoizf(FEEDBK)
  MPY     *                        ;Noizf(FEEDBK) * Em
  ;use 'hysteresis' xfer function to convert linear pre-Fbk
product
  PAC                              ;ACCH=Noizf(FEEDBK) * Em
  BSAR    9                            ;ACCH,1=FBKTABL index
(0-7F)
  SACH    INDX,1                   ;ACCH=FBKTABL index (0-7F)
  AND     #7FFFh                          ;ACCL=frac for
interpolation (Q15)
  SACL    TREG0                           ;TREG0=frac for
interpolation (Q15)
  LAR     AR4,#FBKTABL             ;AR4=FBKTABL base address
  MAR     *0+                      ;AR4=pFBKTABL(PFbk)
  ;interpolate Fbk Coeff.
  LACC *, 16                 ; Zero ACCL and load ACCH with x(n)
MPY  *+                     ; PREG=x(n)*frac(n*p)
  MPYS *,AR3                     ; ACC =x(n) - x(n)*frac(n*p);
PREG=x(n+1)*frac(n*p)
APAC                             ; ACC =x(n) - x(n)*frac(n*p) +
x(n+1)*frac(n*p)
  SACH * ,AR5                ; save Fbk
  LACC    *,16,AR3                 ;ACCH=One
  SUB     *+,16                    ;ACCH=One-Fbk,AR3=pMFbk
  SACH    *+                       ;save MFbk,AR3=pEm
  MAR     *+                       ;AR3=pOne
;calculate series range # and mix coefficient
  ;AR3=pOne,ARP=>AR3,SXM=0,AR2=pFSerOff
; LACC    #4000h,4                 ;ACC=8.0 (q15)
; SACB                             ;ACCB=8.0 (q15)
LACC *-, 3, AR3            ;ACC=One*8.0 (Q15)

  SUB     *+, 1, AR2                       ;ACC=(One-Em)*8.0
```

```
(Q15),AR3=pOne

     ;  ADD      *,2,AR2                    ;Add Nom_Pch offset (anti
alias)
     ;  ADRK     #8                         ;AR2=pFSerOff
        ; Feedback Series offset subtract
        SUB      *,2,AR3                   ;add Feedback Series Offset
(FSerOff)
        NOP                                 ;XC pipeline
        XC       1,LT                       ;check for ACC < 0
        LACL     #0                          ;ACC=minimum boundary if
ACC < 0
      ; CRLT                                ;ACC=upper boundary (8.0
q15)
Range1  SACH     INDX, 1                    ;INDX=new series range #
(0-8)
     AND  *                ;ACCL=(mixCoefficient)
     SACL TREG0                 ;TREG0=(mixCoefficient)
     SUB  *+               ;ACCL=(mixCoefficient-1),AR3=pMCoeff_
     NEG                   ;ACCL=(1-mixCoefficient)
     SACL *+               ;update MCoeff_, AR3=pSRange
     ;Update SRange, TblBase, Tabl_Ptr
     SAR  AR0,AR5          ;AR5=pVoiceds
     SAR  AR0,AR2          ;AR2=pVoiceds
        LACL     INDX                       ;ACCL=new series range#
(0-9)
     SACL *+,0,AR5         ;SRange updated,AR3=pAmpCar
     ADRK #pSpecSer        ;AR5=p(pSpecSer)
     LAR  AR5,*                 ;AR5=pSpecSer
     MAR  *0+              ;AR5=pTblBase(SRange)
     LACC *,15,AR2         ;ACC=new TblBase

        ADRK     #Tabl_Ptr                 ;AR2=pTabl_Ptr
        SACH     TEMP1,1                   ;TEMP1= new TblBase
        LACL      *                                ;ACCL=Tabl_Ptr
```

```
(TableAddress)
        ADRK    #2                          ;AR2=pTblBase
        SUB     *                           ;ACCL=(TableOffset)
        ADD         TEMP1                                   ;ACCL=new
Tabl_Ptr(TableAddress)
        SBRK    #2                          ;AR2=pTabl_Ptr
        SACL    *                           ;update Tabl_Ptr
        ADRK    #2                          ;AR2=pTblBase
        LACL    TEMP1                       ;ACCL=new TblBase
        SACL    *,AR5                       ;update TblBase
       ;Update Carrier Amplitude per MixCoefficent
       ;TREG0=MixCoefficent, AR3=pAmpCar, ARP=>AR5, INDX=SRange
CarAmp1 LAR     AR5,#AmpCarS0               ;AR5=pAmpCarS0
     MAR  *0+            ;AR5=pAmpCarS(INDX+1)
     LACC *, 16      ; Zero ACCL and load ACCH with a(n)
     MPY  *+    ; PREG=a(n)*frac(n*p)
     MPYS   *,AR3                ;   ACC   =a(n)-a(n)*frac(n*p);
PREG=a(n+1)*frac(n*p)
        RETD            ; return to calling function
     APAC       ; ACCH=interpolated Amplitude of carrier
     SACH *          ; Store a(n+p) AmpCar
;*****************************************************************
*************
*


;*****************************************************************
************
;Carrier envelope and oscillator function
;*****************************************************************
************
CarEnvOsc:
;*****************************************************************
************
;Carrier Envelope Update, Voice OFF (emode=0) status maintainence
```

```
; AR0=addr of Voiceds pointer, DP=0
;*****************************************************************
************
     CLRC OVM              ;saturation=off
     MAR  *,AR3                 ;ARP=>AR3
     LAR  AR3,AR0          ;AR3=pVoiceds
     ADRK #EnvMSB_C        ;AR3=pEnvMSB_C
     SAR  AR3,AR2          ;AR2=pEnvMSB_C
      ; LACC    *, 12                    ;ACCH=EnvMSB_C / 16
        LACC    *, 13                    ;ACCH=EnvMSB_C / 8
        SACH    TREG0                    ;TREG0=EnvMSB_C / 16
     LACC *+, 16                ;ACCH=EnvMSB_C
     ADD  *+               ;ACCL=EnvLSB_C,AR3=pC_Rnge
     SAR  AR3,AR1          ;AR1=pC_Rnge
     lar  AR5, *,AR5            ;AR5=C_Rnge
     BANZD     CRnge1,*-,AR3        ;AR5=C_Rnge-1
CRnge0    MAR  *+, AR5        ;AR3=pA_SlpeC
        nop                              ;Delayed Branch pipeline
_______
        MAR     *,AR3                    ;ARP=>AR3
     ADD  *+, 12, AR2           ;ACC=new Envelope,AR3=pD_SlpeC
     BCND AtkTopC,LT            ;Check for 'top of attack'
     BD   UpdatEc          ;stay in attack
     SACH *+               ;Save EnvMSB_C
     SACL *-               ;Save EnvLSB_C,AR2=pEnvMSB_C
AtkTopC SPLK   #7FFFh,*,AR1         ;Env_MSB_C=7FFFh
     BD   UpdatEc          ;Switch to Range 1 (decay)
     LACL #1               ;ACC=1
     SACL *                ;C_Rnge=1, Envelope=> Decay
CRnge1    BANZD     CRnge2,*-,AR3        ;AR5=C_Rnge-2
     MAR  *+, AR5          ;AR3=pD_SlpeC
        nop                              ;Delayed Branch pipeline
_______
        MAR     *,AR3                    ;ARP=>AR3
        MPYU    *+,AR2                   ;(EnvMSB_C / 16)*D_SlpeC
```

```
        SPAC                                                    ;ACC=new
Envelope,AR3=pS_SlpeC
        SUB     #4,15                           ;TEST!!!
      ;  SUB          *+,  12,  AR2                             ;ACC=new
Envelope,AR3=pS_SlpeC
     BCNDD     ZipEnvC,LEQ          ;Branch to clear Env if <= 0
     SACH *+                 ;Save EnvMSB_C
     SACL *-, 0, AR3              ;Save EnvLSB_C,AR2=pEnvMSB_C
     MAR  *+                 ;AR3=pS_Lev1C
     SUB  *, 16, AR1              ;ACCH=Envelope-S_Lev1C
     BCND UpdatEc,GT              ;Branch to Series Modulation if >0
     BD   UpdatEc            ;Switch to Range 2 (sustain)
        LACL    #2                           ;ACC=2
     SACL *                  ;C_Rnge=2, Envelope=> Sustain
CRnge2    BANZD     CRnge3,*-,AR3        ;AR5=C_Rnge-3
     MAR  *+                 ;AR3=pS_SlpeC
     MAR  *+, AR5            ;AR3=pS_Lev1C
     MAR  *, AR3                  ;ARp=>AR3
     MAR  *-                 ;AR3=pS_SlpeC (EG Type- 1=sustain)
     LACL *,AR1                   ;ACCL=EG Type
     BCND UpdatEc,GT              ;branch if sustain=on
     BD   UpdatEc            ;Switch to Range 3 (release)
     LACL #3                 ;ACC=3
     SACL *                  ;C_Rnge=3, Envelope=> release
CRnge3    BANZD     ZipEnvC,*-, AR3      ;AR5=C_Rnge-4
     MAR  *+                 ;AR3=pR_SlpeC
        nop                                   ;Delayed Branch pipeline
        MPYU    *+,AR2                        ;(EnvMSB_C / 16)*D_SlpeC
        SPAC                                                    ;ACC=new
Envelope,AR3=pS_SlpeC
        SUB     #4,15                         ;TEST!!!
      ;  SUB          *+,  12,  AR2                             ;ACC=new
Envelope,AR3=pS_SlpeC
     BCND ZipEnvC,LEQ          ;Branch to clear Env if <= 0
```

```
      BD   UpdatEc          ;Done
      SACH *+               ;Save EnvMSB_C
      SACL *-               ;Save EnvMSB_L,AR2=pEnvMSB_C
 ZipEnvC MAR    *,AR2                ;ARP=>AR2
         ZAP                                ;ACC=0
      SACH *+               ;zero EnvMSB_C
      SACL *+               ;zero EnvLSB_C,AR2=pC_Rnge
         LACL    #4                         ;ACC=4
      SACL *-               ;C_Rnge=4, Envelope=OFF
      MAR  *-,AR3                ;AR2=pEnvMSB_C
      ;turn voice off: connect=1 (emode=4) requires mod and car
 env=0
      LAR  AR3,AR0          ;AR3=voiceds ptr
      SAR  AR0,AR5          ;AR5=voiceds ptr
      ADRK #EMode                ;AR3=pEMode
      SUB  *,0,AR5          ;ACC= 4 - EMode
      BCNDD       ZipVoic,NEQ            ;don't branch if EMode=4
 (connect=1)
      ADRK #EnvMSB_M        ;AR5=pEnvMSB_M
      LACL *,AR3                 ;ACC=EnvMSB_M,ARP=>AR3
      BCND UpdatEc,NEQ           ;don't turn voice off if Mod active
 ZipVoic LACL   #0               ;ACC=0
      SACL *,0,AR0          ;EMode=0 (voice=off)
      LAR  AR3,*,AR3        ;AR3=pA_Reg_xx (register status)
      MAR  *+               ;AR3=addr of voice assignment
      SACL *                ;clear voice assignment
 ; update Carrier Envelope Coefficients.
 UpdatEc:
      MAR  *,AR2                 ;ARP=>AR2
      LT   *-               ;TREG0=EnvMSB_C, AR2=pLevel_C
      MPY  *, AR3                ;(Level_C * EnvMSB_C),ARP=>AR3
      LAR  AR3,AR0          ;AR3=pVoiceds
      ADRK #Ec              ;AR3=pEc (addr. of env. coefficient)
      SPH  *+               ;save Ec
;*****************************************************************
```

```
************

;*****************************************************************
*******
        ;Carrier Oscillator
        ; AR0= voiceds ptr, DP=0

;*****************************************************************
*******
        ;setup registers for oscillator loop
         CLRC    SXM              ; clear sign extension
      MAR  *, AR3          ; ARP=>AR3
      LAR  AR3,AR0    ; AR3=pVoiceds
      ADRK #Pch_StpC ; AR3=pPch_StpC
      LACC *+, 16          ; ACCH = Pch_StpC,AR3=pOut_ptr
      SACH TEMP1           ; TEMP1 = Pch_StpC
      LAR  AR2, *+    ; AR2 =  pointer to OscOutBuff,AR3=pTbl_ptrC
         LAR            AR4,   *+                          ;  AR4   =  Wave
TableAddress,AR3=pRun_ValC
         LACL     *                ; ACCL = .Frac(Q15)
         SACL       TREG0                   ;  TREG0=  .Frac(Q15)  (for
interpolation)
         LACC     AR4,15           ; ACCH,1=Wave TableAddress
         ADD            *+                                        ;  ACC   =
TableAddress.Frac(Q15),AR3=pTblBaseC
         SUB      *,15             ; ACC = TableOffset.Frac(Q15)
     SACB            ; ACCB=  TableOffset.Frac (Q15)
         LACL     *+,AR4           ; ACCL= TableBase, AR3 = pMaskMSBC
     SACL INDX       ; INDX=TableBase
     LACL #7Fh       ; TEMPORARY for modulo 128
     SACL DBMR       ; DBMR=modulo mask
     LACC #15        ; ACC = 15
     SAMM BRCR       ; BRCR = 15, for repeat of block 16 times
     RPTB ENDBLK_C - 1    ; Begin repeat block
```

```
;*****************************************************************
*********
; ACCB=TableOffset.Frac(Q15), AR2=pOscOutBuff, AR3=pMaskMSB,
AR4=TableAddress
; TREG0=.Frac(Q15), TEMP1=PitchInt.PitchFrac(Q10), DP=0, ARP=4, SXM
= 0,
PM = 1
; INDX=TableBase, DBMR=modulo mask
;*****************************************************************
*********
LOOP_C    LACC *, 16          ; Zero ACCL and load ACCH with x(n)
     MPY  *+                 ; PREG=x(n)*frac(n*p)
     MPYS *,AR2                   ; ACC =x(n) - x(n)*frac(n*p);
PREG=x(n+1)*frac(n*p)
     APAC                         ; ACC =x(n) - x(n)*frac(n*p) +
x(n+1)*frac(n*p)
     SACH *+,AR3          ; Store x(n+p) integer (output value)
        LACC TEMP1,5            ; ACC = PitchInt.PitchFrac (Q15)
        ADDB                                                ;  ACC  =
TableOffset.Frac+PitchInt.PitchFrac(Q15)
     SACH AR4,1           ; AR4 = new TableOffset w/ spillovers
        SACB                      ; ACCB= new TableOffset.Frac w/
spillovers (Q15)
     AND  *, AR4          ; ACCL= Frac for interpolation (positive
Q15)
        APL  AR4                 ; AR4 = clean TableOffset (manual
modulo)
        SACL TREG0                ; TREG = Frac for interpolation
(positive Q15)
        nop                      ; pipeline (MM write to AR4)
        MAR  *0+                 ; (add input waveform TableBase -
manual modulo)
ENDBLK_C:
;*****************************************************************
*********
```

```
      MAR  *,AR3                    ;ARP=>AR3
      LAR  AR3,AR0            ;AR3=pVoiceds
      ADRK #Tbl_PtrC          ;AR3=pTbl_PtrC
         LACL    TREG0                          ;ACCL= .Frac (Q15)
         RETD                                       ;return (delayed) to
 calling function
         SAR            AR4,   *+
 ;Tbl_PtrC=TableAddress,AR3=pRun_ValC
         SACL    *                              ;Run_ValC=.Frac (Q15)
 ;*****************************************************************
 ************


 UpdtEm:
 ;*****************************************************************
 ************
 ; AR0= Voiceds pointer, AR2=pEnvMSB_M, DP=0, PM=1
 ;*****************************************************************
 ************
 ;First, update Mod. Envelope Coefficients.
      MAR  *,AR2                    ;ARP=>AR2
      LT   *-                 ;TREG0=EnvMSB_M, AR2=pLevel_M
      MPY  *, AR3                   ;(Level_M * EnvMSB_M),ARP=>AR3
      LAR  AR3,AR0            ;AR3=pVoiceds
         ADRK    #FSerOff                       ;AR3=pFSerOff
         SAR     AR3,AR2                        ;AR2=pFSerOff
      RETD                    ;return to calling function
         ADRK    #4                             ;AR3=pEm (addr. of env.
coefficient)
         SPH     *+                             ;save Em,AR3=pOne
;*****************************************************************
************


ModOsc:
```

```
;*****************************************************************
 ;Modulator Oscillator  (plain vanilla)
 ; AR0= voiceds ptr, DP=0

;*****************************************************************
*******

 ;setup registers for oscillator loop
  CLRC    SXM                  ; clear sign extension
MAR  *, AR3              ; ARP=>AR3
LAR  AR3,AR0    ; AR3=pVoiceds
ADRK #Pch_Step ; AR3=pPch_Step
LACC *+, 16              ; ACCH = Pch_Step,AR3=pOut_ptr
   SACH    TEMP1                 ; TEMP1= Pch_Step
   LAR         AR2,  *+                    ;  AR2  =   pointer  to
OscOutBuff,AR3=pTabl_ptr
LAR  AR4, *+    ; AR4 => Wave Address,AR3=pRun_Val
   LACL    *                     ; ACCL = .Frac(Q15)
   SACL      TREG0                       ;  TREG0=  .Frac(Q15)  (for
interpolation)
   LACC    AR4,15                ; ACCH,1=Wave TableAddress
   ADD            *+
TableAddress.Frac(Q15),AR3=pTblBase                          ;  ACC   =
   SUB     *,15                  ; ACC = TableOffset.Frac(Q15)
SACB              ; ACCB=  TableOffset.Frac (Q15)
   LACL    *+,AR4                ; ACCL= TableBase, AR3 = pMaskMSB
SACL INDX       ; INDX=TableBase
LACL #7Fh       ; TEMPORARY for modulo 128
SACL DBMR       ; DBMR=modulo mask
LACC #15        ; ACC = 15
SAMM BRCR       ; BRCR = 15, for repeat of block 16 times
RPTB ENDBLKPM - 1    ; Begin repeat block
;*****************************************************************
*********
; ACCB=TableOffset.Frac(Q15), AR2=pOscOutBuff, AR3=pMaskMSB,
AR4=TableAddress
```

```
; TREG0=.Frac(Q15), TEMP1=PitchInt.PitchFrac(Q10), DP=0, ARP=4, SXM
= 0,
PM = 1
; INDX=TableBase, DBMR=modulo mask
;*****************************************************************
*********
LOOPPM    LACC *, 16            ; Zero ACCL and load ACCH with x(n)
     MPY  *+                   ; PREG=x(n)*frac(n*p)
     MPYS *,AR2                ; ACC =x(n) - x(n)*frac(n*p);
PREG=x(n+1)*frac(n*p)
     APAC                      ; ACC =x(n) - x(n)*frac(n*p) +
x(n+1)*frac(n*p)
        SACH *+,AR3            ; Store x(n+p) integer (output
value)
        LACC TEMP1,5           ; ACC = PitchInt.PitchFrac (Q15)
        ADDB                                                ; ACC =
TableOffset.Frac+PitchInt.PitchFrac(Q15)
     SACH AR4,1                ; AR4 = new TableOffset w/ spillovers
        SACB                   ; ACCB= new TableOffset.Frac w/
spillovers (Q15)
     AND  *, AR4               ; ACCL= Frac for interpolation (positive
Q15)
        APL  AR4               ; AR4 = clean TableOffset (manual
modulo)
        SACL TREG0             ; TREG = Frac for interpolation
(positive Q15)
        nop                    ; pipeline (MM write to AR4)
        MAR  *0+               ; (add input waveform TableBase -
manual modulo)
ENDBLKPM:
;*****************************************************************
*********
     MAR  *,AR3                ;ARP=>AR3
     LAR  AR3,AR0              ;AR3=pVoiceds
     ADRK #Tabl_Ptr            ;AR3=pTabl_Ptr
```

```
        LACL    TREG0                           ;ACCL= .Frac (Q15)
        RETD                                        ;return (delayed) to
calling function
        SAR             AR4,   *+
;Tbl_PtrC=TableAddress,AR3=pRun_ValC
        SACL    *                               ;Run_ValC=.Frac (Q15)
;*****************************************************************
************

;*****************************************************************
************
SynConn0:
;*****************************************************************
;CONNECT=0 Synth funtion, includes Ec envelope coefficient
;Apply Synthesis Function w/ Noise => Voicex buffer
; AR0= Voiceds pointer, DP=0
;*****************************************************************
************
    ;setup registers for synthesis function
    MAR  *,AR3                  ;ARP=>AR3
    LAR  AR3,AR0            ;AR3=pVoiceds
    ADRK #Vce_Ptr           ;AR3=pVce_Ptr
    LAR  AR5, *                 ;[AR5]=Vce_Ptr (ptr to voice buffer)
    LAR  AR2, #OutModT          ;[AR2]=addr of Mod. Osc buffer
    LAR  AR1, #OutCarT          ;[AR1]=addr of Carrier Osc. buffer
    LAR  AR4, #Noiz             ;[AR4]=addr of Noise buffer
    ADRK #12                ;AR3=pEc
    LT   *                  ;TREG0=Ec
    SBRK #9                 ;AR3=pFbk
    MPY  *+                 ;PREG=Ec*Fbk
    SPH  TEMP2                  ;TEMP2=Ec*Fbk
    MPY  *                  ;PREG=Ec*MFbk
    SPH  TEMP3                  ;TEMP3=Ec*MFbk
    SPH  TREG0                  ;TREG0=Ec*MFbk
    ADRK #5                 ;AR3=pAmpCar
```

```
      MPY  *,AR1                ;PREG=Ec*MFbk*AmpCar
      SPH  TEMP1                ;TEMP1=Ec*MFbk*AmpCar
         SETC    OVM                   ;saturation=on
      ZAP                     ;ACC,PREG=0
      LT   *+,AR2               ;TREG0=carrier osc value
      LACC #15                ;ACC = 15
      SAMM BRCR               ;BRCR = 15, repeat Block 16 times
      RPTB ENDSNTH1 - 1         ;Begin repeat block
;*********************************************************************
      MPY  TEMP1                ;PREG=(car. osc)*AmpCar*MFbk*Ec
      MPYA *+, AR4            ;PREG=(spec osc)*(car osc),ACC=^
      SPH  TREG0                ;TREG0=(spec osc)*(car osc)
      MPY  TEMP3                ;PREG=Ec*MFbk*(spec osc)*(car osc)
      LTA  TEMP2                ;TREG=Ec*Fbk,ACC=ACC'+PREG
      MPY  *+,AR1               ;PREG=noiz*Fbk*Ec
      LTA  *+,AR5              ;TREG0=(car osc(n+1)),ACCH=Voice Out
      SACH *+,AR2               ;save output to voice buffer
      ZAP                     ;ACC,PREG=0
ENDSNTH1:
;*********************************************************************
************
        CLRC    OVM                     ;saturation=off
        RET                            ;return to calling function
;*********************************************************************
************
```

```
;*********************************************************************
************
SynConn1:
;*********************************************************************
************
```

```
;CONNECT=1 Synth funtion, includes Ec envelope coefficient
;Apply Synthesis Function w/ Noise => Voicex buffer
; AR0= Voiceds pointer, DP=0
;*****************************************************************
************
     ;setup registers for synthesis function
        SPM     0                          ; set product register mode
for shift 0
     MAR  *,AR3                 ;ARP=>AR3
     LAR  AR3,AR0          ;AR3=pVoiceds
     ADRK #Vce_Ptr         ;AR3=pVce_Ptr
     LAR  AR5, *               ;[AR5]=Vce_Ptr (ptr to voice buffer)
     LAR  AR2, #OutModT         ;[AR2]=addr of Mod. Osc buffer
     LAR  AR1, #OutCarT         ;[AR1]=addr of Carrier Osc. buffer
     LAR  AR4, #Noiz            ;[AR4]=addr of Noise buffer
        ADRK    #5                        ;AR3=pEm
        LT      *                         ;TREG0=Em
        SBRK    #2                        ;AR3=pFbk
        MPY     *+                        ;PREG=Em*Fbk
        SPH     TEMP2                     ;TEMP2=Em*Fbk
        MPY     *                         ;PREG=Em*MFbk
        SPH     TEMP3                     ;TEMP3=Em*MFbk
        ADRK    #8                        ;AR3=pEc
        LACL    *,AR1                     ;ACCL=Ec
        SACL    TEMP1                     ;TEMP1=Ec
        SETC    OVM                       ;saturation=on
    ZAP                     ;ACC,PREG=0
        LT      TEMP1                     ;TREG0=Ec
    LACC #15                ;ACC = 15
    SAMM BRCR               ;BRCR = 15, repeat Block 16 times
        RPTB ENDSNTH2 - 1                 ;Begin repeat block
;*****************************************************************
*********
        MPY        *+,AR4                                  ;PREG=(car.
osc)*Ec,ARP=>AR4
```

```
        LTP     TEMP2                   ;TREG0=Em*Fbk,ACC=Ec*(car.
osc.)
        MPY     *+,AR2                  ;PREG=(Noiz)*Em*Fbk
        LTA     TEMP3                   ;TREG0=Em*MFbk,ACC=Ec*(car.
osc.)+ ^
        MPY         *+,AR5                          ;PREG=(Mod.
osc)*Em*MFbk,ARP=>AR5
        LTA     TEMP1                   ;TREG0=Ec,ACC=voice output
        SACH     *+,AR1                     ;save output to voice
buffer
ENDSNTH2:
;*****************************************************************
************
        CLRC    OVM                     ;saturation=off
        RETD                            ;return to calling function
        SPM     1                       ; set product register mode
for shift 1
        NOP
;*****************************************************************
************


;*****************************************************************
************
SynConnS:
;*****************************************************************
************
;Snare Synth funtion, includes Ec envelope coefficient
;Apply Synthesis Function w/ Noise => Voicex buffer
; AR0= Voiceds pointer, DP=0
;*****************************************************************
************
    ;setup registers for synthesis function
    SPM  1              ; set product register mode for shift 1
    MAR  *,AR3              ;ARP=>AR3
```

```
      LAR  AR3,AR0          ;AR3=pVoiceds
      ADRK #Vce_Ptr         ;AR3=pVce_Ptr
      LAR  AR5, *               ;[AR5]=Vce_Ptr (ptr to voice buffer)
       ; LAR    AR2, #OutModT        ;[AR2]=addr of Mod. Osc buffer
      LAR  AR1, #OutCarT        ;[AR1]=addr of Carrier Osc. buffer
      LAR  AR4, #Noiz           ;[AR4]=addr of Noise buffer
      ADRK #12              ;AR3=pEc
         LACL    *,AR1                    ;ACCL=Ec
         SACL    TEMP1                    ;TEMP1=Ec
         LT      TEMP1                    ;TREG0=Ec
      SPLK #7FFFh,TEMP2         ;TEMP2=noiz scale
      MPY  TEMP2                ;Ec*(noiz scale)
      SPH  TEMP2                ;TEMP2=Ec*(noiz scale)
      ZAP                   ;ACC,PREG=0
      SPM  0                ; set product register mode for shift 0
      LACC #15              ;ACC = 15
      SAMM BRCR             ;BRCR = 15, repeat Block 16 times
      RPTB ENDSNTHS - 1         ;Begin repeat block
;*****************************************************************
*********
         MPY        *+,AR4                                  ;PREG=(car.
osc)*Ec,ARP=>AR4
      LTP  TEMP2                ;TREG0=Ec*(noiz scale),ACC=Ec*(car.
osc.)
      MPY  *+,AR5               ;PREG=(Ec*(noiz scale))*noiz
         LTA     TEMP1                  ;TREG0=Ec,ACC=voice output
         SACH     *+,AR1                     ;save output to voice
buffer
ENDSNTHS:
;*****************************************************************
************
         RETD                           ;return to calling function
         SPM     1                      ; set product register mode
for shift 1
         NOP
```

```
;*****************************************************************
************

;*****************************************************************
************
SynConnT:
;*****************************************************************
************
;Tom Synth funtion, includes Em envelope coefficient
;Apply Synthesis Function w/ Noise => Voicex buffer
; AR0= Voiceds pointer, DP=0
;*****************************************************************
************
     ;setup registers for synthesis function
     SPM  1                ; set product register mode for shift 0
     MAR  *,AR3                ;ARP=>AR3
     LAR  AR3,AR0          ;AR3=pVoiceds
     ADRK #Vce_Ptr         ;AR3=pVce_Ptr
     LAR  AR5, *               ;[AR5]=Vce_Ptr (ptr to voice buffer)
     LAR  AR1, #OutModT        ;[AR1]=addr of Mod. Osc buffer
    ;     LAR  AR4, #Noiz          ;[AR4]=addr of Noise buffer
     ADRK #5               ;AR3=pEm
     LACL *,AR1                ;ACCL=Em
     SACL TEMP1                ;TEMP1=Em
     LT   TEMP1                ;TREG0=Em
    ;     SPLK #7FFFh,TEMP2         ;TEMP2=noiz scale
    ;     MPY  TEMP2                ;Em*(noiz scale)
    ;     SPH  TEMP2                ;TEMP2=Em*(noiz scale)
     ZAP                   ;ACC,PREG=0
     LACC #15              ;ACC = 15
     SAMM BRCR             ;BRCR = 15, repeat Block 16 times
     RPTB ENDSNTHT - 1         ;Begin repeat block
;*****************************************************************
```

```
*********
     MPY   *+,AR5              ;PREG=(mod. osc)*Em,ARP=>AR4
     PAC                   ;ACC=Em*(mod. osc.)
        SACH     *+,AR1                     ;save output to voice
buffer
ENDSNTHT:
;*****************************************************************
************
        RETD                            ;return to calling function
        SPM     1                       ; set product register mode
for shift 1
        NOP
;*****************************************************************
************



;*****************************************************************
************
SynConnC:
;*****************************************************************
************
;Cymbal Synth funtion, includes Ec envelope coefficient
;Apply Synthesis Function w/ Noise => Voicex buffer
; AR0= Voiceds pointer, DP=0
;*****************************************************************
************
     ;setup registers for synthesis function
     SPM  0                ; set product register mode for shift 0
     MAR  *,AR3                ;ARP=>AR3
     LAR  AR3,AR0          ;AR3=pVoiceds
     ADRK #Vce_Ptr         ;AR3=pVce_Ptr
     LAR  AR5, *               ;[AR5]=Vce_Ptr (ptr to voice buffer)
      ; LAR    AR2, #OutModT        ;[AR2]=addr of Mod. Osc buffer
     LAR  AR1, #OutCarT        ;[AR1]=addr of Carrier Osc. buffer
```

```
     LAR  AR4, #Noiz          ;[AR4]=addr of Noise buffer
     ADRK #12             ;AR3=pEc
        LACL    *,AR1                    ;ACCL=Ec
        SACL    TEMP1                    ;TEMP1=Ec
        LT      TEMP1                    ;TREG0=Ec
     SPLK #3FFFh,TEMP2        ;TEMP2=noiz scale
     MPY  TEMP2               ;Ec*(noiz scale)
     SPH  TEMP2               ;TEMP2=Ec*(noiz scale)
     ZAP                  ;ACC,PREG=0
     SPM  1               ; set product register mode for shift 1
     LACC #15             ;ACC = 15
     SAMM BRCR            ;BRCR = 15, repeat Block 16 times
     RPTB ENDSNTHC - 1        ;Begin repeat block
;*****************************************************************
*********
     MPY  *               ;PREG=(mod. osc)*Ec
     SPH  TREG0               ;TREG0=(mod. osc)*Ec
     MPY  *               ;PREG=(mod. osc)*Ec
     SPH  TREG0               ;TREG0=(mod. osc)*Ec
        MPY         *+,AR4                          ;PREG=(car.
osc)*Ec,ARP=>AR4
     LTP  TEMP2               ;TREG0=Ec*(noiz scale),ACC=Ec*(car.
osc.)
     MPY  *+,AR5              ;PREG=(Ec*(noiz scale))*noiz
        LTA     TEMP1                   ;TREG0=Ec,ACC=voice output
        SACH     *+,AR1                     ;save output to voice
buffer
ENDSNTHC:
;*****************************************************************
************
        RETD                         ;return to calling function
        SPM     1                    ; set product register mode
for shift 1
        NOP
;*****************************************************************
```

```
************


;*****************************************************************
************
SynConnH:
;*****************************************************************
************
;Hihat Synth funtion, includes Em envelope coefficient
;Apply Synthesis Function w/ Noise => Voicex buffer
; AR0= Voiceds pointer, DP=0
;*****************************************************************
************
     ;setup registers for synthesis function
     SPM  0                ; set product register mode for shift 0
     MAR  *,AR3                ;ARP=>AR3
     LAR  AR3,AR0          ;AR3=pVoiceds
     ADRK #Vce_Ptr         ;AR3=pVce_Ptr
     LAR  AR5, *               ;[AR5]=Vce_Ptr (ptr to voice buffer)
     LAR  AR1, #OutModT        ;[AR1]=addr of Mod. Osc buffer
     LAR  AR4, #Noiz           ;[AR4]=addr of Noise buffer
     ADRK #5               ;AR3=pEm
     LACL *,AR1                ;ACCL=Em
     SACL TEMP1                ;TEMP1=Em
     LT   TEMP1                ;TREG0=Em
     SPLK #2FFFh,TEMP2         ;TEMP2=noiz scale
     MPY  TEMP2                ;Ec*(noiz scale)
     SPH  TEMP2                ;TEMP2=Em*(noiz scale)
     ZAP                   ;ACC,PREG=0
     SPM  1                ; set product register mode for shift 1
     LACC #15              ;ACC = 15
     SAMM BRCR             ;BRCR = 15, repeat Block 16 times
     RPTB ENDSNTHH - 1         ;Begin repeat block
;*****************************************************************
```

```
*********
     SQRA *+,AR4
     SPH  TREG0
     MPY  TEMP1
      ; MPY    *                ;PREG=(mod. osc)*Em
      ; SPH    TREG0                 ;TREG0=(mod. osc)*Em
      ; MPY    *                ;PREG=(mod. osc)*Em
      ; SPH    TREG0                 ;TREG0=(mod. osc)*Em
      ; MPY    *+,AR4                ;PREG=(mod. osc)*Em,ARP=>AR4
     LTP  TEMP2                ;TREG0=Em*(noiz scale),ACC=Em*(mod.
osc.)
     MPY  *+,AR5               ;PREG=(Em*(noiz scale))*noiz
     LTA  TEMP1                ;TREG0=Em,ACC=voice output
        SACH     *+,AR1                     ;save output to voice
buffer
ENDSNTHH:
;*************************************************************************
        RETD                           ;return to calling function
        SPM     1                      ; set product register mode
for shift 1
        NOP
;*****************************************************************
************
     .end
```

```
     .title    "TMS320C5x FM Music Synthesis Emulation Task 0.2x"

*****************************************************************
*************
* TMS320C5x Game Music Synthesis Engine Control DSP Task
* (c) 1993 Texas Instruments, Inc.
* Author:   Jim Van Buskirk
      *
* Prelim. Coding: Jeffrey S. Hayes  9/24/93
*
*****************************************************************
*************

        .include "..\dspos.inc"
        .include "..\itc.inc"
        .include "voiceds.inc"
     .mmregs

        .global SYNTH_ENG,SYNTH_CTL,envl,AtkTabl,DkyTabl
        .global Log64,TempBK,SpecTab0,SpecTab1,SpecTab2,SpecTab3
        .global SpecTab4,SpecTab5,SpecTab6,SpecTab7
        .global Voice18,Voice19,Voice20,Voice21,Voice22
        .global Log64C,Mas_Ptch,Mas_Vol,NewBit
                                  .   r   e   f
SIN128,S1,S2,S3,S4,S5,S6,S7,S8,HALFSIN,ABSSIN,CLIPSIN
        .ref    CAR_W4,CAR_W5,CAR_W6,CAR_W7
     .ref MULTI,FRQ_L,Voice0,OutCarT,OutModT,Noiz
        .ref    LPanVce0,outVoic0,Max_Vce,Max_Mel,Rhy_Mode
        .ref    RPanVce0
        .ref   EMode1,EMode4

        .def    A_Reg_0,A_Rhy_0,A_Rhy_1,A_Rhy_2,A_Rhy_3,A_Rhy_4
*****************************************************************
*************
      ; .data
```

```
; @21.781kHz - Dev't EVM sampling rate

        .sect  "RegStat"
;*****************************************************************
*****
; Melodic Register status table, voice and register vectors
A_Reg_0  .word  0          ;Register Key Status - (ON > 3F) 1F=off
       .word    0          ;addr of assigned voice - 0=off
       .word    MULTI+0    ;V_Multi (addr of MULTI Reg value)
       .word    FRQ_L+0    ;V_Frq_L (addr of FRQ_L Reg value)
A_Reg_1  .word  0          ;Register Key Status - (ON > 3F) 1F=off
       .word    0          ;addr of assigned voice - 0=off
       .word    MULTI+1    ;V_Multi (addr of MULTI Reg value)
       .word    FRQ_L+1    ;V_Frq_L (addr of FRQ_L Reg value)
A_Reg_2  .word  0          ;Register Key Status - (ON > 3F) 1F=off
       .word    0          ;addr of assigned voice - 0=off
       .word    MULTI+2    ;V_Multi (addr of MULTI Reg value)
       .word    FRQ_L+2    ;V_Frq_L (addr of FRQ_L Reg value)
A_Reg_3  .word  0          ;Register Key Status - (ON > 3F) 1F=off
       .word    0          ;addr of assigned voice - 0=off
       .word    MULTI+8    ;V_Multi (addr of MULTI Reg value)
       .word    FRQ_L+3    ;V_Frq_L (addr of FRQ_L Reg value)
A_Reg_4  .word  0          ;Register Key Status - (ON > 3F) 1F=off
       .word    0          ;addr of assigned voice - 0=off
       .word    MULTI+9    ;V_Multi (addr of MULTI Reg value)
       .word    FRQ_L+4    ;V_Frq_L (addr of FRQ_L Reg value)
A_Reg_5  .word  0          ;Register Key Status - (ON > 3F) 1F=off
       .word    0          ;addr of assigned voice - 0=off
       .word    MULTI+10   ;V_Multi (addr of MULTI Reg value)
       .word    FRQ_L+5    ;V_Frq_L (addr of FRQ_L Reg value)
A_Reg_6  .word  0          ;Register Key Status - (ON > 3F) 1F=off
       .word    0          ;addr of assigned voice - 0=off
       .word    MULTI+16   ;V_Multi (addr of MULTI Reg value)
       .word    FRQ_L+6    ;V_Frq_L (addr of FRQ_L Reg value)
A_Reg_7  .word  0          ;Register Key Status - (ON > 3F) 1F=off
```

```
        .word     0          ;addr of assigned voice - 0=off
        .word     MULTI+17   ;V_Multi (addr of MULTI Reg value)
        .word     FRQ_L+7    ;V_Frq_L (addr of FRQ_L Reg value)
A_Reg_8  .word    0          ;Register Key Status - (ON > 3F) 1F=off
        .word     0          ;addr of assigned voice - 0=off
        .word     MULTI+18   ;V_Multi (addr of MULTI Reg value)
        .word     FRQ_L+8    ;V_Frq_L (addr of FRQ_L Reg value)
A_Reg_9  .word    0          ;Register Key Status - (ON > 3F) 1F=off
        .word     0          ;addr of assigned voice - 0=off
        .word     MULTIH+0   ;V_Multi (addr of MULTI Reg value)
        .word     FRQ_LH+0   ;V_Frq_L (addr of FRQ_L Reg value)
A_Reg_10 .word    0          ;Register Key Status - (ON > 3F) 1F=off
        .word     0          ;addr of assigned voice - 0=off
        .word     MULTIH+1   ;V_Multi (addr of MULTI Reg value)
        .word     FRQ_LH+1   ;V_Frq_L (addr of FRQ_L Reg value)
A_Reg_11 .word    0          ;Register Key Status - (ON > 3F) 1F=off
        .word     0          ;addr of assigned voice - 0=off
        .word     MULTIH+2   ;V_Multi (addr of MULTI Reg value)
        .word     FRQ_LH+2   ;V_Frq_L (addr of FRQ_L Reg value)
A_Reg_12 .word    0          ;Register Key Status - (ON > 3F) 1F=off
        .word     0          ;addr of assigned voice - 0=off
        .word     MULTIH+8   ;V_Multi (addr of MULTI Reg value)
        .word     FRQ_LH+3   ;V_Frq_L (addr of FRQ_L Reg value)
A_Reg_13 .word    0          ;Register Key Status - (ON > 3F) 1F=off
        .word     0          ;addr of assigned voice - 0=off
        .word     MULTIH+9   ;V_Multi (addr of MULTI Reg value)
        .word     FRQ_LH+4   ;V_Frq_L (addr of FRQ_L Reg value)
A_Reg_14 .word    0          ;Register Key Status - (ON > 3F) 1F=off
        .word     0          ;addr of assigned voice - 0=off
        .word     MULTIH+10      ;V_Multi (addr of MULTI Reg value)
        .word     FRQ_LH+5   ;V_Frq_L (addr of FRQ_L Reg value)
A_Reg_15 .word    0          ;Register Key Status - (ON > 3F) 1F=off
        .word     0          ;addr of assigned voice - 0=off
        .word     MULTIH+16      ;V_Multi (addr of MULTI Reg value)
        .word     FRQ_LH+6   ;V_Frq_L (addr of FRQ_L Reg value)
```

```
A_Reg_16 .word  0          ;Register Key Status - (ON > 3F) 1F=off
         .word  0          ;addr of assigned voice - 0=off
         .word  MULTIH+17      ;V_Multi (addr of MULTI Reg value)
         .word  FRQ_LH+7 ;V_Frq_L (addr of FRQ_L Reg value)
A_Reg_17 .word  0          ;Register Key Status - (ON > 3F) 1F=off
         .word  0          ;addr of assigned voice - 0=off
         .word  MULTIH+18      ;V_Multi (addr of MULTI Reg value)
         .word  FRQ_LH+8 ;V_Frq_L (addr of FRQ_L Reg value)
; Rhythmic Register status table, voice and register vectors
A_Rhy_0  .word  0                ;BASS DRUM Reg. Key Status - (ON >
3F) 1F=off
         .word  Voice18           ;addr of assigned voice
         .word  MULTI+16 ;V_Multi (addr of MULTI Reg value)
         .word  FRQ_L+6  ;V_Frq_L (addr of FRQ_L Reg value)
A_Rhy_1  .word  0                ;SNARE Register Key Status - (ON >
3F) 1F=off
         .word  Voice19           ;addr of assigned voice
         ; .word  MULTI+20 ;V_Multi (addr of MULTI Reg value)
         .word  MULTI+17 ;V_Multi (addr of MULTI Reg value)
         .word  FRQ_L+7          ;V_Frq_L (addr of FRQ_L Reg value)
A_Rhy_2  .word  0                ;TOM TOM Register Key Status - (ON
> 3F) 1F=off
         .word  Voice20           ;addr of assigned voice
         .word  MULTI+18         ;V_Multi (addr of MULTI Reg value)
         .word  FRQ_L+8          ;V_Frq_L (addr of FRQ_L Reg value)
A_Rhy_3  .word  0                 ;CYMBAL Register Key Status - (ON
> 3F) 1F=off
         .word  Voice21           ;addr of assigned voice
         ; .word  MULTI+21 ;V_Multi (addr of MULTI Reg value)
         .word  MULTI+18 ;V_Multi (addr of MULTI Reg value)
         .word  FRQ_L+8          ;V_Frq_L (addr of FRQ_L Reg value)
A_Rhy_4  .word  0                 ;HI HAT Register Key Status - (ON
> 3F) 1F=off
         .word  Voice22           ;addr of assigned voice
         .word  MULTI+17         ;V_Multi (addr of MULTI Reg value)
```

```
        .word   FRQ_L+7         ;V_Frq_L (addr of FRQ_L Reg value)
;*************************************************************
*****
        .data
New_Vce     .word    0
Mas_Ptch    .word  8000h  ;master pitch scale (q15 unsigned)
Mas_Vol     .word  1FFFh          ;mix coefficient for all voices
(synth mixer)
Zip_Vol     .word    0h         ;zero mix coefficient (synth mixer)
ZipFeedbk   .word  0      ;Feedbk message passing (4-op allocation)
NewBit      .word  0            ;OPL3 New bit shadow 0-opl2, 1-opl3

;  B  L  O  C  K       P  I  T  C  H       S  c  a  l  e
CONSTANTS*****************************************
;pscale = (50000 * 2e(2)BLOCK-20 * 512.0) / 22050.0
PScale0     .word  0122h    ;pscale * 8.0 (q15) for BLOCK0
PScale1     .word  0244h    ;pscale * 8.0 (q15) for BLOCK1
PScale2     .word  0489h    ;pscale * 8.0 (q15) for BLOCK2
PScale3     .word  0912h    ;pscale * 8.0 (q15) for BLOCK3
PScale4     .word  1224h    ;pscale * 8.0 (q15) for BLOCK4
PScale5     .word  2448h    ;pscale * 8.0 (q15) for BLOCK5
PScale6     .word  488Fh    ;pscale * 8.0 (q15) for BLOCK6
PScale7     .word  911Fh    ;pscale * 8.0 (q15) for BLOCK7
;MULTIPLICATION PITCH
FACTORS*****************************************
MScale0     .word  0001h    ;MULTI (q1) 0.5
MScale1     .word  0002h    ;MULTI (q1) 1.0
MScale2     .word  0004h    ;MULTI (q1) 2.0
MScale3     .word  0006h    ;MULTI (q1) 3.0
MScale4     .word  0008h    ;MULTI (q1) 4.0
MScale5     .word  000Ah    ;MULTI (q1) 5.0
MScale6     .word  000Ch    ;MULTI (q1) 6.0
MScale7     .word  000Eh    ;MULTI (q1) 7.0
MScale8     .word  0010h    ;MULTI (q1) 8.0
MScale9     .word  0012h    ;MULTI (q1) 9.0
```

```
MScale10    .word  0014h    ;MULTI (q1) 10.0
MScale11    .word  0014h    ;MULTI (q1) 10.0
MScale12    .word  0018h    ;MULTI (q1) 12.0
MScale13    .word  0018h    ;MULTI (q1) 12.0
MScale14    .word  001Eh    ;MULTI (q1) 15.0
MScale15    .word  001Eh    ;MULTI (q1) 15.0
;*****************************************************************
******
Sin_C        .word      SIN128       ;Sine Table address
Sin_1        .word      HALFSIN      ;0-pi Half Sine Table
Sin_2       .word      ABSSIN       ;Absolute value sine table
Sin_3       .word      CLIPSIN      ;pi/2 'shark' table
Sin_4       .word      CAR_W4       ;4OP waveform (carrier)
Sin_5       .word      CAR_W5       ;4OP waveform (carrier)
Sin_6       .word      CAR_W6       ;4OP waveform (carrier)
Sin_7       .word      CAR_W7       ;4OP waveform (carrier)
;*****************************************************************
******
;Modulator Spectra Series per Wave select (0-7)
Sin_M       .word      SpecTab0     ;mod wave select=0
Sin_M1      .word      SpecTab1     ;mod wave select=1
Sin_M2      .word      SpecTab2     ;mod wave select=2
Sin_M3      .word      SpecTab3     ;mod wave select=3
Sin_M4      .word      SpecTab4     ;mod wave select=4
Sin_M5      .word      SpecTab5     ;mod wave select=5
Sin_M6      .word      SpecTab6     ;mod wave select=6
Sin_M7      .word      SpecTab7     ;mod wave select=7
;*****************************************************************
******
;Y0ksl   Factor   Table****For   -1.5db/oct   Q9**(per   FNUM   MS
nibble)**********
Y0ksl0  .word     937     ;FNUM 0   gain (Db) 5.25
        .word     723     ;FNUM 1   gain (Db) 3
        .word     663     ;FNUM 2   gain (Db) 2.25
        .word     629     ;FNUM 3   gain (Db) 1.78125
```

```
        .word     609     ;FNUM 4   gain (Db) 1.5
        .word     589     ;FNUM 5   gain (Db) 1.21875
        .word     577     ;FNUM 6   gain (Db) 1.03125
        .word     564     ;FNUM 7   gain (Db) .84375
        .word     558     ;FNUM 8   gain (Db) .75
        .word     546     ;FNUM 9   gain (Db) .5625
        .word     540     ;FNUM 10  gain (Db) .46875
        .word     535     ;FNUM 11  gain (Db) .375
        .word     529     ;FNUM 12  gain (Db) .28125
        .word     523     ;FNUM 13  gain (Db) .1875
        .word     518     ;FNUM 14  gain (Db) .09375
        .word     512     ;FNUM 15  gain (Db) 0
;Y1ksl   Factor   Table****For   -1.5db/oct   Q9**(per   FNUM   MS
nibble)**********
Y1ksl0  .word     1715    ;FNUM 0   gain (Db) 10.5
        .word     1022    ;FNUM 1   gain (Db) 6
        .word     860     ;FNUM 2   gain (Db) 4.5
        .word     772     ;FNUM 3   gain (Db) 3.5625
        .word     723     ;FNUM 4   gain (Db) 3
        .word     678     ;FNUM 5   gain (Db) 2.4375
        .word     649     ;FNUM 6   gain (Db) 2.0625
        .word     622     ;FNUM 7   gain (Db) 1.6875
        .word     609     ;FNUM 8   gain (Db) 1.5
        .word     583     ;FNUM 9   gain (Db) 1.125
        .word     570     ;FNUM 10  gain (Db) 0.9375
        .word     558     ;FNUM 11  gain (Db) 0.75
        .word     546     ;FNUM 12  gain (Db) 0.5625
        .word     535     ;FNUM 13  gain (Db) 0.375
        .word     523     ;FNUM 14  gain (Db) 0.1875
        .word     512     ;FNUM 15  gain (Db) 0
;Y3ksl   Factor   Table****For   -3db/oct   Q9***(per   FNUM   MS
nibble)**********
Y3ksl0  .word     5745      ;FNUM 0   gain (Db) 21
        .word     2038      ;FNUM 1   gain (Db) 12
        .word     1443      ;FNUM 2   gain (Db) 9
```

```
        .word     1163      ;FNUM 3   gain (Db) 7.125
        .word     1022      ;FNUM 4   gain (Db) 6
        .word     898       ;FNUM 5   gain (Db) 4.875
        .word     823       ;FNUM 6   gain (Db) 4.125
        .word     755       ;FNUM 7   gain (Db) 3.375
        .word     723       ;FNUM 8   gain (Db) 3
        .word     663       ;FNUM 9   gain (Db) 2.25
        .word     635       ;FNUM 10  gain (Db) 1.875
        .word     608       ;FNUM 11  gain (Db) 1.5
        .word     583       ;FNUM 12  gain (Db) 1.125
        .word     558       ;FNUM 13  gain (Db) 0.75
        .word     535       ;FNUM 14  gain (Db) 0.375
        .word     512       ;FNUM 15  gain (Db) 0
;Y6ksl   Factor   Table****For   -6db/oct   Q9***(per   FNUM   MS
nibble)**********
Y6ksl0  .word     64457     ;FNUM 0   gain (Db) 42
        .word     8115      ;FNUM 1   gain (Db) 24
        .word     4067      ;FNUM 2   gain (Db) 18
        .word     2641      ;FNUM 3   gain (Db) 14.25
        .word     2038      ;FNUM 4   gain (Db) 12
        .word     1573      ;FNUM 5   gain (Db) 9.75
        .word     1324      ;FNUM 6   gain (Db) 8.25
        .word     1114      ;FNUM 7   gain (Db) 6.75
        .word     1022      ;FNUM 8   gain (Db) 6
        .word     860       ;FNUM 9   gain (Db) 4.5
        .word     788       ;FNUM 10  gain (Db) 3.75
        .word     723       ;FNUM 11  gain (Db) 3
        .word     663       ;FNUM 12  gain (Db) 2.25
        .word     609       ;FNUM 13  gain (Db) 1.5
        .word     558       ;FNUM 14  gain (Db) 0.75
        .word     512       ;FNUM 15  gain (Db) 0
;Y6ksl   Factor   Table****For   -6db/oct   Q9***(per   FNUM   MS
nibble)**********
;Y6ksl0  .word     64457     ;FNUM 0   gain (Db) 42
;        .word     8115      ;FNUM 1   gain (Db) 24
```

```
;        .word     4067      ;FNUM 2   gain (Db) 18
;        .word     2641      ;FNUM 3   gain (Db) 14.25
;        .word     2038      ;FNUM 4   gain (Db) 12
;        .word     1573      ;FNUM 5   gain (Db) 9.75
;        .word     1324      ;FNUM 6   gain (Db) 8.25
;        .word     1114      ;FNUM 7   gain (Db) 6.75
;        .word     1022      ;FNUM 8   gain (Db) 6
;        .word     860       ;FNUM 9   gain (Db) 4.5
;        .word     788       ;FNUM 10  gain (Db) 3.75
;        .word     723       ;FNUM 11  gain (Db) 3
;        .word     663       ;FNUM 12  gain (Db) 2.25
;        .word     609       ;FNUM 13  gain (Db) 1.5
;        .word     558       ;FNUM 14  gain (Db) 0.75
;        .word     512       ;FNUM 15  gain (Db) 0
; X _ k s l   R a n g e   S e l e c t   T a b l e
(KSL)****************************************
KSL_0        .word      KSL00Oct     ;Table address for 1.5 db/oct
KSL_1         .word      KSL15Oct     ;Table address for 1.5 db/oct
KSL_2         .word      KSL30Oct     ;Table address for 3.0 db/oct
KSL_3         .word      KSL60Oct     ;Table address for 6.0 db/oct
;  X  _  k  s  l      F  a  c  t  o  r      T  a  b  l  e
(BLOCK)*****************************************
         ;1.5DB/OCT
KSL00Oct     .word      07FFFh       ;(0.917)**BLOCK (for BLOCK=0)
Q15
             .word      07569h       ;(0.917)**BLOCK (for BLOCK=1)
Q15
             .word      06BB3h       ;(0.917)**BLOCK (for BLOCK=2)
Q15
             .word      062CAh       ;(0.917)**BLOCK (for BLOCK=3)
Q15
             .word      05A9Eh       ;(0.917)**BLOCK (for BLOCK=4)
Q15
             .word      0531Fh       ;(0.917)**BLOCK (for BLOCK=5)
Q15
```

```
            .word       04C3Fh      ;(0.917)**BLOCK (for BLOCK=6)
Q15
            .word       045F0h      ;(0.917)**BLOCK (for BLOCK=7)
Q15
        ;1.5DB/OCT
KSL15Oct    .word       07FFFh      ;(0.841)**BLOCK (for BLOCK=0)
Q15
            .word       06BA6h      ;(0.841)**BLOCK (for BLOCK=1)
Q15
            .word       05A88h      ;(0.841)**BLOCK (for BLOCK=2)
Q15
            .word       04C23h      ;(0.841)**BLOCK (for BLOCK=3)
Q15
            .word       04008h      ;(0.841)**BLOCK (for BLOCK=4)
Q15
            .word       035DAh      ;(0.841)**BLOCK (for BLOCK=5)
Q15
            .word       02D4Ah      ;(0.841)**BLOCK (for BLOCK=6)
Q15
            .word       02616h      ;(0.841)**BLOCK (for BLOCK=7)
Q15
        ;3.0DB/OCT
KSL30Oct    .word       07FFFh      ;(0.707)**BLOCK (for BLOCK=0)
Q15
        .word       05A7Fh      ;(0.707)**BLOCK (for BLOCK=1) Q15
        .word       03FFFh      ;(0.707)**BLOCK (for BLOCK=2) Q15
        .word       02D3Ch      ;(0.707)**BLOCK (for BLOCK=3) Q15
        .word       01FFFh      ;(0.707)**BLOCK (for BLOCK=4) Q15
        .word       0169Ch      ;(0.707)**BLOCK (for BLOCK=5) Q15
        .word       00FFCh      ;(0.707)**BLOCK (for BLOCK=6) Q15
        .word       00B4Dh      ;(0.707)**BLOCK (for BLOCK=7) Q15
        ;6.0DB/OCT
KSL60Oct    .word       07FFFh      ;(0.600)**BLOCK (for BLOCK=0)
Q15
            .word       04CCDh      ;(0.600)**BLOCK (for BLOCK=1)
```

```
Q15
            .word       02E14h      ;(0.600)**BLOCK (for BLOCK=2)
Q15
            .word       01BA6h      ;(0.600)**BLOCK (for BLOCK=3)
Q15
            .word       01097h      ;(0.600)**BLOCK (for BLOCK=4)
Q15
            .word       009F4h      ;(0.600)**BLOCK (for BLOCK=5)
Q15
            .word       005F9h      ;(0.600)**BLOCK (for BLOCK=6)
Q15
            .word       00395h      ;(0.600)**BLOCK (for BLOCK=7)
Q15
        ;6.0DB/OCT
;KSL60Oct   .word       07FFFh      ;(0.500)**BLOCK (for BLOCK=0)
Q15
;           .word       04000h      ;(0.500)**BLOCK (for BLOCK=1)
Q15
;           .word       02000h      ;(0.500)**BLOCK (for BLOCK=2)
Q15
;           .word       01000h      ;(0.500)**BLOCK (for BLOCK=3)
Q15
;           .word       00800h      ;(0.500)**BLOCK (for BLOCK=4)
Q15
;           .word       00400h      ;(0.500)**BLOCK (for BLOCK=5)
Q15
;           .word       00200h      ;(0.500)**BLOCK (for BLOCK=6)
Q15
;           .word       00100h      ;(0.500)**BLOCK (for BLOCK=7)
Q15
;Feedback   Series   Offset   --   (added   to   series
range.mixfrac)************
;for 10 segment series tables with positive 2 offset
;FSO0       .word       0FFFFh      ;For Feedback Reg Val=0 (q15)
;FSO1       .word       0C000h ;CCCC ;For Feedback Reg Val=1 (q15)
```

```
;FSO2        .word      7FFFh ;4ccd ;For Feedback Reg Val=2 (q15)
;FSO3        .word      3FFFh ;999a ;For Feedback Reg Val=3 (q15)
;FSO4        .word      2FFFh ;3334 ;For Feedback Reg Val=4 (q15)
;FSO5        .word      1FFFh ;199a ;For Feedback Reg Val=5 (q15)
;FSO6        .word      0000h       ;For Feedback Reg Val=6 (q15)
;FSO7        .word      0000h       ;For Feedback Reg Val=7 (q15)
;FSO8         .word       0000h        ;For Feedback Reg Val=7 +
weighting(q15)
;FSO9         .word       0000h        ;For Feedback Reg Val=7 +
weighting(q15)
;Feedback    Series    Offset    --    (subtracted    to    series
range.mixfrac)*********
FSO0        .word      0000h       ;For Feedback Reg Val=0 (q15)
FSO1        .word      03FFh ;CCCC ;For Feedback Reg Val=1 (q15)
FSO2        .word      07FFh ;4ccd ;For Feedback Reg Val=2 (q15)
FSO3        .word      0FFFh ;999a ;For Feedback Reg Val=3 (q15)
FSO4        .word      1FFFh ;3334 ;For Feedback Reg Val=4 (q15)
FSO5        .word      2FFFh ;199a ;For Feedback Reg Val=5 (q15)
FSO6        .word     03FFFh       ;For Feedback Reg Val=6 (q15)
FSO7        .word     0C000h       ;For Feedback Reg Val=7 (q15)
FSO8         .word      0FFFFh        ;For Feedback Reg Val=7 +
weighting(q15)
FSO9         .word      0FFFFh        ;For Feedback Reg Val=7 +
weighting(q15)
;*****************************************************************
*****
;Engine Mode Function pointers
AdrEMode1   .word       EMode1      ;melodic,connect=0,two-op
AdrEMode4   .word   EMode4       ;melodic,connect=1,two-op
;*****************************************************************
*****
; 2-op mode FRQ_L vector table
Frq_2op  .word   FRQ_L+3        ;V_Frq_L (addr of FRQ_L Reg value)
      .word     FRQ_L+4  ;V_Frq_L (addr of FRQ_L Reg value)
      .word     FRQ_L+5  ;V_Frq_L (addr of FRQ_L Reg value)
```

```
      .word     FRQ_LH+3 ;V_Frq_L (addr of FRQ_L Reg value)
      .word     FRQ_LH+4 ;V_Frq_L (addr of FRQ_L Reg value)
      .word     FRQ_LH+5 ;V_Frq_L (addr of FRQ_L Reg value)
;*************************************************************
*****
; 4-op mode FRQ_L vector table
Frq_4op  .word   FRQ_L+0        ;V_Frq_L (addr of FRQ_L Reg value)
         .word   FRQ_L+1        ;V_Frq_L (addr of FRQ_L Reg value)
         .word   FRQ_L+2        ;V_Frq_L (addr of FRQ_L Reg value)
      .word     FRQ_LH+0 ;V_Frq_L (addr of FRQ_L Reg value)
      .word     FRQ_LH+1 ;V_Frq_L (addr of FRQ_L Reg value)
      .word     FRQ_LH+2 ;V_Frq_L (addr of FRQ_L Reg value)
;*************************************************************
*****
     .text
SYNTH_CTL:

        ;setup machine state
        ldp      #0                 ; used only for memory mapped
register,
                                   ; data section will be accessed
indirectly,
                                   ; with no dependency on dp.
        clrc    SXM                ; clear sign extended mode for ACC
     clrc OVM        ; clear overflow mode for ACC
        spm      1                  ; set product register mode for
shift 1

;Setup Max # of physical OPL melodic voices
        LAR     AR4,#PhyMelVc    ;AR4=pPhyMelVc
        LAR     AR1,#Max_Mel     ;AR1=pMax_Mel
        MAR     *,AR4            ;ARP=>AR4
        LACL    *,AR1            ;ACCL=PhyVoice
        SACL    *                ;Max_Mel updated
```

```
; Process percussive key-off data

;*****************************************************************
        ;process Rhythm Mode key events

;*****************************************************************
RHY_CHKP:
        ;chek for Rhythm mode on/off
        MAR     *,AR4           ;ARP=>AR4
        LAR      AR4,#D_RHYTH     ;AR4=addr of rhythm note on/off
registers
        BIT     *,10,AR1        ;chek rhythm mode reg value => TC
     BCND RHY_OFFP,NTC   ;branch if rhytm mode is off
RHY_ONP:

;*****************************************************************
     ;Slam all Rhythm Register Key-offs into Register key status
        ; DP=0,AR4=#D_RHYTH,ARP=>AR4

;*****************************************************************
        LAR     AR1,#A_Rhy_0     ;AR1=addr of Register Key Status
Table
     LACL #4         ;ACC=4
     SACL INDX       ;INDX=4
     LACL #1Fh       ;ACC=1Fh
     MAR  *,AR4           ;ARP=>AR4
KyOffLP BIT    *,11,AR4  ;test for note-on Bass Drum
     BCNDD     R0onLP,TC ;branch if reg value=note-on
     MAR  *,AR4           ;ARP=>AR4
        BIT     *,12,AR1        ;test for note-on Snare
     SACL *          ;save note-off (1Fh) in Reg Status table
R0onLP    BCNDD     R1onLP,TC ;branch if reg value=note-on
     MAR  *0+,AR4    ;AR1=pA_Reg_(n+1),ARP=>AR4
        BIT     *,13,AR1        ;test for note-on Tom Tom
     SACL *          ;save note-off (1Fh) in Reg Status table
```

```
R1onLP    BCNDD     R2onLP,TC ;branch if reg value=note-on
     MAR  *0+,AR4   ;AR1=pA_Reg_(n+1),ARP=>AR4
        BIT     *,14,AR1        ;test for note-on Cymbal
     SACL *         ;save note-off (1Fh) in Reg Status table
R2onLP    BCNDD     R3onLP,TC ;branch if reg value=note-on
     MAR  *0+,AR4   ;AR1=pA_Reg_(n+1),ARP=>AR4
        BIT     *,15,AR1        ;test for note-on Hi Hat
     SACL *         ;save note-off (1Fh) in Reg Status table
R3onLP    BCNDD     R4onLP,TC ;branch if reg value=note-on
        MAR     *0+,AR1         ;AR1=pA_Reg_(n+1),ARP=>AR1
        nop                     ;delayed branch pipeline
     SACL *         ;save note-off (1Fh) in Reg Status table
R4onLP    MAR  *,AR4          ;ARP=AR4

RHY_OFFP:
;    Melodic    Voice    Correlation    and    Control
*******************************
        ;4-op mode status table pre-processing
        ;Setup Melodic status table with FRQ_L vector per NEW, 4OP
bits
        LAR     AR1,#opl3Regs+5         ;AR1=pNEW reg. value
        LAR     AR4,#A_Reg_3+3          ;AR4=pV_Frq_L
        LACL    #4                      ;ACC=4
        SACL    INDX                    ;INDX=4
        LAR     AR2,#Frq_2op            ;AR2=source FRQ_L vector -
2op
        LAR     AR3,#Frq_4op            ;AR2=source FRQ_L vector -
4op
        LAR     AR0,#NewBit             ;AR0=pNewBit
        ;begin
        MAR     *,AR1                   ;ARP=>AR1
        LACL    *-,AR0                    ;ACCL=NEW bit, AR1=p4OP
bits
        AND     #1                      ;mask don't care bits
        SACL    *,0,AR2                 ;update NewBit shadow
```

```
        BCND    Set4op,NEQ              ;branch if new is set

      ;AR1=p4OPbits,AR2=(addr Frq_2op),AR3=(addr Frq_4op)
      ;AR4=pV_Frq_L (A_Reg_3),ARP=>AR2,INDX=4
        ;NEW=off, setup 2op FRQ_L addresses in status table
        LACL    *+,AR4                  ;ACCL=2-op FRQ_L value
        SACL    *0+,AR2                   ;stamp FRQ_L value into
status table
        LACL    *+,AR4                  ;ACCL=2-op FRQ_L value
        SACL    *0+,AR2                   ;stamp FRQ_L value into
status table
        LACL    *+,AR4                  ;ACCL=2-op FRQ_L value
        SACL    *,AR2                     ;stamp FRQ_L value into
status table
        LAR     AR4,#A_Reg_12+3         ;AR4=pV_Frq_L (bank High)
        LACL    *+,AR4                  ;ACCL=2-op FRQ_L value
        SACL    *0+,AR2                   ;stamp FRQ_L value into
status table
        LACL    *+,AR4                  ;ACCL=2-op FRQ_L value
        SACL    *0+,AR2                   ;stamp FRQ_L value into
status table
        LACL    *+,AR4                  ;ACCL=2-op FRQ_L value
        SACL    *,AR2                     ;stamp FRQ_L value into
status table

        ;setup left mix coefficients for mono operation
        LAR     AR2,#Mas_Vol            ;AR2=pMas_Vol coefficient
        LACC    #LPanVce0               ;ACCL=program mem addr of
left coeffs.
        MAR     *,AR2                   ;arp=>ar2
        RPT  #17                        ; repeat 18 times
        TBLW    *                         ;copy coeff. into prog.
memory
        B       MRegKOff                  ;branch delayed to mel.
key-off
```

```
     ;AR1=p4OPbits,AR2=(addr Frq_2op),AR3=(addr Frq_4op)
     ;AR4=pV_Frq_L (A_Reg_3),ARP=>AR2,INDX=4
        ;NEW=on, setup 4op FRQ_L addresses in status table per 4OP
bit
Set4op    MAR  *,AR1          ;ARP=>AR1
     BIT  *,15,AR2  ;test 4op bit 0
     BCNDD     FRQ3,NTC  ;branch (delayed) if 4op bit not set
     LACL *+,AR1          ;ACCL=pFRQ_L (2op)
     BIT  *,14,AR3  ;test 4op bit 1
     LACL *         ;ACCL=pFRQ_L (4op)
FRQ3 MAR  *+,AR4          ;AR3=next (addr Frq_4op)
     SACL *0+,AR2   ;stamp FRQ_L value into status table

     BCNDD     FRQ4,NTC  ;branch (delayed) if 4op bit not set
     LACL *+,AR1          ;ACCL=pFRQ_L (2op)
     BIT  *,13,AR3  ;test 4op bit 2
     LACL *         ;ACCL=pFRQ_L (4op)
FRQ4 MAR  *+,AR4          ;AR3=next (addr Frq_4op)
     SACL *0+,AR2   ;stamp FRQ_L value into status table

     BCNDD     FRQ5,NTC  ;branch (delayed) if 4op bit not set
     LACL *+,AR1          ;ACCL=pFRQ_L (2op)
     BIT  *,12,AR3  ;test 4op bit 3
     LACL *         ;ACCL=pFRQ_L (4op)
FRQ5 MAR  *+,AR4          ;AR3=next (addr Frq_4op)
     SACL *0+,AR2   ;stamp FRQ_L value into status table

     LAR  AR4,#A_Reg_12+3 ;AR4=pV_Frq_L (bank High)
     BCNDD     FRQ3H,NTC ;branch (delayed) if 4op bit not set
     LACL *+,AR1          ;ACCL=pFRQ_L (2op)
     BIT  *,11,AR3  ;test 4op bit 4
     LACL *         ;ACCL=pFRQ_L (4op)
FRQ3H     MAR  *+,AR4          ;AR3=next (addr Frq_4op)
     SACL *0+,AR2   ;stamp FRQ_L value into status table
```

```
      BCNDD     FRQ4H,NTC ;branch (delayed) if 4op bit not set
      LACL *+,AR1         ;ACCL=pFRQ_L (2op)
      BIT  *,10,AR3  ;test 4op bit 5
      LACL *         ;ACCL=pFRQ_L (4op)
FRQ4H     MAR  *+,AR4         ;AR3=next (addr Frq_4op)
      SACL *0+,AR2   ;stamp FRQ_L value into status table

      BCNDD     FRQ5H,NTC ;branch (delayed) if 4op bit not set
      LACL *+,AR1         ;ACCL=pFRQ_L (2op)
      MAR  *,AR3          ;ARp=>AR3
      LACL *         ;ACCL=pFRQ_L (4op)
FRQ5H     MAR  *+,AR4         ;AR3=next (addr Frq_4op)
      SACL *0+,AR2   ;stamp FRQ_L value into status table

        B       MRegKOff   ;TEMPORARY!!! uncomment for EVM dev't

        ;setup stereo mix coefficients per STL, STR register bits
        ;if corresponding STx bit is set then coeff=Mas_Vol else
coeff=Zip_vol
        LAR     AR1,#Voice0            ;AR1=pVoice0 (1st voice)
        LAR     AR2,#Mas_Vol           ;AR2=pMas_Vol coefficient
        LAR     AR3,#Zip_Vol           ;AR3=pZip_Vol coefficient
        SPLK    #blok,INDX             ;INDX = blok (voice addr.
step)
        LACC    #LPanVce0-1            ;ACCL=program mem addr of
left coeffs.
        MAR     *,AR1                  ;arp=>ar1

        ;left coeffs.
        SPLK    #17,BRCR               ; BRCR =17, for repeat of
block 18times
        RPTB LCOEFFL - 1               ; Begin repeat block
        ;*****************************************************
        LAR     AR4,*0+,AR4               ;AR4=pA_Reg_x (addr of
assigned reg st)
```

```
        ADRK    #3                      ;AR4=pV_FRQ_L
        LAR     AR4,*                   ;AR4=pFRQ_L
        ADRK    #20h                    ;AR4=pFEED_C
        BIT     *,10,AR3                ;check STL bit
        ADD     #1                      ;incr. coeff. address, xc
pipeline
        XC      1,TC                    ;if STL bit is set
        MAR     *,AR2                   ;then point to Zip_Vol w/
AR2
        TBLW    *,AR1                     ;copy coeff. into prog.
memory
        ;*****************************************************
LCOEFFL:

        ;setup for right coefficients
        LAR     AR1,#Voice0             ;AR1=p1st voiceds
        LACC    #RPanVce0-1             ;ACCL=program mem addr of
left coeffs.

        ;right coeffs.
        SPLK    #17,BRCR                ; BRCR =17, for repeat of
block 18times
        RPTB RCOEFFL - 1                ; Begin repeat block
        ;*****************************************************
        LAR     AR4,*0+,AR4               ;AR4=pA_Reg_x (addr of
assigned reg st)
        ADRK    #3                      ;AR4=pV_FRQ_L
        LAR     AR4,*                   ;AR4=pFRQ_L
        ADRK    #20h                    ;AR4=pFEED_C
        BIT     *,11,AR3                ;check STR bit
        ADD     #1                      ;incr. coeff. address, xc
pipeline
        XC      1,TC                    ;if STR bit is set
        MAR     *,AR2                   ;then point to Zip_Vol w/
AR2
```

```
        TBLW     *,AR1                          ;copy coeff. into prog.
memory
        ;*************************************************
RCOEFFL:


;*****************************************************************
     ;Slam all Melodic Register Key-offs into Register key status
     ; DP=0
     ;*****************************************************************
MRegKOff:
      ; LAR      AR4,#ON_OCTF     ;AR4=addr of arrayL note on/off
registers
     LAR  AR1,#A_Reg_0   ;AR1=addr of Register Key Status Table
     LAR  AR2,#A_Reg_0+3 ;AR2=addr of FRQ_L pointer in Reg. Stat
table
     LACL #4          ;ACC=4
     SACL INDX        ;INDX=4
     LACL #1Fh        ;ACC=1Fh
     LAR  AR5,#1           ;AR5=1 (for loop control, repeat=1)
     ;start
     MAR  *,AR2            ;ARP=>AR2
     LAR   AR4,*0+,AR4       ;AR4=pFRQ_L (addr of low order voice
pitch)
     ADRK #10h        ;AR4=pON_OCTF (addr of on/off per FRQ_L
assign)
KyOffL    BIT  *,10,AR2  ;test for note-on (20h)
     LAR   AR4,*0+,AR4       ;AR4=pFRQ_L (addr of low order voice
pitch)
     ADRK #10h        ;AR4=pON_OCTF (addr of on/off per FRQ_L
assign)
     BCNDD     R0onL,TC  ;branch if reg value=note-on
     BIT  *,10,AR2  ;test for note-on (20h)
     LAR   AR4,*0+,AR1       ;AR4=pFRQ_L (addr of low order voice
pitch)
```

```
     SACL *          ;save note-off (1Fh) in Reg Status table
R0onL     MAR  *0+,AR4    ;AR1=pA_Reg_(n+1),ARP=>AR2
     ADRK #10h       ;AR4=pON_OCTF (addr of on/off per FRQ_L
assign)
     BCNDD     R1onL,TC  ;branch if reg value=note-on
     BIT  *,10,AR2  ;test for note-on (20h)
     LAR   AR4,*0+,AR1      ;AR4=pFRQ_L (addr of low order voice
pitch)
     SACL *          ;save note-off (1Fh) in Reg Status table
R1onL     MAR  *0+,AR4    ;AR1=pA_Reg_(n+1),ARP=>AR2
     ADRK #10h       ;AR4=pON_OCTF (addr of on/off per FRQ_L
assign)
     BCNDD     R2onL,TC  ;branch if reg value=note-on
     BIT  *,10,AR2  ;test for note-on (20h)
     LAR   AR4,*0+,AR1      ;AR4=pFRQ_L (addr of low order voice
pitch)
     SACL *          ;save note-off (1Fh) in Reg Status table
R2onL     MAR  *0+,AR4    ;AR1=pA_Reg_(n+1),ARP=>AR2
     ADRK #10h       ;AR4=pON_OCTF (addr of on/off per FRQ_L
assign)
     BCNDD     R3onL,TC  ;branch if reg value=note-on
     BIT  *,10,AR2  ;test for note-on (20h)
     LAR   AR4,*0+,AR1      ;AR4=pFRQ_L (addr of low order voice
pitch)
     SACL *          ;save note-off (1Fh) in Reg Status table
R3onL     MAR  *0+,AR4    ;AR1=pA_Reg_(n+1),ARP=>AR2
     ADRK #10h       ;AR4=pON_OCTF (addr of on/off per FRQ_L
assign)
     BCNDD     R4onL,TC  ;branch if reg value=note-on
     BIT  *,10,AR2  ;test for note-on (20h)
     LAR   AR4,*0+,AR1      ;AR4=pFRQ_L (addr of low order voice
pitch)
     SACL *          ;save note-off (1Fh) in Reg Status table
R4onL     MAR  *0+,AR4    ;AR1=pA_Reg_(n+1),ARP=>AR2
     ADRK #10h       ;AR4=pON_OCTF (addr of on/off per FRQ_L
```

```
assign)
     BCNDD     R5onL,TC  ;branch if reg value=note-on
     BIT  *,10,AR2  ;test for note-on (20h)
     LAR   AR4,*0+,AR1      ;AR4=pFRQ_L (addr of low order voice
pitch)
     SACL *          ;save note-off (1Fh) in Reg Status table
R5onL     MAR  *0+,AR4   ;AR1=pA_Reg_(n+1),ARP=>AR2
     ADRK #10h       ;AR4=pON_OCTF (addr of on/off per FRQ_L
assign)
     BCNDD     R6onL,TC  ;branch if reg value=note-on
     BIT  *,10,AR2  ;test for note-on (20h)
     LAR   AR4,*0+,AR1      ;AR4=pFRQ_L (addr of low order voice
pitch)
     SACL *          ;save note-off (1Fh) in Reg Status table
R6onL     MAR  *0+,AR4   ;AR1=pA_Reg_(n+1),ARP=>AR2
     ADRK #10h       ;AR4=pON_OCTF (addr of on/off per FRQ_L
assign)
     BCNDD     R7onL,TC  ;branch if reg value=note-on
     BIT  *,10,AR2  ;test for note-on (20h)
     LAR   AR4,*0+,AR1      ;AR4=pFRQ_L (addr of low order voice
pitch)
     SACL *          ;save note-off (1Fh) in Reg Status table
R7onL     MAR  *0+,AR4   ;AR1=pA_Reg_(n+1),ARP=>AR2
     ADRK #10h       ;AR4=pON_OCTF (addr of on/off per FRQ_L
assign)
     BCNDD     R8onL,TC  ;branch if reg value=note-on
     BIT  *,10,AR2  ;test for note-on (20h)
     LAR   AR4,*0+,AR1      ;AR4=pFRQ_L (addr of low order voice
pitch)
     SACL *          ;save note-off (1Fh) in Reg Status table
R8onL     MAR  *,AR5
     BANZ R0onL,*-,AR1   ;loop back if High Array (OPL3) not done
     MAR  *0+        ;AR1=pA_Reg_(n+1),ARP=>AR2
     BCND R18onL,TC ;branch if reg value=note-on
     SACL *          ;save note-off (1Fh) in Reg Status table
```

```
R18onL:

;*****************************************************************

;*****************************************************************
     ;Check Melodic Voices for Note-on events
     ; DP=0, INDX=4

;*****************************************************************
      ; LAR      AR4,#ON_OCTF     ;AR4=addr of arrayL note on/off
registers
     LAR  AR1,#A_Reg_0    ;AR1=addr of Register Key Status Table
     LAR  AR2,#A_Reg_0+3 ;AR2=addr of FRQ_L pointer in Reg. Stat
table
      ; LAR     AR5,#0FFFFh     ;AR5=voice count (reg note-on)
     LAR  AR3,#1          ;AR3=repeat count
     MAR  *,AR2           ;ARP=>AR2
        LACL     #3Fh             ;ACCL=3Fh
        SACL     TEMP1            ;TEMP1=3Fh

     LAR   AR4,*0+,AR4      ;AR4=pFRQ_L (addr of low order voice
pitch)
     ADRK #10h       ;AR4=pON_OCTF (addr of on/off per FRQ_L
assign)

KyOnL      LACC *,0,AR1    ;ACC=ON_OCTFx,ARP=>AR1
        AND      TEMP1            ;Clear Undefined Bits
     SUB  *0+,0,AR2 ;ACC=[ON_OCTFx - (note-on status 1Fh=off)]
     BCNDD       Note_On,GT       ;Branch if Reg Stat=off and Reg
Val=on
     LAR   AR4,*0+,AR4      ;AR4=pFRQ_L (addr of low order voice
pitch)
     ADRK #10h       ;AR4=pON_OCTF (addr of on/off per FRQ_L
assign)
```

```
LACC *,0,AR1    ;ACC=ON_OCTFx,ARP=>AR1
   AND     TEMP1            ;Clear Undefined Bits
SUB  *0+,0,AR2 ;ACC=[ON_OCTFx - (note-on status 1Fh=off)]
BCNDD       Note_On,GT       ;Branch if Reg Stat=off and Reg
Val=on
LAR   AR4,*0+,AR4      ;AR4=pFRQ_L (addr of low order voice
pitch)
ADRK #10h       ;AR4=pON_OCTF (addr of on/off per FRQ_L
assign)


LACC *,0,AR1    ;ACC=ON_OCTFx,ARP=>AR1
   AND     TEMP1            ;Clear Undefined Bits
SUB  *0+,0,AR2 ;ACC=[ON_OCTFx - (note-on status 1Fh=off)]
BCNDD       Note_On,GT       ;Branch if Reg Stat=off and Reg
Val=on
LAR   AR4,*0+,AR4      ;AR4=pFRQ_L (addr of low order voice
pitch)
ADRK #10h       ;AR4=pON_OCTF (addr of on/off per FRQ_L
assign)

LACC *,0,AR1    ;ACC=ON_OCTFx,ARP=>AR1
   AND     TEMP1            ;Clear Undefined Bits
SUB  *0+,0,AR2 ;ACC=[ON_OCTFx - (note-on status 1Fh=off)]
BCNDD       Note_On,GT       ;Branch if Reg Stat=off and Reg
Val=on
LAR   AR4,*0+,AR4      ;AR4=pFRQ_L (addr of low order voice
pitch)
ADRK #10h       ;AR4=pON_OCTF (addr of on/off per FRQ_L
assign)

LACC *,0,AR1    ;ACC=ON_OCTFx,ARP=>AR1
   AND     TEMP1            ;Clear Undefined Bits
SUB  *0+,0,AR2 ;ACC=[ON_OCTFx - (note-on status 1Fh=off)]
BCNDD       Note_On,GT       ;Branch if Reg Stat=off and Reg
```

```
Val=on
     LAR   AR4,*0+,AR4      ;AR4=pFRQ_L (addr of low order voice
pitch)
     ADRK #10h       ;AR4=pON_OCTF (addr of on/off per FRQ_L
assign)

     LACC *,0,AR1    ;ACC=ON_OCTFx,ARP=>AR1
        AND      TEMP1            ;Clear Undefined Bits
     SUB  *0+,0,AR2 ;ACC=[ON_OCTFx - (note-on status 1Fh=off)]
     BCNDD       Note_On,GT       ;Branch if Reg Stat=off and Reg
Val=on
     LAR   AR4,*0+,AR4      ;AR4=pFRQ_L (addr of low order voice
pitch)
     ADRK #10h       ;AR4=pON_OCTF (addr of on/off per FRQ_L
assign)

     LACC *,0,AR1    ;ACC=ON_OCTFx,ARP=>AR1
        AND      TEMP1            ;Clear Undefined Bits
     SUB  *0+,0,AR2 ;ACC=[ON_OCTFx - (note-on status 1Fh=off)]
     BCNDD       Note_On,GT       ;Branch if Reg Stat=off and Reg
Val=on
     LAR   AR4,*0+,AR4      ;AR4=pFRQ_L (addr of low order voice
pitch)
     ADRK #10h       ;AR4=pON_OCTF (addr of on/off per FRQ_L
assign)

     LACC *,0,AR1    ;ACC=ON_OCTFx,ARP=>AR1
        AND      TEMP1            ;Clear Undefined Bits
     SUB  *0+,0,AR2 ;ACC=[ON_OCTFx - (note-on status 1Fh=off)]
     BCNDD       Note_On,GT       ;Branch if Reg Stat=off and Reg
Val=on
     LAR   AR4,*0+,AR4      ;AR4=pFRQ_L (addr of low order voice
pitch)
     ADRK #10h       ;AR4=pON_OCTF (addr of on/off per FRQ_L
assign)
```

```
     LACC *,0,AR1    ;ACC=ON_OCTFx,ARP=>AR1
        AND      TEMP1            ;Clear Undefined Bits
     SUB  *0+,0,AR2 ;ACC=[ON_OCTFx - (note-on status 1Fh=off)]
     BCNDD       Note_On,GT       ;Branch if Reg Stat=off and Reg
Val=on
     LAR   AR4,*0+,AR4      ;AR4=pFRQ_L (addr of low order voice
pitch)
     ADRK #10h       ;AR4=pON_OCTF (addr of on/off per FRQ_L
assign)

     ;switch to reg arrayH
     MAR  *,AR3           ;ARP=>AR3
     BANZ KyOnL,*-,AR4    ;loop back if High Array (OPL3) not done

;*****************************************************************
        B         RHY_CHEK          ;No note-on's, process rhythm
updates
     ;*****************************************************************


;*****************************************************************
     ;Process new note-on event for Melodic Voice
     ; DP=0, INDX=4
     ; AR1=(Reg Stat Table addr +4)

;*****************************************************************
Note_On:
     SAR  AR1,AR4         ;AR4=(Reg Stat Table Addr + 4)
     MAR  *,AR1                ;ARp=>AR1
     MAR  *0-             ;AR1=pA_Reg_(ar5)
     LACL #90h            ;ACCL=90h
     SACL *,0,AR4         ;note-on status 90h into Reg table
     MAR  *-              ;AR4=pV_FRQ_L
     LAR  AR4,*                ;AR4=pFRQ_L
        ;check reg status for existing voice assignment - use the
```

```
        ;existing assignment if there is one
        LAR     AR2,AR1                 ;AR2=pA_Reg_x
        MAR     *,AR2                   ;ARp=>AR2
        MAR      *+                           ;AR2=p(A_Reg_x + 1)
[pVoiceds]
        LACL    *                      ;ACCL=voice assignment addr
        LAR      AR0,*,AR0                  ;AR0=pVoiceds (only if
branch=true)
        BCNDD    StlnVce,NEQ                ;branch if no existing
assignment
        SPLK    #blok,INDX              ;INDX=voiceds blok size
        ;find an available voice - setup for free voice check
StFreCk SPLK    #blok,INDX              ;INDX=voiceds blok size
     LAR  AR2,#Voice0          ;AR2=init voiceds ptr
     SAR  AR2,AR0         ;AR0=init voiceds ptr
        LAR     AR3,#0                  ;AR3=init voice count
     MAR  *,AR2                ;ARP=>AR2
     ADRK #EMode               ;AR2=pEMode
        LAR     AR5,#Max_Vce            ;AR5=pMax_Vce
        MAR     *,AR5                   ;ARP=>AR5
        LAR     AR5,*                   ;AR5=Max_Vce count
        SAR     AR5,DBMR                ;DBMR=Max_Vce
        MAR     *-,AR2                  ;AR5=Max_Vce-1,ARP=>AR2
        ;Check EMode for a free voice
        LACL    *0+,AR5                ;ACC=EMode,AR2=pEMode(next
voice)
NxtFrVc BCND      FreeVce,EQ                  ;branch if EMode=0
(voice=off)
        BANZD   NxtFrVc,*-,AR3           ;check next voice if not
past Max_Vce
        MAR     *+,AR2                  ;AR3=new voice# (0-max)
        LACL    *0+,AR5                ;ACC=EMode,AR2=pEMode(next
voice)
        ;No Free Voices, find one to steal
        ;INDX=#blok,AR0=#Voice0,ARP=>AR5
```

```
        ;setup voice steal context
        SAR     AR0,AR5                 ;AR5=pVoiceds0
        SAR     AR1,TEMP2               ;Temp save AR1
        LAR     AR1,#Max_Vce            ;AR1=pMax_Vce
        ADRK    #EMode                  ;AR5=pEMode
        SAR     AR5,AR2                 ;AR2=pEMode     **
     ADRK #13            ;AR5=pEm
     SAR  AR5,AR3        ;AR3=pEm  **
     ADRK #7             ;AR5=pEc  **
        MAR     *,AR1                   ;ARP=>AR1
     LAR  AR1,*                ;AR1=Max_Vce (count)
     MAR  *-,AR2               ;AR1=Max_Vce - 1
        LACC    #32767                  ;ACC=32767
        SACB                            ;ACCB=32767
     ;If Connect=0 (EMode=1), then Minimum=Ec[min]
     ;If  Connect=1  (EMode=4  BIT  Tested),  then  Minimum=(Ec  +
Em)[min]
NxtStVc BIT     *0+,13,AR5              ;Check if EMode Bit 2 is
set
     LACL *0+,AR3        ;ACCL=Ec
        XC      1,TC                      ;if EMode bit 2 is set
(EMode=4)
     ADD  *              ;then add Em
     MAR  *0+,AR1        ;ARP=>AR1,AR3=next pEm
        CRLT                            ;check ACC<ACCB
        BANZD   NxtStVc,*-,AR2          ;check next voice if not
past Max_Vce
     XC   1,C            ;if ACC<ACCB then
     SAR  AR2,TEMP3      ;TEMP3=EMode(candidate voiceds + #blok)
     ;Voice Steal checking done, prepare context
        LAR     AR1,TEMP2                 ;restore AR1=(Reg Stat
Table Addr.)
     LAR  AR2,TEMP3      ;AR2=pVoiceds + #EMode + #blok
        MAR     *,AR2                   ;ARP=>AR2
        SBRK    #EMode                  ;AR2=pVoiceds (voice+1)
```

```
        MAR     *0-,AR2                     ;AR2=pVoiceds (new voice)
     LAR  AR0,AR2          ;AR0=pVoiceds (new voice)
        LAR     AR2,*                      ;AR2=Reg stat table of old
assignment
        MAR      *+                             ;AR2=p(A_Reg_St + 1)
[Voiceds]
        BD      StlnVce                     ;branch to voice init
        LACL    #0                          ;ACCL=0
        SACL    *,0,AR0                     ;clear old register voice
assignment


;*************************************************************
     ;Begin new 2-osc voice initialization and correlation
     ; AR2=pEMode(voice+1)
     ; DP=0,INDX=blok
     ; AR1=(Reg Stat Table addr),AR4=(pFRQ_L(reg#))    PM=1

;*************************************************************
FreeVce:
        MAR     *,AR2                       ;ARP=>AR2
        SBRK    #EMode                      ;AR2=pVoiceds (voice+1)
        MAR     *0-,AR0                     ;AR2=pVoiceds (new voice)
     LAR  AR0,AR2          ;AR0=pVoiceds (new voice)
StlnVce SAR      AR1,*,AR1                        ;Stamp voice w/ new
A_Reg_St
        MAR     *+                          ;AR1=pA_Reg_x + 1 (voice
address)
     SAR  AR0,*+                ;voice addr stamped into Reg Table
                          ;AR1=pV_Multi(mod)
     LAR  AR2,*,AR2       ;AR2=pMULTI
     SAR  AR2,TEMP10            ;TEMP10=pMULTI(mod)
     ADRK #3              ;AR2=pMULTI(car)
     SAR  AR2,TEMP16            ;TEMP16=pMULTI(car)
```

```
;4-op half1 (H1) and Half2 (H2) EMode, mod/carrier assign,
;and Correlation message passing

;first, setup default feedback initialization mode
LAR  AR3,#ZipFeedbk       ;AR3= addr of feedback alloc mode
MAR  *,AR3                ;ARp=>AR3
LACL #0              ;ACCL=0
SACL *,AR1               ;ZipFeedbk=0 (normal initialization)

;AR1=pV_Multi(mod),AR0=pVoiceds
;find 4-op half (if 4op voice)
MAR  *+              ;AR1=pV_FRQ_L
LACL *               ;ACCL=pFRQ_L(current)
SACL DBMR            ;DBMR=pFRQ_L(current)
LAR  AR3,AR1         ;AR3=pV_FRQ_L
MAR  *-,AR3               ;AR1=pV_MULTI(mod)
ADRK #12             ;AR3=pV_FRQ_L(current+3)
CPL  *               ;pFRQ_L(current+3)-pFRQ_L(current)
BCND H1_4op,TC       ;branch to half 1 if equal
SBRK #24             ;AR3=pV_FRQ_L(current-3)
CPL  *               ;pFRQ_L(current-3)-pFRQ_L(current)
BCND EMod2osc,NTC         ;do normal 2op if not equal

;Osc pair is Half2 of a 4 oscillator voice
H2_4op:
LAR  AR5,*,AR5       ;AR5=pFRQ_L(base)
ADRK #20h            ;AR5=pFEED_C(base)
LAR  AR3,AR5         ;AR3=pFEED_C(base)
MAR  *,AR3                ;ARp=>AR3
ADRK #3              ;AR3=pFEED_C(+3)
BIT  *,15,AR5        ;check connect(+3) bit
BCND H2_C13,TC       ;branch if connect = 1 or 3
H2_C02:
BIT  *,15            ;check connect(0) bit
   BCND    H2_C2,TC                  ;branch if connect = 2
```

```
H2_C0:
     B    EMod2osc        ;TEMPORARY!!
     B    Voice2osc       ;do default 2osc allocation
H2_C2:
     LAR  AR5,AR0         ;AR5=pVoiceds
     LACL #1              ;ACCL=1
     ADRK #EMode               ;AR5=pEMode
     SACL *-,0,AR3        ;init EMode=1 (2op series)
     LAR  AR3,#AdrEMode1       ;AR3=addr of function address
     LACL *,AR5                ;ACCL=#EMode1
     SACL *,0,AR3         ;init EModFunc
     LAR  AR3,#ZipFeedbk       ;AR3= addr of feedback alloc mode
     LACL #1              ;ACCL=1
     SACL *               ;ZipFeedbk=1 (case=no feedback)
     B    Voice2osc       ;do default 2osc allocation

H2_C13:
     BIT  *,15            ;check connect(0) bit
     BCND H2_C3,TC        ;branch if connect = 3
H2_C1:
     B    EMod2osc        ;TEMPORARY!!
     B    Voice2osc       ;do default 2osc allocation
H2_C3:
     LACL TEMP10               ;ACCL=pMULTI(mod)
     SACL TEMP16               ;update pMULTI(car)
     SUB  #5              ;prep pMULTI(mod)
     SACL TEMP10
     LAR  AR5,AR0         ;AR5=pVoiceds
     LACL #1              ;ACCL=1
     ADRK #EMode               ;AR5=pEMode
     SACL *-,0,AR3        ;init EMode=1 (2op series)
     LAR  AR3,#AdrEMode1       ;AR3=addr of function address
     LACL *,AR5                ;ACCL=#EMode1
     SACL *,0,AR3         ;init EModFunc
     LAR  AR3,#ZipFeedbk       ;AR3= addr of feedback alloc mode
```

```
      LACL #1              ;ACCL=1
      SACL *               ;ZipFeedbk=1 (case=no feedback)
      B    Voice2osc       ;do default 2osc allocation

      ;Osc pair is Half1 of a 4 oscillator voice
H1_4op:
      LAR  AR5,*,AR5       ;AR5=pFRQ_L(base)
      ADRK #20h            ;AR5=pFEED_C(base)
      LAR  AR3,AR5         ;AR3=pFEED_C(base)
      MAR  *,AR3                ;ARp=>AR3
      ADRK #3              ;AR3=pFEED_C(+3)
      BIT  *,15,AR5        ;check connect(+3) bit
      BCND H1_C13,TC       ;branch if connect = 1 or 3

H1_C02:
      BIT  *,15            ;check connect(0) bit
         BCND    H1_C2,TC                ;branch if connect = 2
H1_C0:
      LAR  AR5,AR0         ;AR5=pVoiceds
      LACL #1              ;ACCL=1
      ADRK #EMode               ;AR5=pEMode
      SACL *-,0,AR3        ;init EMode=1 (2op series)
      LAR  AR3,#AdrEMode1       ;AR3=addr of function address
      LACL *,AR5                ;ACCL=#EMode1
         SACL    *                      ;init EModFunc
         ;TEMPORARY set car and mod Level=0, (Kill H1 Output)
      LAR  AR5,AR0         ;AR5=pVoiceds
         ADRK    #Level_M               ;AR5=pLevel_M
         LACL    #0                     ;ACCL=0
         SACL    *                      ;Level_M=0
         ADRK    #9                     ;AR5=pLevel_C
         SACL    *                      ;Level_C=0
      LAR  AR5,AR0         ;AR5=pVoiceds
         ADRK    #Level_MN              ;AR5=pLevel_MN
         SACL    *+                     ;Level_MN=0
```

```
        SACL    *                       ;Level_CN=0
      ; B       Voice2osc               ;do default 2osc allocation
        B       SYNTH_ENG               ;TEMPORARY

H1_C2:
      B     EMod2osc        ;TEMPORARY!!
      B     Voice2osc       ;do default 2osc allocation


H1_C13:
      BIT   *,15            ;check connect(0) bit
      BCND  H1_C3,TC        ;branch if connect = 3
H1_C1:
      B     EMod2osc        ;TEMPORARY!!
      B     Voice2osc       ;do default 2osc allocation
H1_C3:
      LACL  TEMP10                ;ACCL=pMULTI(mod)
      ADD   #11             ;switch to op #4
      SACL  TEMP16                ;update pMULTI(car)
      LAR   AR5,AR0         ;AR5=pVoiceds
      LACL  #4              ;ACCL=4
      ADRK  #EMode                ;AR5=pEMode
      SACL  *-,0,AR3        ;init EMode=4 (2op parallel)
      LAR   AR3,#AdrEMode4        ;AR3=addr of function address
      LACL  *,AR5                 ;ACCL=#EMode4
      SACL  *               ;init EModFunc
      B     Voice2osc       ;do default 2osc allocation

;*** ;EMode - 1-2op(C=0), 2-perc1, 3-perc3, 4-2op(C=1)
EMod2osc:
        MAR     *,AR3                   ;ARP=>AR3
        SAR     AR0,AR2                 ;AR2=pVoiceds
```

```
        LAR     AR3,AR4                     ;AR3=pFRQ_L
        ADRK    #20h                        ;AR3=pFEED_C
        LACL    *,AR5                       ;ACCL=FEED_C reg value
        AND     #1                          ;ACCL= connect value
        SACL    INDX                        ;INDX=connect value
        SACL    TEMP9                       ;TEMP9=connect value
        LAR     AR5,#AdrEMode1              ;AR5=pAdrEMode1
        MAR     *0+,AR2                     ;AR5=pAdrEMode(connect)
     ADRK #EMode                      ;AR2=pEMode
        SPLK    #1,*-,AR5                   ;EMODE=1,ARP=>AR5
     BCNDD      Voice2osc,EQ            ;AR2=pEModFunc
        LACL    *,AR2                       ;ACCL=AdrEMode(connect)
        SACL    *+                          ;stamp EModFunc (addr of
function)
        SPLK    #4,*                        ;EMODE=4


;*****************************************************************
     ;Voice2osc:
     ;Generic 2-osc voice initialization begin
     ; Assumptions:
     ; [] Register Status Table Updated for source Register set
     ; [] Voice stamped with pointer to Register Status Table
     ; [] EMode and EModFunc stamped into voice
     ;
     ; VOICE INITIALIZATION CONTEXT:
     ; AR0=pVoiceds, TEMP10=pMULTI(mod)    [allocation context]
     ;         TEMP16=pMULTI(car)    [allocation context]
     ; #AllocMode = (allocation mode code) [allocation context]
     ; AR2=[misc]  , AR4=(pFRQ_L(reg#))    [dynamic pointers  ]
     ; AR3=[misc]  , AR5=[misc]          [general use    ]
     ; DP=0
     ; SXM=0, PM=1

;*****************************************************************
```

```
Voice2osc:
;***    ;LFOCtl - LFO control word
        LACL    #0                          ;ACCL=0
     MAR  *,AR2                     ;ARp=>AR2
     LAR  AR2,TEMP10                ;AR2=pMULTI(mod)
        BIT     *,9,AR2                     ;Mod Vibrato bit=> TC
     LAR  AR2,TEMP16                ;AR2=pMULTI(car)
        XC      2,TC                        ;if Vib is on then
        OR      #1                          ;set bit in LFOCtl word
        BIT     *,9,AR2                     ;Car Vibrato bit=> TC
        SAR     AR0,AR3                     ;AR3=pVoiceds
        XC      2,TC                        ;if Vib is on then
        OR      #2                          ;set bit in LFOCtl word
     LAR  AR2,TEMP10                ;AR2=pMULTI(mod)
     BIT  *,8,AR2                   ;Mod Tremolo bit=> TC
     LAR  AR2,TEMP16                ;AR2=pMULTI(car)
     XC   2,TC                      ;if Trm is on then
     OR   #8                        ;set bit in LFOCtl word
     BIT  *,8,AR2                   ;Car Tremolo bit=> TC
        SAR     AR0,AR3                     ;AR3=pVoiceds
     XC   2,TC                      ;if Trm is on then
     OR   #010h                     ;set bit in LFOCtl word
        LAR     AR2,#D_RHYTH                ;AR2=pD_RHYTH
        BIT     *,9,AR2                     ;Vibrato Depth bit=> TC
        nop                                 ;xc pipeline
        XC      2,TC                        ;if Vib is on then
        OR      #4                          ;set bit in LFOCtl word
    BIT  *,8,AR2                    ;Tremolo Depth bit=> TC
        nop                                 ;xc pipeline
    XC   2,TC                       ;if Trm is on then
    OR   #020h                      ;set bit in LFOCtl word
        MAR     *,AR3                       ;ARP=>AR3
        ADRK    #LFOCtl                     ;AR3=pLFOCtl
        SACL    *                           ;LFOCtl initialized
;***    ;Nom_Pch
```

```
        ;AR4=pFRQ_L (and voice context)
GNomPch CALL    MNomPch                         ;call Nom_Pch
;***    Run_Val
        ;AR3=pPch_Step, ARP=>AR3 (and voice context)
        CALL    MRun_Val                        ;call Run_Val
;***    ;pSpecSer - stamp voice with SpecTabx base addr per wave
select
     ;ARP=>AR5 ,AR4=pON_OCTF, AR2=pPScale(BLOCK), TEMP2=FNUM(h,l)
     ;AR5=pMULTI, INDX=pMScale0
        ADRK    #0C0h                           ;AR5=pWAVSEL
        LACL    *                               ;ACCL=wave select reg value
(0-7)
        ADD       #Sin_M                                ;ACCL=addr of
SpecTab(WAVSEL) addr
        SACL      AR3                                   ;AR3=addr of
SpecTab(WAVSEL) addr
     ; SBRK   #0BDh                    ;AR5=pMULTI (carrier)
     LAR  AR5,TEMP16                ;AR5=pMULTI (carrier)
        MAR     *,AR3                           ;ARP=>AR3
        LACL    *,AR0                           ;ACCL=SpecTab(WAVSEL)
        MAR     *+                              ;AR0=addr of pSpecSer
        SACL    *-,0,AR5                        ;pSpecSer=SpecTab(WAVSEL)
addr

                                                ;AR0=pVoiceds
;*** ;Nom_PchC - calculate nominal pitch
     ;ARP=>AR5 ,AR4=pON_OCTF, AR2=pPScale(BLOCK), TEMP2=FNUM(h,l)
        ;AR5=pMULTI (carrier), INDX=pMScale0
        CALL    CNom_Pch                ;call carrier nominal pitch
;*** ;Run_ValC - zero initial TableOffset.Frac
     ;AR3=pPch_StpC, ARP=>AR3
        CALL    CRun_Val                        ;init Run_ValC
;*** ;TblBaseC - carrier wave select
        ;AR3=pTblBaseC, ARP=>AR3
     SPLK #Sin_C,INDX           ;INDX=pSin_C (addr of wave select
Tbl)
```

```
      ; MAR    *,AR1                ;ARP=>AR1
     MAR  *,AR2                ;ARP=>AR2
      ; LAR    AR2,*,AR2        ;AR2=pMULTI
     LAR  AR2,TEMP16           ;AR2=pMULTI(carrier)
      ; ADRK   #0C3h                ;AR2=pWAVSEL (carrier)
     ADRK #0C0h                ;AR2=pWAVSEL (carrier)
     LAR  AR5,*,AR5       ;AR5=WAVSEL (carrier)
     MAR  *0+             ;AR5=p(Wave Address)
     LACL *,AR3                ;ACCL=(Wave Address)
     SACL *               ;TblBaseC=(Wave Address)
KIK_PERC:                                ;temporary Kick drum perc.
entry
;***    ;Tbl_PtrC - TEMPORARY set equal to TblBaseC (AFTER CARRIER
WAVE
SELECT!!)
        ;AR3=pTblBaseC, ARP=>AR3
        LACL    *-                    ;ACCL=TblBaseC,AR3=pRunValC
        MAR     *-                      ;AR3=pTbl_PtrC
        SACL     *+                           ;Tbl_PtrC=TblBaseC,
AR3=pRun_ValC
;*** ;C_Rnge - init to range0, init Envl to 0
     ;AR3=pRun_ValC, ARP=>AR3
     LACL #0              ;ACCL=0
     SBRK #10             ;AR3=pC_Rnge
     SACL *-              ;C_Rnge=0
     SACL *-              ;EnvLSB_C=0
     SACL *               ;EnvMSB_C=0,AR3=pEnvMSB_C
;*** ;M_Rnge - init to range0, init Envl to 0
     ;AR3=pEnvMSB_C, ARP=>AR3
     SBRK #9              ;AR3=pEnvMSB_M
     SACL *+              ;EnvMSB_M=0,AR3=pEnvMSB_M
     SACL *+              ;EnvLSB_M=0
     SACL *+,0,AR4        ;M_Rnge=0,AR3=pA_SlpeM
;*** ;A_SlpeM
     ;AR3=pA_SlpeM, ARP=>AR4 ,TEMP3=BLOCK,AR4=pON_OCTF
```

```
     ;Calculate Key Scale#, Assume NTS=1
;envl          LACC          *,14,AR1              ;ACCH=FNUM(MSB)
(w/junk),ARP=>AR1
envl LACC *,14,AR5        ;ACCH=FNUM(MSB) (w/junk),ARP=>AR1
     AND  #1,15                ;ACCH=FNUM(MSB)
     ADD  TEMP3,16        ;ACCH=Key Scale #
     SACH TEMP4,1         ;TEMP4=Key Scale #
(2*BLOK+FNUM(MSBit))
      ; LAR    AR5,*,AR5       ;AR5=pMULTI
     LAR  AR5,TEMP10           ;AR5=pMULTI(mod)
     BIT  *,11,AR5        ;test KSR bit
     nop                  ;XC pipeline
     XC   1,NTC                ;if KSR (modulator) = 0
     BSAR 2               ;then KSRO=(Key Scale #)/4
     SACH TEMP5,1         ;TEMP5=KSRO (Mod Key Rate Scale Offset)
     ADRK #40h            ;AR5=pATK_DKY
     LACC *,14,AR2        ;ACCH=ATK * 4 (w/junk)
      ; OR        #0008h,16                  ;set min attack speed
TEST!!
     AND  #0FFFCh,16           ;mask DKY bits
     NOP                  ;xc pipeline
     XC   1,NEQ                ;chek zero boundary
     ADD  TEMP5,16        ;ACCH=ATK Rate (w/o boundary chek)
     SACH INDX            ;INDX=ATK Rate (0-75)
     LAR  AR2,#AtkTabl         ;AR2=pAtkTabl
     NOP
     MAR  *0+             ;AR2=pAtkTabl(ATK Rate)
     LACL *,AR3                ;ACCL=A_SlpeM(ATK Rate)
     SACL *               ;save A_SlpeM
     SBRK #3              ;AR3=pEnvMSB_M
     SUB  #32767               ;test 'fastest attack limit'
     nop
     XC   2,GT            ;if A_Slpe_M > 7FF.Fh, then
     SPLK #7FFFh,*        ;Env_MSB_M set to fastest attack
;***    ;A_SlpeC
```

```
        ;AR3=pEnvMSB_M, ARP=>AR3, TEMP4=Key Scale#, AR4=pON_OCTF
        ADRK    #12                     ;AR3=pA_SlpeC
      ; MAR    *,AR1                ;ARP=>AR1
     MAR  *,AR5                ;ARP=>AR1
        LACC    TEMP4,15                ;ACCH=Key Scale #
(2*BLOK+FNUM(MSBit))
      ; LAR    AR5,*,AR5        ;AR5=pMULTI
     LAR  AR5,TEMP16           ;AR5=pMULTI(car)
      ; ADRK   #3               ;AR5=pMULTI (carrier)
     BIT  *,11,AR5        ;test KSR bit
     nop                  ;XC pipeline
     XC   1,NTC                ;if KSR (modulator) = 0
     BSAR 2               ;then KSRO=(Key Scale #)/4
     SACH TEMP5,1         ;TEMP5=KSRO (Mod Key Rate Scale Offset)
        ADRK    #40h                    ;AR5=pATK_DKY (carrier)
     LACC *,14,AR2        ;ACCH=ATK * 4 (w/junk)
     AND  #0FFFCh,16           ;mask DKY bits
     NOP                  ;xc pipeline
     XC   1,NEQ                ;chek zero boundary
     ADD  TEMP5,16        ;ACCH=ATK Rate (w/o boundary chek)
     SACH INDX            ;INDX=ATK Rate (0-75)
     LAR  AR2,#AtkTabl         ;AR2=pAtkTabl
     NOP
     MAR  *0+             ;AR2=pAtkTabl(ATK Rate)
        LACL    *,AR3                   ;ACCL=A_SlpeC(ATK Rate)
        SACL    *                       ;save A_SlpeC
        SBRK    #3                      ;AR3=pEnvMSB_C
     SUB  #32767               ;test 'fastest attack limit'
     nop
        XC      2,GT                  ;if A_SlpeC  > 7FF.Fh, then
        SPLK    #7FFFh,*                ;Env_MSB_C set to fastest
attack
;***    ;D_SlpeM
        ;AR3=pEnvMSB_C, ARP=>AR3, TEMP4=Key Scale#, AR4=pON_OCTF
        SBRK    #5                      ;AR3=pD_SlpeM
```

```
      ; MAR    *,AR1                ;ARP=>AR1
     MAR  *,AR5                ;ARP=>AR5
        LACC    TEMP4,15                ;ACCH=Key Scale #
(2*BLOK+FNUM(MSBit))
      ; LAR    AR5,*,AR5        ;AR5=pMULTI
     LAR  AR5,TEMP10           ;AR5=pMULTI(mod)
     BIT  *,11,AR5        ;test KSR bit
     nop                  ;XC pipeline
     XC   1,NTC                ;if KSR (modulator) = 0
     BSAR 2               ;then KSRO=(Key Scale #)/4
     SACH TEMP5,1         ;TEMP5=KSRO (Mod Key Rate Scale Offset)
        ADRK    #40h                    ;AR5=pATK_DKY
        LACC    *,2,AR2                 ;ACCL=DKY * 4 (w/junk)
        AND     #0003Ch                 ;mask ATK bits
     NOP                  ;xc pipeline
     XC   1,NEQ                ;chek zero boundary
        ADD      TEMP5                        ;ACCH=Dky Rate (w/o
boundary chek)
        SACL    INDX                    ;INDX=Dky Rate (0-75)
        LAR     AR2,#DkyTabl            ;AR2=pDkyTabl
     NOP
        MAR     *0+                     ;AR2=pDkyTabl(DKY Rate)
        LACL    *,AR3                   ;ACCL=D_SlpeM(DKY Rate)
        SACL    *                       ;save D_SlpeM
;***    ;D_SlpeC
        ;AR3=pD_SlpeM, ARP=>AR3, TEMP4=Key Scale#, AR4=pON_OCTF
        ADRK    #9                      ;AR3=pD_SlpeC
      ; MAR    *,AR1               ;ARP=>AR1
     MAR  *,AR5                ;ARP=>AR5
        LACC    TEMP4,15                ;ACCH=Key Scale #
(2*BLOK+FNUM(MSBit))
      ; LAR    AR5,*,AR5        ;AR5=pMULTI
      ; ADRK   #3               ;AR5=pMULTI (carrier)
     LAR  AR5,TEMP16           ;AR5=pMULTI(car)
     BIT  *,11,AR5        ;test KSR bit
```

```
      nop                    ;XC pipeline
      XC   1,NTC                  ;if KSR (modulator) = 0
      BSAR 2                 ;then KSRO=(Key Scale #)/4
      SACH TEMP5,1           ;TEMP5=KSRO (Mod Key Rate Scale Offset)
         ADRK     #40h                    ;AR5=pATK_DKY (carrier)
         LACC     *,2,AR2                 ;ACCL=DKY * 4 (w/junk)
         AND      #0003Ch                 ;mask ATK bits
      NOP                    ;xc pipeline
      XC   1,NEQ                  ;chek zero boundary
         ADD       TEMP5                        ;ACCH=Dky Rate (w/o
boundary chek)
         SACL     INDX                    ;INDX=Dky Rate (0-75)
         LAR      AR2,#DkyTabl            ;AR2=pDkyTabl
      NOP
         MAR      *0+                     ;AR2=pDkyTabl(DKY Rate)
         LACL     *,AR3                   ;ACCL=D_SlpeC(DKY Rate)
         SACL     *                       ;save D_SlpeC
;***     ;R_SlpeM
         ;AR3=pD_SlpeC, ARP=>AR3, TEMP4=Key Scale#, AR4=pON_OCTF
         SBRK     #6                      ;AR3=pR_SlpeM
       ; MAR     *,AR1                ;ARP=>AR1
      MAR  *,AR5                ;ARP=>AR5
         LACC     TEMP4,15                ;ACCH=Key Scale #
(2*BLOK+FNUM(MSBit))
       ; LAR     AR5,*,AR5       ;AR5=pMULTI
      LAR  AR5,TEMP10           ;AR5=pMULTI(mod)
      BIT  *,11,AR5          ;test KSR bit
      nop                    ;XC pipeline
      XC   1,NTC                  ;if KSR (modulator) = 0
      BSAR 2                 ;then KSRO=(Key Scale #)/4
      SACH TEMP5,1           ;TEMP5=KSRO (Mod Key Rate Scale Offset)
         ADRK     #60h                    ;AR5=pSUS_REL
         LACC     *,2,AR2                 ;ACCL=REL * 4 (w/junk)
         AND      #0003Ch                 ;mask SUS bits
      NOP                    ;xc pipeline
```

```
     XC   1,NEQ                ;chek zero boundary
        ADD      TEMP5                        ;ACCH=Rel Rate (w/o
boundary chek)
        SACL     INDX                    ;INDX=Rel Rate (0-75)
        LAR      AR2,#DkyTabl            ;AR2=pDkyTabl
     NOP
        MAR      *0+                     ;AR2=pDkyTabl(REL Rate)
        LACL     *,AR3                   ;ACCL=R_SlpeM(REL Rate)
        SACL     *                       ;save R_SlpeM
;***    ;R_SlpeC
        ;AR3=pR_SlpeM, ARP=>AR3, TEMP4=Key Scale#, AR4=pON_OCTF
        ADRK     #9                      ;AR3=pR_SlpeC
     ;     MAR  *,AR1               ;ARP=>AR1
     MAR  *,AR5                ;ARP=>AR5
        LACC     TEMP4,15                ;ACCH=Key Scale #
(2*BLOK+FNUM(MSBit))
     ;     LAR  AR5,*,AR5       ;AR5=pMULTI
     ;     ADRK #3              ;AR5=pMULTI (carrier)
     LAR  AR5,TEMP16           ;AR5=pMULTI(car)
     BIT  *,11,AR5        ;test KSR bit
     nop                  ;XC pipeline
     XC   1,NTC                ;if KSR (modulator) = 0
     BSAR 2               ;then KSRO=(Key Scale #)/4
     SACH TEMP5,1         ;TEMP5=KSRO (Mod Key Rate Scale Offset)
        ADRK     #60h                    ;AR5=pSUS_REL (carrier)
        LACC     *,2,AR2                 ;ACCL=REL * 4 (w/junk)
        AND      #0003Ch                 ;mask SUS bits
     NOP                  ;xc pipeline
     XC   1,NEQ                ;chek zero boundary
        ADD      TEMP5                        ;ACCH=Rel Rate (w/o
boundary chek)
        SACL     INDX                    ;INDX=Rel Rate (0-75)
        LAR      AR2,#DkyTabl            ;AR2=pDkyTabl
     NOP
        MAR      *0+                     ;AR2=pDkyTabl(REL Rate)
```

```
        LACL    *,AR3                   ;ACCL=R_SlpeC(REL Rate)
        SACL    *                       ;save R_SlpeC
;***    ;Level_M
        ;AR3=pR_SlpeC, ARP=>AR3, TEMP4=Key Scale#, AR4=pON_OCTF
        ;TEMP2=FNUM(h,l), TEMP3=BLOCK, PM=1, TEMP6=mod MULTI
TempBK   CALL   LevelM                  ;call LevelM function
;***    ;Feedbk
        ;AR3=pLevl_M, ARP=>AR3, TEMP4=Key Scale#, AR4=pON_OCTF
        ;TEMP2=FNUM(h,l), TEMP3=BLOCK, PM=1 ,TEMP8=LEVEL (0-63)
FeedT   LACC    #63,9                   ;ACCL=7E00h
        SUB     TEMP8,9                 ;ACCL=linear Mod level
(0-7E00h)
        ADD     #1FFh                   ;ACCL=linear Mod
LEVEL(1FFh-7FFFh)
        SACL    TREG0                   ;TREG0=linear Mod
LEVEL(1FFh-7FFFh)
        MAR     *,AR4                   ;ARP=>AR4
        ADRK    #10h                    ;AR4=pFEED_C
        SAR     AR0,AR5                 ;AR5=pVoiceds
        LACC    *,15,AR5                ;ACCH=FEED_C reg value (w/o
CONN)
        AND     #0007h,16               ;ACCH=Feedbk
        SACH    INDX                    ;INDX=Feedbk
        ADRK    #Feedbk                 ;AR5=pFeedbk
    ;   MPY     INDX                    ;LEVEL_M*FEEDBK
    ;   PAC                             ;ACC=Level_M*Feedbk
    ;   ADD     #0C000h                 ;add round-off
        SACH    *-,0,AR2                ;save Feedbk to
voice,AR5=pFSerOff
;***    ;FSerOff - feedback series offset
        ;TEMP6=mod MULTI, INDX=Feedbk (reg),AR5=pFSerOff,ARP=AR2
        ;AR4=pFEED_C
        LACL    INDX                    ;ACCL=Feedbk reg value
    ;   ADD     #1                      ;weighting (feedback
increase)
```

```
        SUB     TEMP6                   ;ACCL=(Feedbk reg) - (MULTI
reg)
     ;     SUB            TEMP9
;ACCL=(Feedbk)-(MULTI)-(CONNECT)
        SACL    INDX                    ;update FSO index
        XC      2,LT                    ;if FSO index < 0
        SPLK    #0,INDX                 ;then FSO index = 0
        LAR     AR2,#FSO0               ;AR2=pFSO0 (Feedback Series
Offset)
        MAR     *0+                     ;AR2=pFSO(FEEDBK reg val)
        LACL    *,AR5                   ;ACCL=FSerOff
        SACL    *,0,AR4                 ;save FSerOff
        SBRK    #10h                    ;AR4=pON_OCTF
        MAR     *,AR3                   ;ARP=>AR3
;***    ;Level_C
        ;AR3=pLevl_M, ARP=>AR3, TEMP4=Key Scale#, AR4=pON_OCTF
     ;TEMP2=FNUM(h,l), TEMP3=BLOCK, PM=1
        CALL    LevelC                  ;call LevelC function
;***    ;S_LevlM
        ;AR3=pLevl_C, ARP=>AR3, TEMP4=Key Scale#, AR4=pON_OCTF
        SBRK    #2                      ;AR3=pS_LevlM
      ; MAR    *,AR1                ;ARP=>AR1
     MAR  *,AR5                ;ARP=>AR5
      ; LAR    AR5,*,AR5         ;AR5=pMULTI
     LAR  AR5,TEMP10            ;AR5=pMULTI(mod)
        ADRK    #60h                    ;AR5=pSUS_REL
        LACC    *,14,AR2                ;ACCH=SUS * 4 (w/junk)
        AND     #0003Ch,16              ;mask REL bits
        SACH    INDX                    ;INDX=Rel Rate (0-63)
        LAR     AR2,#Log64              ;AR2=pLog64
     NOP
        MAR     *0+                     ;AR2=pLog64(SUS)
        LACL    *,AR3                   ;ACCL=S_LevlM(SUS)
        SACL    *                       ;save S_LevlM
;***    ;S_LevlC
```

```
        ;AR3=pS_LevlM, ARP=>AR3, TEMP4=Key Scale#, AR4=pON_OCTF
        ADRK    #9                          ;AR3=pS_LevlC
      ; MAR    *,AR1                   ;ARP=>AR1
     MAR  *,AR5                  ;ARP=>AR5
      ; LAR    AR5,*,AR5          ;AR5=pMULTI
      ; ADRK   #63h               ;AR5=pSUS_REL (carrier)
     LAR  AR5,TEMP16             ;AR5=pMULTI(car)
     ADRK #60h               ;AR5=pSUS_REL (carrier)
        LACC    *,14,AR2                    ;ACCH=SUS * 4 (w/junk)
        AND     #0003Ch,16                  ;mask REL bits
        SACH    INDX                        ;INDX=Rel Rate (0-63)
        LAR     AR2,#Log64C                 ;AR2=pLog64
     NOP
        MAR     *0+                         ;AR2=pLog64(SUS)
        LACL    *,AR3                       ;ACCL=S_LevlC(SUS)
        SACL    *-                          ;save S_LevlC
;***    ;S_SlpeC - EG type 1=sustain
        ;AR3=pS_SlpeC, ARP=>AR3, TEMP4=Key Scale#, AR4=pON_OCTF
      ; MAR    *,AR1                   ;ARP=>AR1
     MAR  *,AR5                  ;ARP=>AR5
      ; LAR    AR5,*,AR5          ;AR5=pMULTI
      ; ADRK   #3                 ;AR5=pMULTI (carrier)
     LAR  AR5,TEMP16             ;AR5=pMULTI(car)
        LACL    #0                          ;ACCL=0
        BIT     *,10,AR3                    ;test EG Type Bit
        nop                                 ;XC pipeline
        XC      1,TC                        ;if EG  (carrier) = 1
        LACL    #1                          ;then S_SlpeC=1
        SACL    *                           ;save S_SlpeC
;***    ;S_SlpeM - EG type 1=sustain
        ;AR3=pS_SlpeC, ARP=>AR3, TEMP4=Key Scale#, AR4=pON_OCTF
        SBRK    #9                          ;AR3=pS_SlpeM
      ; MAR    *,AR1                   ;ARP=>AR1
     MAR  *,AR5                  ;ARP=>AR5
      ; LAR    AR5,*,AR5          ;AR5=pMULTI
```

```
      LAR  AR5,TEMP10          ;AR5=pMULTI(mod)
         LACL    #0                          ;ACCL=0
         BIT     *,10,AR3                    ;test EG Type Bit
         nop                                 ;XC pipeline
         XC      1,TC                        ;if EG  (carrier) = 1
         LACL    #1                          ;then S_SlpeM=1
         SACL    *                           ;save S_SlpeM
;***     ;ZMin1 - carrier oscillator filter output y(n-1)
         ;ARP=>AR3
         LAR     AR3,AR0
         ADRK    #ZMin1
         LACL    #0
         SACL    *
;***     ;ZMin1M - modulator oscillator filter output y(n-1)
         ;ARP=>AR3
         LAR     AR3,AR0
         ADRK    #ZMin1M
         LACL    #0
         SACL    *

;*****************************************************************
*******
         B       SYNTH_ENG                   ;Voice Allocation Done,
goto engine
;*****************************************************************
*******


;*****************************************************************
*******
;Note Update Routine
FLY_CHEK:
         LAR     AR1,#(A_Reg_0 + 1)          ;AR1=addr of reg status
table (pVoiceds)
         SPLK    #(A_Reg_17 + 5),ARCR        ;ARCR=addr of (1+last)
```

```
status (pVoiceds)
        MAR     *,AR1                   ;ARP=>AR1
        LACL    #4                      ;ACCL=4
        SACL    INDX                    ;INDX=4
        LACL    #0                      ;ACCL=0
        SACL    TEMP14                  ;TEMP14=0 (running update
count)
        LACL    #3                     ;ACCL=3  (max update count)
        SACL     TEMP15                     ;TEMP15=3 (max update
count)

;-----------------------------------------------------------------
-------
FRegLp  LACL     *                              ;test for voice
assignment=off=0
        SAR      AR1,AR5                     ;AR5=stat table ptr
(Voiceds)
        LAR     AR2,*0+,AR5             ;AR2=pVoiceds (or 0 if reg
assign=off)
        BCNDD   NxFReg,EQ               ;branch if reg. assign=off
        MAR      *+                         ;AR5=stat table ptr
(V_MULTI)
        MAR      *+,AR1                     ;AR5=stat table ptr
(V_FRQ_L)
     ;first setup TEMP10=pMULTI(mod),TEMP16=pMULTI(car)
     MAR  *,AR5
     MAR  *-              ;AR5=pV_MULTI
     LAR  AR3,*+,AR3           ;AR3=pMULTI(mod),AR5=pV_FRQ_L
     SAR  AR3,TEMP10           ;TEMP10=pMULTI(mod)
     ADRK #3              ;AR3=pMULTI(car) [NORMAL case]
     SAR  AR3,TEMP16           ;TEMP16=pMULTI(car)
     CALL ModCon3         ;correct TEMP10,16 for 4op connect=3

Asg_On  MAR     *,AR5
        ;check voice vs. registers for pitch related update
```

```
        LAR     AR3,*,AR3                   ;AR3=pFRQ_L
        LACL    *,AR2                       ;ACCL=FRQ_L reg value
        ADRK    #SFrq_L                     ;AR2=pSFrq_L
        SUB       *+,0,AR3                          ;(FRQ_L - shadow
FRQ_L),AR2=pSOn_OctF
        BCNDD   Pch_Upd,NEQ                 ;do pitch update if FRQ_L
not= SFrq_L
        ADRK    #10h                        ;AR3=pON_OCTF
        LACL    *,AR2                       ;ACCL=ON_OCTF value
        AND     #1Fh                        ;mask note-on bit
        SUB     *,0,AR1                     ;(ON_OCTF - SOn_OctF)
        BCND    Pch_Upd,NEQ                ;do pitch update if ON_OCTF
not=
SOn_OctF

        ;check voice vs. registers for level related update
     MAR  *,AR3                  ;ARp=>AR3
     LAR  AR3,TEMP10             ;AR3=pMULTI(mod)
        ADRK    #20h                        ;AR3=pLEVEL
        LACL    *,AR2                       ;ACCL=LEVEL reg value
        AND     #3Fh                        ;mask KSL bits
        ADRK    #3                          ;AR2=pMLevel
        SUB       *+,0,AR3                          ;(LEVEL - shadow
LEVEL),AR2=pCLevel
        BCNDD   LvM_Upd,NEQ                 ;do level update if LEVEL
not= MLevel
      ; ADRK   #3                 ;AR3=pLEVEL(carrier)
      ; nop
     LAR  AR3,TEMP16             ;AR3=pMULTI(car)
     ADRK #20h              ;AR3=pLEVEL(car)
        LACL    *,AR2                        ;ACCL=LEVEL(carrier) reg
value
        AND     #3Fh                        ;mask off KSL bits
        SUB     *,0,AR1                     ;(LEVEL(car) - CLevel)
        BCND    LvC_Upd,NEQ                ;do pitch update if ON_OCTF
```

```
not=
SOn_OctF
        ;ARP=>AR1,AR1=next (A_Reg_x + 1),AR5=present (pV_FRQ_L)
        ;TEMP14=running updt count,TEMP15=Max updt count,INDX=4
PchUpdRet:
        ;ARP=>AR1
NxFReg  CMPR    1                       ;set TC if AR1 < ARCR
        BCNDD   FlyDone,NTC             ;Done if AR1 not< ARCR
        CPL     #3,TEMP14               ;set TC if (update count)=3
        BCND    FRegLp,NTC              ;continue if (update count)
not= 3,
                                        ;else, note update done
FlyDone:
        B       SYNTH_ENG               ;Go to synth engine routine

;-----------------------------------------------------------------
-------
        ;pitch update routine, includes shadow reg update
        ;ARP=>AR1,AR1=next (A_Reg_x + 1),AR2=pSOn_OctF,AR5=present
(pV_FRQ_L)
        ;TEMP14=running updt count,TEMP15=Max updt count,INDX=4
     ;TEMP10=pMULTI(mod),TEMP16=pMULTI(car)
Pch_Upd SAR     AR1,TEMP11              ;TEMP11=next (A_Reg_x) + 1)
        SAR     AR2,TEMP12              ;TEMP12=pSON_OctF
        SAR     AR5,TEMP13              ;TEMP13=present (pV_FRQ_L)

        MAR     *,AR2                   ;ARp=>AR2
        SBRK    #SOn_OctF               ;AR2=pVoiceds
        SAR     AR2,AR0                 ;AR0=pVoiceds
        LACL    #1                      ;ACCL=1
        ADD     TEMP14                  ;update (note update count)
        SACL    TEMP14                  ;save (note update count)
        MAR     *,AR1                   ;ARP=>AR1
        SBRK    #2                      ;AR1=pV_FRQ_L
        LAR     AR4,*-                  ;AR4=pFRQ_L,AR1=pV_MULTI
```

```
;***    ;Nom_Pch
        ;AR4=pFRQ_L (and voice context)
        CALL    MNomPch          ;call Nom_Pch

        ;AR3=pPch_Step, ARP=>AR3 (and voice context)
        ADRK    #3                       ;AR3=pRun_Val
        MAR     *,AR5                    ;ARP=>AR5

     ;ARP=>AR5 ,AR4=pON_OCTF, AR2=pPScale(BLOCK), TEMP2=FNUM(h,l)
     ;AR5=pMULTI, INDX=pMScale0
        ;setup context for Nom_PchC
        ADRK    #3               ;AR5=pMULTI (carrier)

;*** ;Nom_PchC - calculate nominal pitch
     ;ARP=>AR5 ,AR4=pON_OCTF, AR2=pPScale(BLOCK), TEMP2=FNUM(h,l)
        ;AR5=pMULTI (carrier), INDX=pMScale0
        CALL    CNom_Pch                ;call carrier nominal pitch

        LACL    TEMP14                  ;ACCL=running update count
        SUB      TEMP15                       ;(max updt count) -
(running count)
        BCNDD   FlyDone,EQ               ;if = max updt count then
done

        ;restore note update context
        SPLK     #(A_Reg_17 + 5),ARCR     ;ARCR=addr of (1+last)
status (pVoiceds)
        LACL    #4                      ;ACCL=4
        SACL    INDX                    ;INDX=4
        LAR     AR1,TEMP11              ;AR1=next (A_Reg_x) + 1)
        LAR     AR2,TEMP12              ;AR2=pSON_OctF
        LAR     AR5,TEMP13              ;AR5=present (pV_FRQ_L)
        BD     PchUpdRet             ;return to note update control
        MAR     *,AR1                   ;ARP=>AR1
        NOP
```

```
;-----------------------------------------------------------------
-------
        ;Mod level update routine, includes shadow reg update
LvM_Upd:
     ;ARP=>AR1,AR1=next (A_Reg_x + 1),AR2=pCLevel,AR5=present
(pV_FRQ_L)
     ;ACC=LEVEL - MLevel
        ;TEMP14=running updt count,TEMP15=Max updt count,INDX=4
     ;TEMP10=pMULTI(mod),TEMP16=pMULTI(car)
        SAR     AR1,TEMP11              ;TEMP11=next (A_Reg_x) + 1)
     SAR  AR2,TEMP12           ;TEMP12=pCLevel
        SAR     AR5,TEMP13              ;TEMP13=present (pV_FRQ_L)

     ;Level update ramping for noise artifact reduction - add (or
     ; subtract 1) to 'old' level per new level; update shadow reg.
to
     ; sum (or difference) value, DO NOT affect opl register value.
     MAR  *,AR2                ;ARP=>AR2
     BCNDD     MRampUp,GT           ;ramp up if new > old
     MAR  *-              ;AR2=pMLevel
     LACL *               ;ACCL=MLevel (old shadow value)
     BD   LvM_Ctx         ;branch to context update setup
     SUB  #1              ;ACCL=new MLevel (and update LEVEL)
     SACL TREG0                ;TREG0= new MLevel (temp save)
MRampUp ADD    #1             ;ACCL= new MLevel (and Update Level)
     SACL TREG0                ;TREG0= new MLevel (temp save)

     ;set up context for level update
      ; MAR    *,AR2                ;ARp=>AR2
LvM_Ctx SBRK   #MLevel        ;AR2=pVoiceds
        SAR     AR2,AR0                 ;AR0=pVoiceds
        SAR     AR2,AR3                 ;AR3=pVoiceds
        LACL    #1                      ;ACCL=1
        ADD     TEMP14                 ;update (note update count)
        SACL    TEMP14                  ;save (note update count)
```

```
        MAR     *,AR1                   ;ARP=>AR1
        SBRK    #2                      ;AR1=pV_FRQ_L
        LAR     AR4,*-,AR4              ;AR4=pFRQ_L,AR1=pV_MULTI
        LACL    *                       ;ACCL=FRQ_L
        ADRK    #10h                    ;AR4=pON_OCTF

        ;setup TEMP2, TEMP3, TEMP6
      ; ADD    *,8,AR1         ;ACC=FNUM (w/junk)
     ADD  *,8,AR5         ;ACC=FNUM (w/junk)
     AND  #3FFh                ;ACC=FNUM(h,l)
     SACL TEMP2                ;TEMP2=FNUM (save for carrier calc)
      ; LAR    AR5,*,AR5       ;AR5=pMULTI(mod)
     LAR  AR5,TEMP10           ;AR5=pMULTI(mod)
        LAR         AR2,*,AR4                           ;AR2=MULTI
(w/junk),ARP=>AR4
        APL     #000Fh,AR2              ;AR2=MULTI
        SMMR    AR2,#TEMP6              ;TEMP6=mod MULTI
        LACC       *,13,AR3                            ;ACCH=BLOCK
(w/junk),ARP=>AR3
     AND  #0007,15        ;ACCH=BLOCK
     SACH TEMP3,1         ;TEMP3=BLOCK
        ADRK    #R_SlpeC                ;AR3=pR_SlpeC

;***    ;Level_M
        ;AR3=pR_SlpeC, ARP=>AR3, AR4=pON_OCTF
        ;TEMP2=FNUM(h,l), TEMP3=BLOCK, PM=1, TEMP6=mod MULTI
        SBRK    #19                     ;AR3=pMLevel (shadow reg)
      ; MAR    *,AR1                ;ARP=>AR1
     MAR  *,AR5                ;ARP=>AR5
      ; LAR    AR5,*,AR5       ;AR5=pMULTI
     LAR  AR5,TEMP10           ;AR5=pMULTI(mod)
     ADRK #20h            ;AR5=pLEVEL(mod)
      ; LACC   *,0,AR3         ;ACCL=LEVEL (w/junk)
     MAR  *,AR3                ;ARP=>AR3
     LACC TREG0,0         ;ACCL= modified LEVEL (new shadow val)
```

```
     CALL LevelMU        ;call LevelMU routine

     ;check update count
        LACL    TEMP14                  ;ACCL=running update count
        SUB      TEMP15                       ;(max updt count) -
(running count)
        BCNDD   FlyDone,EQ               ;if = max updt count then
done

        ;restore note update context
        SPLK     #(A_Reg_17 + 5),ARCR     ;ARCR=addr of (1+last)
status (pVoiceds)
        LACL    #4                      ;ACCL=4
        SACL    INDX                    ;INDX=4
        LAR     AR1,TEMP11              ;AR1=next (A_Reg_x) + 1)
        LAR     AR2,TEMP12              ;AR2=pSON_OctF
        LAR     AR5,TEMP13              ;AR5=present (pV_FRQ_L)
        BD       PchUpdRet                ;return to note update
control
        MAR     *,AR1                   ;ARP=>AR1
        NOP
;-----------------------------------------------------------------
-------
        ;Carrier level update routine, includes shadow reg update
LvC_Upd:
        ;ARP=>AR1,AR1=next (A_Reg_x + 1),AR2=pCLevel,AR5=present
(pV_FRQ_L)
     ;ACC=LEVEL(car) - CLevel
        ;TEMP14=running updt count,TEMP15=Max updt count,INDX=4
     ;TEMP10=pMULTI(mod),TEMP16=pMULTI(car)
        SAR     AR1,TEMP11              ;TEMP11=next (A_Reg_x) + 1)
     SAR  AR2,TEMP12           ;TEMP12=pCLevel
        SAR     AR5,TEMP13               ;TEMP13=present (pV_FRQ_L)

     ;Level update ramping for noise artifact reduction - add (or
```

```
     ; subtract 1) to 'old' level per new level; update shadow reg.
to
     ; sum (or difference) value, DO NOT affect opl register value.
     BCNDD     CRampUp,GT          ;ramp up if new > old
     MAR  *,AR2                ;ARP=>AR2
     LACL *               ;ACCL=CLevel (old shadow value)
     BD   LvC_Ctx         ;branch to context update setup
     SUB  #1              ;ACCL=new CLevel (and update LEVEL)
     SACL TREG0                ;TREG0= new CLevel (temp save)
CRampUp ADD    #1             ;ACCL= new CLevel (and Update Level)
     SACL TREG0                ;TREG0= new CLevel (temp save)

     ;set up context for level update
      ; MAR    *,AR2                ;ARp=>AR2
LvC_Ctx SBRK   #CLevel        ;AR2=pVoiceds
        SAR     AR2,AR0                  ;AR0=pVoiceds
        SAR     AR2,AR3                  ;AR3=pVoiceds
        LACL    #1                       ;ACCL=1
        ADD     TEMP14                  ;update (note update count)
        SACL    TEMP14                   ;save (note update count)
        MAR     *,AR1                    ;ARP=>AR1
        SBRK    #2                       ;AR1=pV_FRQ_L
        LAR     AR4,*-,AR4               ;AR4=pFRQ_L,AR1=pV_MULTI
        LACL    *                        ;ACCL=FRQ_L
        ADRK    #10h                     ;AR4=pON_OCTF

        ;setup TEMP2, TEMP3, TEMP6
      ; ADD    *,8,AR1          ;ACC=FNUM (w/junk)
     ADD  *,8,AR5         ;ACC=FNUM (w/junk)
     AND  #3FFh                ;ACC=FNUM(h,l)
     SACL TEMP2                ;TEMP2=FNUM (save for carrier calc)
      ; LAR    AR5,*,AR5        ;AR5=pMULTI
     LAR  AR5,TEMP10           ;AR5=pMULTI(mod)
        LAR         AR2,*,AR4                          ;AR2=MULTI
(w/junk),ARP=>AR4
```

```
        APL     #000Fh,AR2              ;AR2=MULTI
        SMMR    AR2,#TEMP6              ;TEMP6=mod MULTI
        LACC       *,13,AR3                          ;ACCH=BLOCK
(w/junk),ARP=>AR3
     AND  #0007,15        ;ACCH=BLOCK
     SACH TEMP3,1         ;TEMP3=BLOCK
        ADRK    #Level_M                ;AR3=pLevel_M

;***    ;Level_C
        ;AR3=pLevel_M, ARP=>AR3, AR4=pON_OCTF
     ;TEMP2=FNUM(h,l), TEMP3=BLOCK, PM=1

        SBRK     #1                          ;AR3=pCLevel (shadow
register)
      ; MAR    *,AR1                ;ARP=>AR1
     MAR  *,AR5                ;ARP=>AR5
      ; LAR    AR5,*,AR5         ;AR5=pMULTI
     LAR  AR5,TEMP16            ;AR5=pMULTI(car)
      ; ADRK   #23h             ;AR5=pLEVEL (carrier)
     ADRK #20h            ;AR5=pLEVEL (carrier)
      ; LACC   *,0,AR3          ;ACCL=LEVEL (w/junk)
     MAR  *,AR3                ;ARP=>AR3
     LACC TREG0,0         ;ACCL=update LEVEL (new shadow val)

     CALL LevelCU         ;call LevelC routine

     ;check update count
        LACL    TEMP14                  ;ACCL=running update count
        SUB      TEMP15                       ;(max updt count) -
(running count)
        BCNDD   FlyDone,EQ               ;if = max updt count then
done

        ;restore note update context
        SPLK     #(A_Reg_17 + 5),ARCR     ;ARCR=addr of (1+last)
```

```
status (pVoiceds)
        LACL    #4                      ;ACCL=4
        SACL    INDX                    ;INDX=4
        LAR     AR1,TEMP11              ;AR1=next (A_Reg_x) + 1)
        LAR     AR2,TEMP12              ;AR2=pSON_OctF
        LAR     AR5,TEMP13              ;AR5=present (pV_FRQ_L)
        BD       PchUpdRet                ;return to note update
control
        MAR     *,AR1                   ;ARP=>AR1
        NOP
;-----------------------------------------------------------------
-------

;-----------------------------------------------------------------
-------
;*****************************************************************
*******



;*****************************************************************
        ;process Rhythm Mode key events

;*****************************************************************
RHY_CHEK:
        ;chek for Rhythm mode on/off
        MAR     *,AR4           ;ARP=>AR4
        LAR      AR4,#D_RHYTH     ;AR4=addr of rhythm note on/off
registers
        BIT     *,10,AR1        ;chek rhythm mode reg value => TC
        BCNDD   RHY_ON,TC       ;branch if rhytm mode is on
        LAR     AR1,#Max_Mel    ;AR1=addr of Max_Mel (max# melodic
voices)
        nop
RHY_OFF:
```

```
        LACL    *+              ;ACCL=Max_Mel value
        SACL    *+              ;update Max_Vce=Max_Mel
        BD      FLY_CHEK        ;go process note-updates
        LACL    #0              ;ACCL=0
        SACL    *               ;init Rhy_Mode=0 (off)
RHY_ON:
        LACL    *+              ;ACCL=Max_Mel value
        SUB     #3              ;ACCL=(Max_Mel - 3)
        SACL    *+              ;update Max_Vce=(Max_Mel - 3)
        LACL    #1              ;ACCL=1
        SACL    *,0,AR4         ;init Rhy_Mode=1 (on)

;*****************************************************************
     ;Slam all Register Key-offs into Register key status
        ; DP=0,AR4=#D_RHYTH,ARP=>AR4

;*****************************************************************
        LAR     AR1,#A_Rhy_0    ;AR1=addr of Register Key Status
Table
     LACL #4         ;ACC=4
     SACL INDX       ;INDX=4
     LACL #1Fh       ;ACC=1Fh
     MAR  *,AR4          ;ARP=>AR4
KyOffLR BIT     *,11,AR4        ;test for note-on Bass Drum
        BCNDD   R0onLR,TC       ;branch if reg value=note-on
     MAR  *,AR4          ;ARP=>AR4
        BIT     *,12,AR1        ;test for note-on Snare
     SACL *          ;save note-off (1Fh) in Reg Status table
R0onLR  BCNDD   R1onLR,TC       ;branch if reg value=note-on
     MAR  *0+,AR4    ;AR1=pA_Reg_(n+1),ARP=>AR4
        BIT     *,13,AR1        ;test for note-on Tom Tom
     SACL *          ;save note-off (1Fh) in Reg Status table
R1onLR  BCNDD   R2onLR,TC       ;branch if reg value=note-on
     MAR  *0+,AR4    ;AR1=pA_Reg_(n+1),ARP=>AR4
        BIT     *,14,AR1        ;test for note-on Cymbal
```

```
     SACL *          ;save note-off (1Fh) in Reg Status table
R2onLR  BCNDD   R3onLR,TC       ;branch if reg value=note-on
     MAR  *0+,AR4    ;AR1=pA_Reg_(n+1),ARP=>AR4
        BIT     *,15,AR1        ;test for note-on Hi Hat
     SACL *          ;save note-off (1Fh) in Reg Status table
R3onLR  BCNDD   R4onLR,TC       ;branch if reg value=note-on
        MAR     *0+,AR1         ;AR1=pA_Reg_(n+1),ARP=>AR1
        nop                     ;delayed branch pipeline
     SACL *          ;save note-off (1Fh) in Reg Status table
R4onLR  MAR     *,AR4           ;ARP=AR4

;*************************************************************
        ;Check Cheezy Rhythmic Voices for Note-on events
     ; DP=0, INDX=4
        ; AR4=#D_RHYTH,ARP=>AR4

;*************************************************************
        LAR     AR1,#A_Rhy_0     ;AR1=addr of Register Key Status
Table
        LACL    #3Fh            ;ACCL=3Fh
        SACL    TEMP1           ;TEMP1=3Fh
KyOnLR  LACC    *,1,AR1         ;ACC=D_RHYTH reg. value ,ARP=>AR1
        AND     TEMP1          ;mask vibr. and RHY bit, prev. perc
bit
        SUB      *0+,0,AR4        ;ACC=[D_RHYTH - (note-on status
1Fh=off)]
        BCNDD   Kick_On,GT       ;Branch if Reg Stat=off and Reg
Val=on
     LACC *,2,AR1   ;ACC=D_RHYTH reg. value ,ARP=>AR1
        AND     TEMP1           ;mask prev. perc bit
        SUB      *0+,0,AR4        ;ACC=[D_RHYTH - (note-on status
1Fh=off)]
        BCNDD   Snre_On,GT       ;Branch if Reg Stat=off and Reg
Val=on
     LACC *,3,AR1   ;ACC=D_RHYTH reg. value ,ARP=>AR1
```

```
        AND     TEMP1           ;mask prev. perc bit
        SUB      *0+,0,AR4       ;ACC=[D_RHYTH - (note-on status
1Fh=off)]
        BCNDD   Tomm_On,GT      ;Branch if Reg Stat=off and Reg
Val=on
     LACC *,4,AR1   ;ACC=D_RHYTH reg. value ,ARP=>AR1
        AND     TEMP1           ;mask prev. perc bit
        SUB      *0+,0,AR4       ;ACC=[D_RHYTH - (note-on status
1Fh=off)]
        BCNDD   Cymb_On,GT      ;Branch if Reg Stat=off and Reg
Val=on
     LACC *,5,AR1   ;ACC=D_RHYTH reg. value ,ARP=>AR1
        AND     TEMP1           ;mask prev. perc bit
        SUB      *0+,0,AR4       ;ACC=[D_RHYTH - (note-on status
1Fh=off)]
        BCND    HHat_On,GT      ;Branch if Reg Stat=off and Reg
Val=on
        B       FLY_CHEK        ;no rhythm note-ons, go process
note-updates
;*****************************************************************
*********
Kick_On:
        ;setup voice init context for KICK drum
        LAR     AR0,#Voice18    ;AR0=pVoiceds
        LAR     AR1,#A_Rhy_0    ;AR1=pA_Rhy_0
        MAR     *,AR1           ;ARP=>AR1
        LACL    #90h            ;ACCL=90h
        SACL    *               ;note-on status 90h into Reg table
        ADRK    #3              ;AR1=pV_FRQ_L
     LAR  AR4,*-         ;AR4=pFRQ_L,AR1=pV_MULTI
     ;setup TEMP10=pMULTI(mod),TEMP16=pMULTI(car)
     LAR  AR3,*,AR3      ;AR3=pMULTI(mod),AR5=pV_FRQ_L
     SAR  AR3,TEMP10          ;TEMP10=pMULTI(mod)
     ADRK #3             ;AR3=pMULTI(car) [NORMAL case]
     SAR  AR3,TEMP16          ;TEMP16=pMULTI(car)
```

```
        ;Pre-process  kick  register  values  for  correlation
refinement
     MAR  *,AR4
     ADRK #20h        ;AR4=pFEED_C
     BIT  *,12        ;test msb of feedback value
     NOP              ;xc pipeline
     XC   2,TC        ;if msb of feedback reg is not set, then
     OPL  #0006h,*    ;set 2 lsb's of mod feedback val
     SBRK #20h        ;AR4=pFRQ_L

     MAR  *,AR1            ;ARp=>AR1
        LAR      AR2,*,AR2        ;AR2=pMULTI
      ; OPL      #0001h,*,AR2     ;set bit 0 of mod MULTI reg val

        ADRK     #40h             ;AR2=pATK_DKY
     LACL *          ;ACCL=mod ATK_DKY reg value
        AND      #000Fh           ;ACCL=DKY reg value
     SUB  #1         ;decrease decay by 1
        nop                       ;xc pipeline
        XC       1,LT             ;check for lower boundary
        LACL     #0               ;ACCL= modified mod decay level
        SACL     TEMP1            ;TEMP1=modified mod decay level
        LACL     *                ;ACCL=ATK_DKY reg value
        AND      #00F0h           ;ACCL=ATK reg value
        OR       TEMP1            ;concat w/ decay
        SACL     *                ;save modified ATK_DKY

        ADRK     #20h             ;AR2=pSUS_REL
     LACL *          ;ACCL=mod SUS_REL reg value
        AND      #000Fh           ;ACCL=REL reg value
        SUB      #2               ;decrease REL by 1
        nop                       ;xc pipeline
        XC       1,LT             ;check for lower boundary
        LACL     #0               ;ACCL= modified mod REL level
        SACL     TEMP1            ;TEMP1=modified mod REL level
```

```
        LACL    *               ;ACCL=SUS_REL reg value
        AND     #00F0h          ;ACCL=SUS reg value
        OR      TEMP1           ;concat w/ REL
        SACL    *               ;save modified SUS_REL

        SBRK    #3dh            ;AR2=pLEVEL(carrier)
        LACL    *               ;ACCL=LEVEL reg value
        AND     #003Fh          ;ACCL=LEVEL reg value
        SUB     #16             ;increase LEVEL by #
        nop                     ;xc pipeline
        XC      1,LT            ;check for lower boundary
        LACL    #0              ;ACCL= modified mod REL level
        SACL    TEMP1           ;TEMP1=modified mod REL level
        LACL    *               ;ACCL=LEVEL reg value
        AND     #00C0h          ;ACCL=KSL reg value
        OR      TEMP1           ;concat w/ LEVEL
        SACL    *               ;save modified LEVEL(carrier)

PERC_IN:
;***    ;EMode
        LAR     AR2,AR0         ;AR2=pVoiceds
     MAR  *,AR2           ;ARp=>AR2
     ADRK #EMode          ;AR2=pEMode
        SPLK    #1,*,AR1        ;EMODE=1,ARP=>AR1

;***    ;Nom_Pch
        ;AR4=pFRQ_L (and voice context)
        CALL    MNomPch         ;call Nom_Pch

;***    Run_Val
        ;AR3=pPch_Step, ARP=>AR3 (and voice context)
        CALL    MRun_Val        ;call Run_Val
     ;ARP=>AR5 ,AR4=pON_OCTF, AR2=pPScale(BLOCK), TEMP2=FNUM(h,l)
     ;AR5=pMULTI, INDX=pMScale0
```

```
        ;setup context for Nom_PchC
        ADRK    #3              ;AR5=pMULTI (carrier)

;*** ;Nom_PchC - calculate nominal pitch
     ;ARP=>AR5 ,AR4=pON_OCTF, AR2=pPScale(BLOCK), TEMP2=FNUM(h,l)
        ;AR5=pMULTI (carrier), INDX=pMScale0
        CALL    CNom_Pch                ;call carrier nominal pitch

;*** ;Run_ValC - zero initial TableOffset.Frac
     ;AR3=pPch_StpC, ARP=>AR3
        CALL    CRun_Val                ;init Run_ValC
        ;AR3=pTblBaseC, ARP=>AR3
        B       KIK_PERC                ;finish carrier percussive
voice
;*****************************************************************
*********
Snre_On:
     ;setup voice init context for SNARE drum
     LAR  AR0,#Voice19   ;AR0=pVoiceds
     LAR  AR1,#A_Rhy_1   ;AR1=pA_Rhy_1
        MAR     *,AR1           ;ARP=>AR1
        LACL    #90h            ;ACCL=90h
        SACL    *               ;note-on status 90h into Reg table
        ADRK    #3              ;AR1=pV_FRQ_L
     LAR  AR4,*-         ;AR4=pFRQ_L,AR1=pV_MULTI
     ;setup TEMP10=pMULTI(mod),TEMP16=pMULTI(car)
     LAR  AR3,*,AR3      ;AR3=pMULTI(mod),AR5=pV_FRQ_L
     SAR  AR3,TEMP10         ;TEMP10=pMULTI(mod)
     ADRK #3             ;AR3=pMULTI(car) [NORMAL case]
     SAR  AR3,TEMP16         ;TEMP16=pMULTI(car)
     MAR  *,AR4              ;ARP=>AR4
     B    PERC_IN   ;continue snare voice init

Tomm_On:
     ;setup voice init context for TOM drum
```

```
    LAR  AR0,#Voice20   ;AR0=pVoiceds
    LAR  AR1,#A_Rhy_2   ;AR1=pA_Rhy_2
       MAR     *,AR1            ;ARP=>AR1
       LACL    #90h             ;ACCL=90h
       SACL    *               ;note-on status 90h into Reg table
       ADRK    #3               ;AR1=pV_FRQ_L
    LAR  AR4,*-         ;AR4=pFRQ_L,AR1=pV_MULTI
    ;setup TEMP10=pMULTI(mod),TEMP16=pMULTI(car)
    LAR  AR3,*,AR3      ;AR3=pMULTI(mod),AR5=pV_FRQ_L
    SAR  AR3,TEMP10          ;TEMP10=pMULTI(mod)
    ADRK #3             ;AR3=pMULTI(car) [NORMAL case]
    SAR  AR3,TEMP16          ;TEMP16=pMULTI(car)
    MAR  *,AR4               ;ARP=>AR4
    B    PERC_IN   ;continue snare voice init

Cymb_On:
    ;setup voice init context for SNARE drum
    LAR  AR0,#Voice21   ;AR0=pVoiceds
    LAR  AR1,#A_Rhy_3   ;AR1=pA_Rhy_1
       MAR     *,AR1            ;ARP=>AR1
       LACL    #90h             ;ACCL=90h
       SACL    *               ;note-on status 90h into Reg table
       ADRK    #3               ;AR1=pV_FRQ_L
    LAR  AR4,*-         ;AR4=pFRQ_L,AR1=pV_MULTI
    ;setup TEMP10=pMULTI(mod),TEMP16=pMULTI(car)
    LAR  AR3,*,AR3      ;AR3=pMULTI(mod),AR5=pV_FRQ_L
    SAR  AR3,TEMP10          ;TEMP10=pMULTI(mod)
    ADRK #3             ;AR3=pMULTI(car) [NORMAL case]
    SAR  AR3,TEMP16          ;TEMP16=pMULTI(car)
    MAR  *,AR4               ;ARP=>AR4
    B    PERC_IN   ;continue snare voice init

HHat_On:
    ;setup voice init context for SNARE drum
    LAR  AR0,#Voice22   ;AR0=pVoiceds
```

```
    LAR  AR1,#A_Rhy_4    ;AR1=pA_Rhy_4
       MAR     *,AR1            ;ARP=>AR1
       LACL    #90h             ;ACCL=90h
       SACL    *               ;note-on status 90h into Reg table
       ADRK    #3               ;AR1=pV_FRQ_L
    LAR  AR4,*-          ;AR4=pFRQ_L,AR1=pV_MULTI
    ;setup TEMP10=pMULTI(mod),TEMP16=pMULTI(car)
    LAR  AR3,*,AR3       ;AR3=pMULTI(mod),AR5=pV_FRQ_L
    SAR  AR3,TEMP10           ;TEMP10=pMULTI(mod)
    ADRK #3              ;AR3=pMULTI(car) [NORMAL case]
    SAR  AR3,TEMP16           ;TEMP16=pMULTI(car)
    MAR  *,AR4                ;ARP=>AR4
    B    PERC_IN   ;continue snare voice init
;*****************************************************************
*********


;*****************************************************************
*********
;Nom_Pch function
;*****************************************************************
*********
MNomPch:
        MAR     *,AR4                    ;ARP=>AR4
;***    ;Nom_Pch - calculate nominal pitch
        ;update SFrq_l and SOn_OctF shdw regs
        ;ARP=>AR4 ,AR4=pFRQ_L   (and voice context)
        LAR     AR2,AR0                  ;AR2=pVoiceds
        LACL    *,AR2                    ;ACCL=FRQ_L
        ADRK     #SFrq_L                       ;AR2=pSFrq_L shadow
register
        SACL     *+,0,AR4                      ;update SFrq_L shdw
reg,AR2=pSOn_OctF
     ADRK #10h           ;AR4=pON_OCTF
        LAR     AR5,*                    ;AR5=ON_OCTF reg value
```

```
        APL      #1Fh,AR5                    ;mask note-on bit from
shadow value
        ADD      *,8,AR2                    ;ACC=FNUM (w/junk)
     SPLK #MScale0,INDX        ;INDX=pMScale0
      ; SAR    AR5,*,AR1       ;update SOn_OctF shdw register
     SAR  AR5,*,AR5       ;update SOn_OctF shdw register
      ; LAR    AR5,*,AR5       ;AR5=pMULTI
     LAR  AR5,TEMP10           ;AR5=pMULTI(mod)
     LAR  AR3,*,AR3       ;AR3=MULTI (w/junk)
     APL  #000Fh,AR3           ;AR3=MULTI
        SMMR    AR3,#TEMP6                 ;TEMP6=mod MULTI
     AND  #3FFh                ;ACC=FNUM(h,l)
     SACL TREG0                ;TREG0=FNUM(h,l)
     SACL TEMP2                ;TEMP2=FNUM (save for carrier calc)
     MAR  *0+             ;AR3=pMScale(MULTI)
     MPY  *,AR3                ;PREG=MScale(MULTI) * FNUM
     SPL  TREG0                ;TREG0=MScale(MULTI) * FNUM
     LAR  AR3,#Mas_Ptch        ;AR3=pMas_Ptch
     MPYU *,AR4                ;apply master pitch
     SPH  TREG0                ;TREG0=MScale(MULTI)*FNUM*Mas_Ptch
     LACC *,13,AR3        ;ACCH=BLOCK (w/junk)
     AND  #0007,15        ;ACCH=BLOCK
     SACH TEMP3,1         ;TEMP3=BLOCK
     ADD  #PScale0,15          ;ACCH=pPScale(BLOCK)
     SACH AR2,1                ;AR2=pPScale(BLOCK)
     LAR  AR3,AR0         ;AR3=pVoiceds
     ADRK #Nom_Pch        ;AR3=pNom_Pch
     MAR  *,AR2
     MPYU *,AR3                ;apply PScale
     PAC                  ;ACCH=MScale*FNUM*Mas_Ptch*PScale
        RETD                           ;return to calling function
        SACH          *+,3,AR3
;Nom_Pch=(PitchInt.PitchFrac) Q10
        SACH          *,3,ar3
;Pch_Step=(PitchInt.PitchFrac) Q10
```

```
;*****************************************************************
*********


;*****************************************************************
*********
;*** ;Run_Val - zero initial TableOffset.Frac
        ;AR3=pPch_Step, ARP=>AR3 (and voice context)
;*****************************************************************
*********
MRun_Val:
     LACL #0              ;ACCL=0
        RETD                          ;return to calling function
     ADRK #3              ;AR3=pRun_Val
     SACL *,0,AR5         ;Run_Val=0
;*****************************************************************
*********


;*****************************************************************
*********
;*** ;Nom_PchC - calculate nominal pitch
     ;ARP=>AR5 ,AR4=pON_OCTF, AR2=pPScale(BLOCK), TEMP2=FNUM(h,l)
     ;INDX=pMScale0   (and voice context)
;*****************************************************************
*********
CNom_Pch:
     LAR  AR5,TEMP16          ;AR5=pMULTI (carrier)
     LAR  AR3,*,AR3       ;AR3=MULTI (w/junk)
     APL  #000Fh,AR3          ;AR3=MULTI
     LT   TEMP2               ;TREG0=FNUM(h,l)
     NOP                  ;pipeline prot (AR3 mm write)
     MAR  *0+             ;AR3=pMScale(MULTI)
     MPY  *,AR3               ;PREG=MScale(MULTI) * FNUM
     SPL  TREG0               ;TREG0=MScale(MULTI) * FNUM
```

```
    LAR  AR3,#Mas_Ptch        ;AR3=pMas_Ptch
    MPYU *,AR3                ;apply master pitch
    SPH  TREG0                ;TREG0=MScale(MULTI)*FNUM*Mas_Ptch
    LAR  AR3,AR0          ;AR3=pVoiceds
    ADRK #Nom_PchC        ;AR3=pNom_PchC
    MAR  *,AR2                ;ARP=>AR2
    MPYU *,AR3                ;apply PScale
    PAC                   ;ACCH=MScale*FNUM*Mas_Ptch*PScale
       RETD                           ;return to calling function
       SACH          *+,3,AR3
;Nom_PchC=(PitchInt.PitchFrac) Q10
       SACH          *,3,ar3
;Pch_StpC=(PitchInt.PitchFrac) Q10
;*************************************************************
*********


;*************************************************************
*********
;***    ;Run_ValC - zero initial .Frac (Q15)
     ;AR3=pPch_StpC, ARP=>AR3
;*************************************************************
*********
CRun_Val:
     LACL #0              ;ACCL=0
        RETD                          ;return to calling function
     ADRK #3              ;AR3=pRun_ValC
        SACL    *+                      ;Run_ValC=0,AR3=pTblBaseC
;*************************************************************
*********


;*************************************************************
```

```
*********
;***    ;Level_M - Modulation Level
        ;AR3=pR_SlpeC, ARP=>AR3, TEMP4=Key Scale#, AR4=pON_OCTF
        ;TEMP2=FNUM(h,1), TEMP3=BLOCK, PM=1, TEMP6=mod MULTI
;*************************************************************
*********
LevelM:
        SBRK    #19                     ;AR3=pMLevel (shadow reg)
     ;    MAR  *,AR1                ;ARP=>AR1
     MAR  *,AR5                ;ARP=>AR5
     ;    LAR  AR5,*,AR5       ;AR5=pMULTI
     LAR  AR5,TEMP10           ;AR5=pMULTI(mod)
        ADRK    #20h                    ;AR5=pLEVEL
     LACC *,0,AR3         ;ACCL=LEVEL (w/junk)
LevelMU:                  ;update entry point
        AND     #0003Fh                 ;mask KSL bits
     SACL *+              ;MLevel updated
     MAR  *+,AR2               ;AR3=pLevel_M,ARP=>AR2
        SACL    INDX                    ;INDX=LEVEL (0-63)
        SACL    TEMP8                   ;TEMP8=LEVEL (0-63)
        LAR     AR2,#Log64              ;AR2=pLog64
     NOP
        MAR     *0+                     ;AR2=pLog64(LEVEL)
     LACL *,AR5                ;ACCL=Level_M(LEVEL)
     SACL TEMP7                ;TEMP7=Level_M(LEVEL)
     ;Calculate and apply Mod KSL to Level_M
     LACC TEMP2,10        ;ACCH=FNUM (four MSB's)
     SACH INDX            ;INDX=FNUM (four MSB's)
     ;  LAR     AR2,#Y0ksl0             ;AR2=pY0ksl0 factor

        LACC    #0Ch,15                ;ACCH=0006h (ksl max limit)
        SACB                           ;ACCB=0006h (ksl max limit)
       ;LACC    *,11                    ;ACCH,3=KSL*16 (w/junk)
        LACC    *,11,AR2                ;ACCH,3=KSL*16 (w/junk)
      ; ADD     TEMP6,15                ;add mod MULTI ksl bias
```

```
        ADD     TEMP6,14                ;add mod MULTI ksl bias
        CRLT                            ;apply max KSL boundary
        AND     #00F0h,13               ;ACCH,3=KSL*16
        SACH    TREG0                   ;TREG0=biased KSL*2
        ADD     #Y0ksl0,13              ;ACCH,3=KSL*16 + #Y0ksl0
        SACH    AR2,3                   ;AR2=pY(ksl)ksl0

       ;LACC    *,9,AR2                 ;ACCH=KSL,1
        LACC    TREG0,14                ;ACCH=KSL,1

     ADD  #KSL_0,15        ;ACCH=KSL select address,1
     SACH AR5,1                ;AR5=pKSL_(KSL)
        MAR     *0+,AR5                 ;AR2=pY3ksl(FNUM)
     LACL TEMP3                ;ACCL=BLOCK
        ADD     *,0,AR2                ;ACCL=pKslxxOct(KSL,BLOCK)
     SACL AR5              ;AR5=pKslxxOct(KSL,BLOCK)
        LT      *,AR5                   ;TREG0=Y3ksl(FNUM)
     NOP                   ;pipeline (AR5 MM write)
     MPYU *,AR5
;PREG=KslxxOct(KSL,BLOCK)*Y3ksl(FNUM)
     ;  SPH     TREG0                   ;TREG0=(KSL Scale) Q13
        PAC                            ;ACCH= unshifted KSL scale
        SACH    TREG0,4                 ;TREG0=(KSL Scale) Q13
        MPYU    TEMP7                   ;apply KSL Scale

        ; Correlation fix - post KSL amplitude scale
        SPH     TREG0                   ;prep for level scaling
        MPY     #4228h                 ;1.034 (q14) * Levl_M (amp.
scale)
     SAR  AR0,AR5          ;AR5=pVoiceds
        PAC                             ;ACC=scaled Level_M,3
        SFL                             ;ACC=scaled Level_M,2
     ADRK #Level_MN        ;AR5=pLevel_MN (nominal level)
      ; PAC                            ;ACC=scaled Level_M,2
     SACH TREG0,2          ;TEMP save Level_M
```

```
    SUB  #3FFFh,15        ;Test for overflow
    NOP                   ;XC pipeline prot.
    XC   2,GT             ;if overflow,
    SPLK #7FFFh,TREG0          ;then Level_M=7FFFh (max)
    nop              ;pipeline protect????
    nop              ;pipeline protect????
    LACL TREG0                 ;ACC1=Level_M
    RETD                  ;return to calling function
    SACL *,0,AR3          ;update Level_MN
    SACL *                ;update Level_M
;*****************************************************************
*********


;*****************************************************************
*********
;***     ;Level_C
        ;AR3=pLevel_M, ARP=>AR3, TEMP4=Key Scale#, AR4=pON_OCTF
     ;TEMP2=FNUM(h,l), TEMP3=BLOCK, PM=1
;*****************************************************************
*********
LevelC:
        SBRK     #1                          ;AR3=pCLevel (shadow
register)
      ; MAR    *,AR1                ;ARP=>AR1
     MAR  *,AR5                ;ARP=>AR5
      ; LAR    AR5,*,AR5         ;AR5=pMULTI
     LAR  AR5,TEMP16            ;AR5=pMULTI(car)
      ; ADRK   #23h             ;AR5=pLEVEL (carrier)
     ADRK #20h             ;AR5=pLEVEL (carrier)
     LACC *,0,AR3          ;ACCL=LEVEL (w/junk)
 LevelCU:                  ;Level update entry point
         AND      #0003Fh                  ;mask KSL bits
     SACL *                ;CLevel updated
```

```
ADRK #10                ;AR3=pLevel_C
   SACL    INDX                        ;INDX=Rel Rate (0-63)
   LAR     AR2,#Log64C                 ;AR2=pLog64
MAR  *,AR2                  ;ARP=AR2
   MAR     *0+                         ;AR2=pLog64(LEVEL)
 ; LACL   *,AR3                  ;ACCL=Level_C(LEVEL)
 ; SACL   *                    ;save Level_C
LACL *,AR5                    ;ACCL=Level_C(LEVEL)
SACL TEMP7                    ;TEMP7=Level_C(LEVEL)
;Calculate and apply Car KSL to Level_C
LACC TEMP2,10          ;ACCH=FNUM (four MSB's)
SACH INDX              ;INDX=FNUM (four MSB's)
 ; LAR     AR2,#Y0ksl0                 ;AR2=pY0ksl0 factor
   LACC    *,13                        ;ACCH,1=KSL*16 (w/junk)
   AND     #00F0h,15                   ;ACCH,1=KSL*16
   ADD     #Y0ksl0,15                  ;ACCH,1=KSL*16 + #Y0ksl0
   SACH    AR2,1                       ;AR2=pY(ksl)ksl0
LACC *,9,AR2           ;ACCH=KSL,1
ADD  #KSL_0,15         ;ACCH=KSL select address,1
SACH AR5,1                  ;AR5=pKSL_(KSL)
   MAR     *0+,AR5                     ;AR2=pY3ksl(FNUM)
LACL TEMP3                  ;ACCL=BLOCK
ADD  *,0,AR2           ;ACCL=pKslxxOct(KSL,BLOCK)
SACL AR5               ;AR5=pKslxxOct(KSL,BLOCK)
   LT      *,AR5                       ;TREG0=Y3ksl(FNUM)
NOP                    ;pipeline (AR5 MM write)
MPYU *,AR5
;PREG=KslxxOct(KSL,BLOCK)*Y3ksl(FNUM)
 ;  SPH     TREG0                      ;TREG0=(KSL Scale) Q13
    PAC                                ;ACCH= unshifted KSL scale
 SAR  AR0,AR5          ;AR5=pVoiceds
    SACH    TREG0,4                    ;TREG0=(KSL Scale) Q13
    MPYU    TEMP7                      ;apply KSL Scale
 PAC                   ;ACC=scaled Level_M,2
 ADRK #Level_CN        ;AR5=pLevel_CN (nominal level)
```

```
    SACH TREG0,2          ;TEMP save Level_C
    SUB  #3FFFh,15        ;Test for overflow
    NOP                   ;XC pipeline prot.
    XC   2,GT             ;if overflow,
    SPLK #7FFFh,TREG0          ;then Level_C=7FFFh (max)
    nop              ;pipeline protect????
    nop              ;pipeline protect????
    LACL TREG0                 ;ACC1=Level_C
    RETD                  ;return to calling function
    SACL *,0,AR3          ;update Level_CN
    SACL *                ;update Level_C
;*****************************************************************
*********


;*****************************************************************
*********
     ;ModCon3 - fix TEMP10 and TEMP16 for 4op connect=3
     ;AR5=pV_FRQ_L
     ;modifies AR3,AR4
     ;find 4-op half (if 4op voice)
;*****************************************************************
*********
ModCon3:
     MAR  *,AR5
     LACL *,AR3                ;ACCL=pFRQ_L(current)
     SACL DBMR            ;DBMR=pFRQ_L(current)
     LAR  AR3,AR5         ;AR3=pV_FRQ_L
     ADRK #12             ;AR3=pV_FRQ_L(current+3)
     CPL  *               ;pFRQ_L(current+3)-pFRQ_L(current)
     BCND H1m4op,TC       ;branch to half 1 if equal
     SBRK #24             ;AR3=pV_FRQ_L(current-3)
     CPL  *               ;pFRQ_L(current-3)-pFRQ_L(current)
     BCND VModNrm,NTC          ;do normal 2op if not equal
```

```
    ;Osc pair is Half2 of a 4 oscillator voice
H2m4op:
    LAR  AR4,*,AR4        ;AR4=pFRQ_L(base)
    ADRK #20h             ;AR4=pFEED_C(base)
    LAR  AR3,AR4          ;AR3=pFEED_C(base)
    MAR  *,AR3                 ;ARp=>AR3
    ADRK #3               ;AR3=pFEED_C(+3)
    BIT  *,15,AR4         ;check connect(+3) bit
    BCND H2mC13,TC        ;branch if connect = 1 or 3
H2mC02:
    B    VModNrm
H2mC13:
    BIT  *,15             ;check connect(0) bit
    BCND H2mC3,TC         ;branch if connect = 3
H2mC1:
    B    VModNrm            ;TEMPORARY!!
H2mC3:
    LACL TEMP10                ;ACCL=pMULTI(mod)
    SACL TEMP16                ;update pMULTI(car)
    RETD                  ;return to calling function
    SUB  #5               ;prep pMULTI(mod)
    SACL TEMP10

    ;Osc pair is Half1 of a 4 oscillator voice
H1m4op:
    LAR  AR4,*,AR4        ;AR4=pFRQ_L(base)
    ADRK #20h             ;AR4=pFEED_C(base)
    LAR  AR3,AR4          ;AR3=pFEED_C(base)
    MAR  *,AR3                 ;ARp=>AR3
    ADRK #3               ;AR3=pFEED_C(+3)
    BIT  *,15,AR4         ;check connect(+3) bit
    BCND H1mC13,TC        ;branch if connect = 1 or 3
H1mC02:
    B    VModNrm
H1mC13:
```

```
     BIT  *,15            ;check connect(0) bit
     BCND H1mC3,TC        ;branch if connect = 3
H1mC1:
     B    VModNrm
H1mC3:
     LACL TEMP10               ;ACCL=pMULTI(mod)
     ADD  #11             ;switch to op #4
     RETD                 ;return to calling function
     SACL TEMP16               ;update pMULTI(car)
     nop
VModNrm:
     RET
;*****************************************************************
*********
```

What is claimed is:

1. A method for generating an audio signal, comprising:

selecting waveform spectral values, generating a composite waveform representative of an audio signal using said selected values, generating noise spectral values, and combining said noise spectral values and said composite waveform to provide a waveform representative of an audio signal.

2. The method of claim 1, further comprising, interpolating between said selected waveform spectral values.

3. The method of claim 1, further comprising, scaling the amplitude of said waveform spectral values.

4. The method of claim 1, further comprising, scaling the amplitude of said composite waveform.

5. The method of claim 1, further comprising, scaling the amplitude of said noise spectral values.

6. The method of claim 1, further comprising, receiving a preselected number of input signals, and generating a preselected number of control signals from said preselected input signals.

7. The method of claim 6, wherein said selecting values comprises, selecting a modulator envelope type as a function of one of said control signals.

8. The method of claim 7, wherein said selecting values comprises, selecting a carrier envelope type as a function of one of said control signals.

9. The method of claim 8, wherein said selecting values comprises, selecting modulator spectral values as a function of a portion of said control signals, and further comprising, interpolating said selected modulator spectral values as a function of a portion of said control signals and said selected modulator envelope.

10. The method of claim 9, further comprising, generating carrier spectral values as a function of a portion of said control signals and said selected carrier envelope.

11. The method of claim 10, wherein said generating a composite waveform comprises, generating a carrier amplitude as a function of a portion of said control signals.

12. The method of claim 11, wherein said generating a composite waveform comprises, adding the carrier amplitude and interpolated modulator spectral values.

13. The method of claim 12, wherein said generating a composite waveform comprises, multiplying the sum of the carrier amplitude and interpolated modulator spectral values by carrier waveform spectral values.

14. The method of claim 13, wherein said generating a composite waveform comprises, multiplying the multiplied sum of the carrier and modulator spectral values by a carrier envelop amplitude to provide said composite waveform.

15. The method of claim 14, further comprising, performing the foregoing method steps for each of a preselected number of audio signals.

16. The method of claim 15, further comprising, summing the preselected audio signals.

17. A method for emulating an audio signal, comprising:

determining harmonic sideband spectral values as a function of modulation indices, calculating carrier waveform spectral values, combining said harmonic sideband and carrier spectral values to provide a composite carrier and modulator waveform, scaling said combined waveform, generating white noise values, and combining said white noise values with said scaled combined waveform as a function of preselected control parameters to provide a waveform representative of an audio signal.

18. The method of claim 17, wherein said scaling comprises, scaling said combined waveform based upon a carrier envelope amplitude.

19. The method of claim 18, further comprising, calculating LFO spectral and amplitude values.

20. The method of claim 19, further comprising, combining LFO values with said scaled combined waveform.

21. A method for synthesizing audio signals, comprising:

selecting complex periodic waveform spectral values stored in a memory, interpolating between said selected values, generating a composite waveform using said interpolated values, scaling the amplitude of said composite waveform, generating noise spectral values, and combining said noise spectral values and composite waveform to provide spectral values for audio signals.

22. A system for generating audio signals, comprising:

a host processor, a memory for storing at least tables of spectral values, a digital signal processor connected to said host processor and memory for generating digital signals representative of audio signals using said tables of spectral values, wherein said digital signal processor is programmed for selecting said waveform spectral values, generating a composite waveform using said selected values, generating noise spectral values, and combining said noise spectral values and composite waveforms to provide said distal signals representative of audio signals;

a digital to analog circuit connected to said digital signal processor for converting said digital signals to analog signals, and a sound system connected to said digital to analog circuit.

23. Apparatus for generating audio signals, comprising:

a digital signal processor programmed for selecting waveform spectral values, generating a composite waveform using said selected values, generating noise spectral values, and combining said noise spectral values and composite waveform to provide digital signals representative of audio signals.

24. The apparatus for generating audio signals of claim 23, further comprising:

a memory for storing at least tables of said spectral values representative of audio signals, and a digital to analog circuit connected to said digital signal processor for converting said digital signals to analog signals.

* * * * *